US006311981B1

(12) United States Patent
Uetono et al.

(10) Patent No.: US 6,311,981 B1
(45) Date of Patent: Nov. 6, 2001

(54) GAME MACHINE AND GRIPPER AND PRIZE SUSPENDER THEREFOR

(75) Inventors: Yoshikazu Uetono, Gunma; Yoshihisa Kanesaka, Tokyo, both of (JP)

(73) Assignee: Nihon Servo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/352,234

(22) Filed: Jul. 13, 1999

Related U.S. Application Data

(62) Division of application No. 09/057,962, filed on Apr. 9, 1998, now Pat. No. 6,062,567.

(30) Foreign Application Priority Data

| | | |
|---|---|---|
| Apr. 9, 1997 | (JP) | 9-105477 |
| Jun. 18, 1997 | (JP) | 9-177771 |
| Jun. 23, 1997 | (JP) | 9-180268 |
| Jun. 24, 1997 | (JP) | 9-181810 |
| Jun. 25, 1997 | (JP) | 9-184519 |
| Jul. 10, 1997 | (JP) | 9-199138 |
| Jul. 10, 1997 | (JP) | 9-199139 |

(51) Int. Cl.[7] ..... A63F 9/30
(52) U.S. Cl. ..... 273/447; 463/25; 463/29
(58) Field of Search ..... 463/25, 29, 20; 273/143 R, 274, 138.2, 447

(56) References Cited

U.S. PATENT DOCUMENTS

| | | | | |
|---|---|---|---|---|
| 4,948,134 | * | 8/1990 | Suttle et al. | 273/274 |
| 5,038,022 | * | 8/1991 | Lucero | 273/143 R |
| 5,277,424 | * | 1/1994 | Wilms | 273/274 |

* cited by examiner

*Primary Examiner*—Benjamin H. Layno
(74) *Attorney, Agent, or Firm*—Smith Patent Office

(57) ABSTRACT

The invention contemplates to provide: a prize acquisition game machine capable of either recovering the prize, as having failed to acquire and fallen to the floor of the game machine automatically into the game machine body, or delivering the prize as in the acquisition success a gripper capable of lightening the load on drive means such as a drive motor to prevent the individual parts such as hand members or gears and the prizes from being broken an changing the shape of the hand members; a prize suspender capable of adjusting the degree of difficulty in the prize acquisition automatically; and a game machine capable of changing the indication of play fare and number in association with a setting changing device disposed therein.

6 Claims, 134 Drawing Sheets

PRIOR ART

PRIOR ART

PRIOR ART

PRIOR ART

PRIOR ART

PRIOR ART

PRIOR ART

PRIOR ART

709

| 100Yen | 500Yen | 1 | 2 | 3 | 4 |
|---|---|---|---|---|---|
| 100Yen/1Play | 500Yen/5Plays | OFF | OFF | OFF | OFF |
| 100Yen/1Play | 500Yen/6Plays | ON | OFF | OFF | OFF |
| 100Yen/2Plays | - - -/- - - | OFF | ON | OFF | OFF |
| 200Yen/1Play | - - -/- - - | ON | ON | OFF | OFF |
| 200Yen/1Play | 500Yen/2Plays | OFF | OFF | ON | OFF |
| 300Yen/1Play | - - -/- - - | ON | OFF | ON | OFF |
| 300Yen/1Play | 500Yen/2Plays | OFF | ON | ON | OFF |
| 400Yen/1Play | - - -/- - - | ON | ON | ON | OFF |
| 500Yen/1Play | 500Yen/1Play | OFF | OFF | OFF | ON |

FIG. 132

PRIOR ART

PRIOR ART

752

| 100Yen | 500Yen | 1 | 2 | 3 | 4 | No. |
|---|---|---|---|---|---|---|
| 100Yen/1Play | 500Yen/5Plays | OFF | OFF | OFF | OFF | 0 |
| 100Yen/1Play | 500Yen/6Plays | ON | OFF | OFF | OFF | 1 |
| 100Yen/2Plays | - - -/- - - | OFF | ON | OFF | OFF | 2 |
| 200Yen/1Play | - - -/- - - | ON | ON | OFF | OFF | 3 |
| 200Yen/1Play | 500Yen/2Plays | OFF | OFF | ON | OFF | 4 |
| 300Yen/1Play | - - -/- - - | ON | OFF | ON | OFF | 5 |
| 300Yen/1Play | 500Yen/2Plays | OFF | ON | ON | OFF | 6 |
| 400Yen/1Play | - - -/- - - | ON | ON | ON | OFF | 7 |
| 500Yen/1Play | 500Yen/1Play | OFF | OFF | OFF | ON | 8 |

FIG. 134

GAME MACHINE AND GRIPPER AND PRIZE SUSPENDER THEREFOR

This application is a Division of application Ser. No. 09/057,962, filed Apr. 9, 1998, now U.S. Pat. No. 6,062,567.

BACKGROUND OF THE INVENTION

1. Field of the Invention

The present invention relates to a prize acquisition game machine to be installed in a game center or the like so as to grip a prize to acquire it, a gripper for the game machine provided with at least one pair of hand members for taking out a prize disposed the prize acquisition game machine one by one, a prize suspender for suspending the prizes in the prize acquisition game machine body, and a game machine having a function to change the play fare and number of time to be played, and the operators (players) can visually confirm the play fare and number of time to be played.

2. Related Art

A game machine for commercial use in which doles, candies or capsuled toys are juxtaposed on the floor surface so that they may be picked up, as disclosed in Examined Published Japanese Patent Application No. 7-112513 and a game machine in which prizes are placed on shelves so that they may be gripped and acquired, as shown in FIG. 28, and a game machine in which prizes suspended therein so that they may be gripped and acquired, as disclosed in Unexamined Published Japanese Patent Application No.8-112446 have appeared and become popular.

Even in the game machine of the second example in which recently popular prizes are placed on the shelves so that they may be gripped and acquired, as shown in FIG. 28, or the game machine of the third example in which the prizes are suspended so that they may be gripped and acquired, as shown in FIG. 29, a variety of prizes have to be simultaneously accommodated to satisfy the various needs of the player for the prizes, and a various devices have been made in response to the diversities of the prizes. In a suspension type game machine, as detailed in Unexamined Published Japanese Patent Application No. 8-112446, the prizes, as suspended from horizontal rod-shaped retaining means by strings or chains and ring members, are acquired by controlling the position of a drive mechanism unit which is made movable in three X (transverse), Y (vertical) and Z (longitudinal) directions with respect to a casing and provided with grip means integrally. It is then competed what portion of a prize is to be grasped by pawls for gripping it. It could therefore be said absolutely arbitrary whether or not the operation is in the state in which the prize is naturally readily available to be take out and acquired from the retaining means.

Accordingly, in addition to the control inability of the player or customer, if the aimed prize has a shape and material difficult to be gripped, an extremely high frequency of the failure in the acquisition would disinterest the player. As in Examined Published Japanese Patent Application No. 7-112513, if a prize which is not aimed at by the player but stored in the game machine is delivered, the player would be disinterested. If the frequency of drops increases due to the failure in the acquisition, the installer is required to collect the fallen prizes frequently, which would raise a problem of management cost.

Conventionally, there is another prize acquisition game machine (i.e., the so-called "crane game machine") in which a gripper suspended by a string member is vertically moved to pull up the prize placed on the bottom in the game machine. As disclosed in Unexamined Published Japanese Patent Application No. 8-112446, there is still another prize acquisition game machine 301 (as shown in FIGS. 68 to 70), in which a gripper 303 is moved horizontally or vertically by an expander 302 to acquire either a prize 300 suspended from a suspending member in a prize acquisition game machine 301 or a prize 300 placed on the bottom surface.

The gripper 300 to be employed in these game machines has at least one pair of hand members 306 and 306 to be opened/closed for gripping the prize 300. These paired hand members 306 and 306 are turnably mounted mainly to a gripper body 305.

As disclosed in Unexamined Published Japanese Patent Application No. 8-112446 and shown in FIG. 126, there is also a prize acquisition game machine 650 in which prizes P suspended in a game machine body 651 are individually taken out by prize gripping means 660 composed of a pair of pawl members 661 and 662, as shown in FIG. 128. In this prize acquisition game machine 650, the prizes P are suspended by a prize suspender 653 which is mounted to a back plate 652.

This prize suspender 653 of the prior art is constructed to include a rod-shaped member 654 and a conical drop preventing member 655 mounted on the leading end of the rod-shaped member 654. The prize P is composed of a prize body P1, a ring P2, and a string P3 joining the ring P2 and the prize body P1 so that it is suspended from the prize suspender 653 by hooking the ring P2 on the rod-shaped member 654.

This prize acquisition game machine 650 is activated when a coin is inserted into a coin insertion slot 656. When a transverse control switch 657 and a vertical control switch 658 are depressed, the prize gripping means 660 is moved to a desired height and then is automatically moved forward to the vicinity of the prize P. Then, the paired pawl members 661 and 662 are automatically closed so that the prize gripping means 660 is returned to its original position with the pawl members 661 and 662 being closed, no matter whether or not the pawl members 661 and 662 might grip the prize P.

When the prize gripping means 660 restores the original position, the paired pawl members 661 and 662 are automatically opened to fall the prize P, if they grip it, into the recovery mouth of the game machine body 651. The prize P thus fallen into the recovery mouth is moved to a take-out mouth formed in the front face of the game machine body 651, so that the prize P can be taken out from the take-out mouth.

As described above, the prize P is disposed in the game machine body 651 and is gripped and delivered by the paired pawl members 661 and 662 of the grip means 660. When the prize P is gripped and pulled to this side by the paired pawl members 661 and 662 of the grip means 660, the ring P2 is slid along the upper edge of the rod-shaped member 654 and the upper edge of the drop preventing member 655.

There is also a prize acquisition game machine 670 having the structure in which the prize suspender 653 is mounted to one side of a turnable member 672 mounted rotatably in a game machine body 671, as shown in FIG. 127. In this prize acquisition game machine 670, while the prize P is being suspended by the prize suspender 653 and turned by the turnable member 672, the prize gripping means 660, as composed of the paired pawl members 661 and 662, as described above, is controlled by the control means so that the prizes P being turned can be individually gripped and taken out by the paired pawl members 661 and 662.

In the conventional game machine for commercial use, on the other hand, the play fare and number display means displays it with a printed seal in the vicinity of the coin insertion slot, as shown in FIG. 133. Specifically, there are displayed a "coin insertion slot seal" 720, "play fare indicating seals" 750*a* and 750*b,* and "play number indicating seals" 751*a* and 751*b*. These displays are either adhered at the time of manufacturing the game machine or adhered when the seals (backed by an adhesive) attached to the game machine and shipped to a game center are adhered at the time of installing it in the game center or the like.

In the construction of the conventional game machine for commercial use, at the change of players at the end of a game, for example, the prizes having failed to be acquired will be scattered on the floor surface. Since kinds of the fallen prizes show tendency, a new player is worried about the possibility of acquiring the kind of prize and disinterested by the indication of the prize selection. For the installer, on the other hand, there may arise an undesired situation in which the management cost for collecting the fallen prizes scattered on the floor surface is raised.

In the gripper 303 shown in FIG. 69, on the other hand, the hand members 306 and 306 formed integrally cause a problem that it is impossible to adjust the angle of opening of the hand members 306 and 306 in accordance with the size of the prize 300 or to change the shape of the hand members 306 and 306 in accordance with the shape of the prize 300.

Especially when the paired hand members 306 and 306 are to be opened/closed by the drive motor, the opening angle changes with the power supply time period of the drive motor so that a small prize P cannot be gripped if the opening angle is adjusted for a large prize 300. If the opening angle is adjusted for the small prize 300, there arise problems that a serious load is applied to heat the drive motor and that the hand members or gears are broken or the prize 300 is broken, when the prize 300 to be gripped is larger. Thus, the prize acquisition game machine 301 employing the conventional gripper 303 of the prior art is accompanied by a problem that the sizes and shapes of the prizes 300 to be accommodated therein are substantially identical to lose the interest.

A gripper for game machine has been desired, which is enabled to lighten the load on the drive means such as a drive motor by the elastic deformation of elastic members even for a large prize requiring an opening angle larger than that of the paired hand members, because the drive force of the drive means such as the drive motor is transmitted through the elastic members to the hand members, and to change the shape of the hand members in accordance with the shape of the prize because the hand members are bendably constructed of at least two members.

As shown in FIG. 128, moreover, the conventional prize suspender 653 is constructed to include the rod-shaped member 654 and the conical drop preventing member 655 mounted to the leading end of the rod-shaped member 654, and the distance R0 from the axis 665 of the rod-shaped member 654 and the leading end outer circumference edge 666 of the drop preventing member 655 is fixed. As a result, the slope gradient of the upper edge of the drop preventing member 655 is unchanged no matter what direction the drop preventing member 655 might be turned in, so that the difficulty in removal (or difficulty in the acquisition) of the prize P cannot be changed.

This raises a problem that a player skilled in the play of the prize acquisition game machine 650 or 670 can easily remove (or acquire) the prize P by operating the prize gripping means 660 but a player unskilled in the play of the prize acquisition game machine 650 or 670 or an infant finds it extremely difficult to remove (or acquire) the prize P. Thus, a prize suspender which can automatically interchange the structures in which the prize P is removed easily or with difficulty has been desired.

On the other hand, the conventional prize suspender 653 is followed by a problem that the suspender 653 makes it easy to get (or acquire) the suspended prize P thereby to deteriorate the game fun if the prize P has a shape and material to allow an easy grip by the prize gripping means 660, and makes it difficult to get the prize P thereby to disinterest the possible players if the prize P has a shape and material difficult for the prize gripping means 660 to grip. Thus, a prize suspender which can be automatically interchanged to a structure in which the prize P is removed with difficulty if the prize P to be suspended has a size and material easy for the prize gripping means 660 to grip or is expensive, or to a structure in which the prize P is removed easily if the prize P to be suspended has a size and material difficult for the prize gripping means 660 to grip or is inexpensive is desired.

A prize suspender for game machine has bee desired, which is capable of automatically changing and adjusting the degree of difficulty in the acquisition of prizes.

With the construction of the conventional game machine for commercial use thus far described, when the play fare is to be set lower by a game center for a special day (or event day) such as the Child's day or the celebration day of establishing the game center, the controls of the game machine are changed by setting the play fare setting means (generally using dip switches) packaged in the game machine, so that the displays visible to the player are manually changed each time in the display of the fare by adhering seals of different display fares, as attached in advance to the game machine, or by preparing the display seals at the game center and adhering them.

Likewise, the number of play times is also changed by setting the number of play time setting means, as packaged in the game machine, and the seals and so on are newly adhered for the displays visible to the player.

In the method of the conventional arts thus far described, works are required for applying the seals to the game machine at each change of the play fare and the number of play time, thus causing a problem that the management cost at the game center is added. Moreover, the preparations of the seals at the game center are followed by the rise in the management cost at the game center, thus, improvements have been expected. In addition to the aforementioned problem of the management cost, the preparations of the seals at the game center are followed by a problem that the design of the game machine is deteriorated.

When the play fare and the number of play time of the game machine was changed, game credit (i.e., the number of games to be played by the money inserted) display means (e.g., 7-segment LED) has generally been used to confirm it. In this example, the machine is changed at first into a confirmation (or check) mode by controlling switches in the game machine, to display the results of setting the play fare and number of time in the credit display means. Since the credit display means generally employs only one 7-segment LED 703*a,* however, the results are so encoded as can be understood by one figure, as shown in FIG. 134. This requires a complicated troublesome work for confirming the code table and raises a problem that the confirmation is not done at the place of the game machine or that an error in the setting cannot be found out.

SUMMARY OF THE INVENTION

The present invention has been conceived in view of the problems described above and has a first object to provide a game machine which is constructed such that the floor surface of the compartment for accommodating prizes is either activated at all times simultaneously with the play start or can be moved or inclined each time of a failure in the prize acquisition by detecting a drop of the prize by a sensor disposed in the vicinity of the floor surface, and such that a recovery box for the prize is disposed in the vicinity of the terminal end of movement or the lower end of the inclined slope of the floor to recover prizes fallen due to a failure in the aquisition.

In the construction described above, since a prize having failed to be acquired can be recovered into a predetermined recovery box without being accumulated on the floor surface of a storage compartment of the game machine body for accommodating prizes, a fear of allowing the player to recognize the kind of the failed prizes can be reduced to suppress the management cost necessary for removing the fallen prizes effectively. Depending upon the number of failure in the prize acquisition the prizes fallen due to the failure in the acquisition, can be employed as those to be delivered, which is effective to enhance the incentive to the game machine.

In order to achieve the first object, the game machine of the present invention is constructed such that the compartment accommodating the prizes to be acquired is made movable in at least a portion of its floor surface, such that a recovery box for recovering the prizes having fallen due to the failure in the acquisition is disposed in the vicinity of the end portion of the floor surface of the compartment, and such that the passage for recovery or delivery can be changed by a damper mechanism. This change in the passage is decided according to the prize acquisition factor at the time of drop of the prize.

In the construction described above, a prize having failed to be acquired can be recovered into a predetermined recovery box without being accumulated on the floor surface of the storage compartment, the management cost necessary for the installer of the game center or the like to recover the fallen prizes is suppressed. Depending upon the number of time of the failure in the prize acquisition, moreover, the prizes fallen due to the failure in the acquisition may be delivered to the player, which enhances the incentive of the player to continue the game.

In order to achieve the first object, the compartment of the game machine of the present invention for accommodating prizes is constructed: such that the wiper mechanism is activated in the vicinity of the floor surface simultaneously with the game end such that the wiper mechanism is activated when it is detected that the prize is neither acquired nor delivered to the player, or: such that the wiper mechanism is activated in response to a signal of a sensor, as disposed in the vicinity of the floor surface, at the game end when the sensor detects the drop of a prize; and such that a recovery box for the fallen prize is provided.

In the construction described above, since a prize having failed to be acquired can be recovered into a predetermined recovery box without being accumulated on the floor surface of a storage compartment, a fear of, allowing the player to recognize the kind of the failed prizes can be reduced to suppress the management cost necessary for the installer to remove the fallen prizes and effective to enhance the incentive to the game machine.

In order to achieve the first object, the game machine of the present invention is constructed such that a wiper mechanism having a blade made movable in at least its portion is disposed in the vicinity of the floor surface of a compartment accommodating prizes to be acquired, such that a recovery box for recovering the prize having fallen due to a failure in the acquisition is disposed in the vicinity of the end portion of the floor surface in the moving direction of the wiper mechanism, such that a passage leading to the recovery box has communication with a prize delivery mouth, and such that a damper mechanism is disposed midway of the passage so that the recovery or delivery of the fallen prize can be selected by operating the damper mechanism.

Another construction is made such that the wiper mechanism is provided with two independently active blade, and such that a recovery box is disposed in the vicinity of the action end of one blade whereas a reception mouth of a passing pipe leading to the prize delivery mouth is formed in the vicinity of the action end of the other blade, so that the fallen prize can be recovered or delivered by selecting the blade activating directions of the wiper mechanism.

Still another construction is made such that a sensor for detecting the fallen prize is disposed in the vicinity of the floor surface of the compartment accommodating the prizes to be acquired, and such that a prize delivery sensor is provided for detecting the detection signal of the former sensor or the delivery of the prize, so that the fallen prize can be selectively recovered or delivered by combining the output signals of the individual sensors.

Moreover, the sensor disposed in the vicinity of the floor surface of the compartment accommodating the prizes to be acquired for detecting the fallen prize is constructed to detect the drop position of the fallen prize so that the fallen prize is delivered when it drops to a predetermined position.

In the construction described above, a prize having failed to be acquired can be recovered into a predetermined recovery box without being accumulated on the floor surface of the storage compartment, the management cost necessary for the installer of the game center or the like to recover the fallen prizes is suppressed. Depending upon the number of time of failure in the prize acquisition, moreover, the prizes fallen due to the failure in the acquisition are delivered to the player to enhance the incentive of the player to continue the game.

The present invention has a second object to provide a gripper for game machine in which the angle of opening of the hand members can be adjusted in accordance with the size of the prize or to change the shape of the hand members in accordancw with the shape of the prize. In order to achieve the aforementioned second object, the gripper of the present invention comprises the following constructions:

(a) that a gripper body is movably disposed in a prize acquisition game machine;

(b) that at least one pair of hand members are mounted openably and closably in said gripper body for gripping a prize in said prize acquisition game machine;

(c) that said hand members are constructed by jointing a plurality of members turnably sequentially, the adjoining ones of which are associated by first elastic members, the trailing end one of which is turnably mounted to said gripper body by a root pin, and the leading end one of which forms pawl members;

(d) that the individual root pins of said paired hand members are provided with rotatable gears meshing with each other, one of which is meshing with a drive gear driven by drive means disposed in said gripper body; and (e) that the gears and the trailing end one of said hand members are associated by second elastic members.

In order to achieve the aforementioned second object, the gripper of the present invention comprises the following constructions:

(a) that a gripper body is movably disposed in a prize acquisition game machine;

(b) that at least one pair of hand members are mounted openably and closably in said gripper body for gripping a prize in said prize acquisition game machine;

(c) that said hand members are constructed to include arm members and pawl members by jointing the root portions of said arm members turnably to said gripper body by root pins, and by mounting the root portions of said pawl members turnably to the leading portions of said arm members by pivot pins;

(d) that said pawl members and said arm members are associated by first elastic members;

(e) that the individual root pins of said paired hand members are provided with rotatable gears meshing with each other, one of which is meshing with a drive gear driven by drive means disposed in said gripper body; and (f) that the gears and said arm members are associated by second elastic members.

In order to achieve the second object, the gripper of the present invention comprises the following constructions:

(a) that a gripper body is movably disposed in a prize acquisition game machine;

(b) that at least one pair of hand members are mounted openably and closably in said gripper body for gripping a prize in said prize acquisition game machine;

(c) that said hand members are constructed to include arm members and pawl members by jointing the root portions of said arm members turnably to said gripper body by root pins, and by mounting the root portions of said pawl members turnably to the leading portions of said arm members by pivot pins;

(d) that said arm members or said pawl members have first engaging projections whereas said pawl members or said arm members are provided with first engaging portions and second engaging portions interposing said first engaging projections at a clearance of a predetermined distance so that said pawl members can turn within the range of said clearance;

(e) that said pawl members are urged in a closing direction by first elastic members interposed between said pawl members and said arm members so that the first engaging portions or said first engaging projections of said pawl members abut against the first engaging projections or the first engaging portions of said arm members;

(f) that the individual root pins of said paired hand members are provided with rotatable gears meshing with each other, one of which is meshing with a drive gear driven by drive means disposed in said gripper body;

(g) that said arm members or said gears are provided with second engaging projections whereas said gears or said arm members are provided with third engaging portions to engage with said second engaging projections; and (h) that said arm members are urged in the closing direction by second elastic members interposed between said arm members and said gears so that the second engaging projections or said third engaging portions of said arm members abut against the third engaging portions or the second engaging projections of said gears.

In order to achieve the second object, the gripper of the present invention comprises the following constructions:

(a) that a gripper body is movably disposed in a prize acquisition game machine;

(b) that at least one pair of hand members are mounted openably and closably in said gripper body for gripping a prize in said prize acquisition game machine;

(c) that said hand members are constructed by jointing a plurality of members turnably sequentially, the adjoining ones of which are associated by first elastic members, the trailing end one of which is turnably mounted to said gripper body by a root pin, and the leading end one of which forms pawl members; and (d) that the individual terminal end members of said paired hand members are provided with gears meshing with each other, one of which is meshing with a drive gear driven by drive means disposed in said gripper body.

In order to achieve the second object, the gripper of the present invention comprises the following constructions:

(a) that a gripper body is movably disposed in a prize acquisition game machine;

(b) that at least one pair of hand members are mounted openably and closably in said gripper body for gripping a prize in said prize acquisition game machine;

(c) that said hand members are constructed to include arm members, intermediate members and pawl members;

(d) that said arm members are turnably mounted at their root portions to said gripper body by root pins, the root portions of said intermediate members are turnably mounted to the leading portions of said arm members by first pivot pins, and said pawl members are turnably mounted to the leading portions of said intermediate members by second pivot pins;

(e) that said arm members and said intermediate members are associated by first elastic members whereas said intermediate members and said pawl members are associated by second elastic members; and (f) that the root portions of said paired arm members are provided with gears meshing with each other, one of which is meshing with a drive gear driven by drive means disposed in said gripper body.

In order to achieve the second object, the gripper of the present invention comprises the following constructions:

(a) that a gripper body movably is disposed in a prize acquisition game machine;

(b) that at least one pair of hand members are mounted openably and closably in said gripper body for gripping a prize in said prize acquisition game machine;

(c) that said hand members are constructed to include arm members, intermediate members and pawl members;

(d) that said arm members are turnably mounted at their root portions to said gripper body by root pins, the root portions of said intermediate members are turnably mounted to the leading portions of said arm members by first pivot pins, and said pawl members are turnably mounted to the leading portions of said intermediate members by second pivot pins;

(e) that said arm members or intermediate members are provided with first engaging projections whereas said intermediate members or said arm members are provided with first engaging portions to engage with said first engaging projections;

(f) that said intermediate members are urged in a closing direction by first elastic members interposed between said intermediate members and said arm members so that the first engaging portions or the first engaging projections of said intermediate members abut against the first engaging projections or the first engaging portions of said arm members;

(g) that said intermediate members or said pawl members are provided with second engaging projections, said pawl members or said intermediate members are provided with third engaging portions and fourth engaging portions interposing said second engaging projections at a clearance of a predetermined distance, and said pawl members can be turned within the range of said clearance;

(h) that said pawl members are biased in the closing direction by second elastic members interposed between said pawl members and said intermediate members so that the third engaging portions or the second engaging projections of said pawl members abut against the second engaging projections or the third engaging portions of said intermediate members; and (i) that the root portions of said paired arm members are provided with gears meshing with each other, one of which is meshing with a drive gear driven by drive means disposed in said gripper body.

The present invention has a third object to privide a prize suspender in which difficulty in removal (or difficulty in the acquisition) of the prize can be changed. To achieve the third object the prize suspender of the present invention comprises the following constructions:

(a) a rod-shaped member mounted at its rear portion to one side of a game machine body, and a drop preventing member mounted on the leading end of said rod-shaped member;

(b) that said drop preventing member is so fixed on said rod-shaped member that the distance between the outer circumference edge and the general axis of said rod-shaped member may not be fixed; and (c) said game machine body is provided with drive means for turning said rod-shaped member on the general axis.

In order to achieve the third object, the gripper of the present inventio comprises the following constructions:

(a) a rod-shaped member mounted at its rear portion to one side of a turnable member turnably mounted in a game machine body, and a drop preventing member mounted on the leading end of said rod-shaped member;

(b) that said drop preventing member is so fixed on said rod-shaped member that the distance between the outer circumference edge and the general axis of said rod-shaped member may not be fixed; and (c) said game machine body is provided with drive means for turning said rod-shaped member on the general axis.

In order to achieve the third object, the gripper of the present invention comprises the following constructions:

(a) a suspending member mounted at its rear portion to one side of a game machine body for suspending a prize, a drop preventing member mounted on the leading end of said suspending member, and a turning shaft for turning said drop preventing member;

(b) that said drop preventing member is so fixed on said turning shaft that the distance between the outer circumference edge and the general axis of said turning shaft may not be fixed; and (c) said game machine body is provided with drive means for turning said turning shaft on the general axis.

In order to achieve the third object, the gripper of the present invention comprises the following constructions:

(a) a suspending member mounted at its rear portion to one side of a turnable member mounted turnably in a game machine body for suspending a prize, a drop preventing member mounted on the leading end of said suspending member, and a turning shaft for turning said drop preventing member;

(b) that said drop preventing member is so fixed on said turning shaft that the distance between the outer circumference edge and the general axis of said turning shaft may not be fixed; and (c) said game machine body is provided with drive means for turning said turning shaft on the general axis.

In order to achieve the third object, the gripper of the present invention comprises the following constructions:

(a) a rod-shaped member mounted at its rear portion to one side of a game machine body, and a drop preventing member mounted on the leading end of said rod-shaped member;

(b) that said drop preventing member is so fixed on said rod-shaped member that the distance between the outer circumference edge and the general axis of said rod-shaped member may not be fixed; and (c) said game machine body is provided with a turning arm mounting the rear portion of said rod-shaped member for turning said rod-shaped member, and drive means for turning said turning arm.

In order to achieve the third object, the gripper of the present invention comprises the following constructions:

(a) a rod-shaped member mounted at its rear portion to one side of a turnable member mounted turnably in a game machine body, and a drop preventing member mounted on the leading end of said rod-shaped member;

(b) that said drop preventing member is so fixed on said rod-shaped member that the distance between the outer circumference edge and the general axis of said rod-shaped member may not be fixed; and (c) said game machine body is provided with a turning arm mounting the rear portion of said rod-shaped member for turning said rod-shaped member, and drive means for turning said turning arm.

Said drop preventing member is formed into a generally conical, generally elliptically conical or generally pyramid shape or a generally circular column, generally elliptical column or a generally prism shape having a section enlarged toward its leading end, or a generally circular disc, generally elliptical disc or generally square disc shape.

Said drive means includes one power means, and power transmission means for turning a plurality of rod-shaped members, a plurality of turning shafts or a plurality of turning arms generally simultaneously.

Said game machine body includes: detection means for detecting the turning position of said drop preventing member; and control means for controlling the drive of said drive means on the basis of the detection result of said detection means to change the turning position of said drop preventing member.

The present invention has a fourth object to provide a game machine in which the number of play time is changed by setting the number of play time setting means, as packaged in the game machine, and the seals and so on are newly adhered for the displays visible to the player.

In order to achieve the fourth object, display means for displaying the play fare and number of the play according to the present invention is constructed such that play fare and number setting means in the game machine body is made of a 7-segment LED at a third (of 100) figure so that the indication of the play fare can be changed from 100 yens to 200 yens in response to the ON/OFF switching of a dip switch, for example, and so that the indication of the play number can be changed from two to three times.

In the construction described above, the indications of the play fare and number are changed in response to the switching (or the ON/OFF of the dip switch) of the setting changing means can be changed to avoid the occurrence of the management cost for adhering the display seals at each change in the setting. By indicating the set play fare and number directly, moreover, the troublesome confirmations can be eliminated to simplify the confirmations of the setting errors and accordingly the management of the game machine.

BRIEF DESCRIPTION OF THE DRAWINGS

FIG. 120 is a front elevation of FIG. 119.

FIG. 121 is a side elevation showing the state in which the drop preventing member of FIG. 119 is turned by 180 degrees.

FIG. 122 is a front elevation of FIG. 121.

FIG. 123 is a side elevation showing a mode of a prize suspending device for turning two rod-shaped members.

FIG. 124 is a front elevation of FIG. 123.

FIG. 125 is a front elevation showing the state in which one of the drop preventing members of FIG. 123 is turned by 90 degrees.

FIG. 126 is a schematic perspective view showing a mode of a prize acquisition game machine of the prior art.

FIG. 127 is a schematic perspective view showing a mode of a prize acquisition game machine of the prior art.

FIG. 128 is a schematic perspective view showing a prize suspending device of the prior art.

FIG. 129 is a block diagram of an essential portion of one embodiment of a game machine according to the present invention.

FIG. 130 is a top plan view showing a portion of a display device of the game machine.

FIG. 131 is a schematic top plan view showing a play fare/fare setting device of the game machine.

FIG. 132 is a table tabulating relations among play fares, play numbers and the ON/OFF of dip switches.

Figure 133:
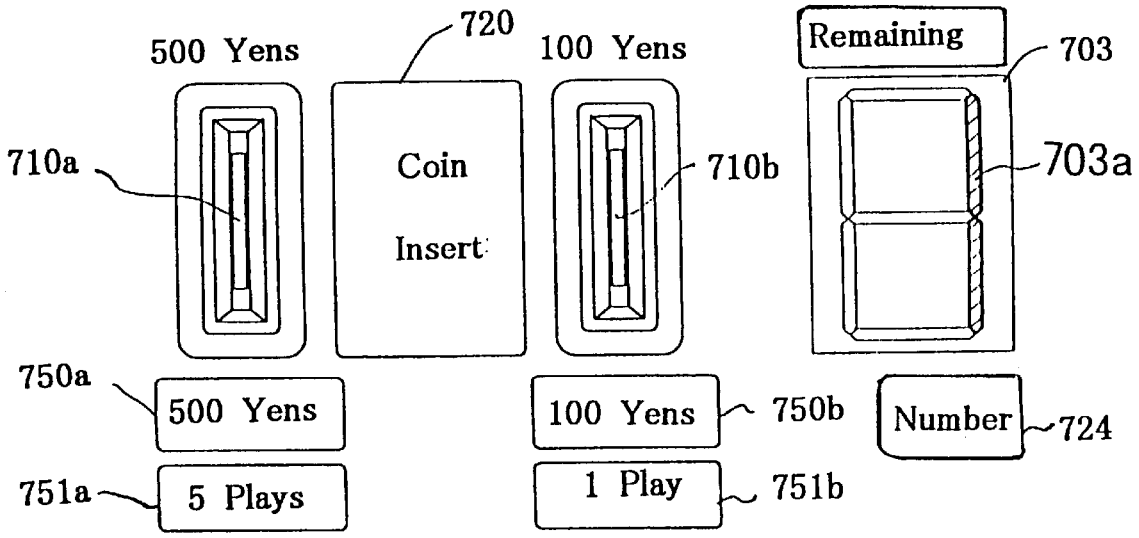

FIG. 133 is a schematic top plan view showing a display portion of the prior art.

FIG. 134 is a table tabulating relations among play fares, play numbers and the ON/OFF of dip switches, and relations of display symbols of an example of the prior art.

DESCRIPTION OF THE PREFERRED EMBODIMENTS

Figure 1:
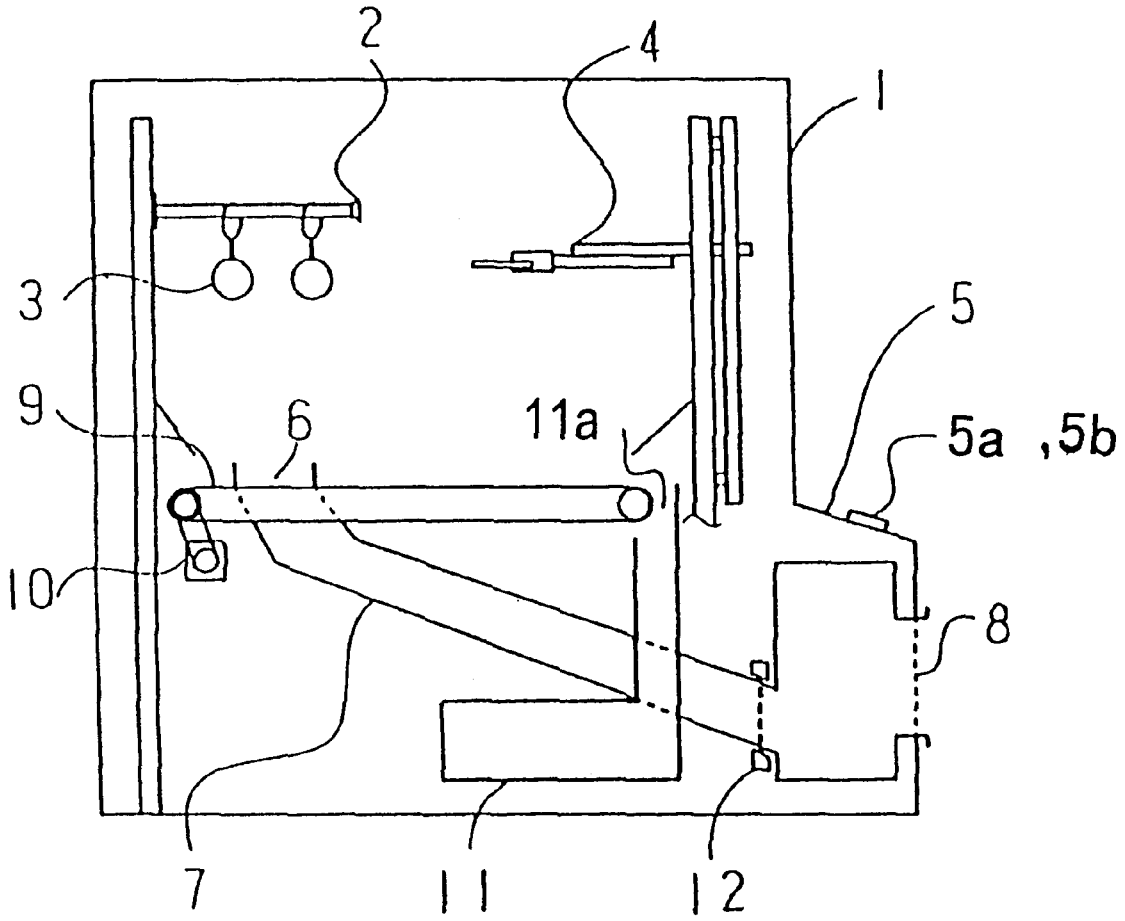
FIG. 1 is a perspective schematic side elevation showing a first embodiment of a game machine according to the present invention.

Embodiments according to the present invention will be described with reference to the accompanying drawings. For the entire construction and the actions of the game machine, Unexamined Published Japanese Patent Application No. 8-112446 should be referred to the description mentioned before. FIG. 1 shows one embodiment of the invention, in which a floor is moved like a belt conveyor, for example, so that the prize failed to be acquired by a prize acquiring operation and dropped to the floor may be recovered in a recovery box. This floor can be made movable either wholly all over its surface so that it may recover all the fallen prizes or partially at its predetermined partial surface so that it may recover some of them.

In FIG. 1, numeral 1 designates a game machine body; numeral 2 designates prize retaining means; numeral 3 desinates prizes suspended by the prize retaining means 2; numeral 4 designates grip means for acquiring a prize; numeral 5 designates a play panel; numeral 6 designates a reception mouth for receiving an acquired prize; numeral 7 designates a prize passing pipe; numeral 8 designates a prize take-out mouth; numeral 9 designates a movable floor (e.g., a belt conveyor device); numeral 10 designates a floor driver; numeral 11 designates a recovery box for recovering fallen prizes; and numeral 12 designates a prize delivery sensor.

Figure 2:
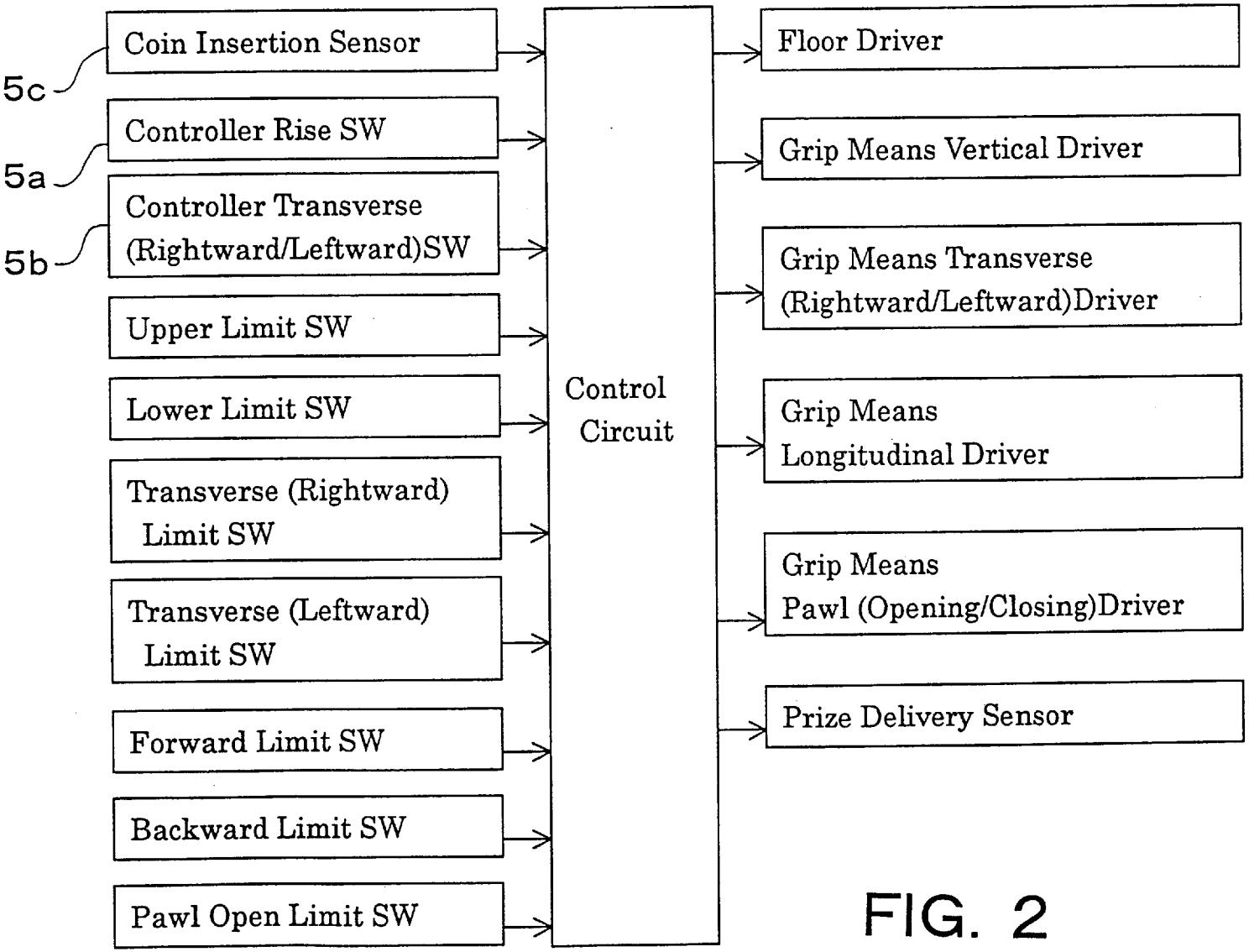
FIG. 2 is a schematic block diagram showing a construction of a control circuit of the first embodiment of the game machine.

FIG. 2 is a schematic block diagram showing a control circuit of the machine of FIG. 1. The actions of the invention will be described with reference to FIGS. 2 and 1. When a coil is inserted into a coil insertion slot of the play panel 5 (not shown), a coin insertion sensor 5*c* detects the coin to activate the game machine. The player operates play switches 5*a* and 5*b* of the play panel 5 to move the grip means 4, aiming at the prizes 3 suspended by the retaining means 2. When the grip means 4 is brought close to the aimed prize 3, it is controlled to grip and acquire the prize 3 and is moved to over the prize reception mouth 6. When the grip means 4 is released, the acquired prize 3 is passed through the prize passing pipe 7 to activate the prize delivery sensor 12 until it reaches the prize take-out mouth 8. Then, the player takes out the prize 3 from the take-out mouth, and the game is ended by this success in the acquisition.

On the other hand, if the prize 3 suspended by the retaining means 2 is gripped and removed from the retaining means 2 by the grip means 4 and but is released in the moving course, the prize 3 falls to the movable floor 9, and the game is also ended by this failure in the acquisition. At this time, the game is ended without any action of the prize delivery sensor 12. Therefore, the acquisition is decided to have failed, and the floor driver 10 is activated to activate the movable floor 9 to recover the fallen prize 3, from a recovery mouth 11*a,* as formed in the vicinity of the terminal in the moving direction, into the recovery box 11.

This action of the movable floor 9 can be started by detecting that the prize has not been delivered yet after the action start of the floor or the play end at the operation start or the action changing time (from a rise to a transverse movement, for example) of the grip means. This makes it possible to recover the prize having fallen to the floor.

Figure 3:
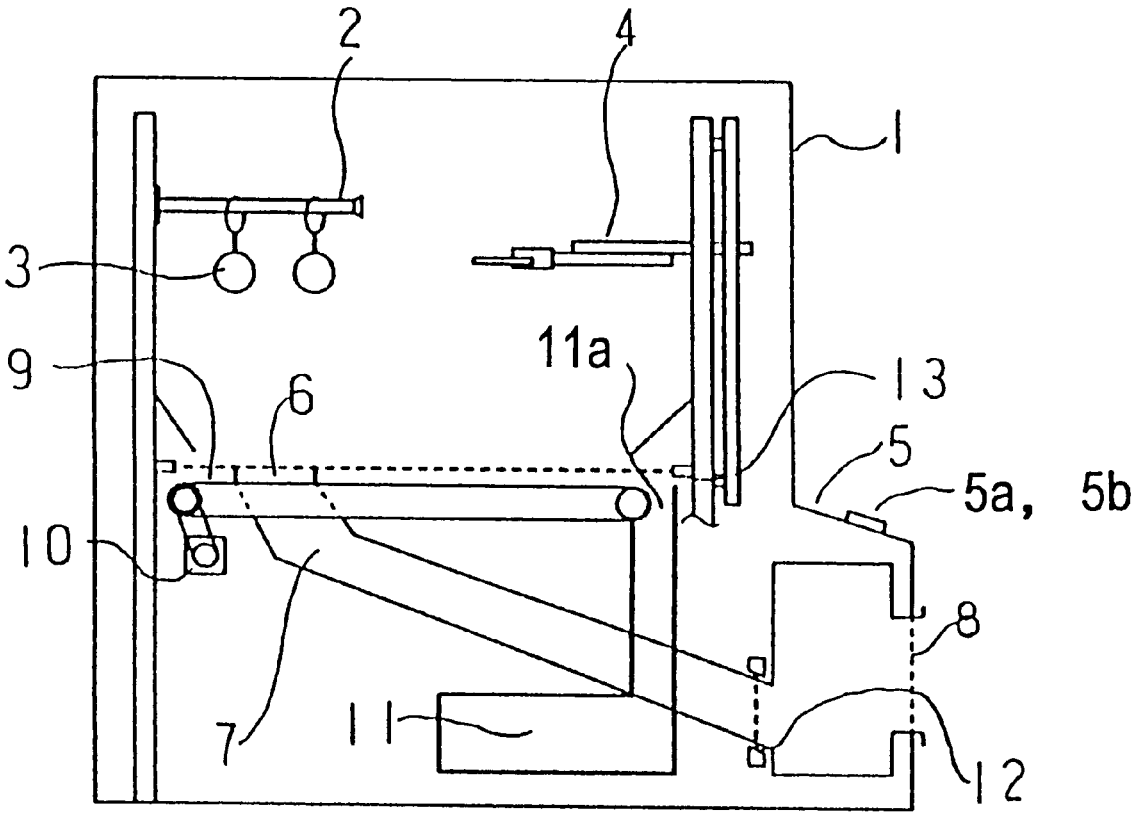
FIG. 3 is a perspective schematic side elevation showing a second embodiment of the game machine.

As shown in FIG. 3, a second embodiment according to the present invention may be equipped with a sensor 13 which is arranged above and close to the movable floor 9 for detecting the fallen prize 3. When the prize falls due to the grip failure, the sensor 13 may act to activate the floor driver 10 so that the movable floor 9 may be driven to recover the fallen prize 3.

Figure 4:
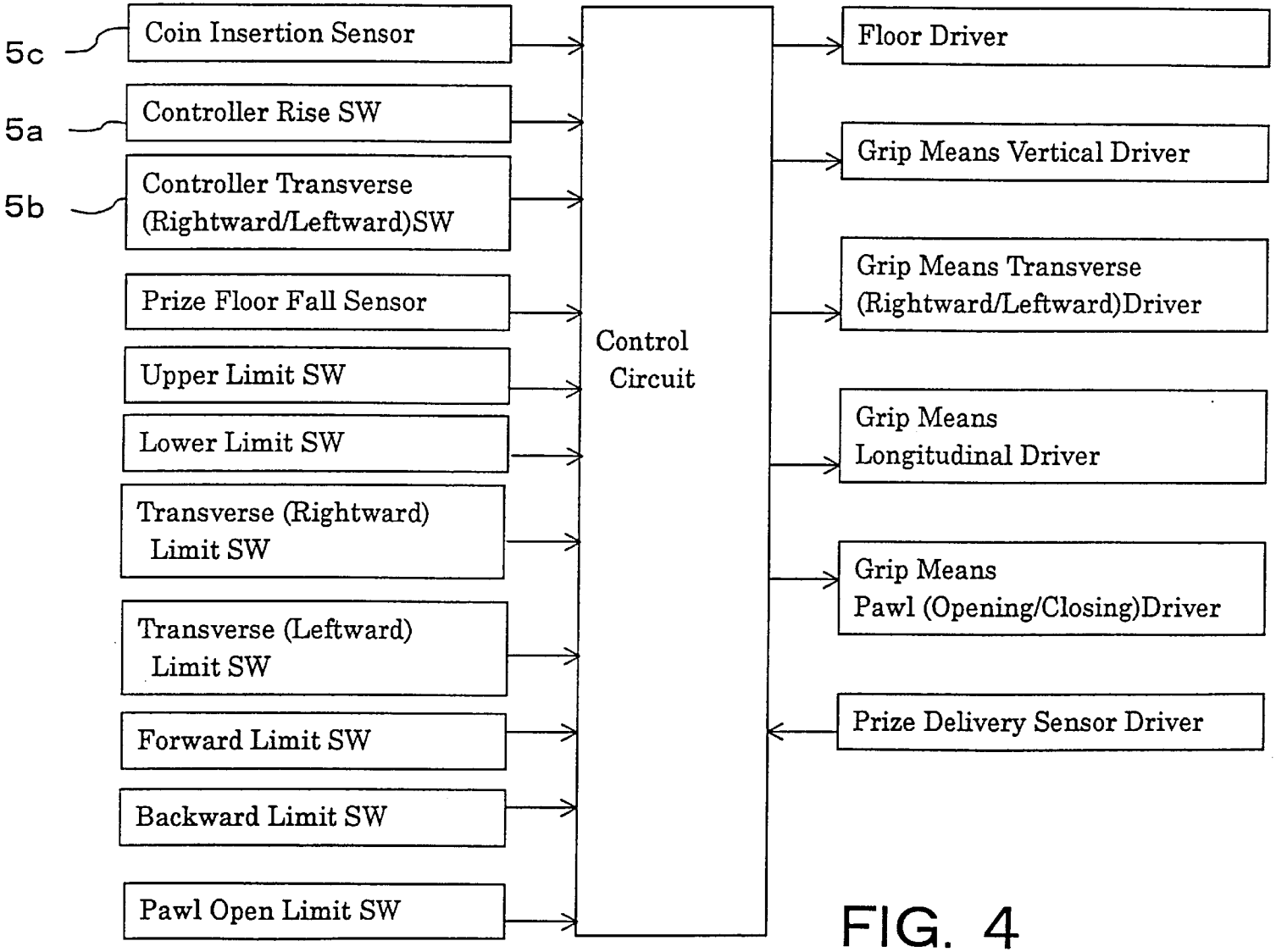
FIG. 4 is a schematic block diagram showing a construction of a control circuit of the second embodiment of the game machine.

FIG. 4 is a schematic block diagram showing a control circuit of the second embodiment shown in FIG. 3.

In a third embodiment of the according to the present invention, the floor is so sloped at its portion as to drop the fallen prize. A tilting movable floor 16 is provided together with a driver 17 in connection with the sloped floor 15. The tilting movable floor 16 is normally held in a horizontal position to shut the recovery mouth 11*a* leading to the recovery box 11 for the fallen prize. If the player falls the prize from the grip means 4, the prize, as fallen to the sloped floor 15, naturally drops to the tilting movable floor 16. When the game ends in this state, the prize delivery sensor 12 is not activated so that the prize acquisition failure is decided. Then, the driver 17 is activated to turn the tilting movable floor 16 in the direction to open the recovery mouth 11*a* so that the fallen prize on the tilting movable floor 16 is recovered from the recovery mouth 11*a* into the recovery box 11. For recovering the fallen prize, the floor surface is moved and sloped, and the recovery box is disposed close thereto in the moving and sloped direction, as described above, so that the prize to be recovered can be stored outside of the visible range of the player.

Figure 5:
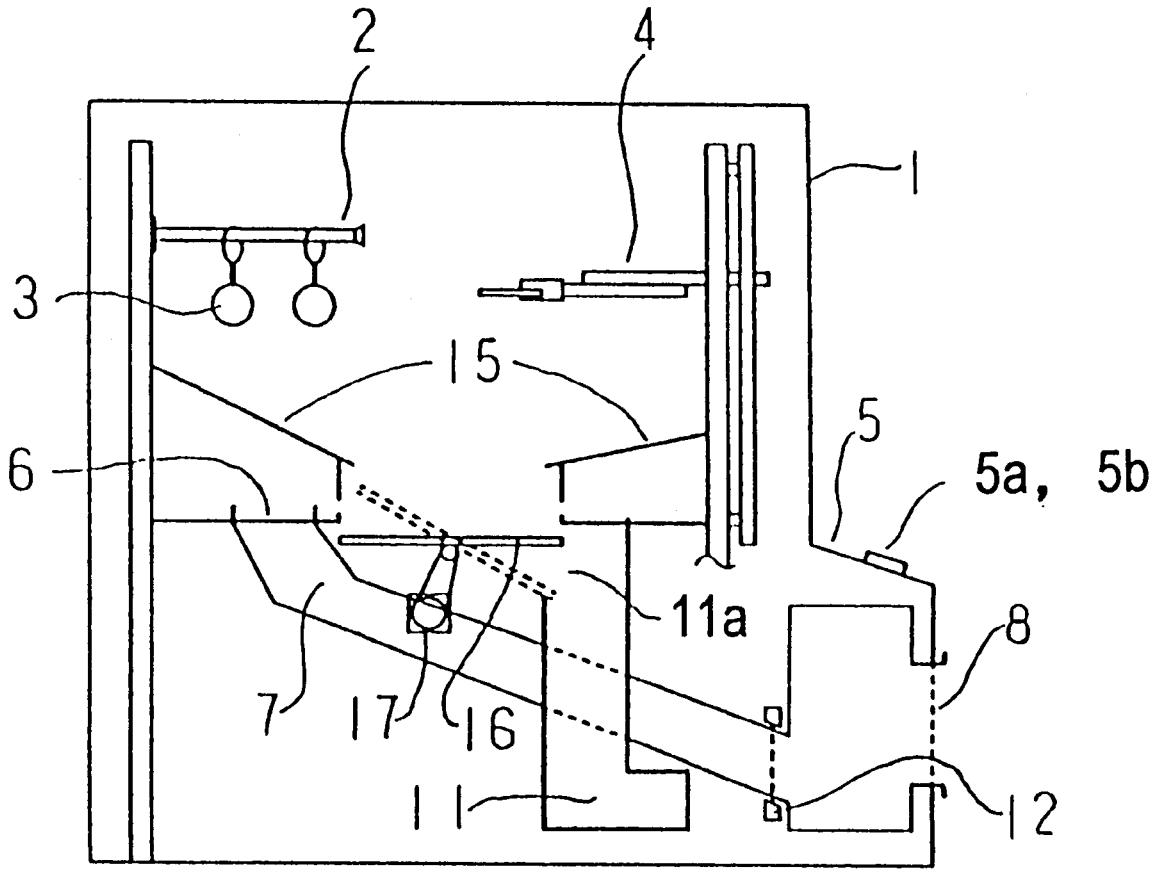
FIG. 5 is a perspective schematic side elevation showing a third embodiment of the game machine.
Figure 6:
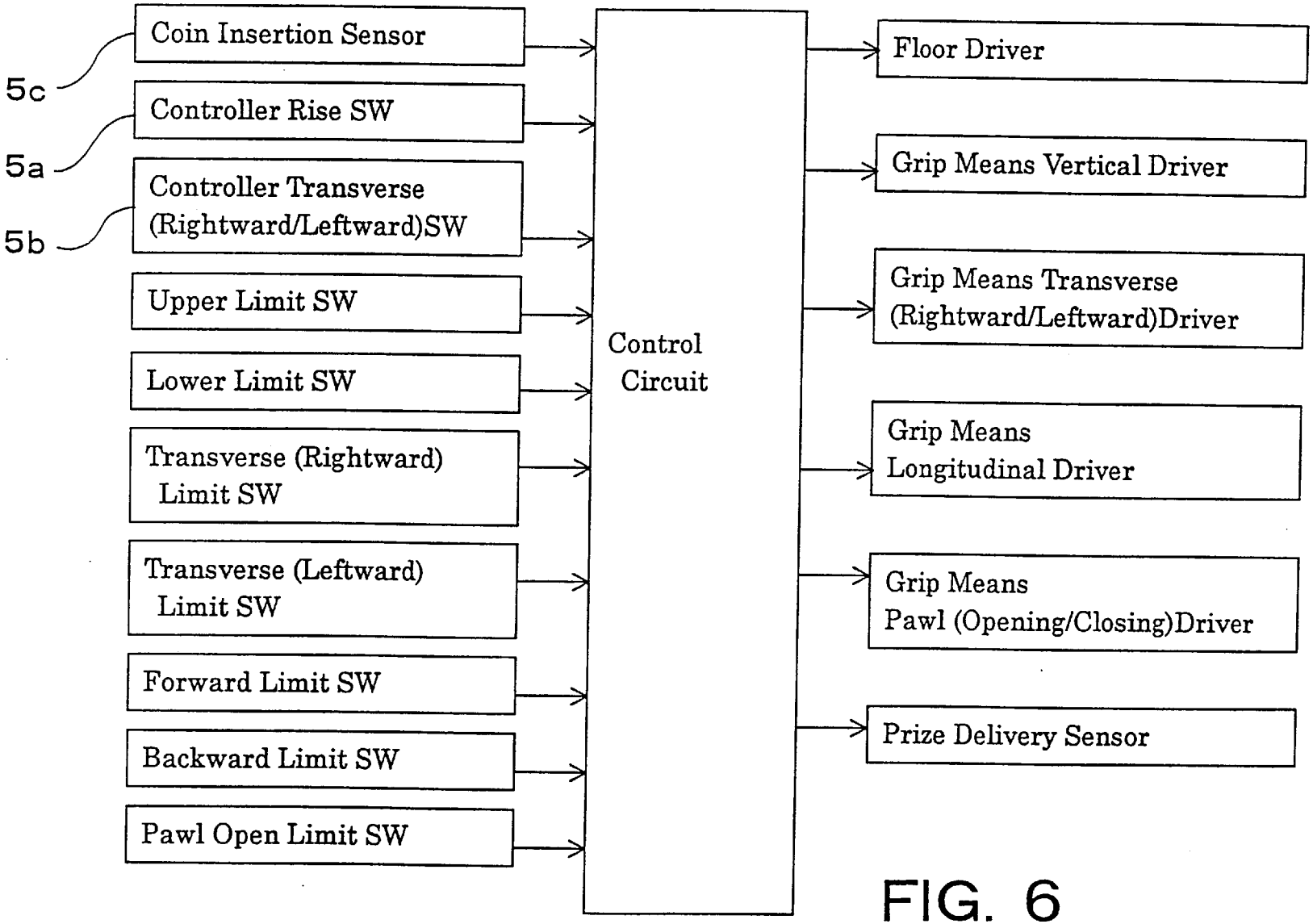
FIG. 6 is a schematic block diagram showing a construction of a control circuit of the third embodiment of the game machine.

FIG. 6 is a schematic block diagram showing a control circuit of the third embodiment shown in FIG. 5.

In order that the installer (e.g., the game center) may easily take out the prize, as fallen and recovered in the recovery box, later from the recovery box, on the other hand, the take-out mouth for the recovered prize may be formed in the outer periphery of the game machine body.

Figure 7:
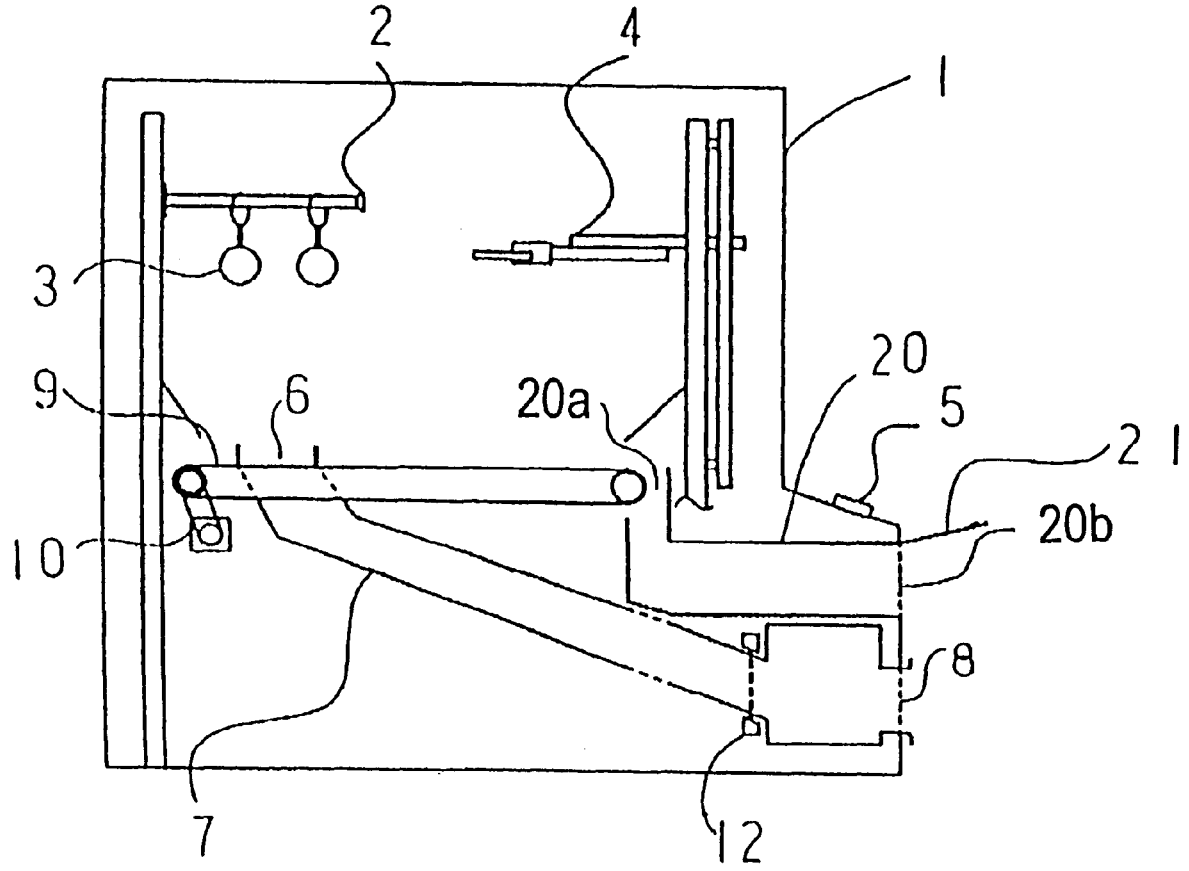
FIG. 7 is a perspective schematic side elevation showing the first embodiment in which structure of a recovery box of the game machine is modified.
Figure 8:
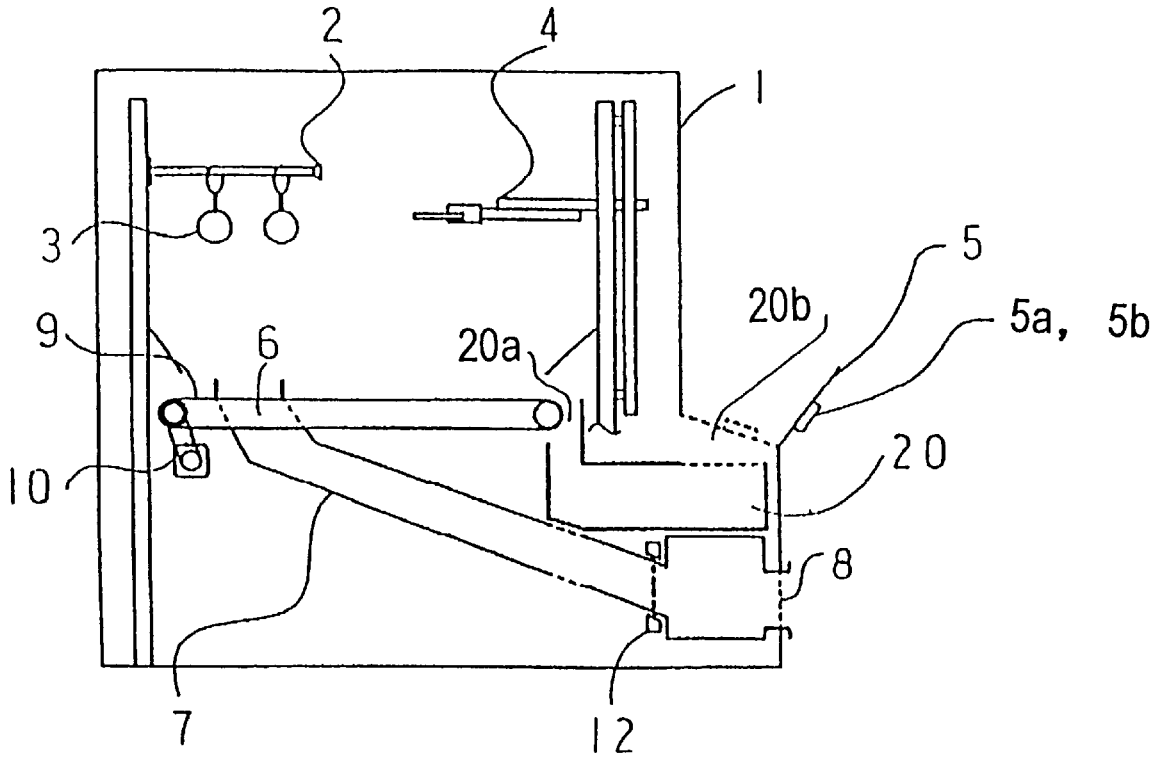
FIG. 8 is a perspective schematic side elevation showing the second embodiment in which structure of a recovery box of the game machine is modified.

FIG. 7 shows an example of the construction in which a prize take-out mouth 20*b* is formed in the front face of a recovery box 20 and provided with a cover 21. FIG. 8 shows an example of the construction in which the prize take-out mouth 20*b* of the recovery box 20 is formed under the play panel 5 so that the play panel 5 may act as a cover 21 for the prize take-out mouth.

The examples of FIGS. 7 and 8 are modified in the structure of the recovery box from the construction of the first embodiment and can also be applied to the embodiments having other constructions shown in FIGS. 3 and 5.

Figure 9:
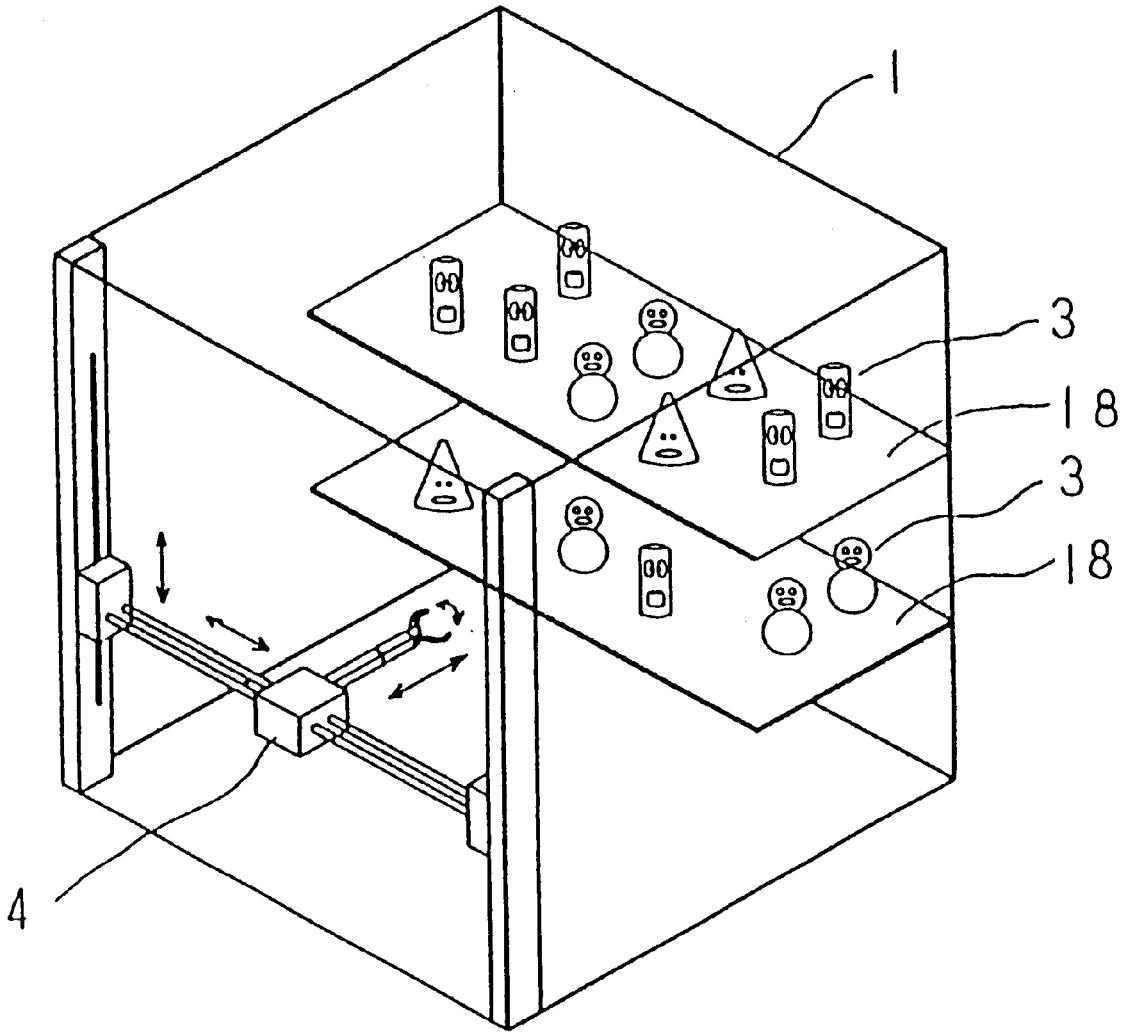
FIG. 9 is a perspective schematic view showing an embodiment, as equipped with another prize mounting device, of the game machine.
Figure 10:
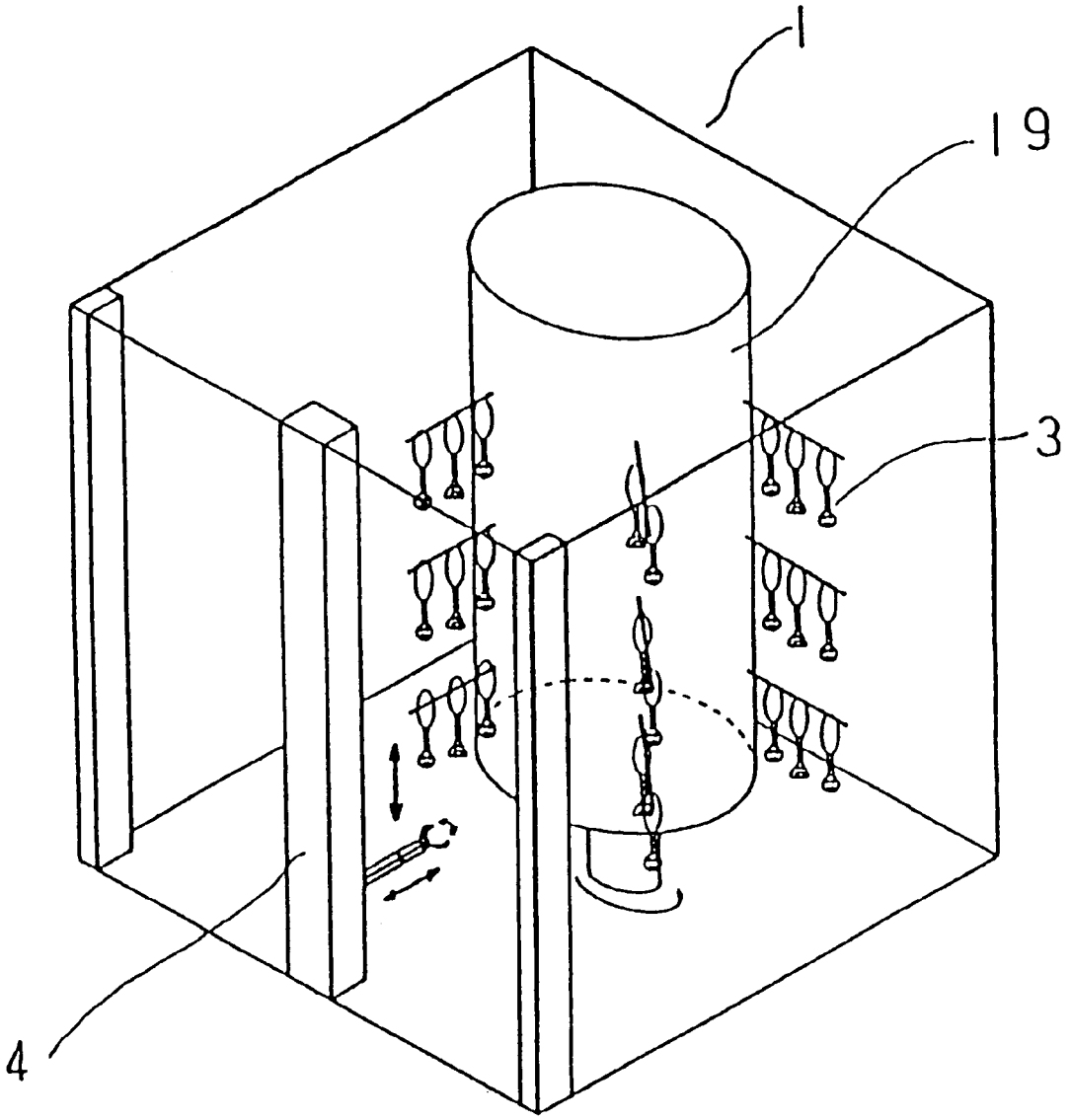
FIG. 10 is a perspective schematic view showing an embodiment, as equipped with another prize mounting device, of the game machine.

Here, the construction of the game machine according to the present invention should not limit the prize holding/retaining means and the grip means, as exemplified in FIGS. 3 and 5, but can adopt, without any difference, not only to the constructions in which the prizes are suspended by the rod-shaped retaining means, as exemplified in FIGS. 1, 3 and 5, but also to a construction in which prizes are placed on a shelf 18 so that the grip means is three-dimensionally operated, as shown in FIG. 9, and a construction in which retaining means for suspending the prizes are embedded in the outer circumference of a turnable column member 19 so that the grip means is two-dimensionally operated.

Moreover, the constructions per se of the control of the turnable column-shaped retaining means, the three- or two-dimensional control of the grip means, and the control of the floor surface activating means are well known in the art, and their descriptions will be omitted.

Figure 11:
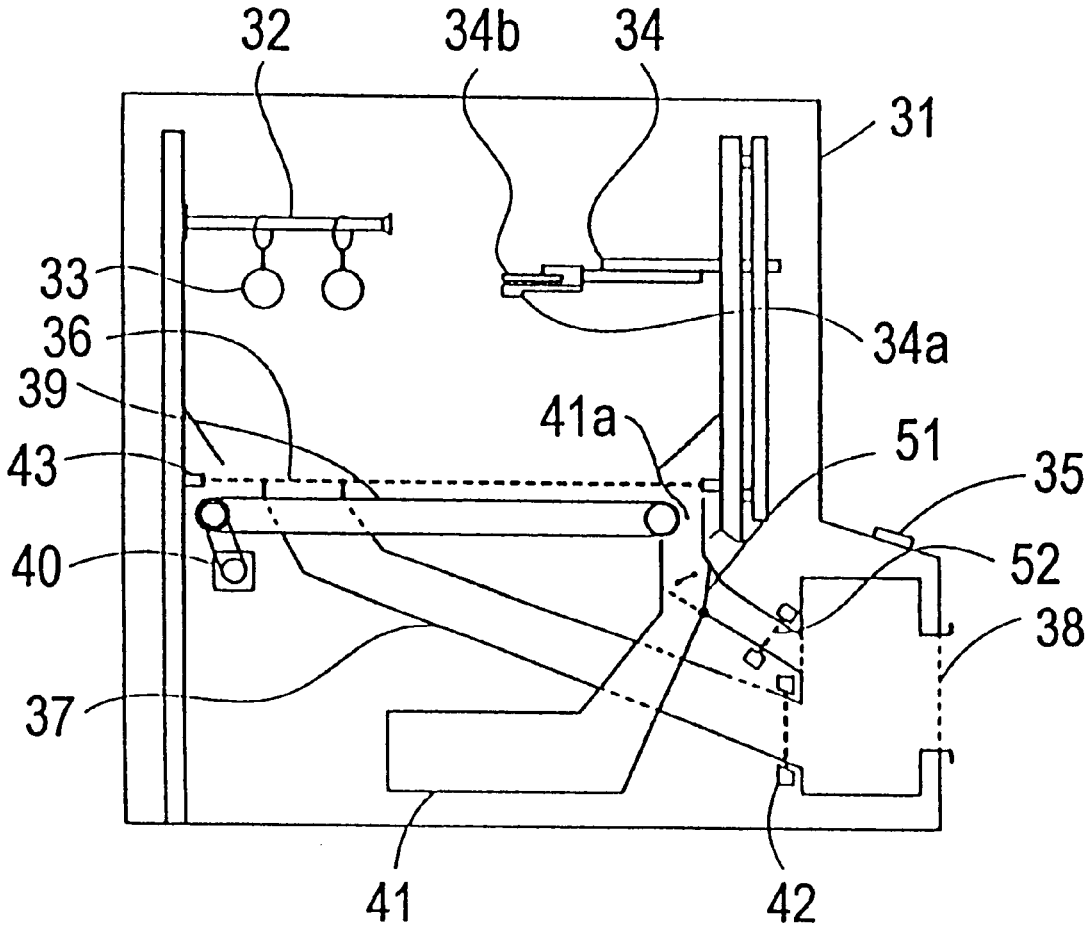
FIG. 11 is a perspective schematic side elevation showing a first embodiment of a game machine according to the present invention.

Embodiments according to the present invention will be described with reference to the accompanying drawings. The entire construction of the game machine and its basic actions will refer to Unexamined Published Japanese Patent Application No. 8-112446. FIG. 11 is a schematic view showing a construction of a first embodiment according to the invention, in which a floor is moved like a belt conveyor, for example, so that the prize, as has failed to be acquired by a prize acquiring operation and has dropped to the floor, may be recovered in a recovery box. In FIG. 11, numeral 31 designates a compartment for housing the game machine body; numeral 32 designates a rod-shaped retaining means for suspending prizes; numeral 33 designates prizes; numeral 34 designates grip means; numeral 35 designates a play button of a play box; numeral 36 designates an acquired prize reception mouth; numeral 37 designates a passing pipe; numeral 38 designates a prize take-out mouth; numeral 39 designates a movable floor (or belt conveyor); numeral 40 designates a driver for the movable floor; numeral 41 designates a recovery box; numeral 41*a* designates a recovery mouth of the recovery box; numeral 42 designates an acquired prize delivery sensor; numeral 43 designates a fallen prize detecting sensor; numeral 51 designates a damper mechanism disposed just under the recovery mouth 41*a* of the fallen prize recovery box 41; and numeral 52 designates a fallen prize delivery sensor.

Figure 12:
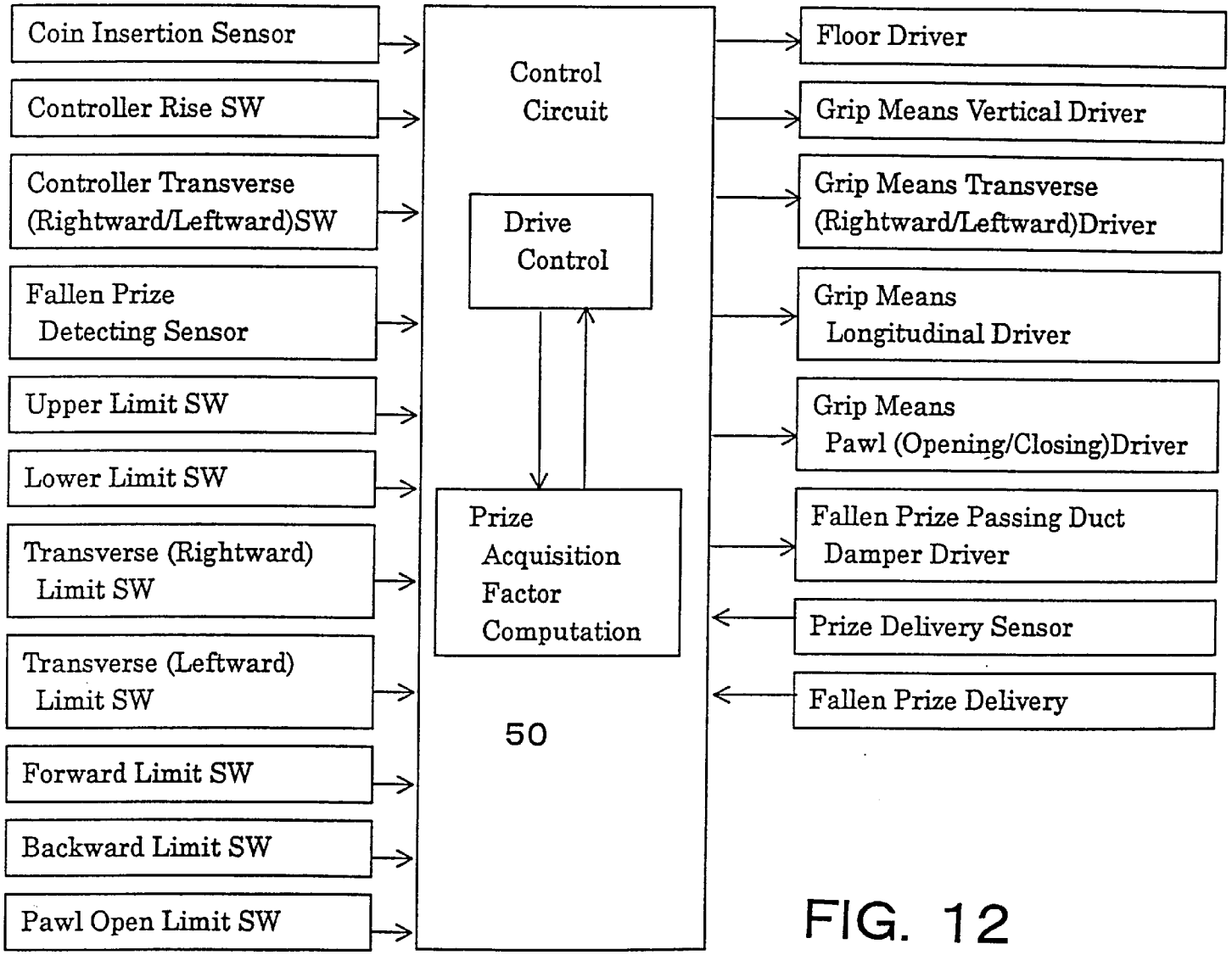
FIG. 12 is a schematic diagram showing a construction of a control device of the example of FIG. 11.

FIG. 12 shows a schematic construction of a controller of the game machine according to the present invention. In this game machine, the prizes 33 such as key holders are suspended by the rod-shaped retaining means 32. The grip means 34, which can be moved in vertical (Y), transverse (X) and longitudinal (Z) directions and having a function to drive a pair of pawls 34*b* for gripping the prize 33, is operated by controlling the play button 35 on the play box, to grip the prize 33. When the paired pawls are opened over the acquired prize reception mouth 36, the prize 33 can be delivered through the prize passing pipe 37 from the prize take-out mouth 38. On the other hand, the prize 33 may be gripped insufficiently by the pawls of the grip means 34, and may drop, before the grip means 34 comes to over the acquired prize reception mouth 36, to fail to be acquired.

The game machine comprises: the optical sensor 43 for detecting the prize which has failed to be acquired and has dropped to the movable floor 39 (or belt conveyor); the drive device 40 for driving the movable floor; the fallen prize recovery box 41 for recovering the fallen prize; the damper mechanism 51 for delivering the fallen prize; the prize passing pipe 37 for delivering the normally acquired prize; the aquired prize delivery sensor 42 for counting the normally acquired prizes; the fallen prize delivery sensor 54 for counting the number of delivered ones of the fallen prizes; and an operation unit 50 for computing the acquisition factor of prizes.

Figure 13:
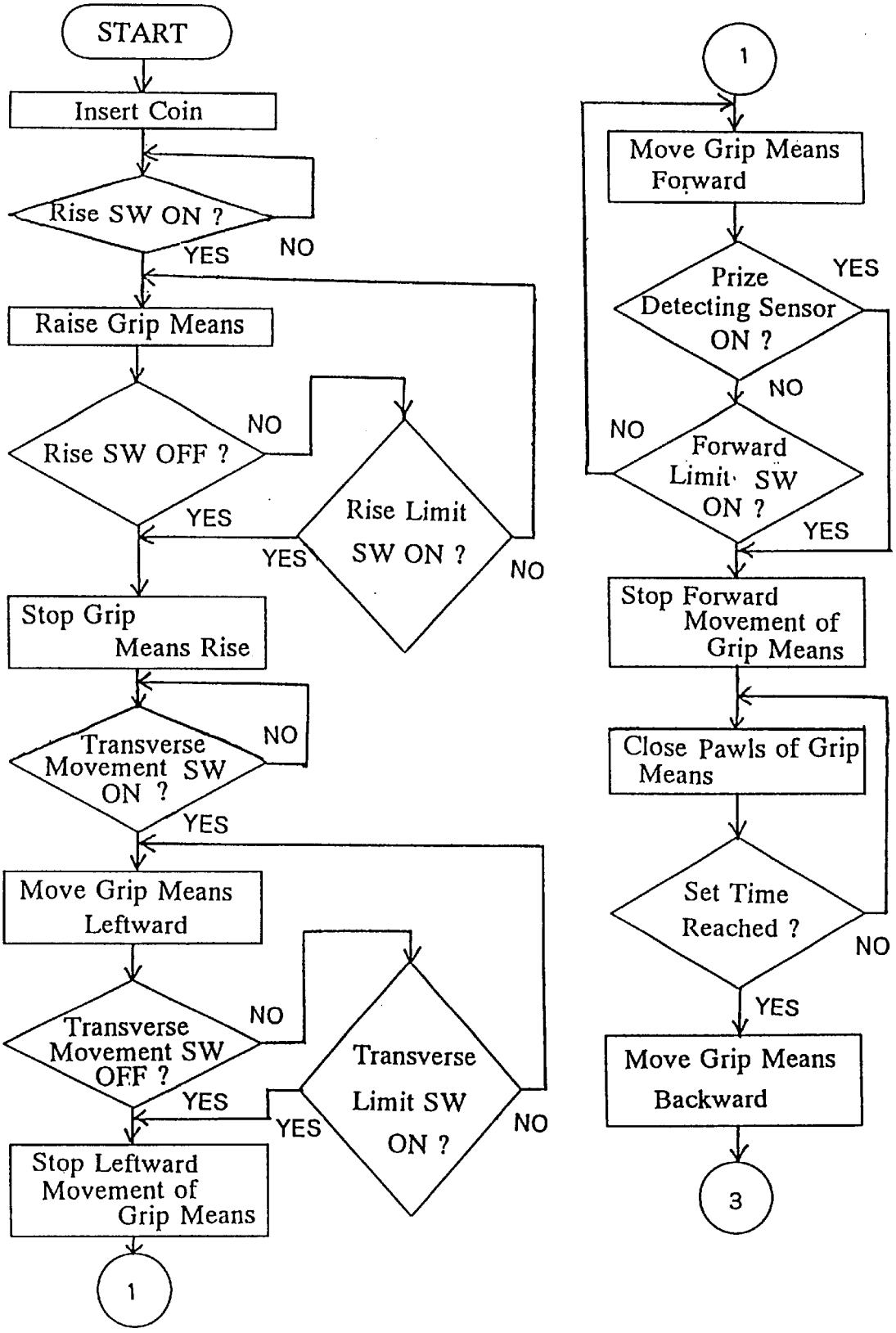
FIG. 13 is a flow chart 1 of the control device of FIG. 11.
Figure 14:
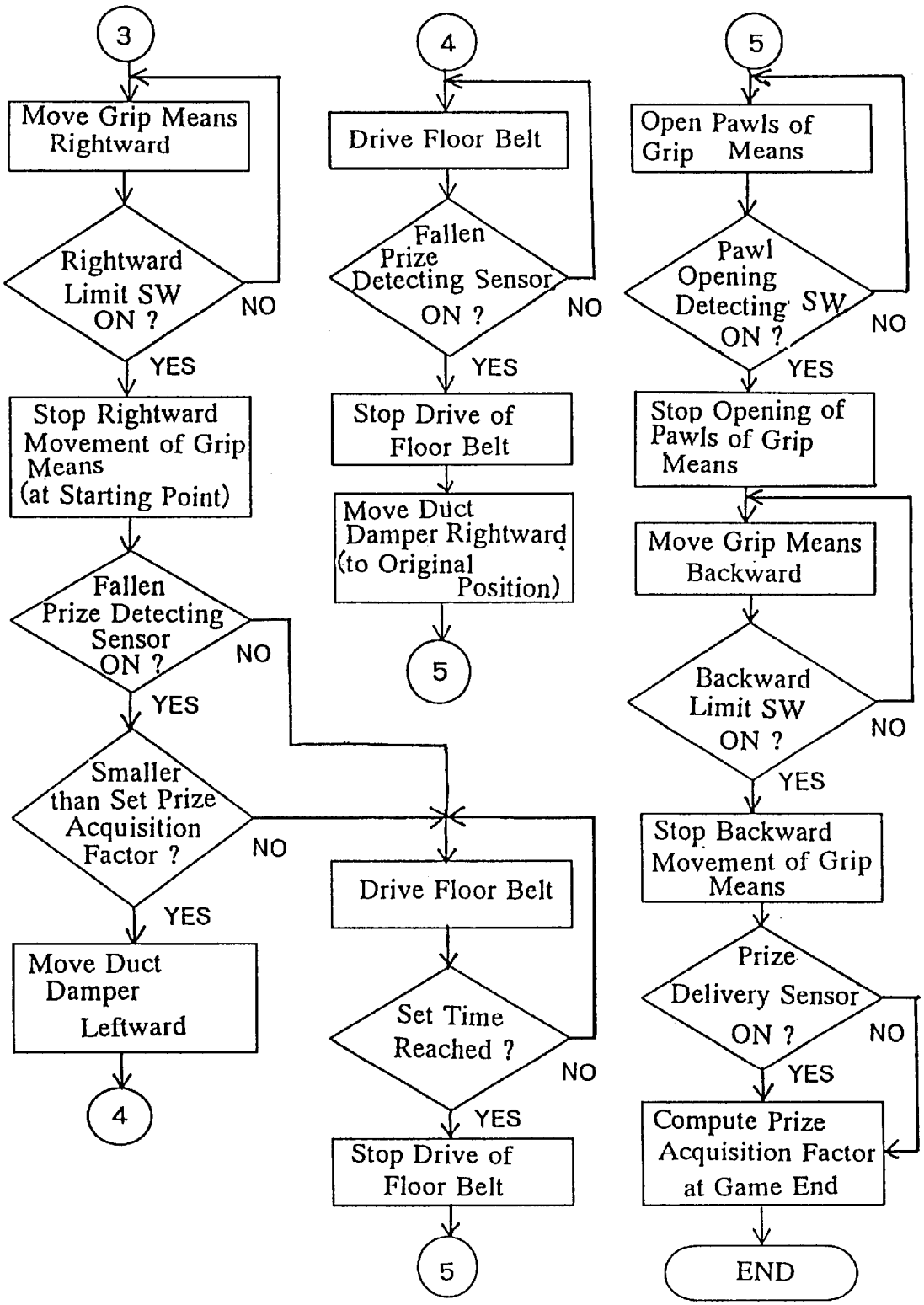
FIG. 14 is a flow chart 2 of the control device of FIG. 11.

The actions of the construction thus made will be described with reference to the flow charts of FIGS. 13 and 14. When a coin is inserted, it is detected by the coin insertion sensor to start a game. The grip means 34 is raised, when the controller rise button 35 is turned ON, and is stopped when the rise button 35 is turned OFF. If this rise button 35 is not turned OFF, the grip means 34 is stopped by an upper limit SW. The grip means 34 is moved transversely, when the transverse (rightward/leftward) button 35 is turned ON, and is stopped when the transverse button 35 is turned OFF. In the transverse case, too, the grip means is stopped by the transverse limit SW if the transverse button 35 is not turned OFF.

The grip means 34 thus stopped is moved forward according to a program installed in the controller and is stopped to close its pawls 34*b* for gripping a prize, when a prize detecting sensor 34*a* carried by the grip means 34 detects the prize and is turned ON. After this, the grip means 34 is automatically returned to the starting position by the program no matter whether it might succeed or not in acquiring the prize.

If, at this time, the fallen prize detecting sensor 43 detects whether or not the prize has dropped to the floor and is turned ON, a prize acquisition factor (B) in this game play is compared with that (A) which is set by the installer such as the game center in the operation unit 50 packaged in the controller. If $A \geqq B$, the damper mechanism 51 is moved to the delivery side, and the belt conveyor of the movable floor 39 is driven to deliver the prize. If $A<B$, not the damper mechanism 51 but the movable floor 39 is driven to recover the fallen prize into the fallen prize recovery box 41. After this, the grip means 34 is retracted and stopped at the starting position. After the acquired prizes are counted, the game is ended by computing the prize acquisition factor at the ending time of the present play. Here in the computation of the prize acquisition factor, the number of delivered ones of the fallen prizes can also be counted by the fallen prize delivery sensor so that it can also be contained as inclusive in the number of acquired prizes.

Figure 15:
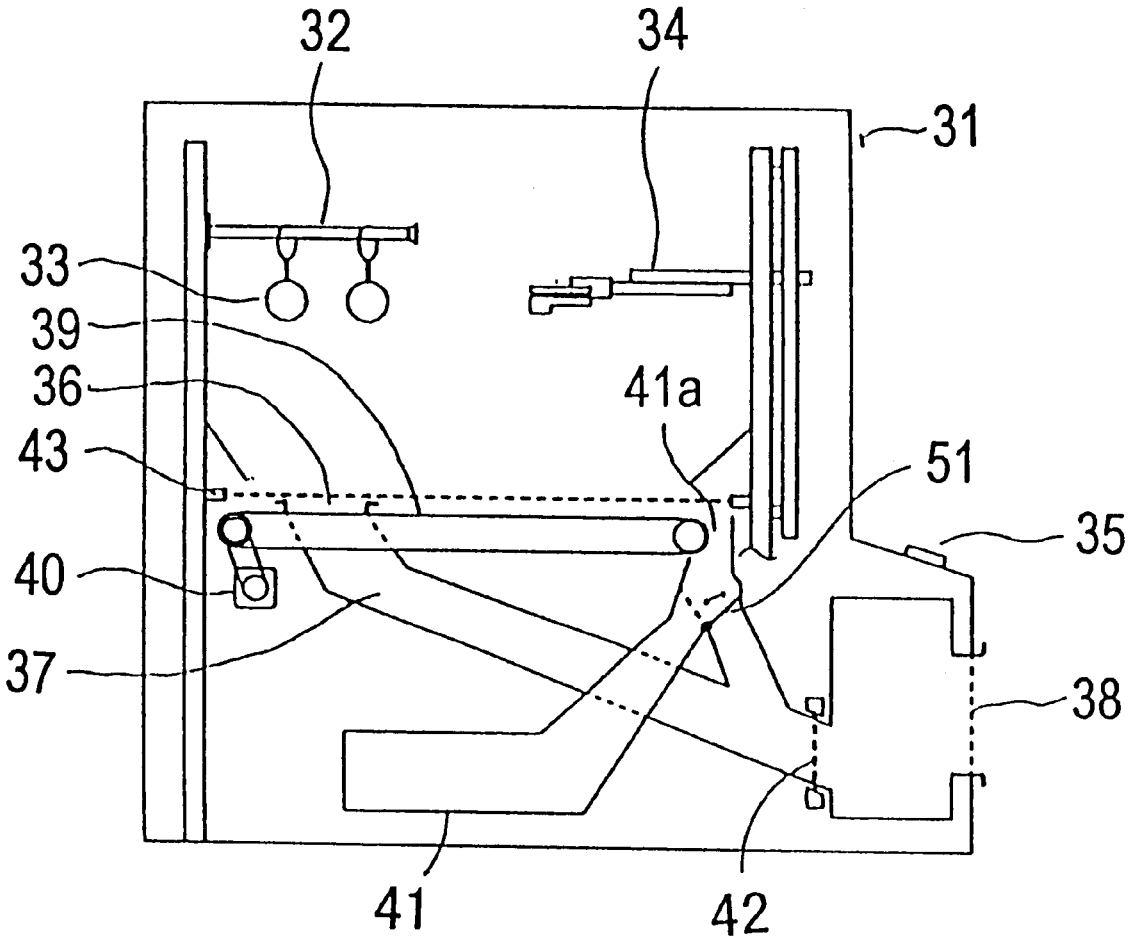
FIG. 15 is a perspective schematic side elevation showing a second embodiment of a game machine according to the present invention.

FIG. 15 shows a second embodiment according to the present invention, in which the acquired prize delivery sensor 42 and the fallen prize delivery sensor are shared.

Specifically, the passage at the delivery side of the damper mechanism 51, as disposed just under the recovery mouth 41*a* of the fallen prize recovery box 41, is arranged sideways of the passing pipe 37 so that both the acquired prizes and the fallen prizes may reach the prize take-out mouth 38 through the aquired prize delivery sensor 42.

Figure 16:
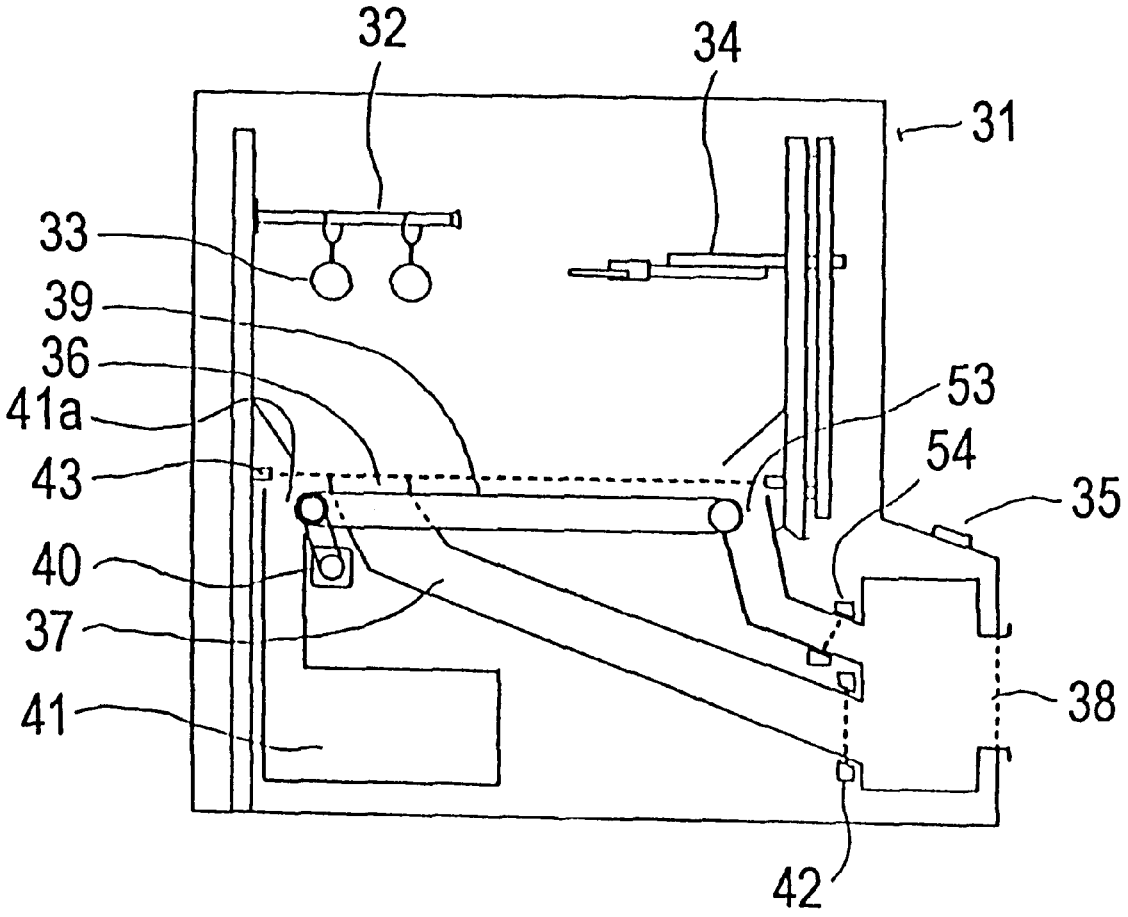
FIG. 16 is a schematic diagram showing a construction of a third embodiment of the game machine.

On the other hand, FIG. 16 shows another embodiment of the present, in which the fallen prize recovery box 41 and a fallen prize delivery passage 53 are separated by making it possible to drive the belt conveyor of the movable floor 39 in two directions so that the fallen prizes can be recovered and delivered without providing the damper mechanism.

Figure 17:
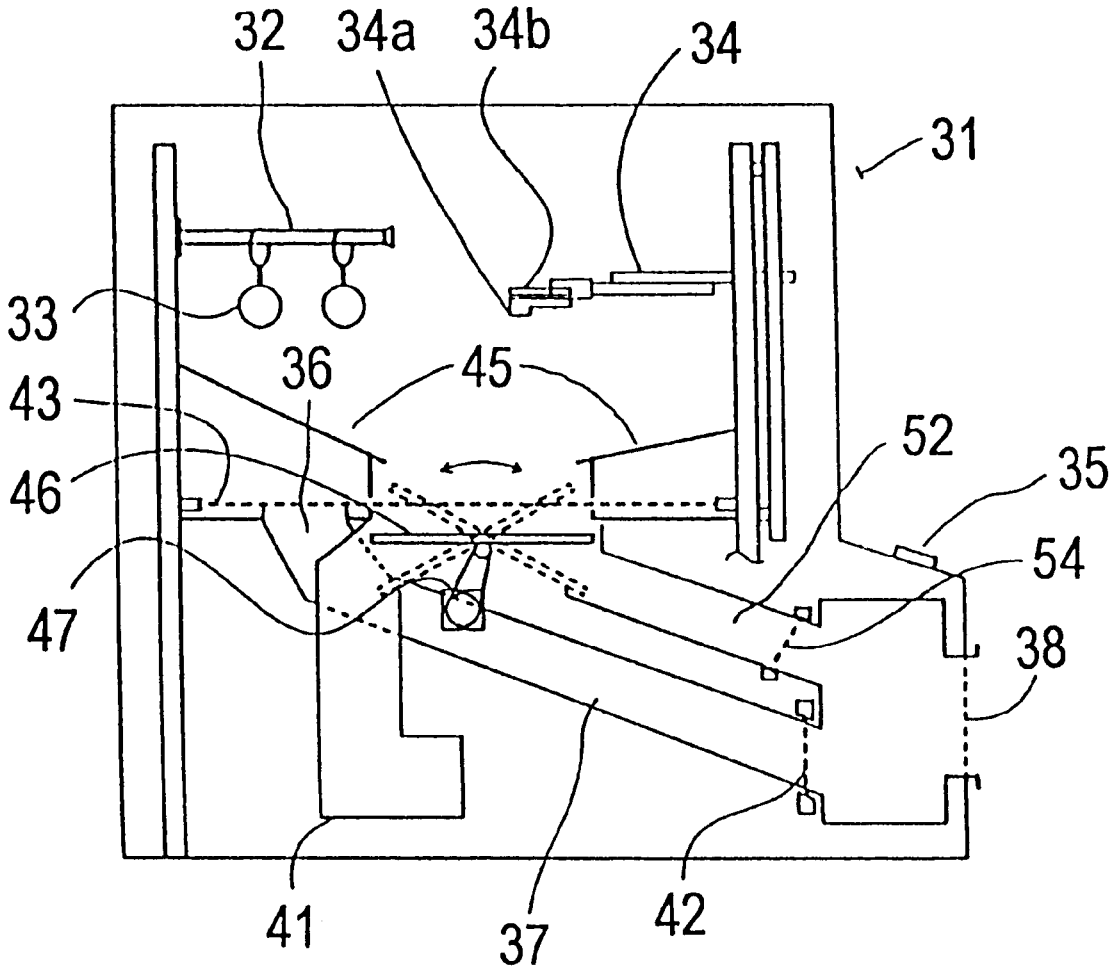
FIG. 17 is a schematic diagram showing a construction of a fourth embodiment of the game machine.

FIG. 17 shows another embodiment according to the present invention, in which a movable floor 46 is made of a seesaw so that the fallen prizes may be recovered or delivered.

Specifically, a sloped floor 45 close to the outer periphery of the compartment 31 is sloped down to the center, and the seesaw-shaped movable floor 46 is arranged adjacent to the sloped floor 45 together with a floor driver 47. The fallen prize recovery box 41 for, the fallen prizes is disposed at the lefthand side of the seesaw-shaped movable floor 46 whereas the delivery passage 52 for the fallen prizes is disposed at the righthand side of the movable floor 46, and this delivery passage 52 leads to the prize take-out mouth 38 and is provided in its leading midway with a fallen prize delivery sensor 54.

In the state of normal actions, moreover, the movable floor 46 is held in a horizontal position and covers the individual entrances of the fallen prize recovery box 41 and the fallen prize delivery sensor 52. The prize having succeeded in acquisition is passed from the acquired prize reception mouth 36 through the passing pipe 37 to activate the aquired prize delivery sensor 42, and reaches the prize take-out mouth 38 so that it can be taken out by the player. On the other hand, the prize having failed to be acquired drops from the sloped floor 45 to the movable floor 46 so that it is detected by the fallen prize detecting sensor 43. If this sensor 43 detects the drop of the prize on the floor and is turned ON, the prize acquisition factor (B) in this game play is compared with that (A) which is set by the installer such as the game center in the operation unit 50 packaged in the controller. If A≦B, the movable floor 46 is turned rightward to the delivery side to deliver the prize through the fallen prize delivery passage 52. If A (B, the movable floor 46 is turned leftward to recover the fallen prize into the fallen prize recovery box 41.

Figure 18:
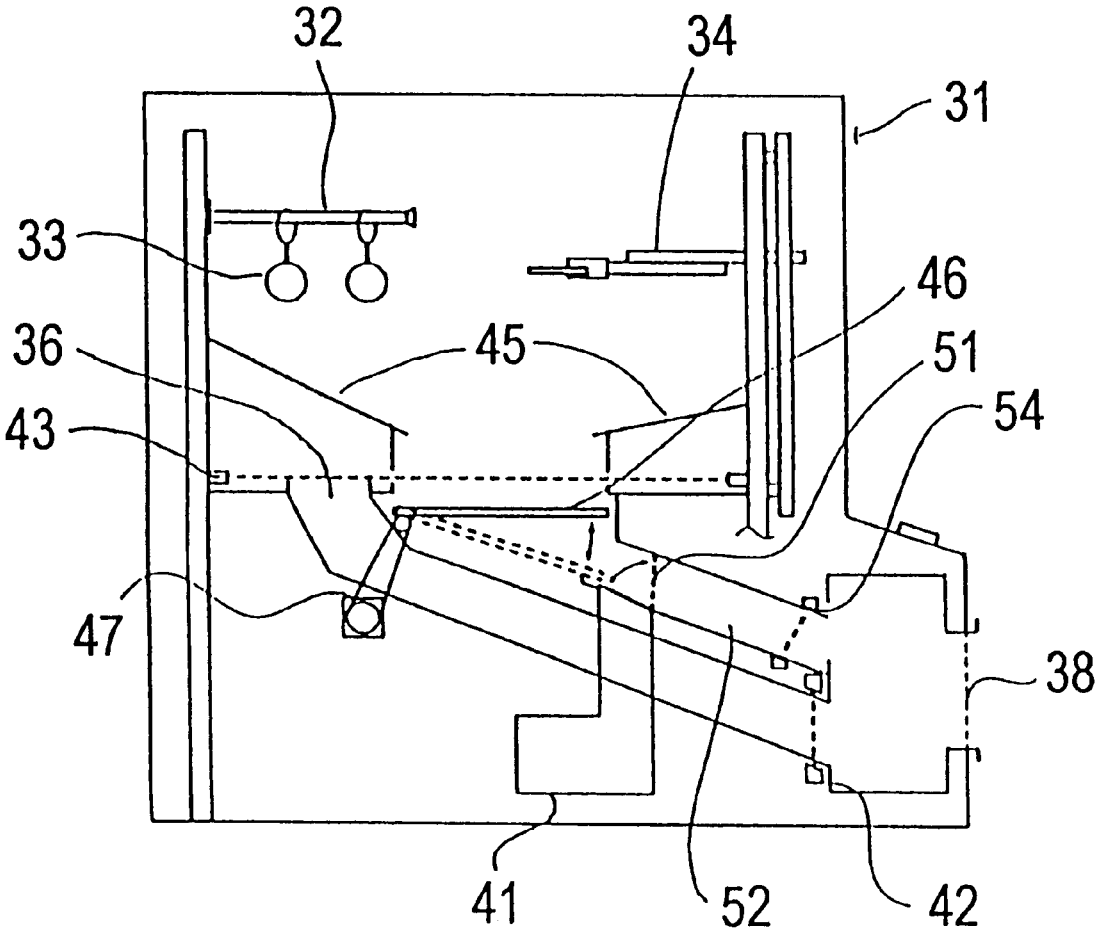
FIG. 18 is a schematic diagram showing a construction of a fifth embodiment of the game machine.

In an embodiment of FIG. 18, the movable floor 46 is given a cantilever structure and connected to the floor driver 47, and the entrance of the passage 52 for the fallen prizes is formed in the vicinity of the end portion at the movable side of the movable floor 46. Just under the passage entrance, there is disposed the damper mechanism 51, under which the fallen prize recovery box 41 for the fallen prizes is disposed. The passage 52 for the fallen prizes is provided with the fallen prize delivery sensor 54 and leads to the prize take-out mouth 38.

In the construction of FIG. 18, in the state of normal actions, moreover, the movable floor 46 is held in a horizontal position. The prize having failed to be acquired drops from the sloped floor 45 to the movable floor 46 so that it is detected by the fallen prize detecting sensor 43. If this sensor 43 detects the drop of the prize on the floor and is turned ON, the prize acquisition factor (B) in this game play is compared with that (A) which is set by the installer such as the game center in the operation unit 50 packaged in the controller. If A≦B, the movable floor 46 is turned rightward to the delivery side, and the damper mechanism 51 is swung to the delivery side to deliver the prize through the fallen prize delivery passage 52. If A(B, the movable floor 46 is turned left ward, and the damper mechanism 51 is swung to the delivery side to recover the fallen prize into the fallen prize recovery box 41.

Figure 19:
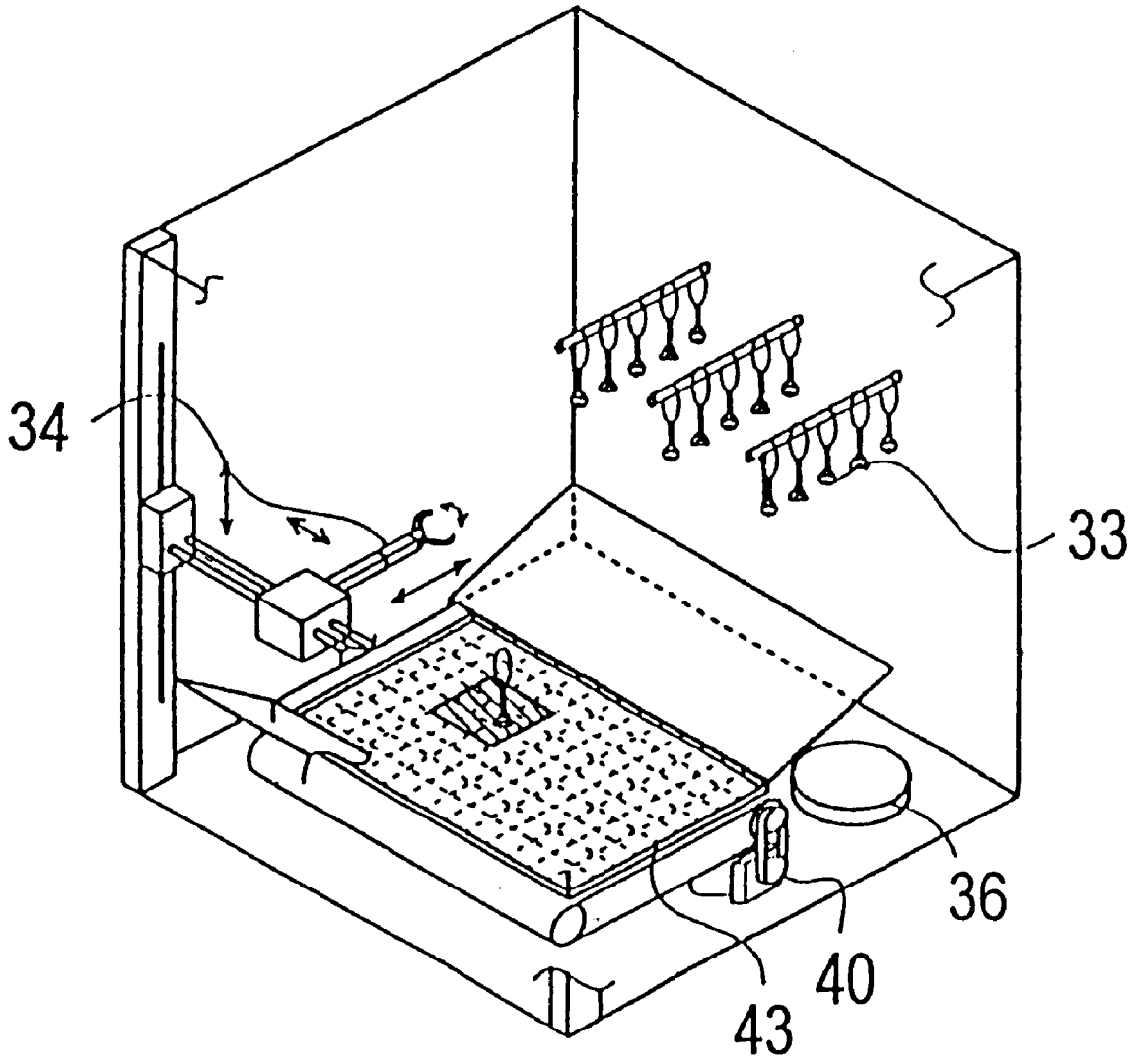
FIG. 19 is a schematic view showing another example of a dropping prize detecting device of the game machine.
Figure 20:
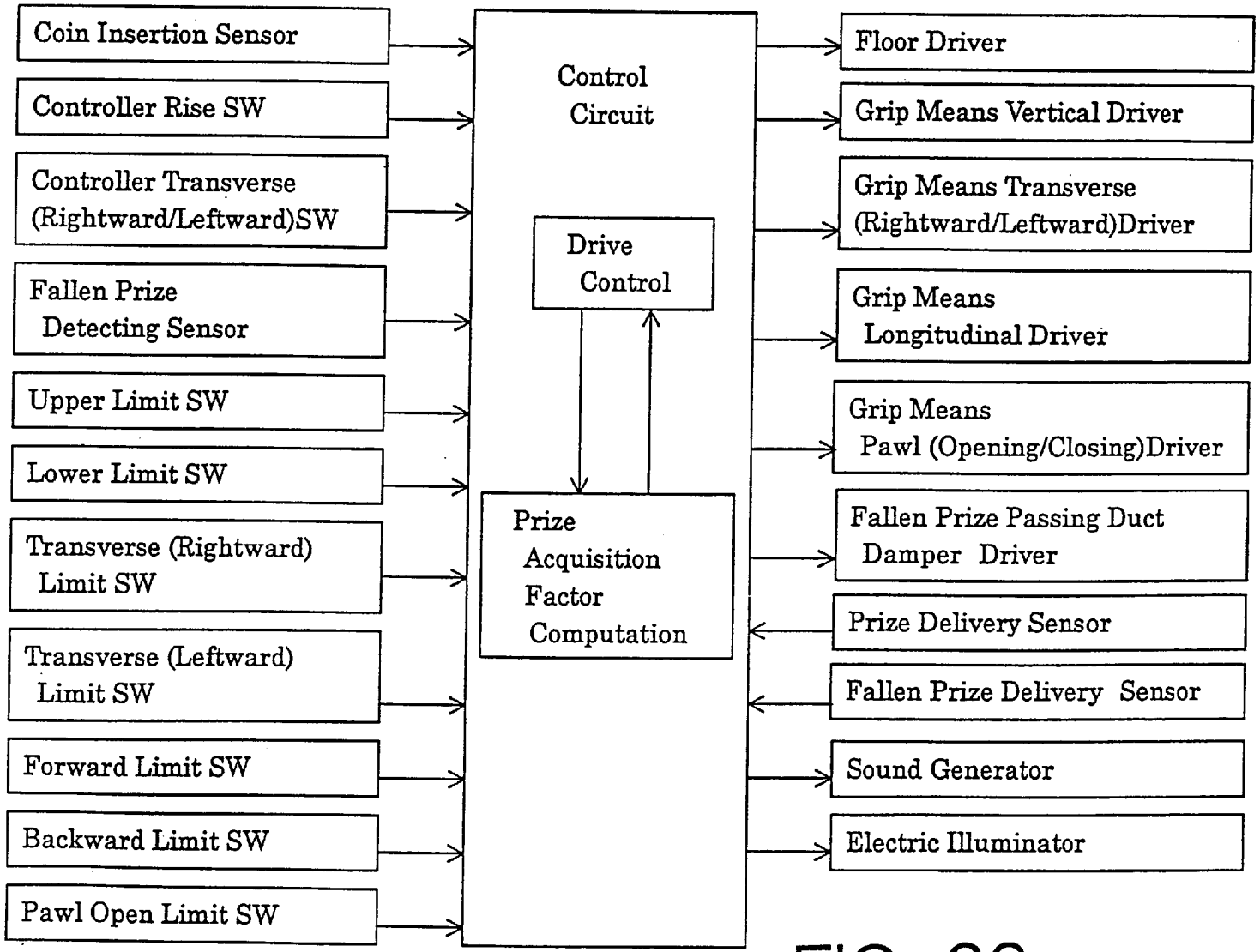
FIG. 20 is schematic diagram showing a control device of a sixth embodiment of the game machine.

FIG. 19 shows a construction in which the fallen prize detecting sensor 43 is formed into a matrix shape, for example, so that it may locate the position where a prize has dropped. This sensor is exemplified by a touch panel of photo sensor type. The installer can make a construction in which the prize is delivered if it drops on a specific position (as hatched in FIG. 19) of the floor. This specific position is made recognizable to interest the player. As shown in a schematic diagram in FIG. 20, the controller can be provided with a sound generator such as a speaker and an electric illuminator such as an LED or a stroboscopic tube so that a Fanfare may be generated or an electric illumination may be flashed, when the fallen prize is to be delivered, to interest the player or to make an appeal to the circumference.

Figure 21:
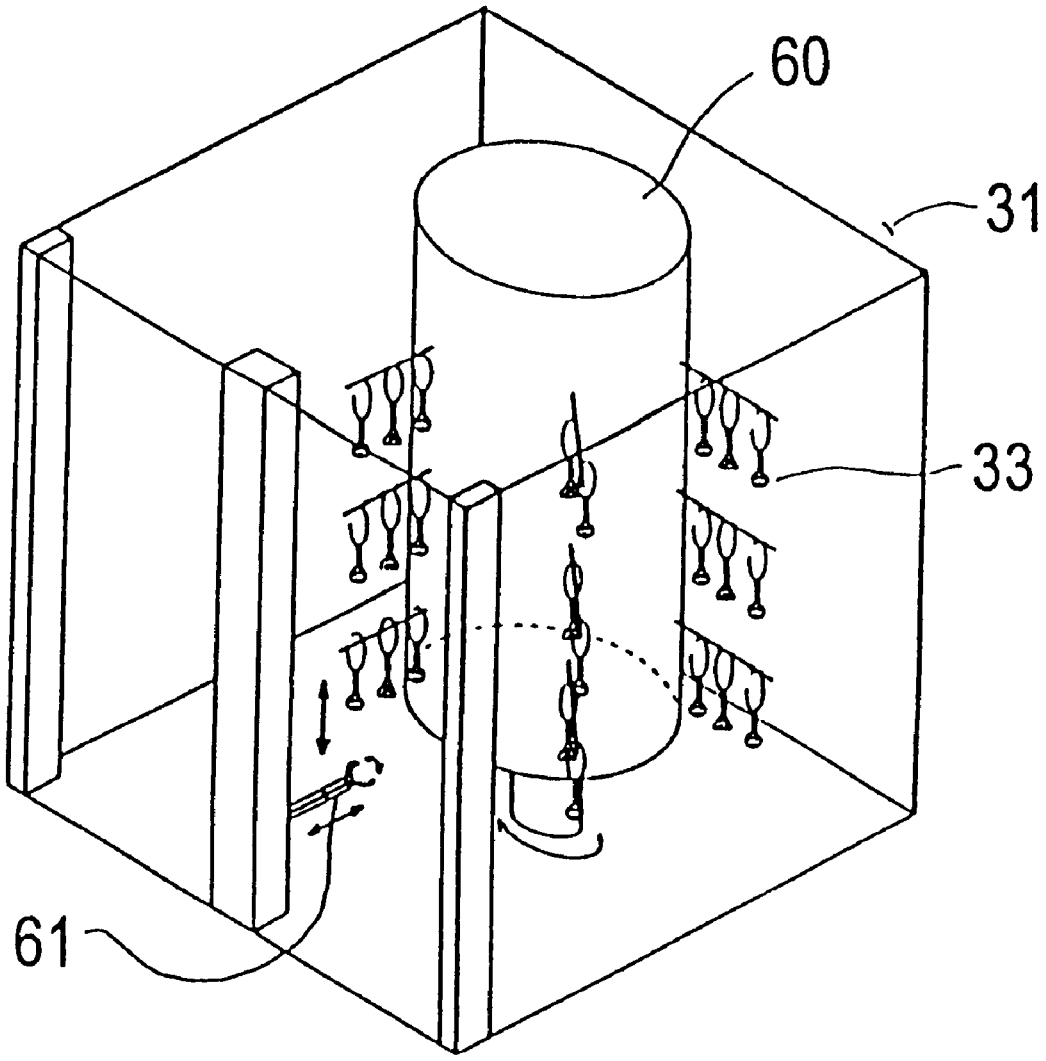
FIG. 21 is a schematic view showing an embodiment, as equipped with another prize suspending device, of the game machine.

The foregoing embodiments are based on the construction of the game machine, as disclosed in Unexamined Published Japanese Patent Application No. 8-112446. However, no problem arises either in a game machine shown in FIG. 21, in which a turnable column-shaped prize retainer 60 is disposed at the center and in which grip means 61 can be moved vertically (Y) and longitudinally (Z), or in a game machine shown in FIG. 22, which is constructed to comprise shelf-shaped prize retaining means 62 and grip means 63 capable of moving vertically (Y), transversely (X) and longitudinally (Z).

Figure 22:
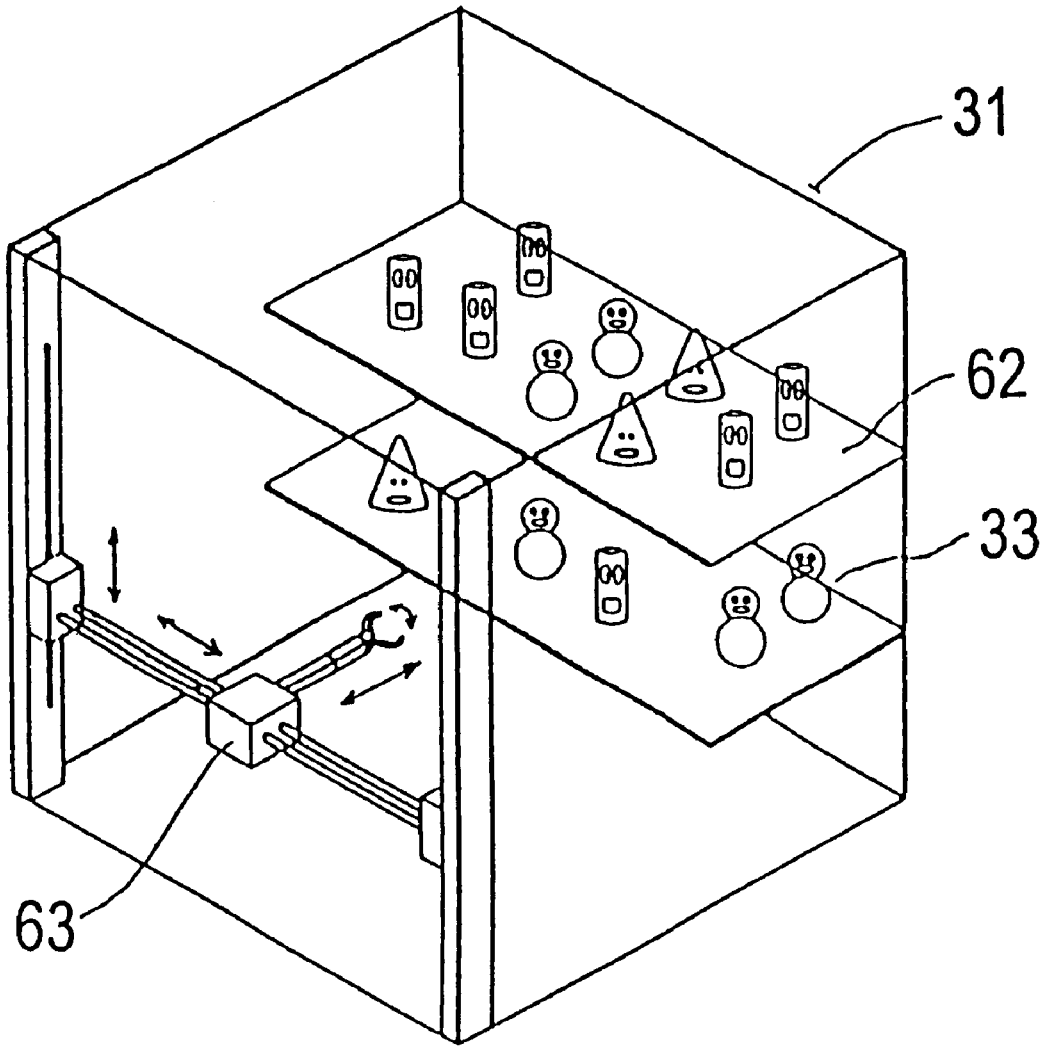
FIG. 22 is a schematic view showing an embodiment, as equipped with another prize mounting device, of the game machine.

Nor arises any problem either in the game machine which is constructed such that the prizes are placed on the shelf-shaped prize retaining means 62 and such that the grip means 63 can be moved vertically (Y) and longitudinally (Z), as shown in FIG. 22, or in the game machine which is constructed to comprise the shelf-shaped prize retaining means and the grip means capable of moving vertically (Y), transversely (X) and longitudinally (Z), as shown in FIG. 22.

Figure 23:
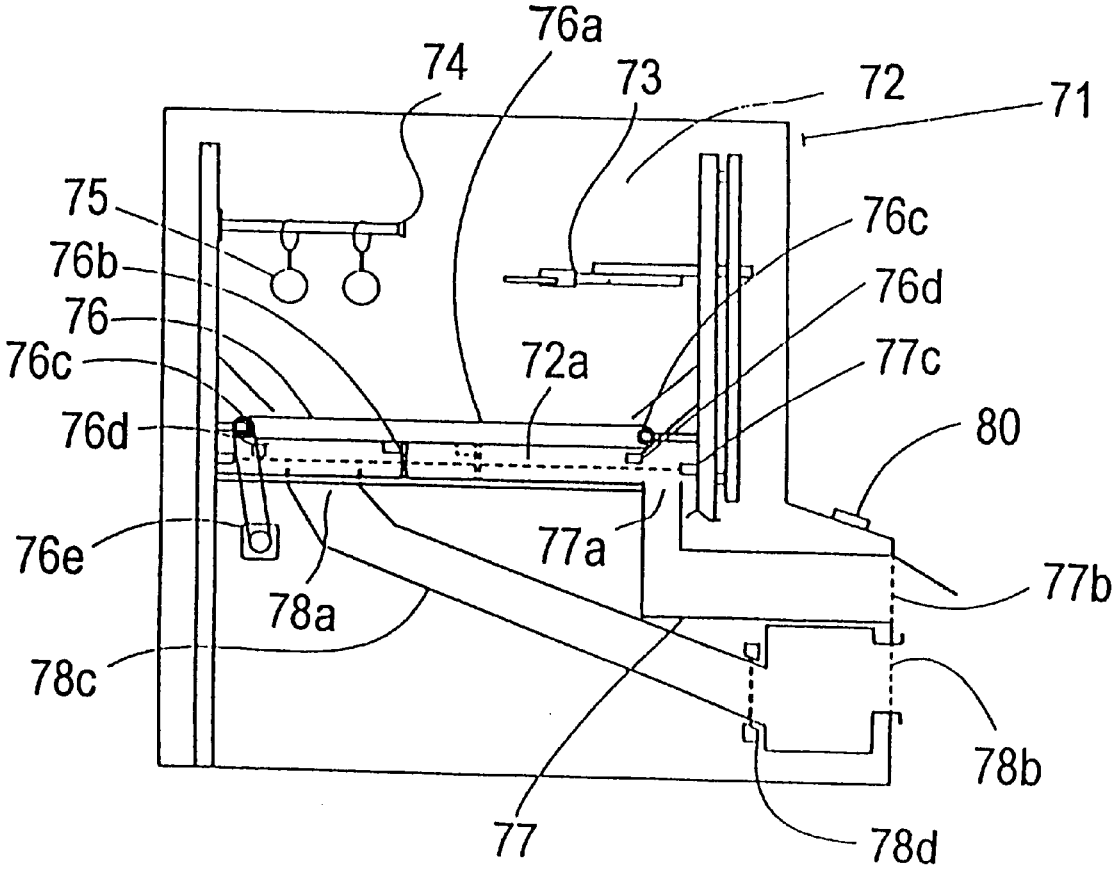
FIG. 23 is a schematic side elevation showing an embodiment of a game machine according to the present invention.

Embodiments according to the present invention will be described with reference to the accompanying drawings. For the entire construction and the actions of the game machine, Unexamined Published Japanese Patent Application No. 8-112446 should be referred to the description mentioned before. FIG. 23 shows one embodiment according to the invention, which is constructed such that a wiper mechanism 76 having a drive belt 76*a,* a blade 76*b* and a pulley 76*c* is disposed in the vicinity of a floor surface 72*a* so that a prize 75, as suspended by horizontal retaining means 74 but failed to acquire and fallen to the floor surface 72*a,* may be recovered into a fallen prize recovery box 77, and such that the prize 75 having dropped to the floor surface 72*a* is moved and recovered by the action of the wiper mechanism 76. In the vicinity of the floor surface 72*a,* there is arranged a photo sensor which is enabled to detect the passage of the fallen prize 75 by shielding the light through an optical touch panel so as to detect the fallen prize 75.

Figure 24:
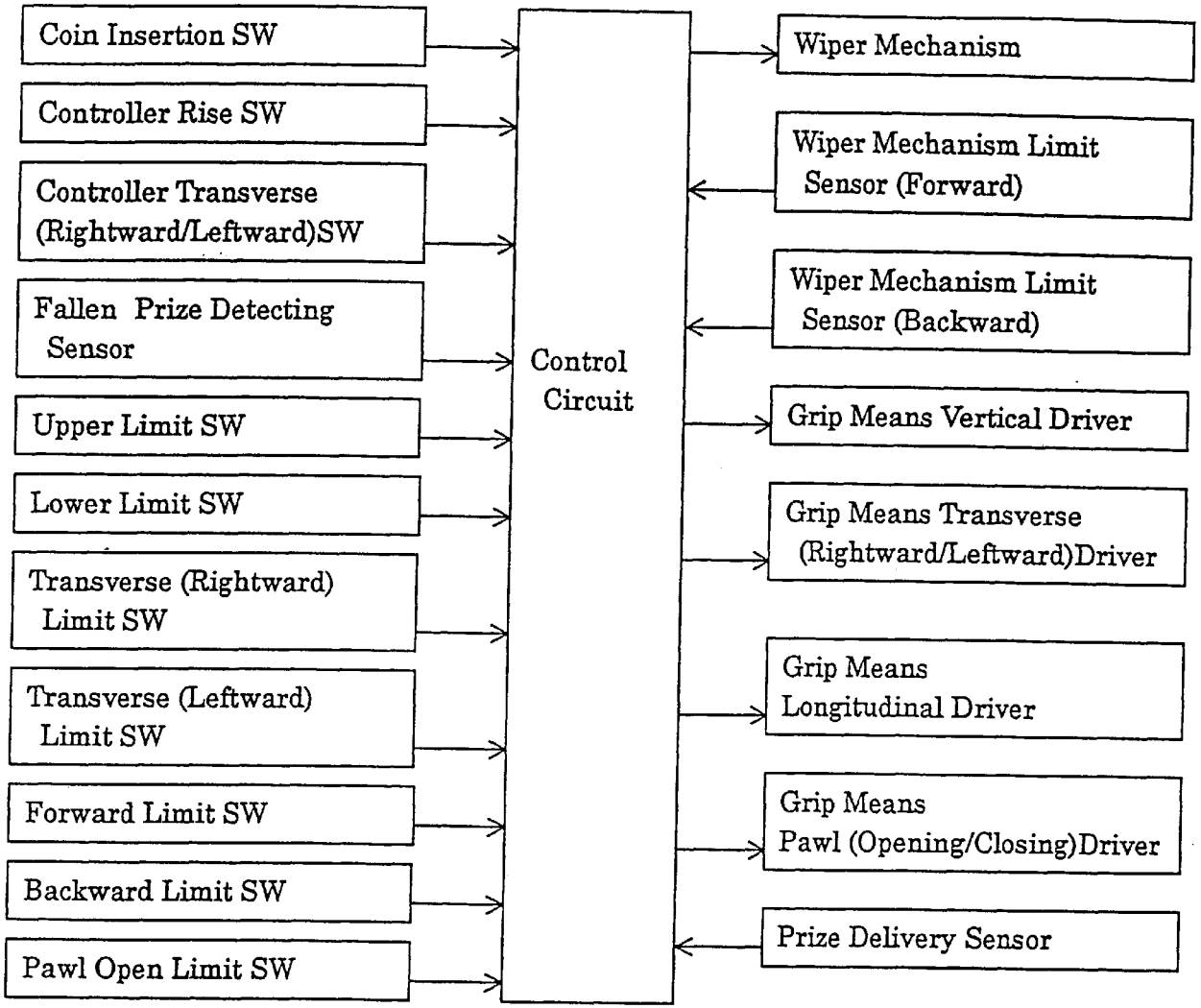
FIG. 24 is a schematic block diagram showing a control device of the embodiment of the game machine.
Figure 25:
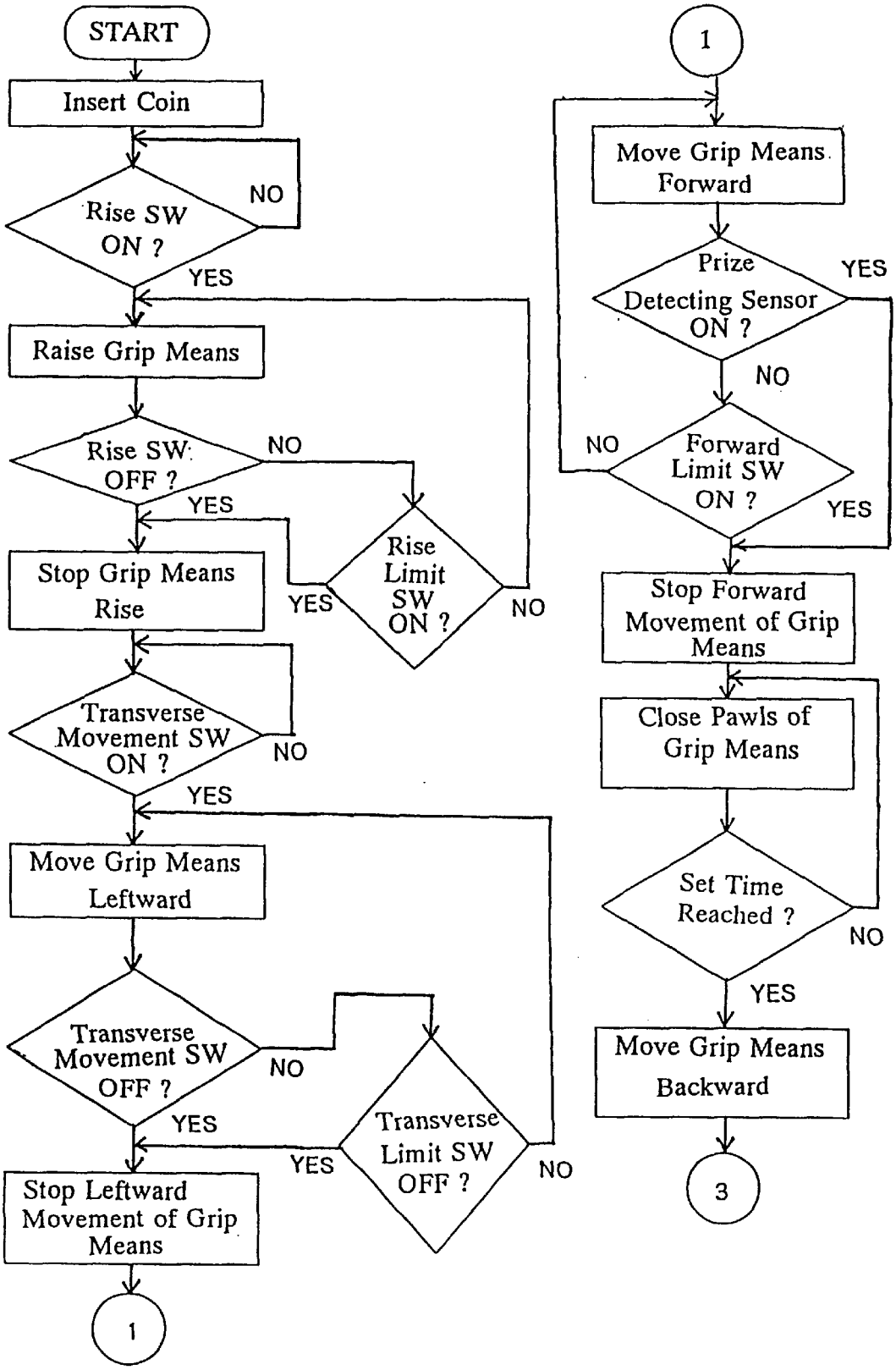
FIG. 25 is a first half stage of a flow chart of the actions of the game machine.
Figure 26:
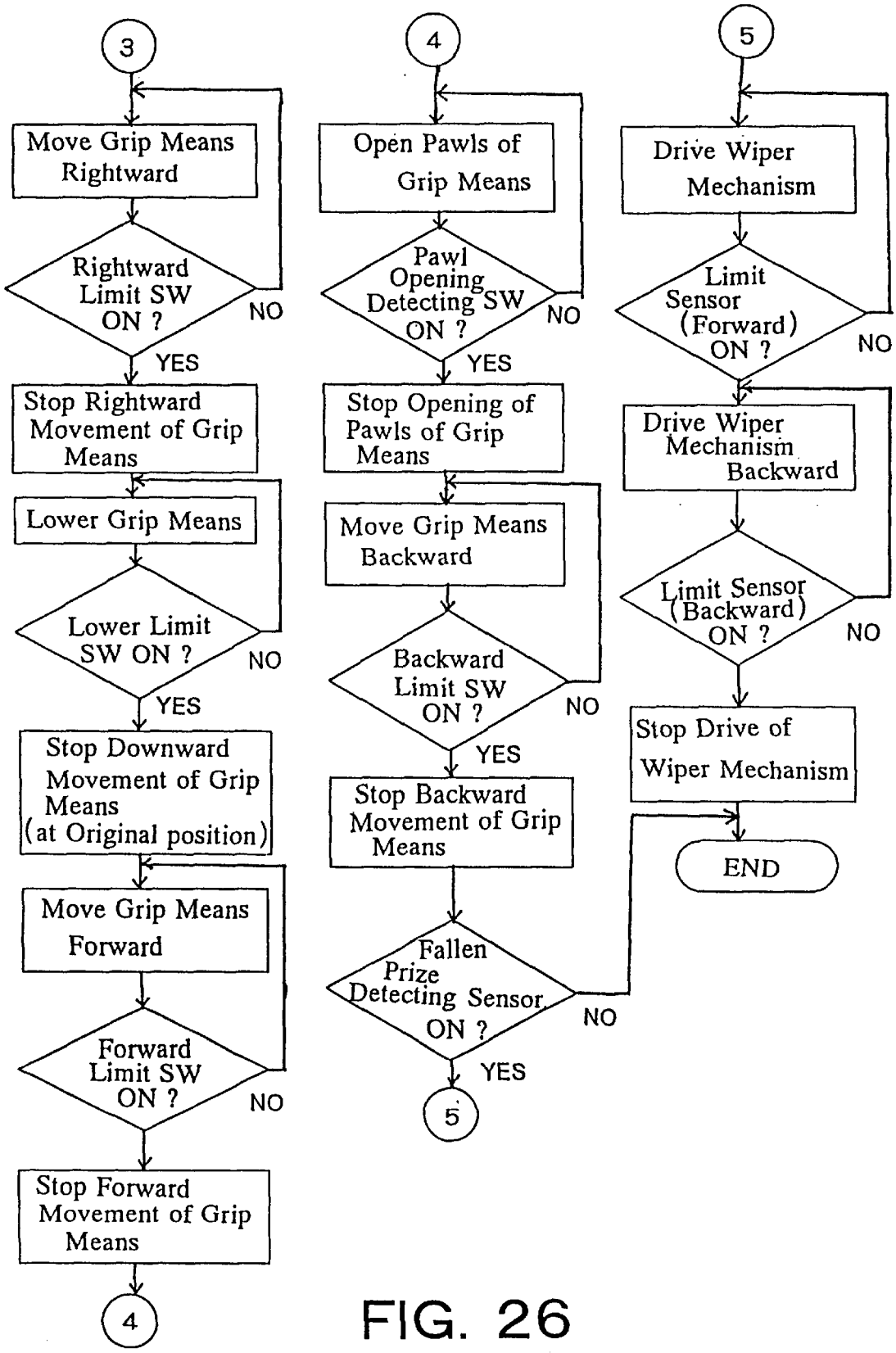
FIG. 26 is a second half stage of the flow chart of the actions of the game machine.

FIG. 24 is a schematic block diagram showing a controller corresponding to the machine shown in FIG. 23. The specific actions will be described with reference to the action flow charts shown in FIGS. 25 and 26.

When the player(not-shown) inserts a coin, the play is started. When the rise SW is turned ON, grip means 73 starts to rise. This grip means 73 is stopped by turning OFF the rise switch SW when it reaches the height of the prize 75 to be acquired by the player. When the transverse movement SW is then turned ON, the grip means 73 starts to move transversely. The grip means 73 is stopped by turning OFF the transverse movement SW when it comes to the front of the prize 75 to be acquired. From now, the grip means 73 is automatically moved forward to acquire the prize in accordance with the controller(not-shown) which is mounted in a game machine 71. The grip means 73 is stopped when a prize detecting sensor belonging thereto is activated (or turned ON). On the other hand, if an unskilled player stops the grip means 73 in a position where the prize 75 cannot be acquired, the grip means 73 moves to the forward limit at which it is stopped in response to the ON of a forward limit switch(not shown). Then, the closing action of the paired pawls composing the grip means 73 is executed for a predetermined time period, and the grip means 73 is moved backward. Then, the grip means 73 restores the (original)

position at the coin insertion time so that it acts to return the prize 75 to the player. At this position, the grip means 73 is moved forward so far that the forward limit switch is turned ON. At this position, the paired pawls are opened to fall the acquired prize 75 into a prize reception mouth 78*a* so that the prize 75 is discharged through a prize passing pipe 78*c* into a prize take-out mouth 78*b,* and the grip means 73 is retracted to restore the original position. If the prize failed to be acquire during the play and fallen, is detected by the activated (or turned ON) prize detecting sensor 77*d,* the wiper mechanism 76 is activated. The wiper mechanism 76 is stopped, when a wiper mechanism (forward) limit SW 76*d* is turned ON, and is then driven backward to restore its original position.

Figure 27:
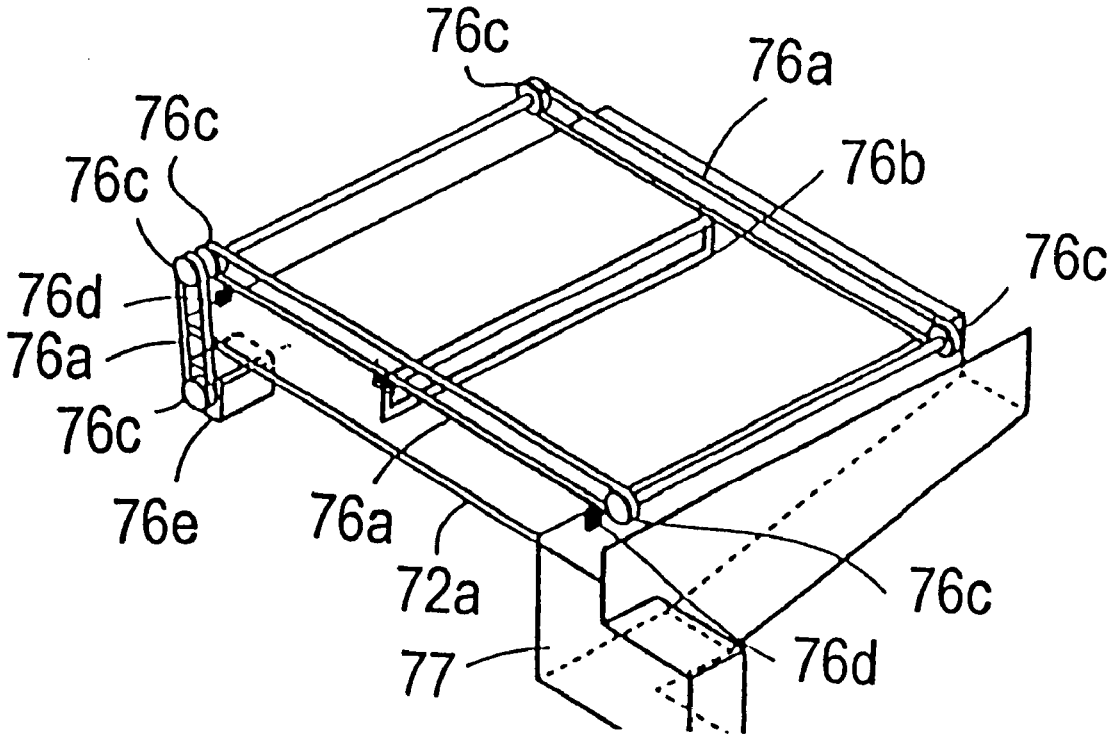
FIG. 27 is a a perspective view showing a wiper mechanism of the game machine.

FIG. 27 is a perspective view for describing the portions of the wiper mechanism 76 and the fallen prize recovery box 77. Two rotatable shafts are arranged in parallel with and at a predetermined distance from the floor surface 72*a* and are individually provided with the two pulleys 76*c* which are spaced at a predetermined axial distance. On the individual pulleys 76*c* of the two rotatable shafts, there are made to run the two belts 76*a* on which the two ends of the blade 76*b* are fixed and arranged close to the floor surface 72*a*. A driver 76*e* is disposed in the vicinity of one rotatable shaft, and the pulleys 76*c* are fixed on the driver and the one rotatable shaft to run the belt 76*a* thereon. In the vicinity of the other rotatable shaft, there is disposed the fallen prize recovery box 77 together with a passage 77*a*.

In the wiper mechanism shown in FIG. 27, the blade 76*b* is normally positioned close to the driver 76*e*. When it is detected by the fallen prize detecting sensor 77*d* that the prize has dropped to the floor surface 72*a* because of a failure in the acquisition, the driver 76*e* rotates in response to the detection signal so that the belts 76*a* and the blade 76*b* associated push the fallen prize to the fallen prize recovery box 77 to recover the prize from the passage 77*a* into the fallen prize recovery box 77.

The prize 75 thus fallen is recovered into the fallen prize recovery box 77 which is disposed in the lower portion of the game machine 71. The installer is enabled to take out the recovered prizes by forming a fallen prize take-out mouth 77*b* in the front of the game machine 71 and to suspend them from the retaining means 74 in the game machine.

On the other hand, a fallen prize detecting sensor 77*c* may not be provided, but a prize delivery sensor 78*d* for detecting the acquired prize 75 may be provided. The wiper mechanism 76 may be activated either only when the prize delivery sensor 78*d* is not activated (or turned ON) at the play ending time or at the play ending time. Here, the wiper mechanism need not necessary be activated at every play ends but can be activated at predetermined intervals.

Figure 28:
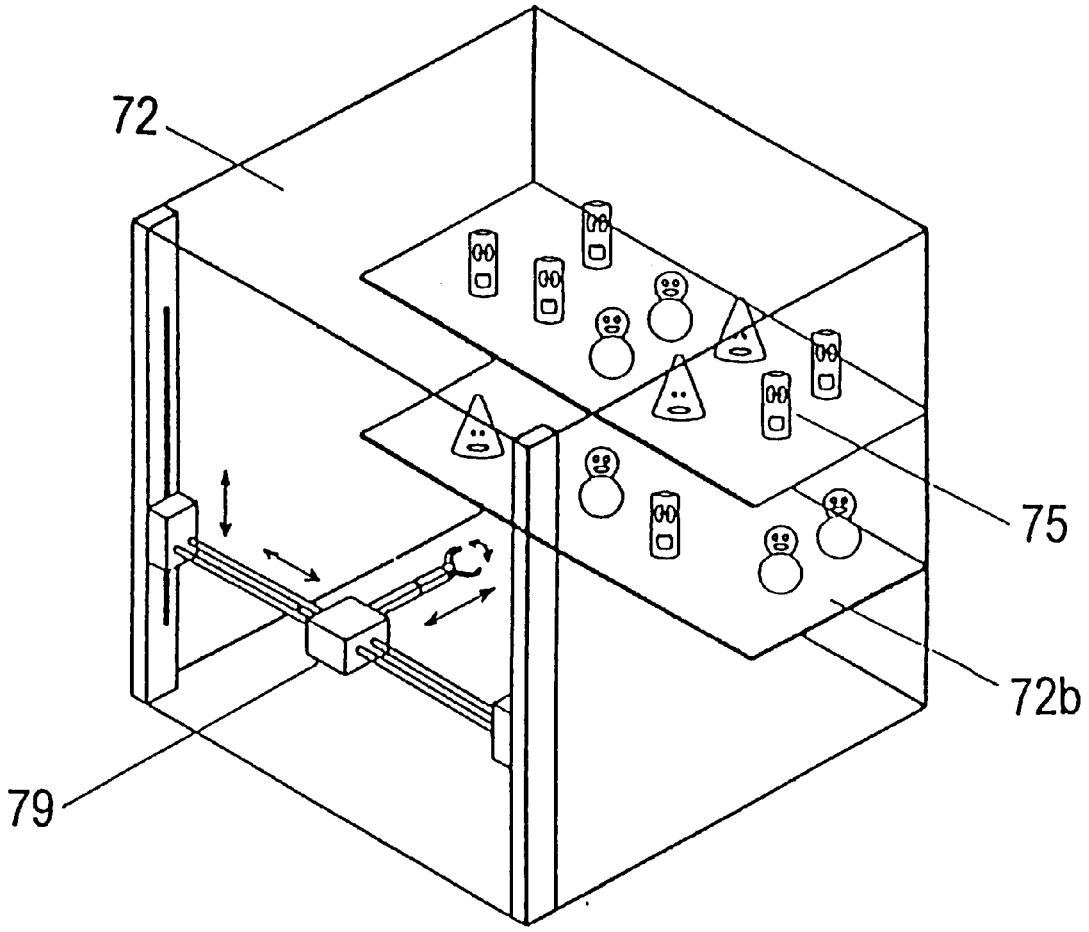
FIG. 28 is a perspective schematic view showing a construction of an embodiment, as equipped with another prize mounting device, of the game machine.
Figure 29:
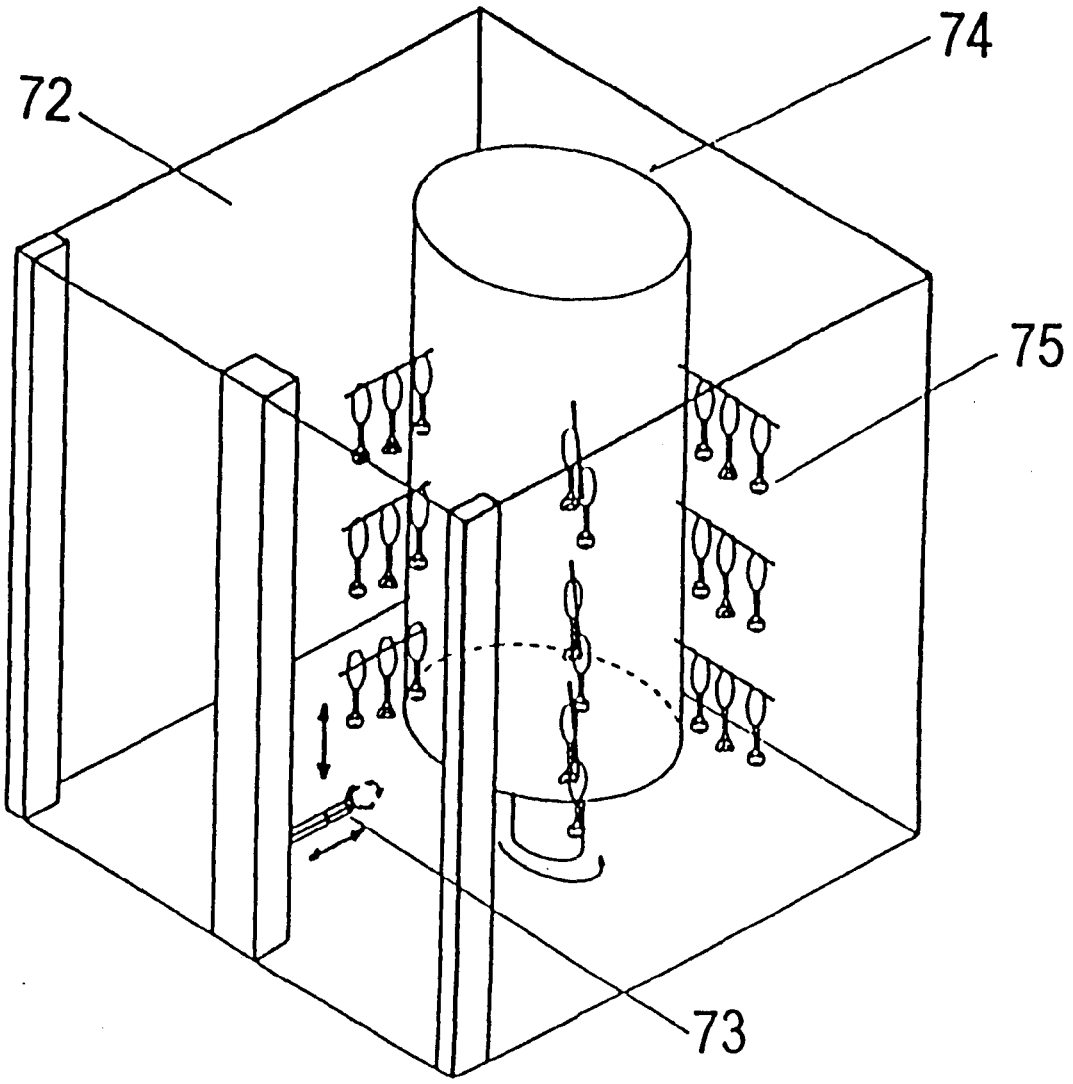
FIG. 29 is a perspective schematic view showing a construction of an embodiment, as equipped with another prize suspending device, of the game machine.

Here, the construction of the game machine to which the present invention should not restrict the prize holding/retaining means and the grip means, but can be adopted, without any difference, not only in a second example, in which prizes are either suspended from rod-shaped retaining means or placed on shelves and in which grip means is operated three-dimensionally, as shown in FIG. 28, but also in a third example, in which retaining means for suspending prizes has a turnable column-shaped structure and in which grip means is operated two-dimensionally, as shown in FIG. 29.

Moreover, the constructions per se of the control of the turnable column-shaped retaining means, the three- or two-dimensional control of the grip means, and the control of the floor surface activating means are well known in the art, and their descriptions will be omitted.

Figure 30:
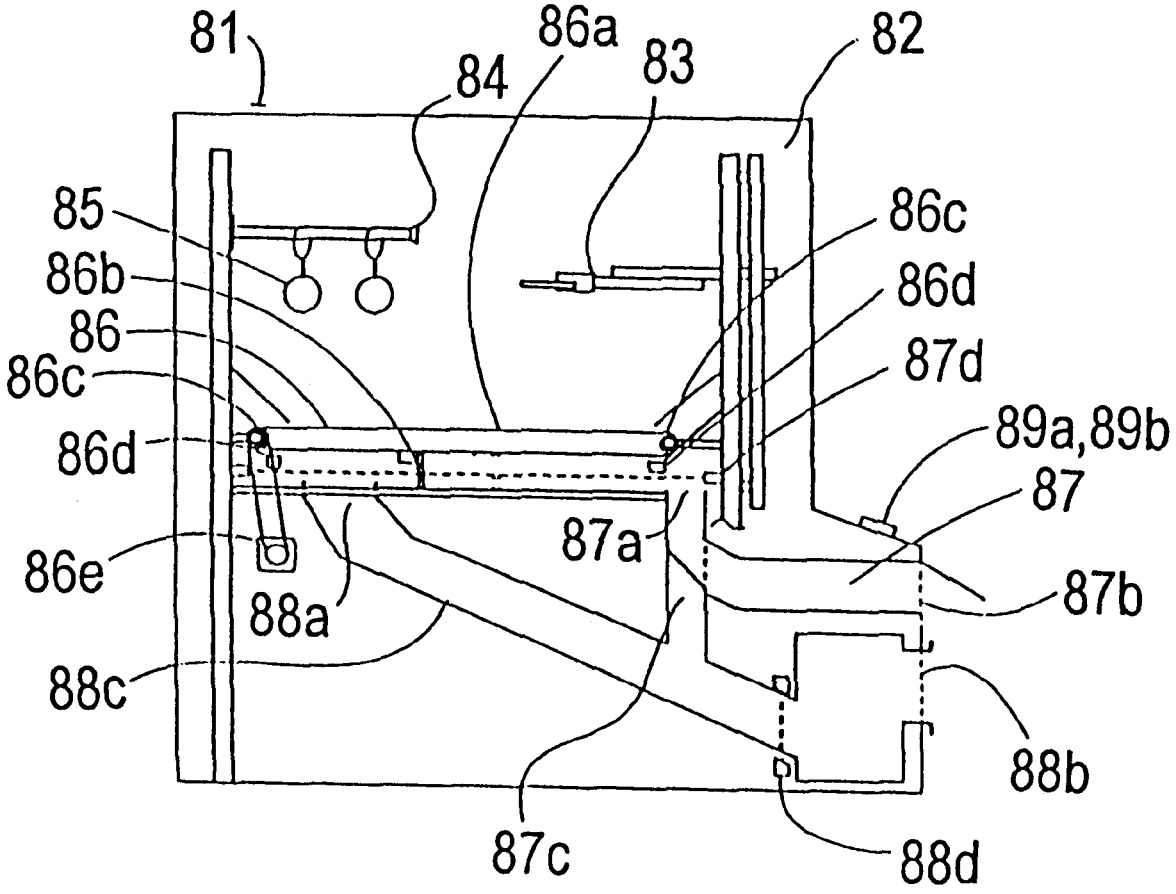
FIG. 30 is a side elevation showing a construction of a first embodiment of a game machine according to the present invention.
Figure 31:
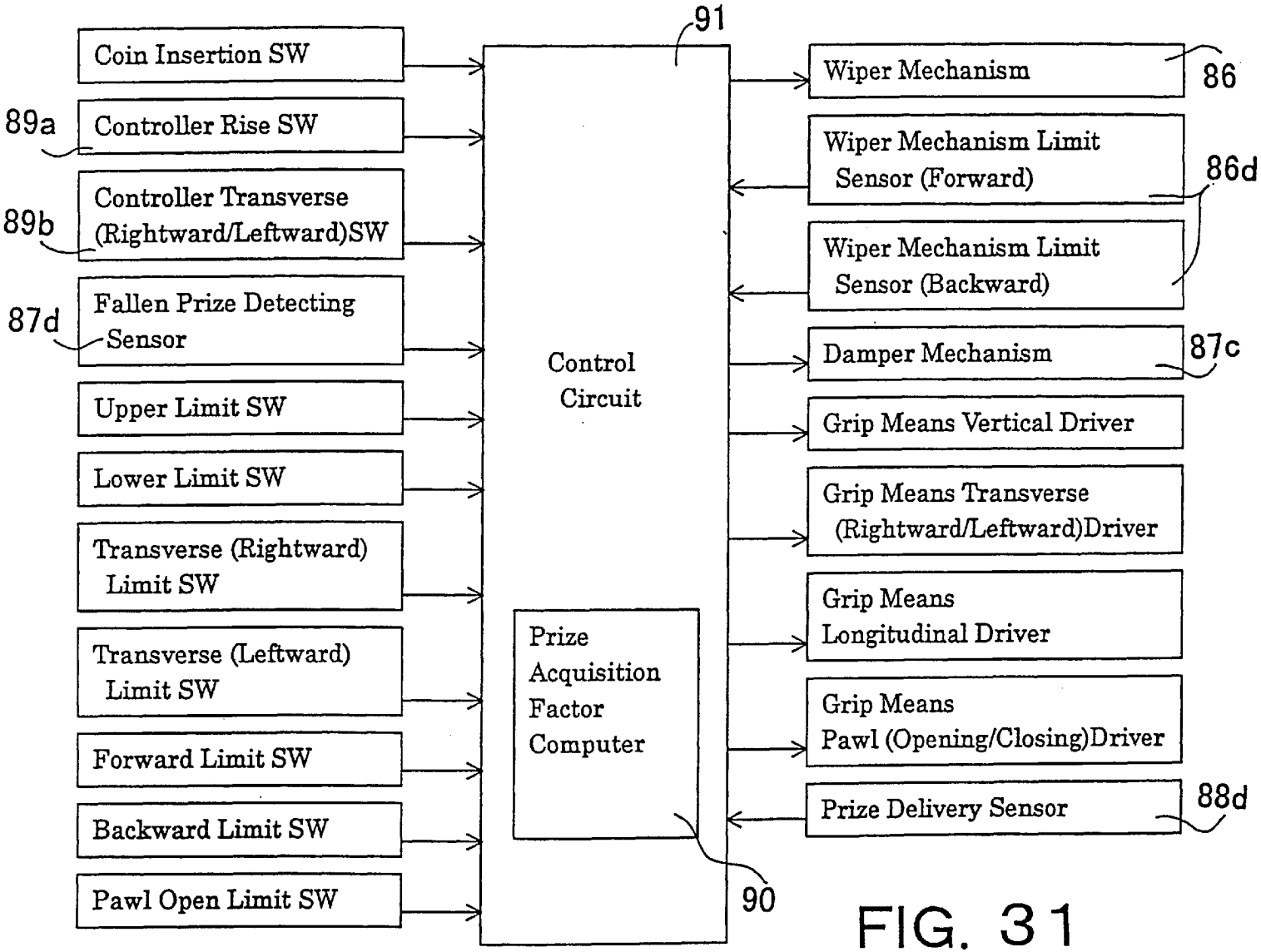
FIG. 31 is a schematic diagram showing a construction of a control device of the game machine.

A construction of a first embodiment of a game machine according to the present invention is shown in FIG. 30. The first embodiment is constructed, as shown in FIG. 30, to comprise: rod-shaped retaining means 84 disposed in a compartment 82 accommodating prizes 85 such as key holders to be acquired, for suspending the prizes; grip means 83 having functions to carry the prizes 85 in vertical (Y), transverse (X) and longitudinal (Z) directions by operating play switches 89*a* and 89*b* to drive a pair of pawls for gripping a prize; a photo sensor acting as sensor means 87*d* for detecting a fallen prize; a wiper mechanism 86 for moving the prize having dropped on the floor surface; a recovery box 87 for recovering the fallen prize; a passage 87*a* to the recovery box; and a damper mechanism 87*c* for delivering the prize to the passage 87*a*. In order to compute the prize acquisition factor, the construction further comprises a control circuit 91 (as shown in FIG. 31) including a prize delivery sensor 88*d* and a computer 90.

Here, the basic constructions and the actions of the prize retaining means and grip means and this mechanism should refer to Unexamined Published Japanese Patent Application No. 8-112446.

Figure 32:
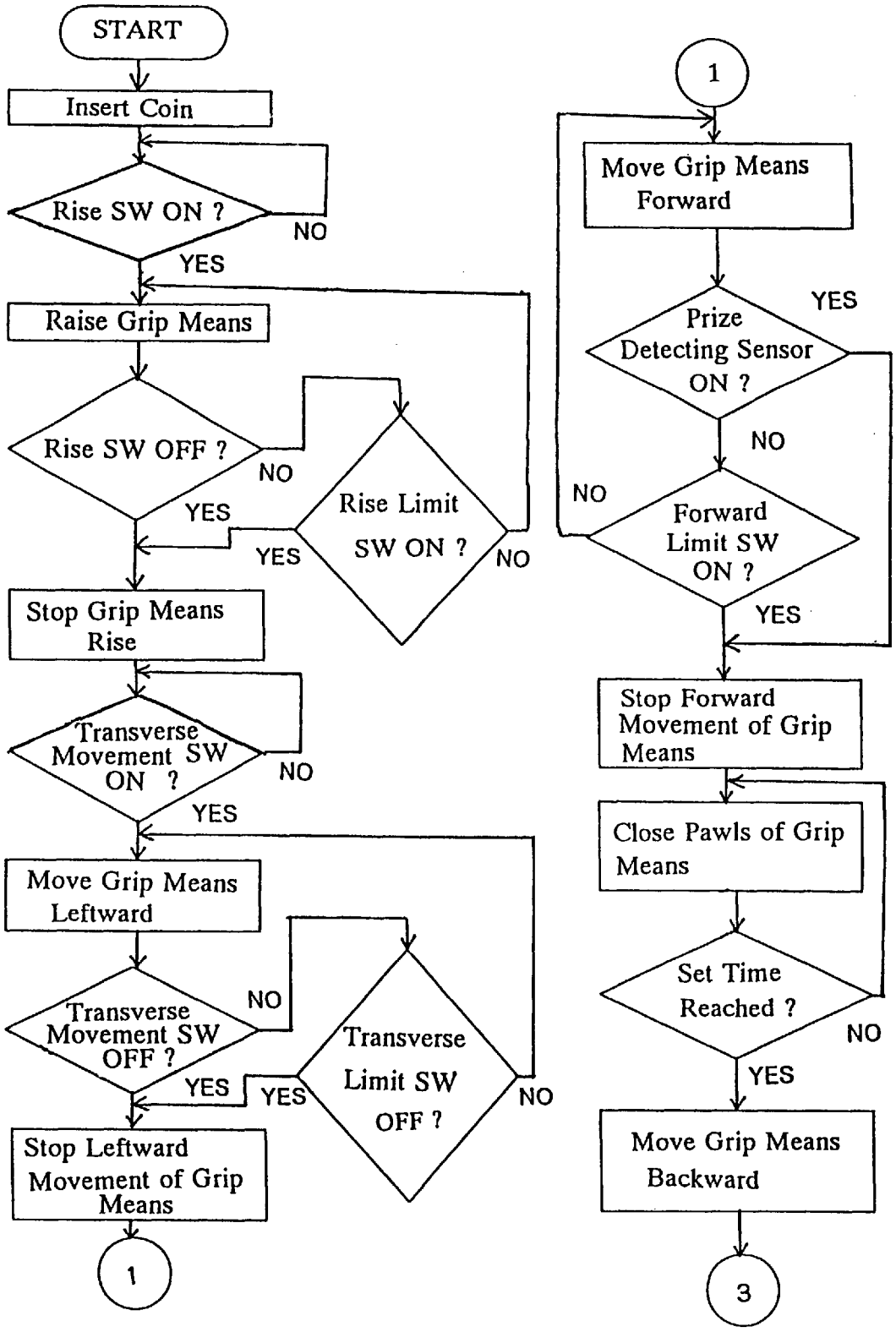
FIG. 32 is a flow chart 1 showing the control device of the first embodiment of the game machine.
Figure 33:
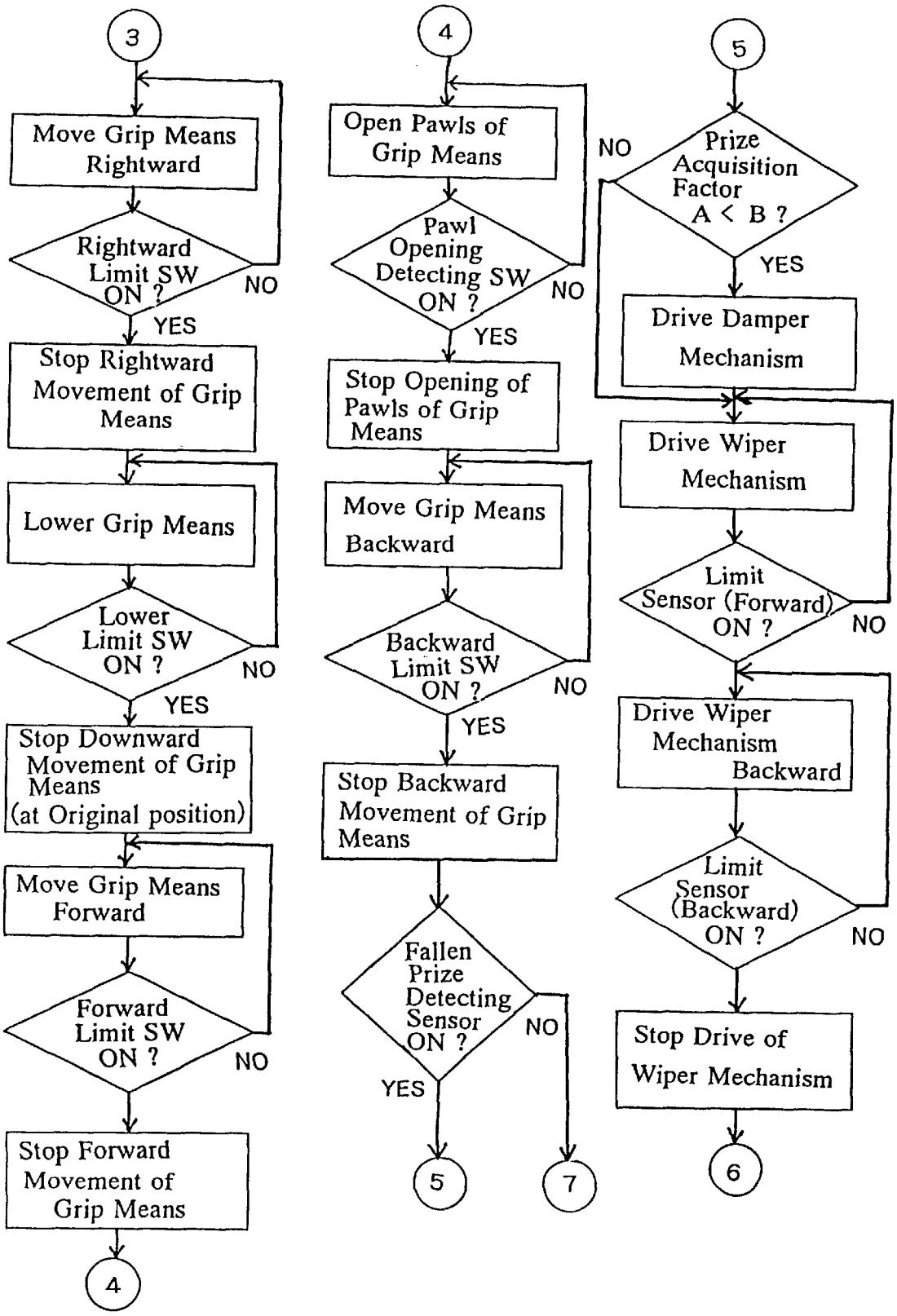
FIG. 33 is a flow chart 2 showing the control device of the first embodiment of the game machine.
Figure 34:
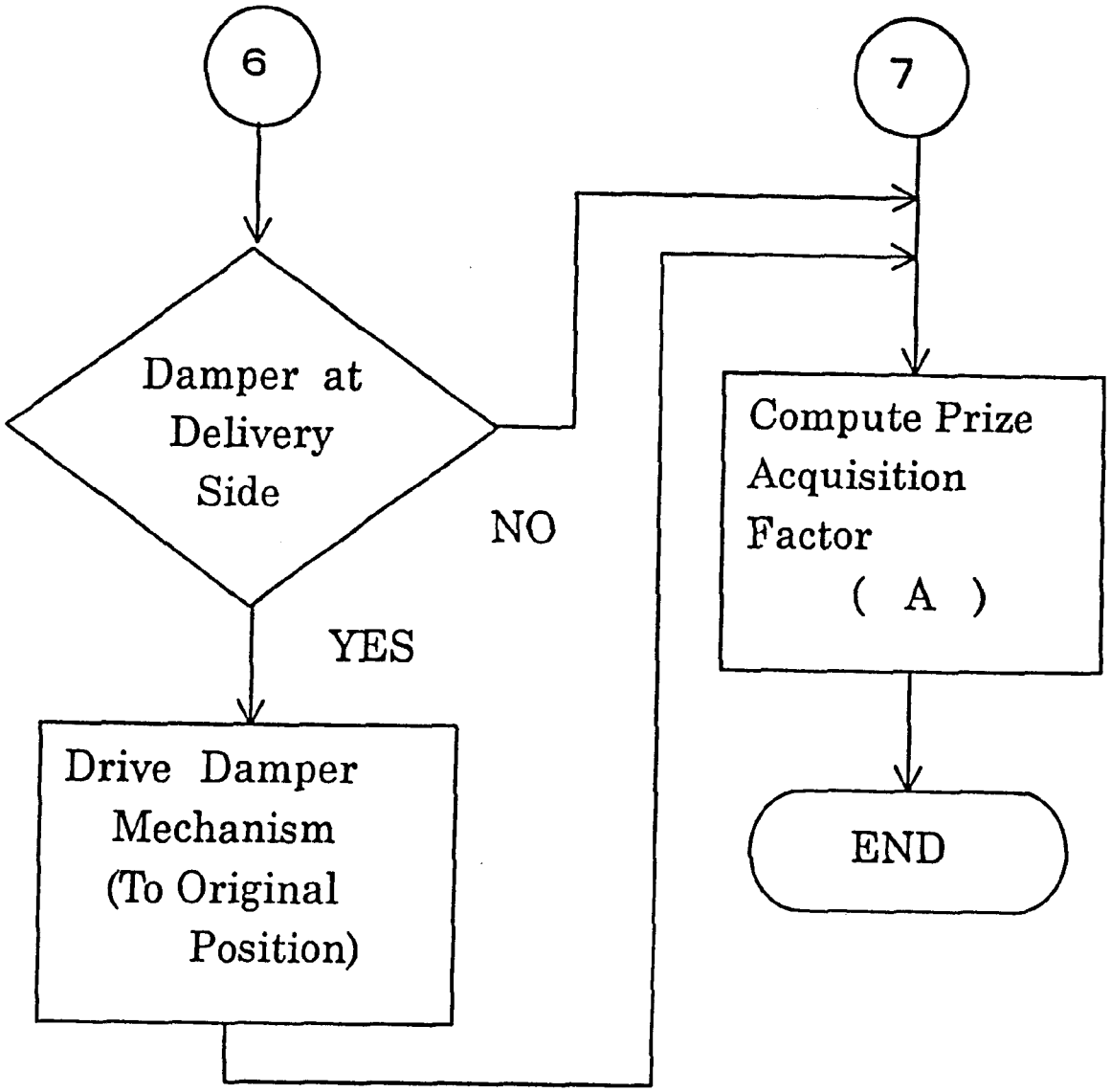
FIG. 34 is a flow chart 3 showing the control device of the first embodiment of the game machine.

The actions of the construction thus made will be described with reference to the flow charts of FIGS. 32 to 34. When the player inserts a coin, the game is started. The grip means is raised by turning ON the rise SW 89*a,* and is stopped by turning it OFF. If the rise SW 89*a* is not turned OFF, the grip means is stopped by the upper limit SW. The grip means is moved transversely by turning the transverse (Rightward/leftward) SW 89*b* and is stopped by turning it OFF. In the transverse movement, too, the grip means is stopped by the transverse limit SW if the transverse SW is not turned OFF.

From now on, the grip means 83 is automatically moved forward in accordance with a program installed in the control circuit 91. When the prize detecting sensor carried on the grip means 83 is turned ON, the grip means 83 is stopped to act to close its pawls for gripping a prize. The grip means 83 is moved forward and stopped irrespective of the success or failure in the acquisition of the prize till the forward limit switch is turned ON, and acts to open its pawls to fall the acquired prize into a prize reception mouth 88*a* until it restores its original position. The prize thus fallen into the prize reception mouth 88*a* is passed through a prize passing pipe 88*c* to activate the prize delivery sensor 88*d* so that the prize can be taken out from a prize take-out mouth 88*b*.

If the grip of the prize is improper in a series of the aforementioned acquiring operations, on the other hand, it drops to the floor to turn ON the fallen prize detecting sensor 87*d*. At this time, the prize acquisition factor (A) is compared with a predetermined value (B). If A (B, the damper mechanism 87*c* is activated to the delivery side, and the wiper mechanism 86 is driven to deliver the fallen prize from the passage 87*a* of the recovery box through the prize passing pipe 88*c* and the prize delivery sensor 88*d* into the prize take-out mouth 88*b*. If A≧B, the fallen prize is recovered into the recovery box 87 by activating the damper mechanism 87*c* to the recovery side and by activating the wiper mechanism 86. At the game ending time, a new prize acquisition factor (A) is computed to end a series of games. Here, the prizes, as recovered in the recovery box 87, can be taken out by the installer of the game machine by forming the fallen prize take-out mouth 87*b* in the game machine.

Figure 35:
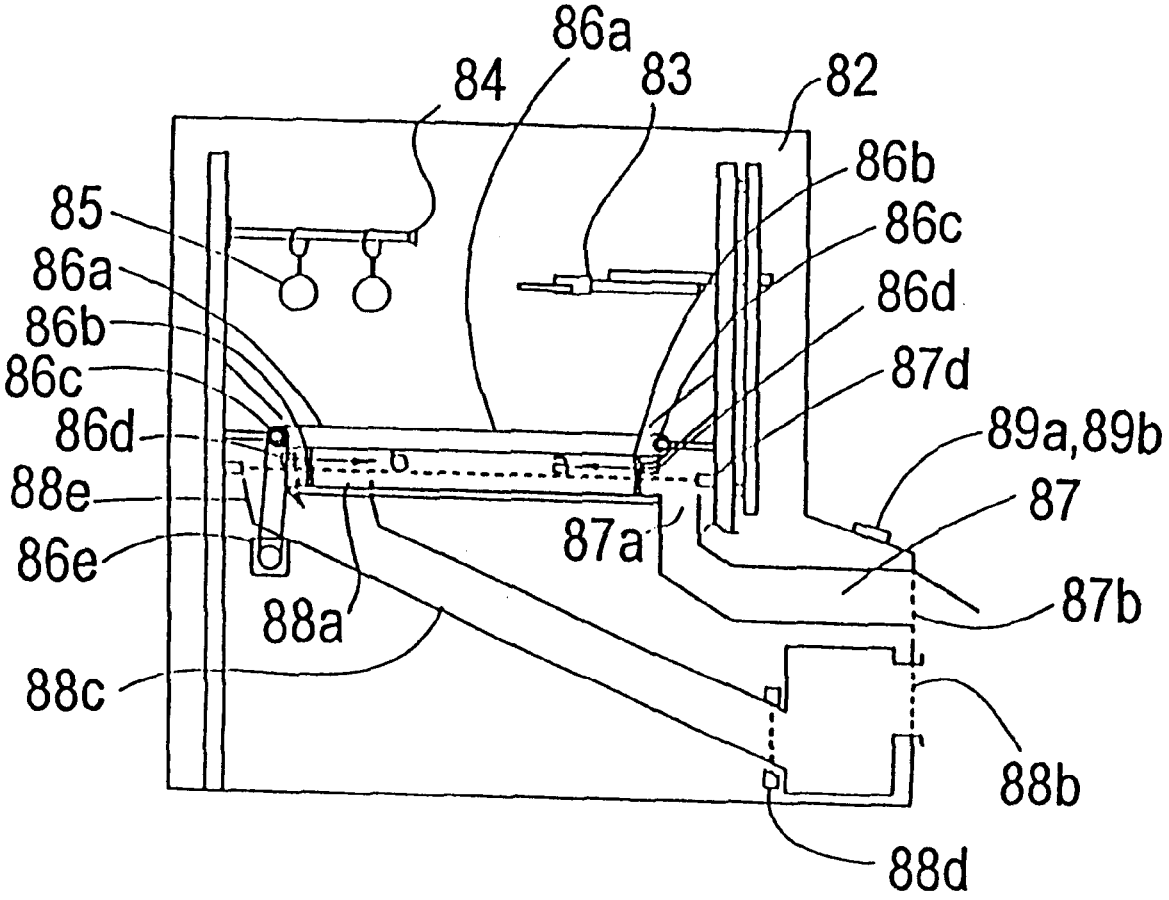
FIG. 35 is a side elevation showing a construction of a second embodiment of the game machine.

FIG. 35 shows a construction of a second embodiment of the game machine according to the present invention. This construction comprises: two blades 86*b* made active independently of the wiper mechanism 86; a passage 87*a* for the recovery box 87 formed in a position close to the floor surface in the moving direction of the blade 86*b* to be driven in a direction b; and a passage 88*e* formed in a position close to the end portion of the floor surface in the moving direction of the blade 86*b* to be driven in a direction a, for delivering the fallen prize. The prize acquisition factor (A) is compared with a predetermined value (B). If A≧B, the blade 86*b* is driven for the recovery in the direction b. If A (B, the blade 86*b* is driven for the delivery in the direction a. This construction is characterized by the absence of the damper mechanism 87*c,* and the remaining portions of the construction are similar to those of FIG. 30.

Figure 36:
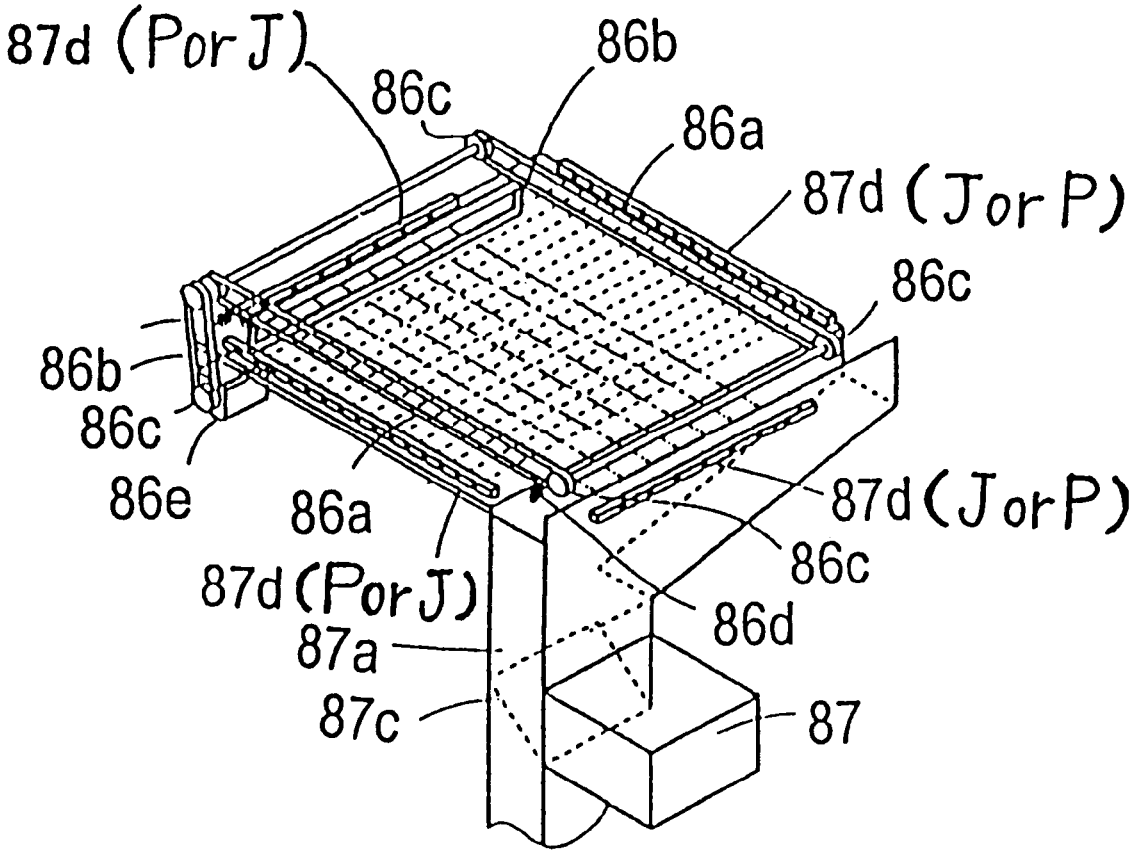
FIG. 36 is a perspective view showing a construction of a wiper mechanism, a dropping prize detecting sensor and a dropping prize recovery box of the game machine.
Figure 37:
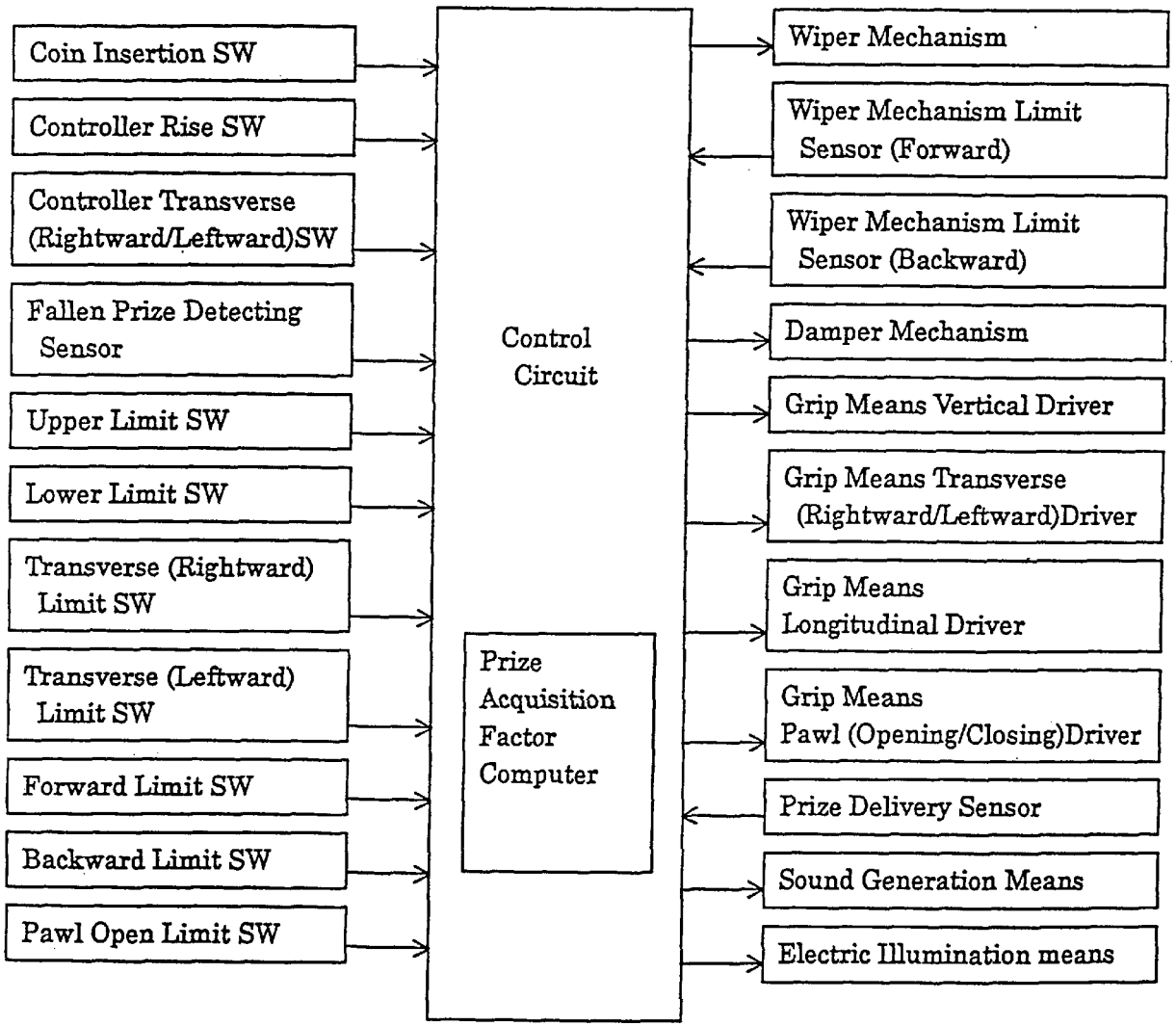
FIG. 37 is a schematic diagram (or a block diagram) showing a construction of a control device of an embodiment of the present invention.

FIG. 36 is a perspective view showing a construction of the wiper mechanism 86 for moving a fallen prize, the fallen rpize detecting sensor 87*d,* and the recovery box 87. The fallen prize detecting sensor 87*d,* as shown, is made by arranging a plurality of photo sensors, as composed of a plurality of light emitting elements Q and a plurality of light receiving elements J, in a matrix shape in the X direction and Y direction as in a touch panel of photo sensor type, so that it detects the position of a fallen prize in terms of the position in which both the photo sensors in the X direction and the Y direction act. The shown fallen prize detecting sensor can be assembled in the game machine having the construction of FIG. 30 or FIG. 35 to make a new construction.

The game machine according to the present invention utilizes the signal of the prize delivery sensor 88*d* of the construction, as shown in FIG. 30, so that the wiper mechanism 86 is activated by deciding that no prize has been delivered from the fact that the prize delivery sensor 88*d* is not turned ON after the game end. In this case, the recovery and delivery may utilize the prize acquisition factor or a certain ratio.

The game machine according to the present invention is provided with sound generation means such as a speaker or electric illumination means such as an LED or a stroboscopic lamp so that a Fanfare may be generated or an electric illumination may be flashed, when the fallen prize is to be delivered, to excite the player and to make an appeal to the circumference.

Figure 38:
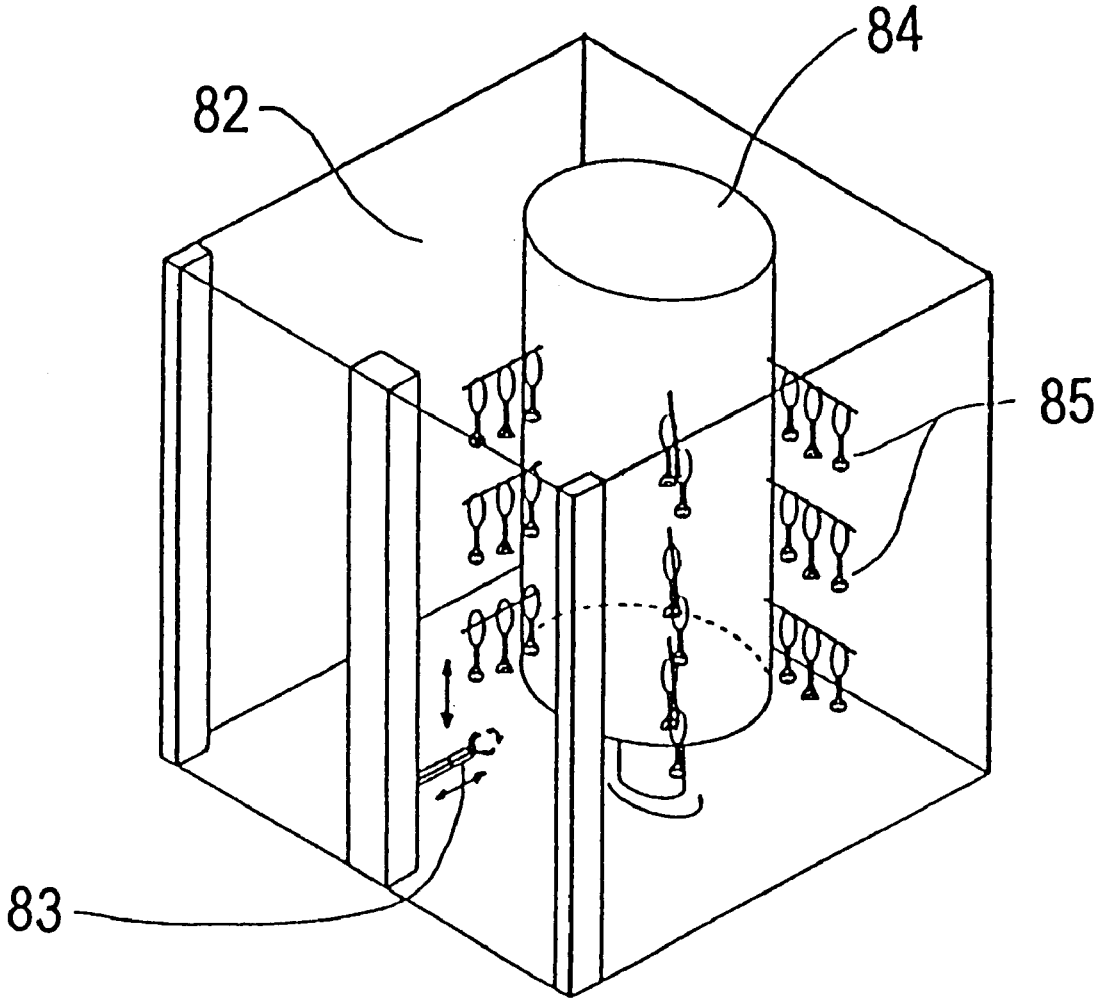
FIG. 38 is a conceptional view showing a game machine according to the present invention.
Figure 39:
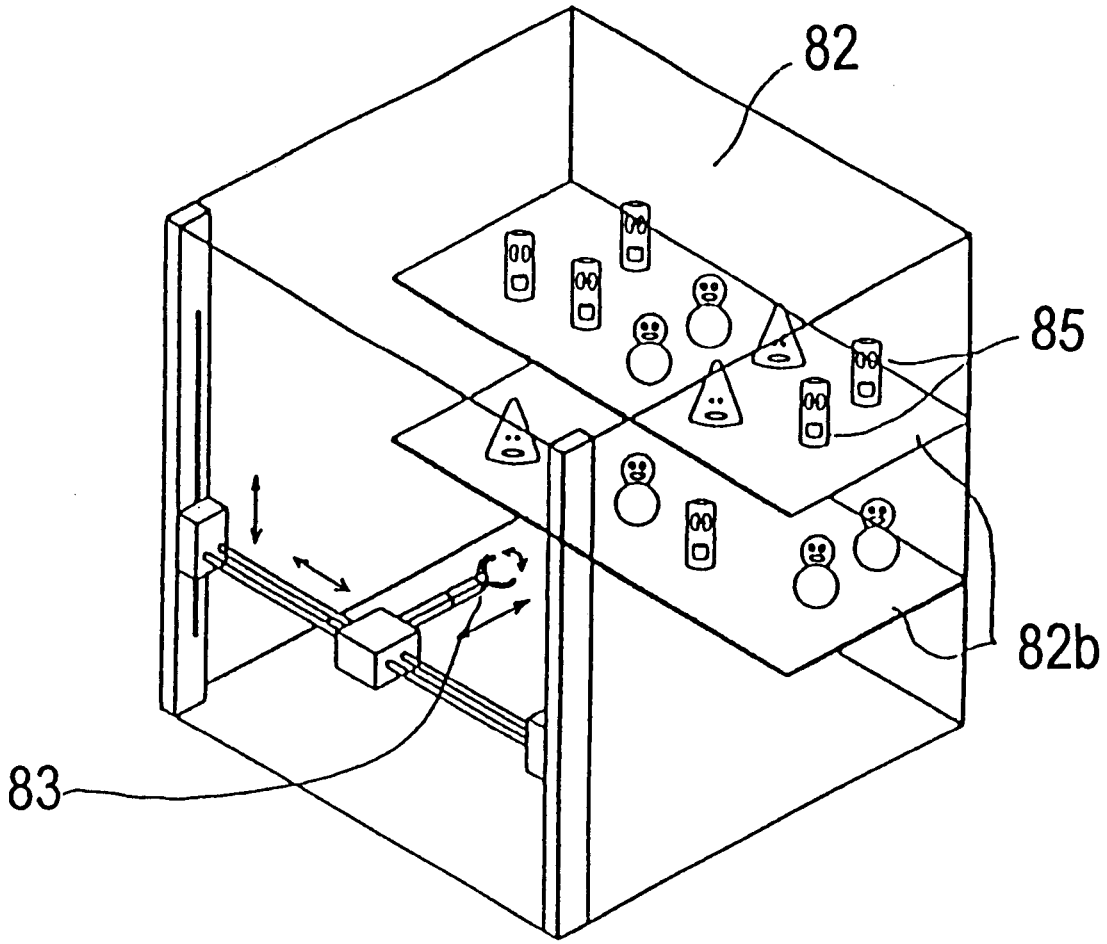
FIG. 39 is a conceptional view showing a game machine according to the present invention.

The foregoing embodiments are based on the construction of the game machine, as disclosed in Unexamined Published Japanese Patent Application No. 8-112446. However, no problem arises either in a game machine shown in FIG. 38, in which a turnable column-shaped prize retainer is disposed at the center and in which grip means can be moved vertically (Y) and longitudinally (Z), or in a game machine shown in FIG. 39, which is constructed to comprise shelf-shaped prize retaining means and grip means capable of moving vertically (Y), transversely (X) and longitudinally (Z).

Figure 40:
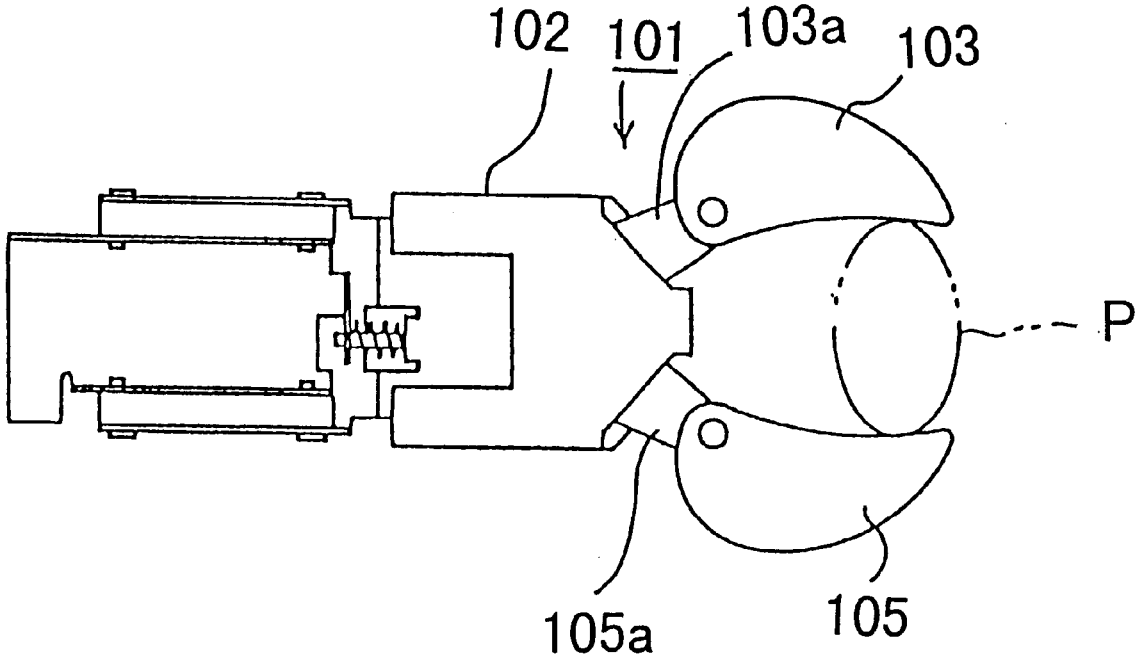
FIG. 40 is a top plan view showing one mode of a gripping device.
Figure 41:
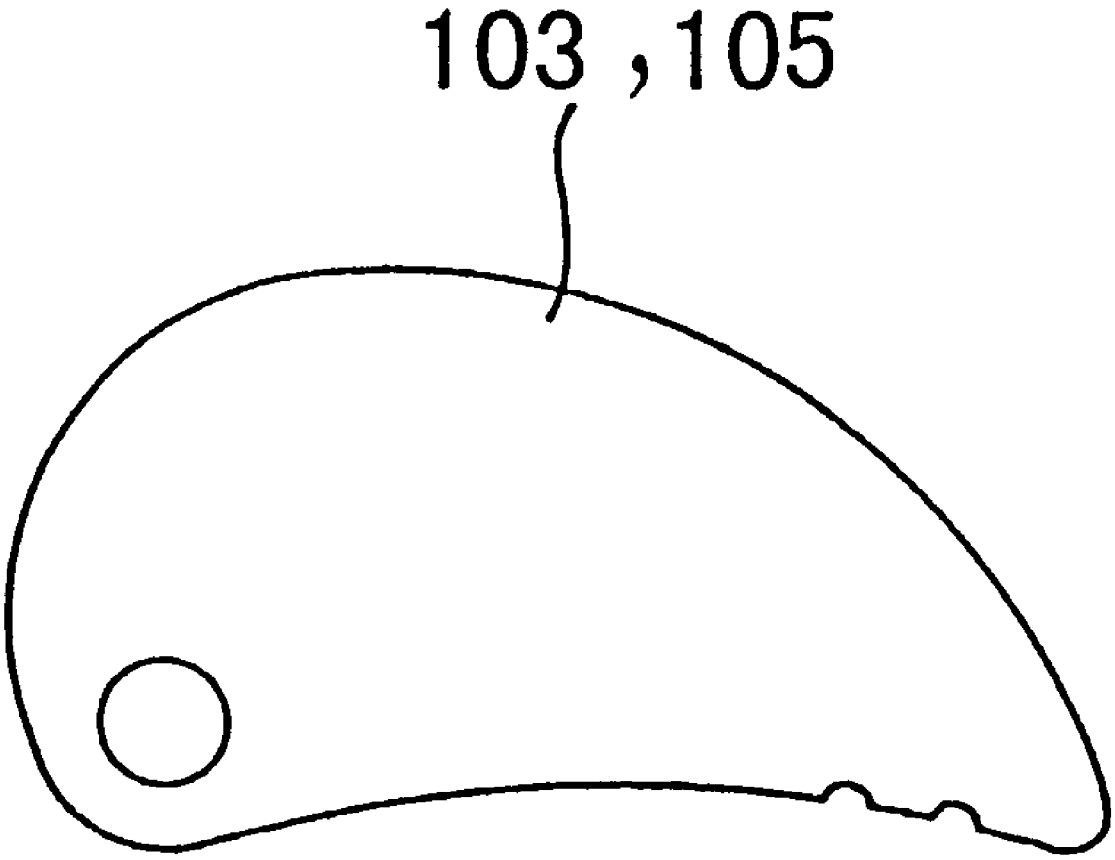
FIG. 41 is an enlarged top plan view showing a pawl member.
Figure 42:
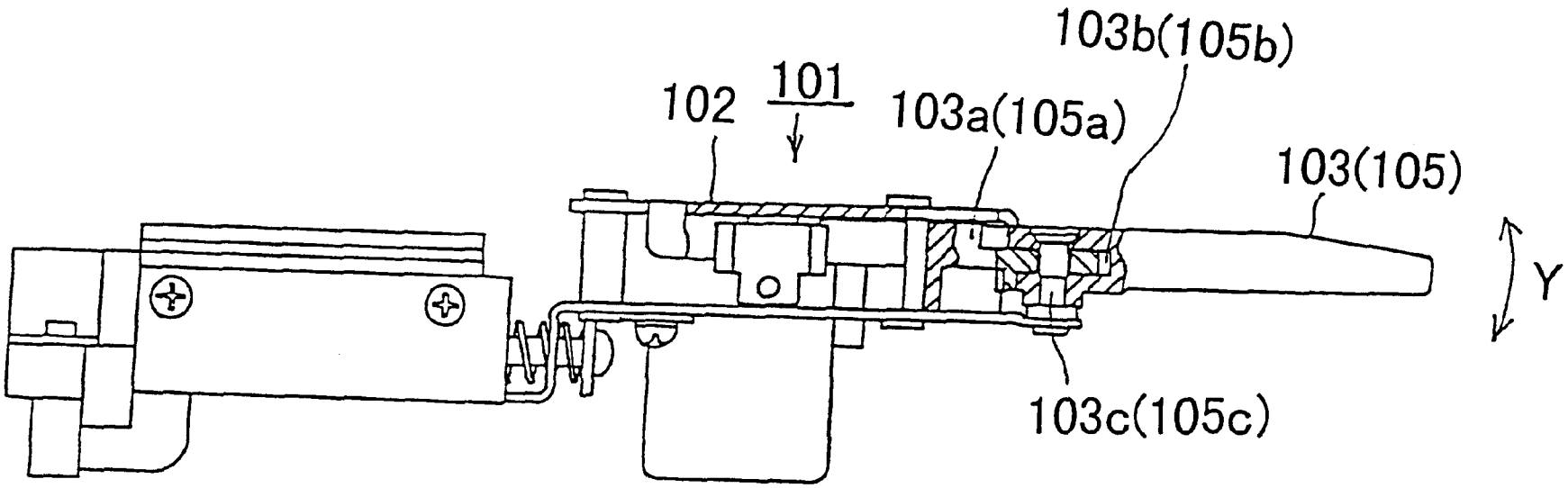
FIG. 42 is a side elevation showing one mode of the gripping device.
Figure 43:
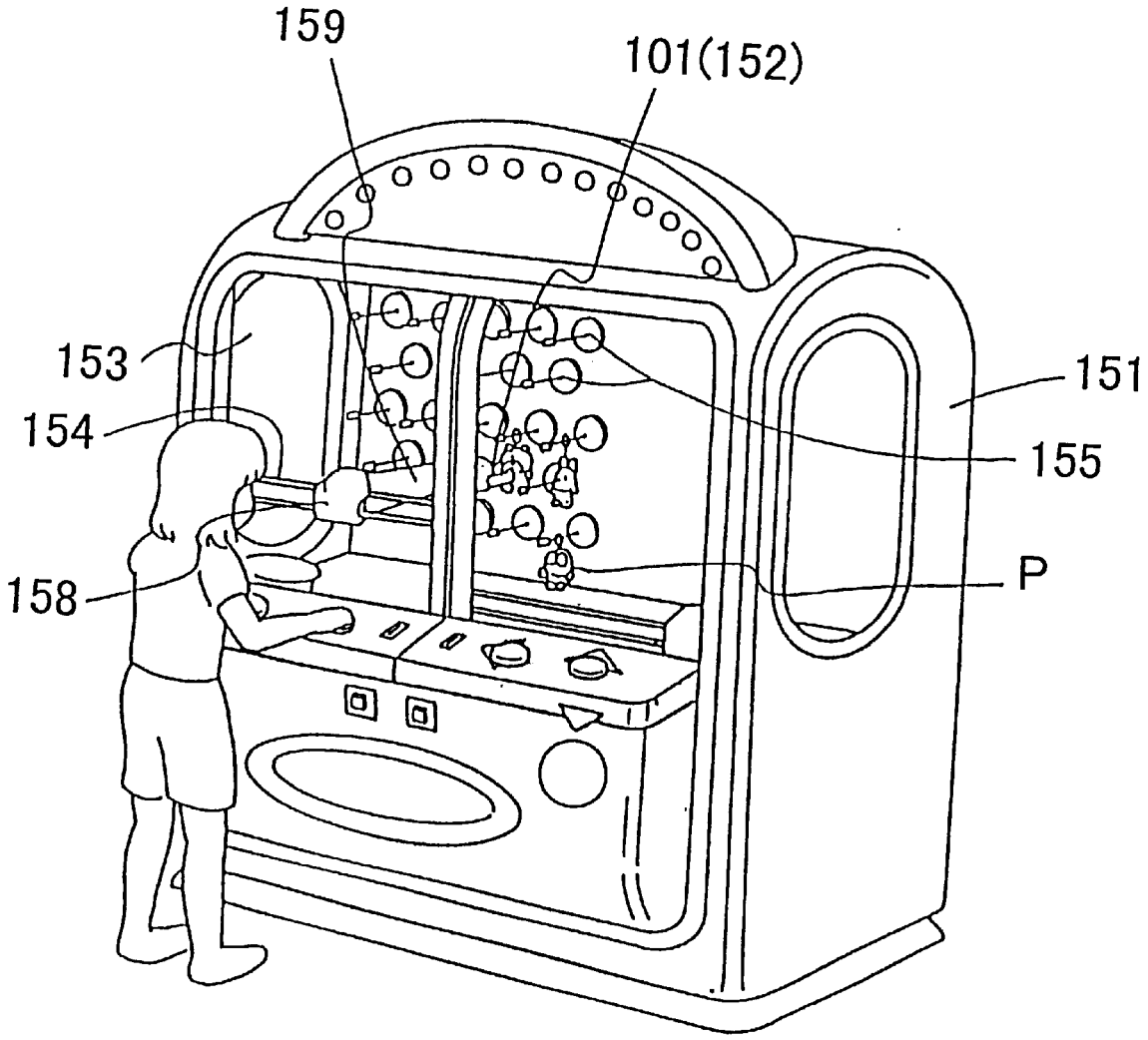
FIG. 43 is a perspective view showing the entirety of a game machine.
Figure 44:
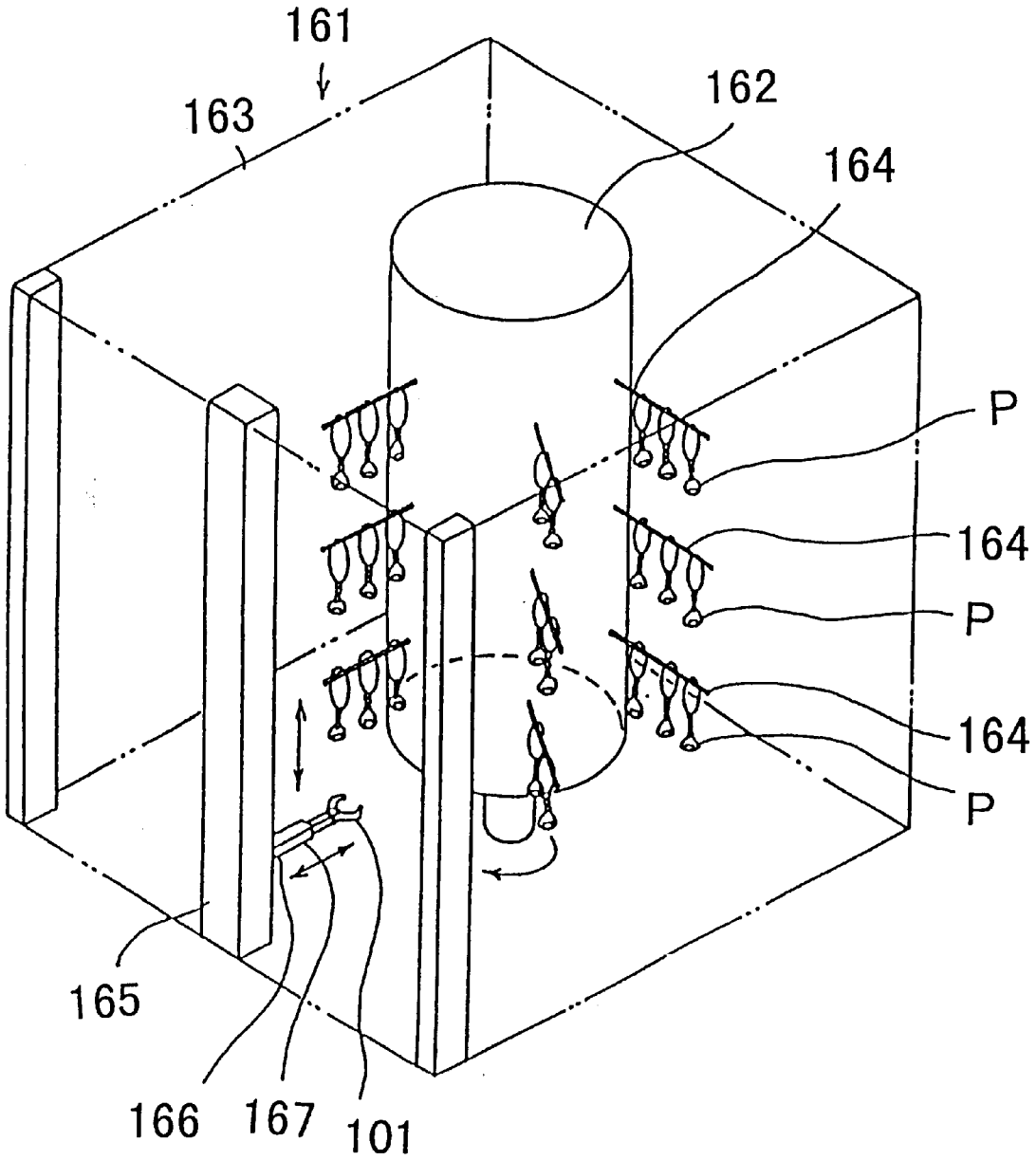
FIG. 44 is a perspective view showing the entirety of a game machine of another mode.
Figure 45:
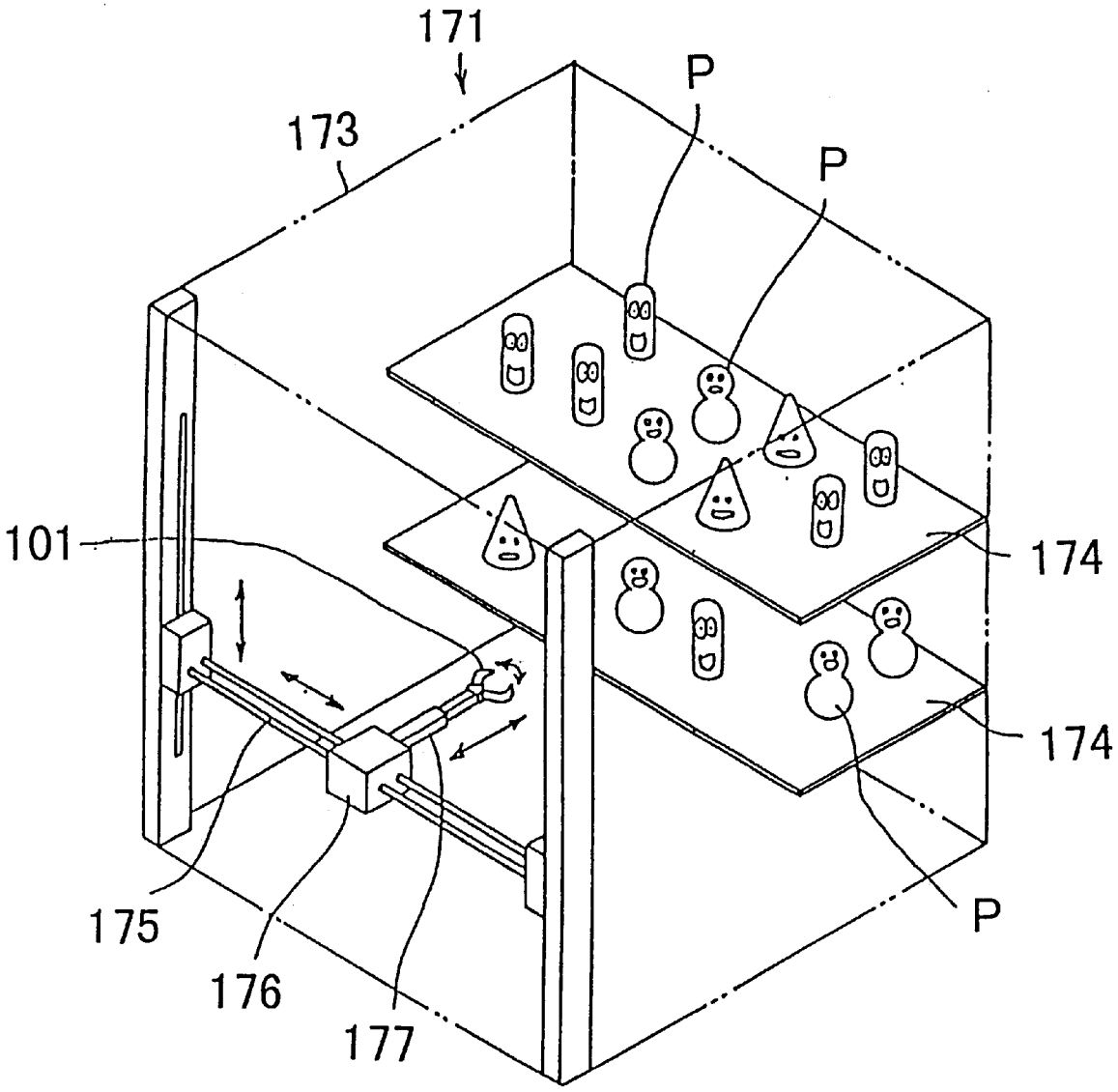
FIG. 45 is a perspective view showing the entirety of a game machine of another mode.
Figure 46:
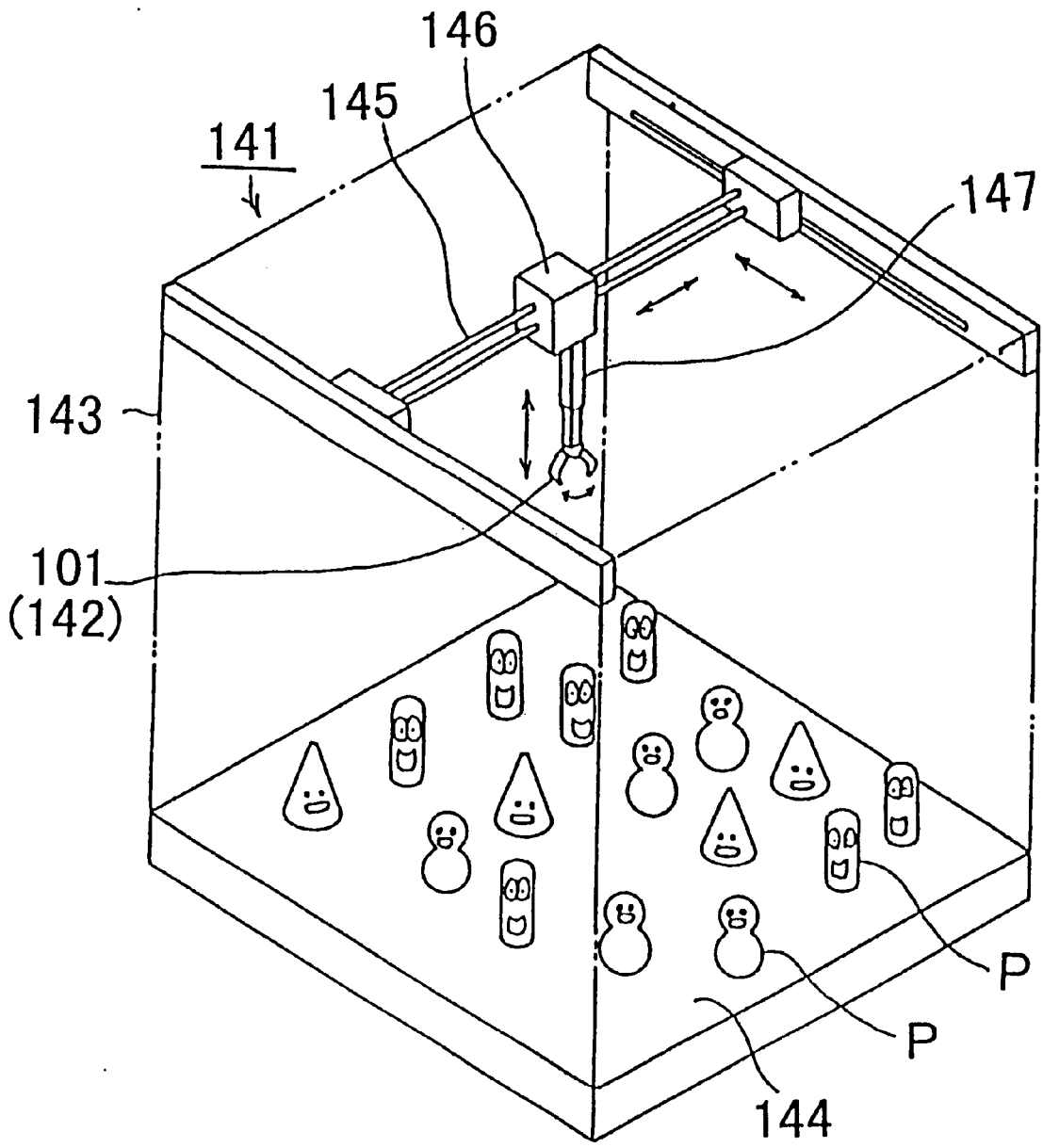
FIG. 46 is a perspective view showing the entirety of a game machine of another mode.

Here will be described an embodiment of the gripper to be used in the foregoing embodiments. FIG. 40 is a top plan view showing one mode of the gripper. FIG. 41 is an enlarged top plan view of a pawl member. FIG. 42 is a side elevation showing one mode of the gripper. FIG. 43 is a perspective view showing the entirety of the game machine. FIGS. 44 to 46 are perspective views showing the entireties of game machines of other modes.

A gripper 101 of FIG. 40 is provided with a mounting frame 102 and at least one pair of pawl members 103 and 105 for gripping a prize P. The paired pawl members 103 and 105 are so mounted to the leading ends of a pair of arm members 103*a* and 105*a* as to turn and to be biased in a closing direction by not-shown springs. The paired arm members 103*a* and 105*a* are turnably mounted to the mounting frame 102. This mounting frame 102 is equipped with a not-shown drive motor for turning the paired arm members 103*a* and 105*a* thereby to open/close the paired pawl members 103 and 105.

Here, the method of mounting,the pawl member 103 (105) to the arm member 103*a* (105*a*) is arbitrary. As shown in FIG. 42, however, a generally C-shaped mounting recess 103*b* (105*b*) may be formed in the mounting portion of the pawl member 103 (105) to fit the leading end of the arm member 103*a* (105*a*) in the mounting recess 103*b* (105*b*) so that the mounting recess 103*b* (105*b*) and the leading end of the arm member 103*a* (105*a*) may be turnably jointed by a joint pin 103*c* (105*c*). This joint will be effective against a load upon the pawl member 103 (105) in the vertical directions (i.e., in the directions of arrows Y generally perpendicular to the turning directions of the pawl member 103 (105)). It goes without saying that the pawl member 103 (105) and the arm member 103*a* (105*a*) may be made integral.

The pawl member 103 (105) is molded of a soft synthetic resin or hard rubber having such a hardness and an elasticity that it can bend. This soft synthetic resin can be selected from various ones, of which a thermoplastic elastomer is desired. This thermoplastic elastomer has excellent rubber elasticity and mechanical strength. The hard rubber and the thermoplastic elastomer have a high frictional resistance so that they can grip even a slippery prize easily.

The gripper 101 is movably disposed in the game machine body 143, 153, 163 or 173 of a game machine 141, 151, 161 or 171. In the game machine 141, more specifically, the gripper 101 is movably disposed by a guide rail 145, a carriage 146 and an expander 147, as shown in FIG. 46, so that the pawl members 103 and 105 of the gripper 101 may grip and suspend a prize P placed on a bottom surface 144.

In the game machine 151, as shown in FIG. 43, the gripper 101 is movably disposed by a guide rail 154, a carriage 158 and an expander 159. The pawl members 103 and 105 of the gripper 101 grip and acquire a prize P suspended by a suspending member 155 of the game machine body 153.

In the game machine 161, as shown in FIG. 44, the gripper 101 is movably disposed by a guide rail 165, a carriage 166 and an expander 167. The pawl members 103 and 105 of the gripper 101 grip and acquire a prize P suspended by a suspending member 164 of a turnable member 162, as turnably disposed in the game machine body 163.

In the game machine 151, as shown in FIG. 45, the gripper 101 is movably disposed by a guide rail 175, a carriage 176 and an expander 177. The pawl members 103 and 105 of the gripper 101 grip and acquire a prize P placed on shelves 174 mounted in the game machine body 173.

In the gripper 101, at least the paired pawl members 103 and 105 for gripping a prize P are molded of a soft synthetic resin or hard rubber. As a result, the pawl members 103 and 105 have a high frictional resistance so that they can easily grip even a slippery prize P, and have an elasticity so that they can be bent to absorb a force even if this force is applied in various directions. Thus, it is possible to prevent the failures of the pawl members 103 and 105 and the breakages of the gripper 101 and the carriage 146. Since the pawl members 103 and 105 are thus molded of a thermoplastic elastomer, the gripper 101 is excellent in mechanical strength, elasticity, bending fatigue resistance and molding workability so that it can be used for a long term.

Figure 47:
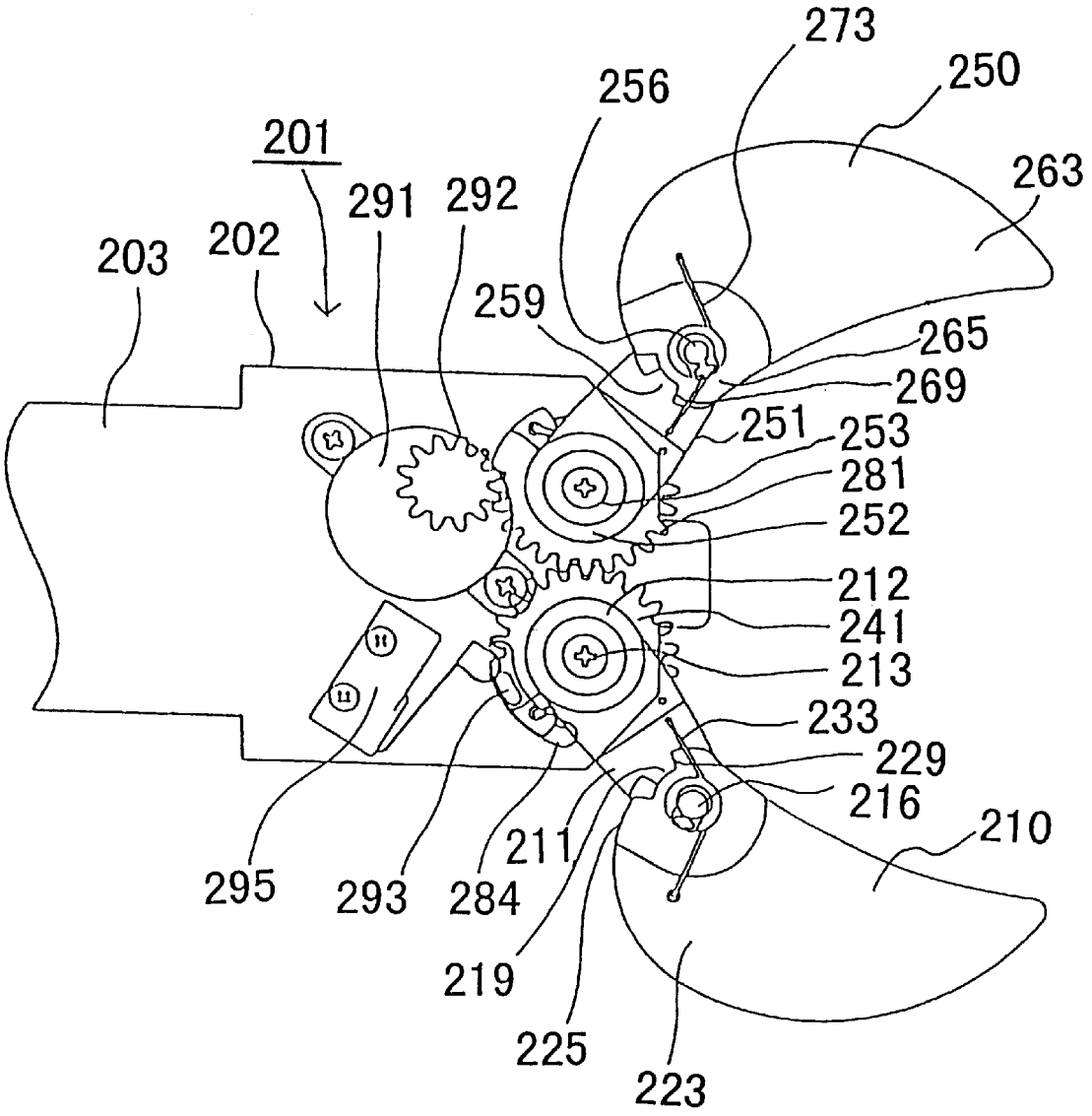
FIG. 47 is a top plan view showing one mode of a gripping device according to the present invention.
Figure 48:
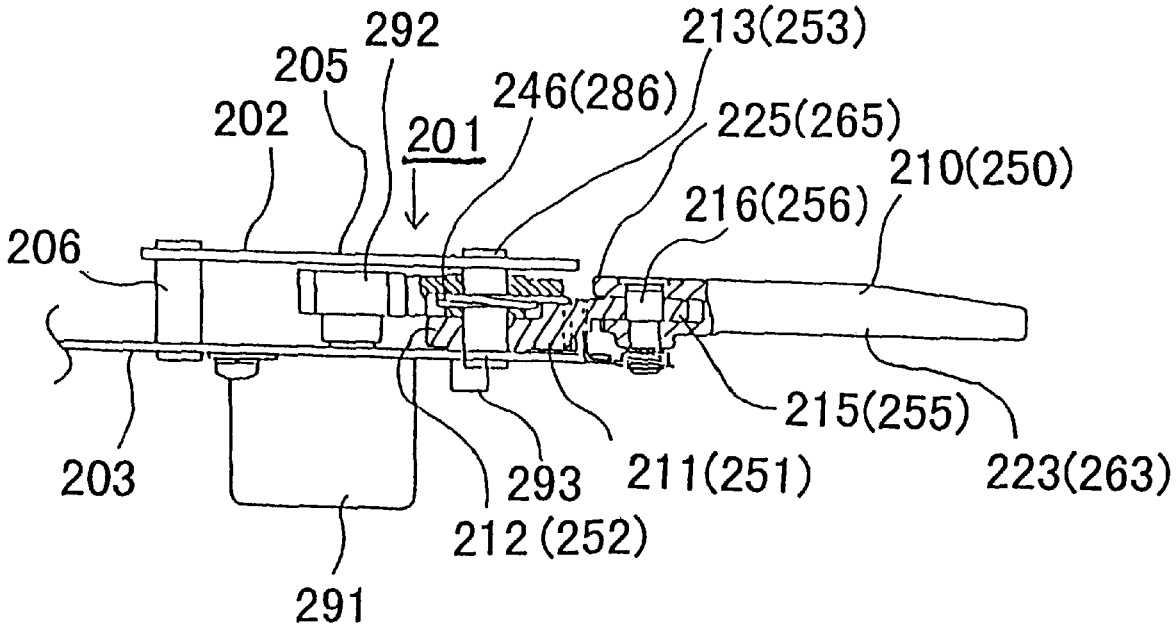
FIG. 48 is a side elevation showing an essential portion of FIG. 47 in section.
Figure 49:
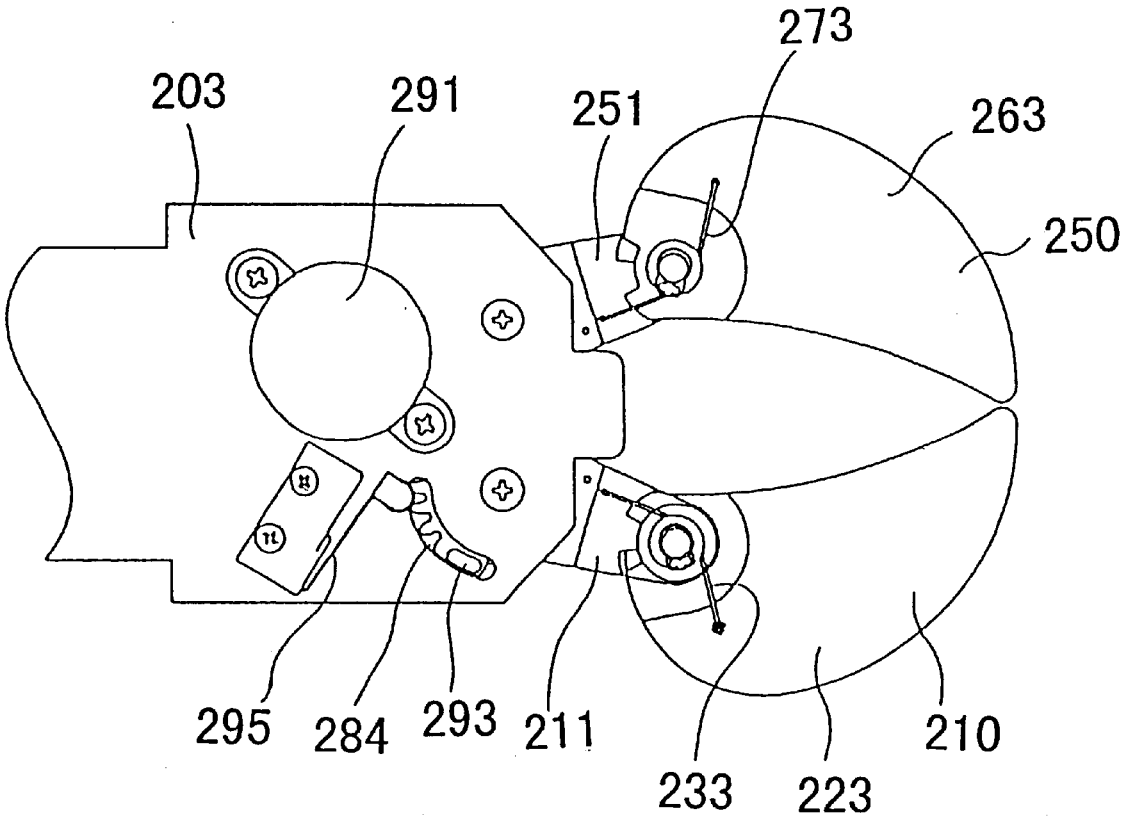
FIG. 49 is a top plan view showing the action of the gripping device.
Figure 50:
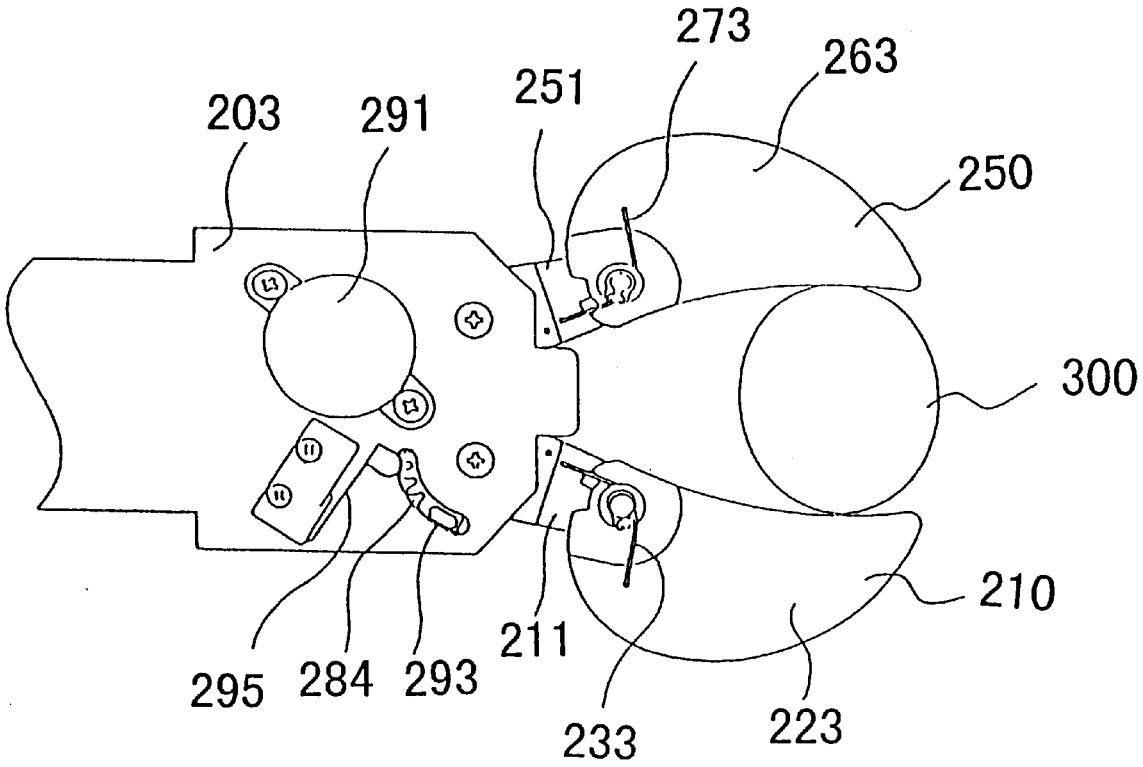
FIG. 50 is a top plan view showing the action of the gripping device.
Figure 51:
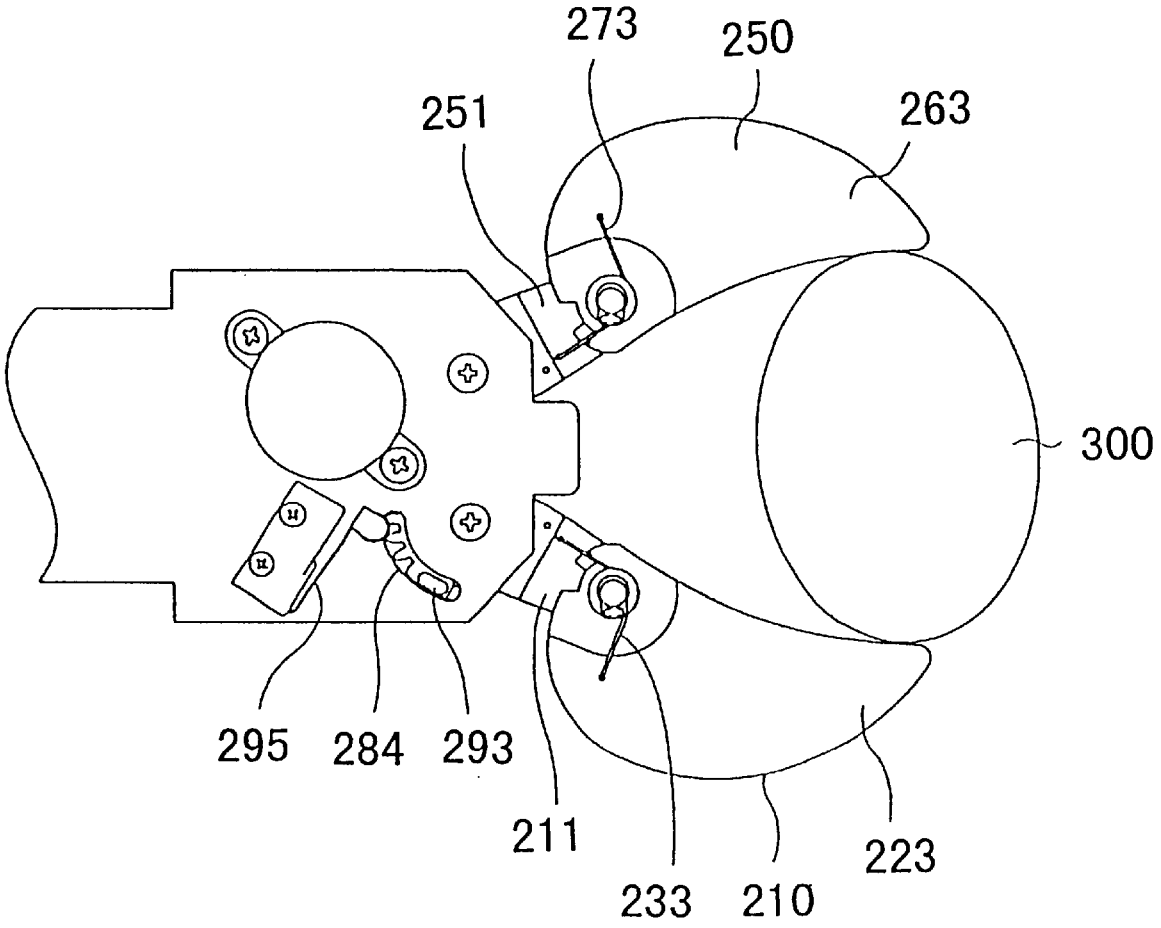
FIG. 51 a top plan view showing the action of the gripping device.
Figure 52:
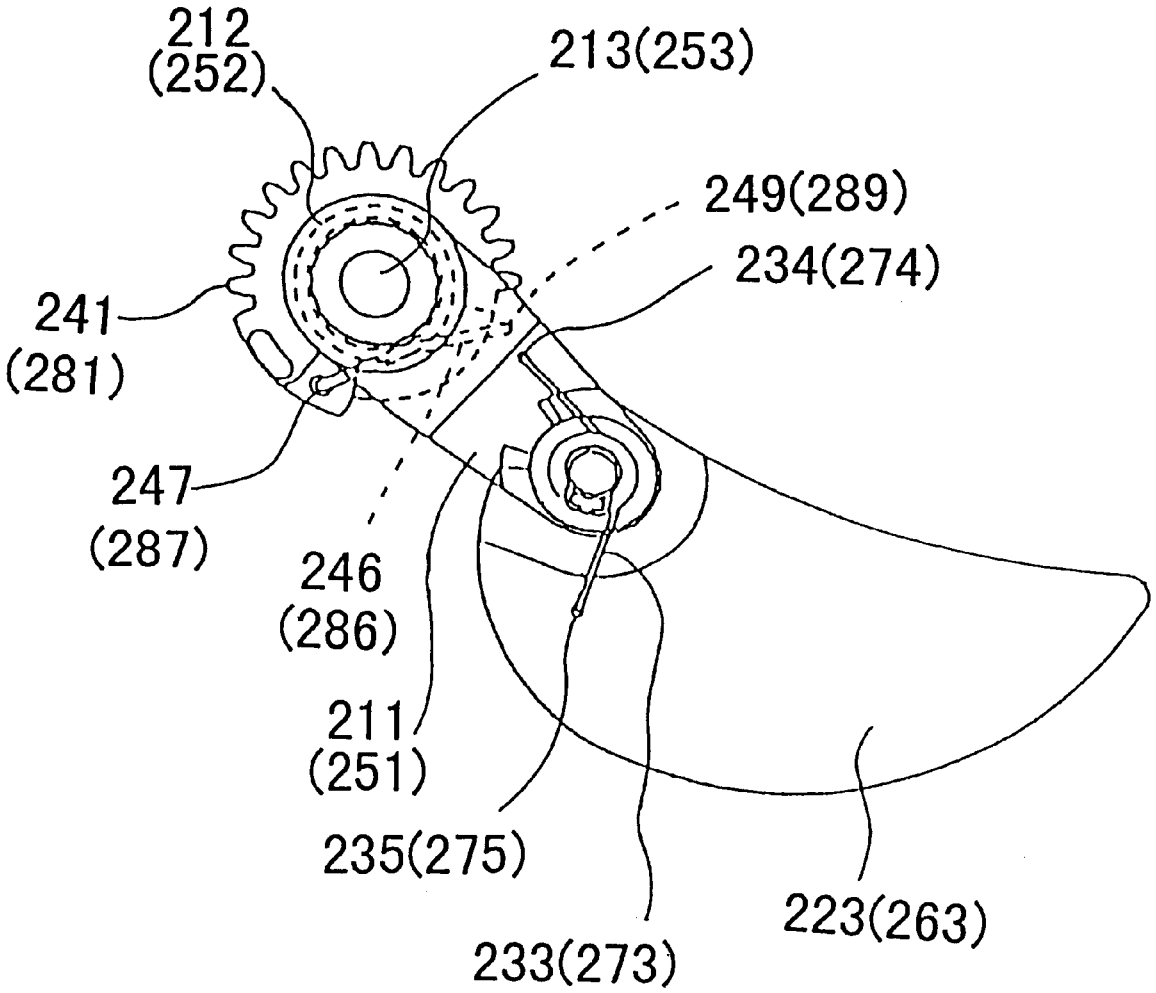
FIG. 52 is a top plan view showing a hand member of the gripping device.
Figure 53:
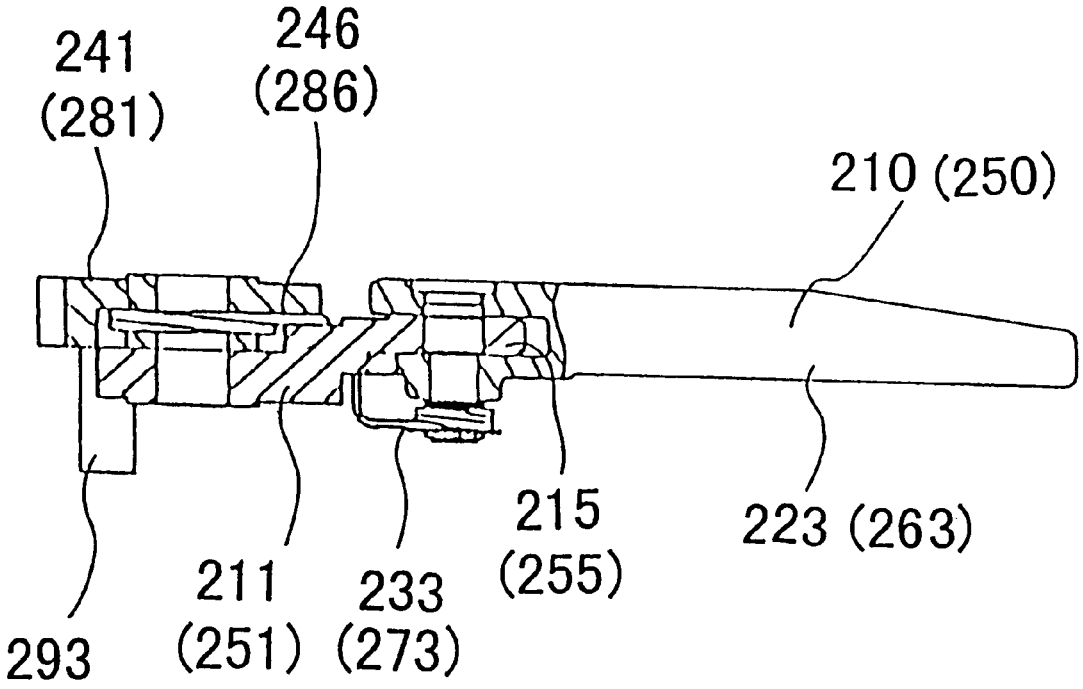
FIG. 53 is a side elevation showing an essential portion of the hand member of the gripping device in section.
Figure 54:
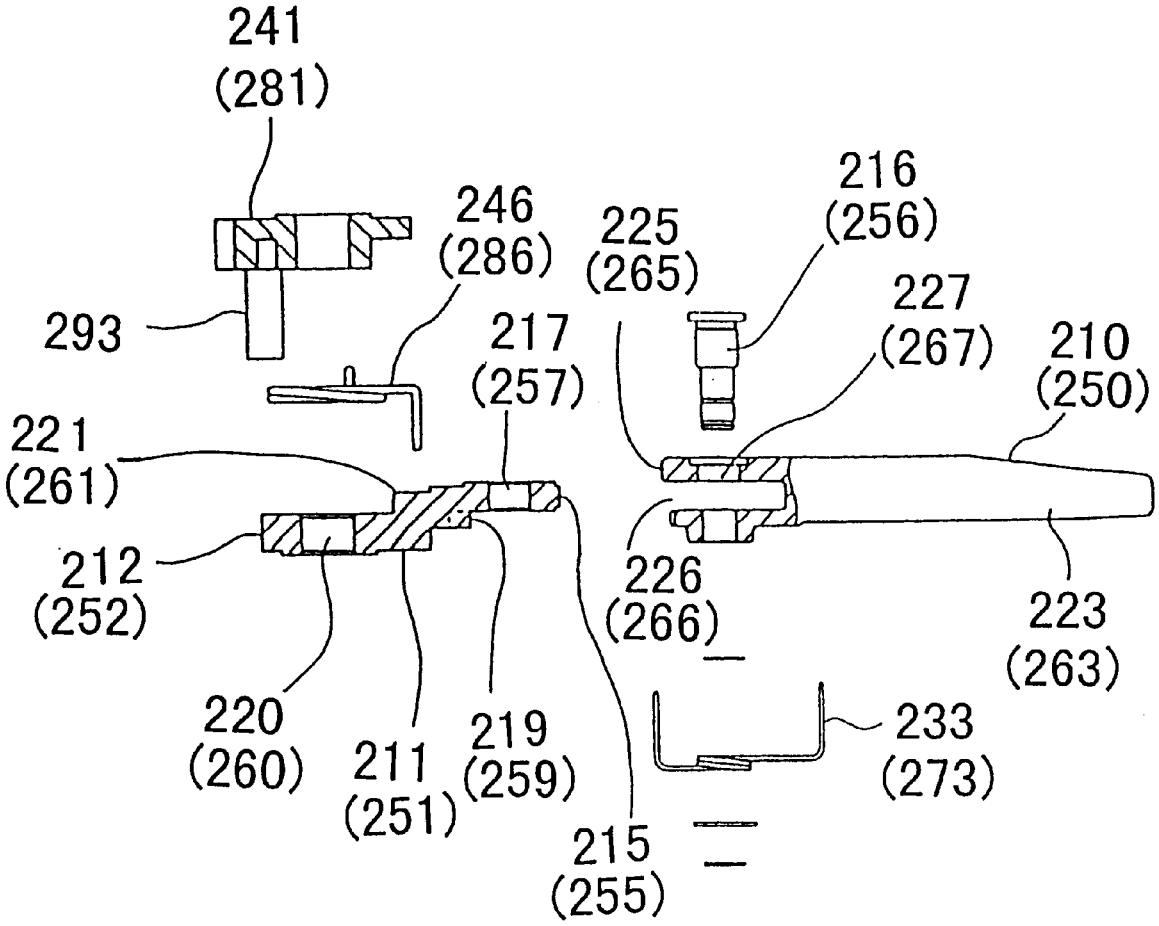
FIG. 54 is an exploded side elevation showing the hand member of the gripping device.
Figure 55:
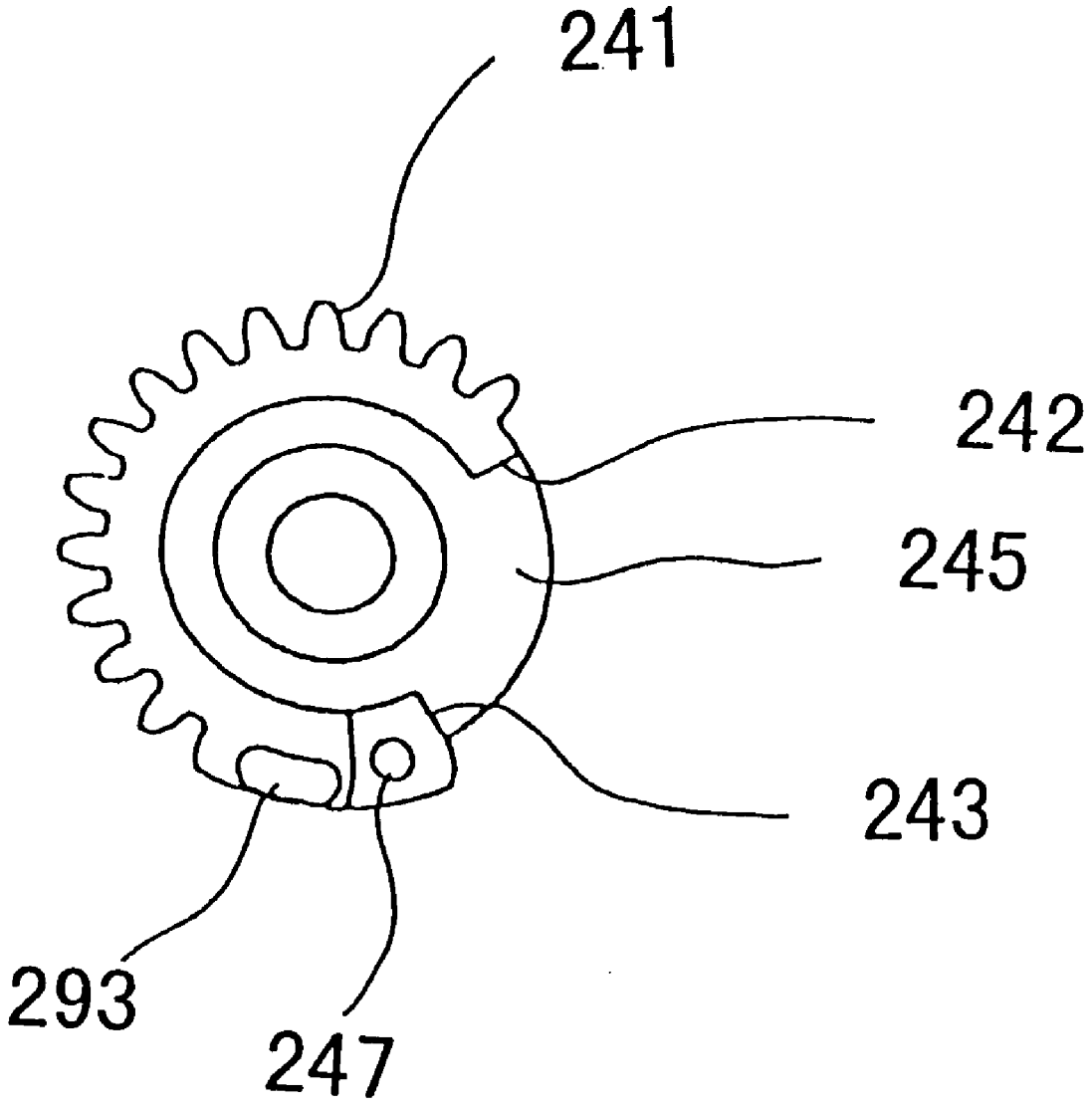
FIG. 55 is top plan view showing one gear of the gripping device.
Figure 56:
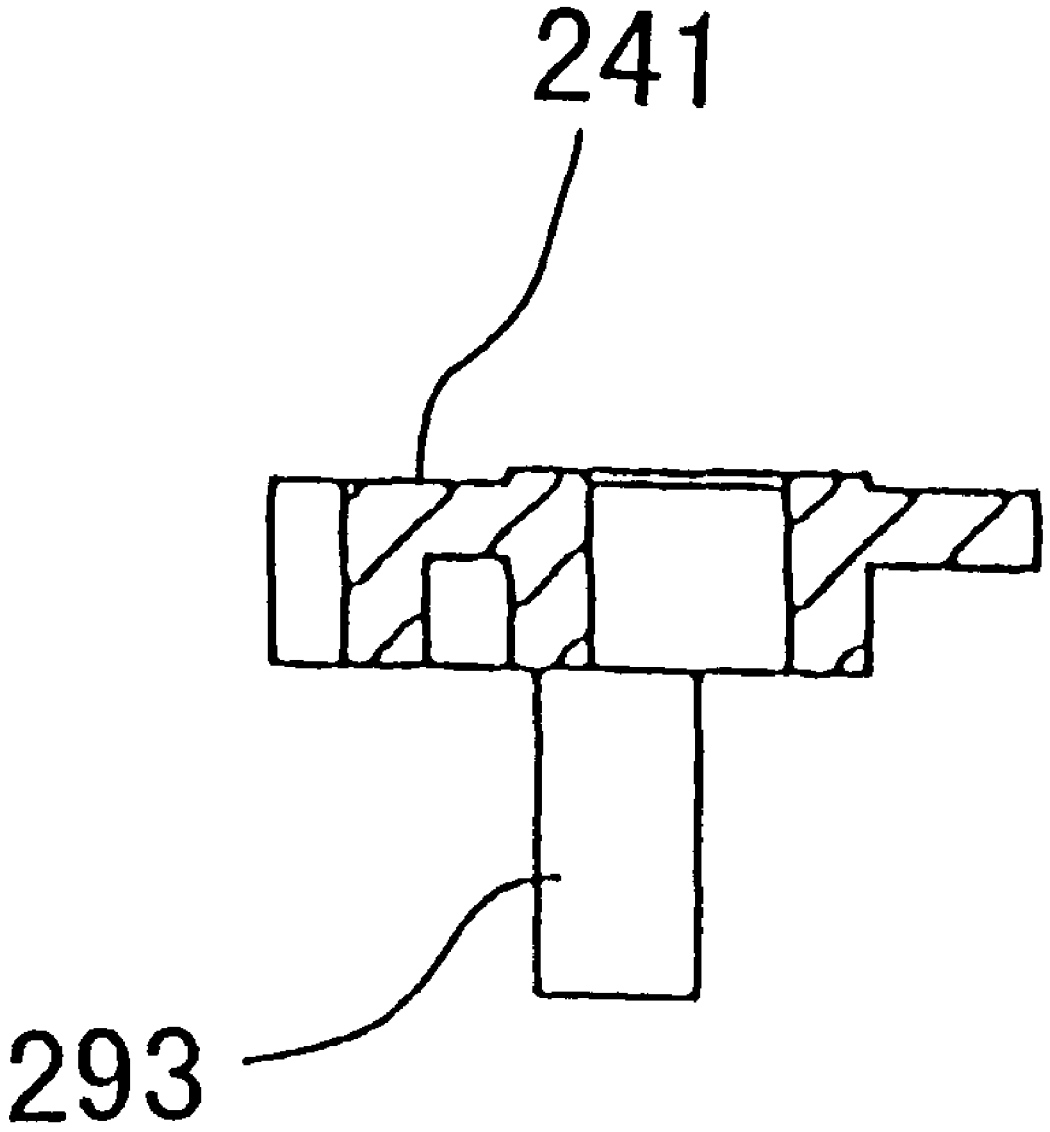
FIG. 56 is a sectional side elevation showing the gear of FIG. 55.
Figure 57:
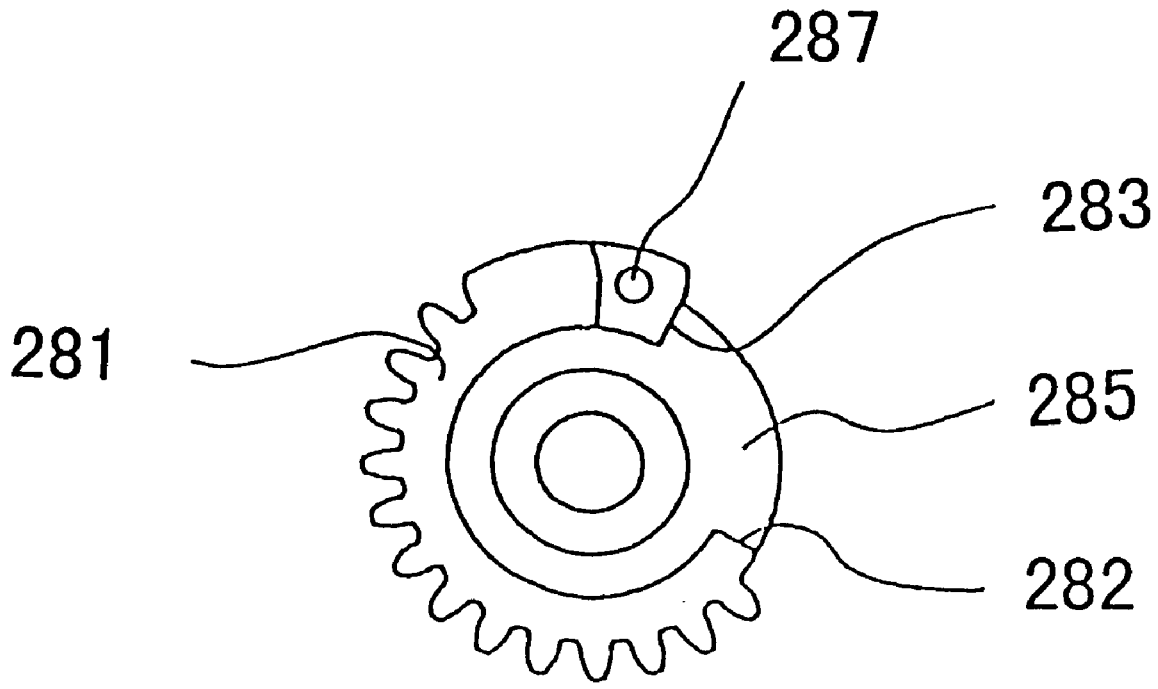
FIG. 57 is a top plan view showing another gear of the gripping device.
Figure 58:
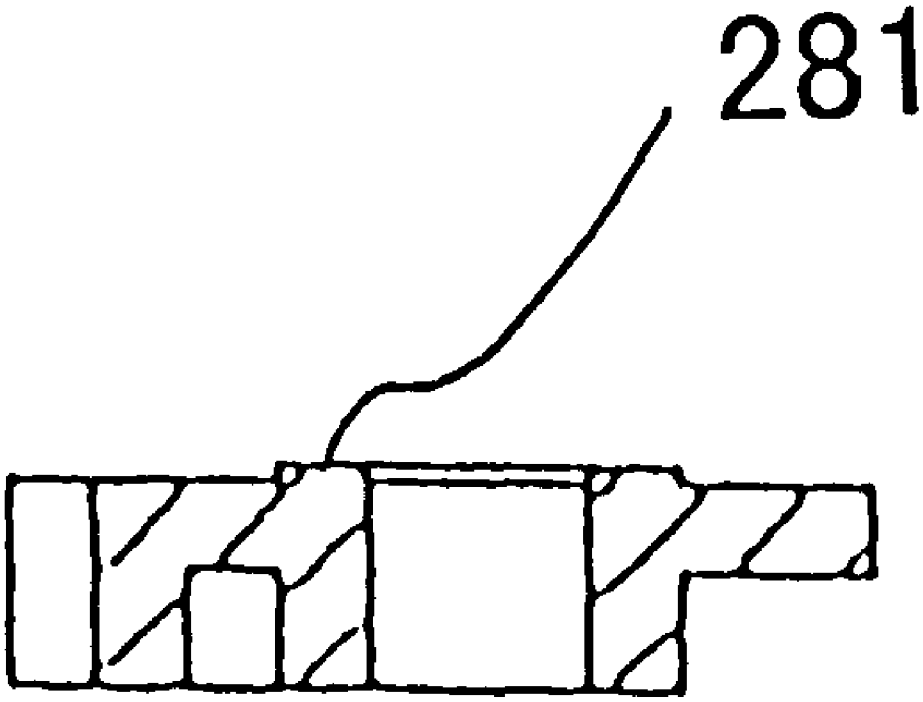
FIG. 58 is a sectional side elevation of the gear of FIG. 57.
Figure 59:
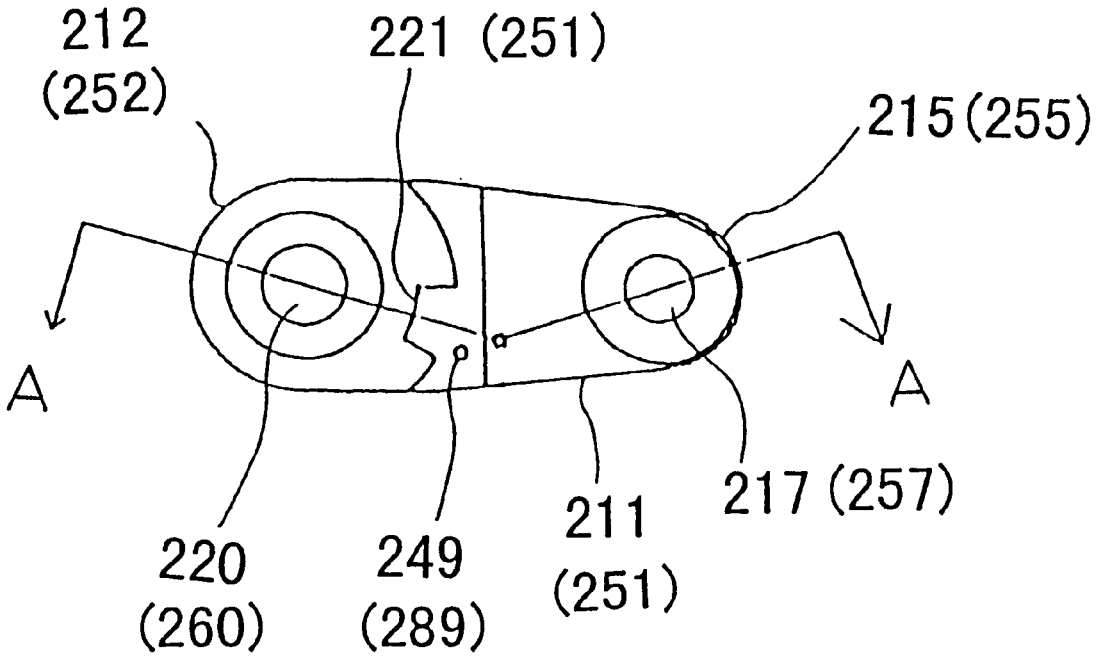
FIG. 59 is a top plan view showing an arm member of the gripping device.
Figure 60:
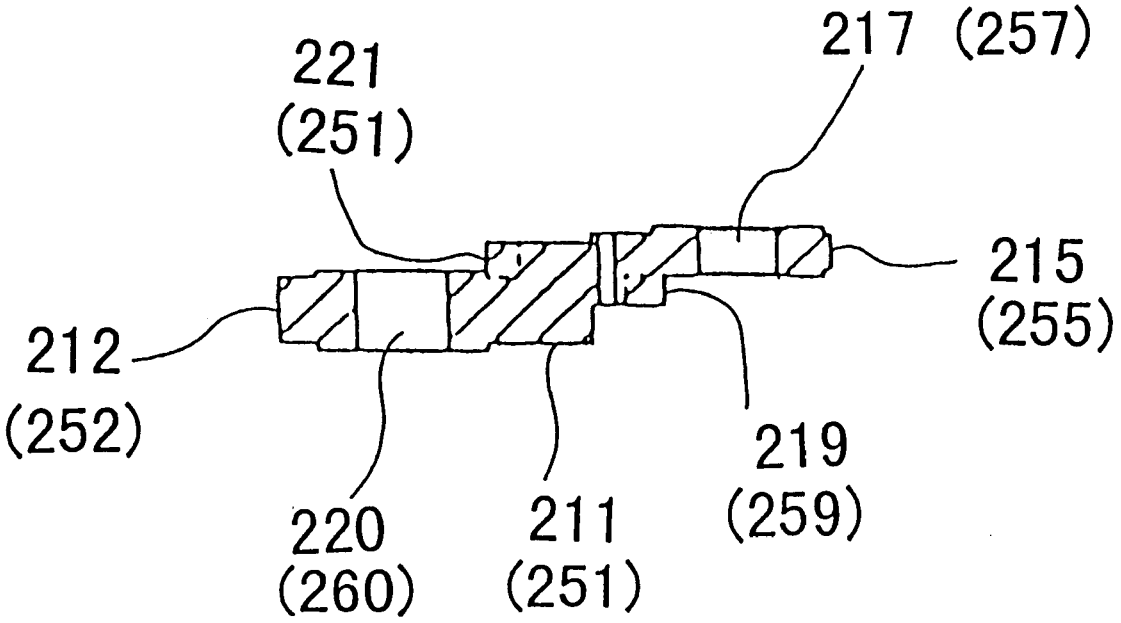
FIG. 60 is a sectional side elevation showing the arm member of the gripping device.
Figure 61:
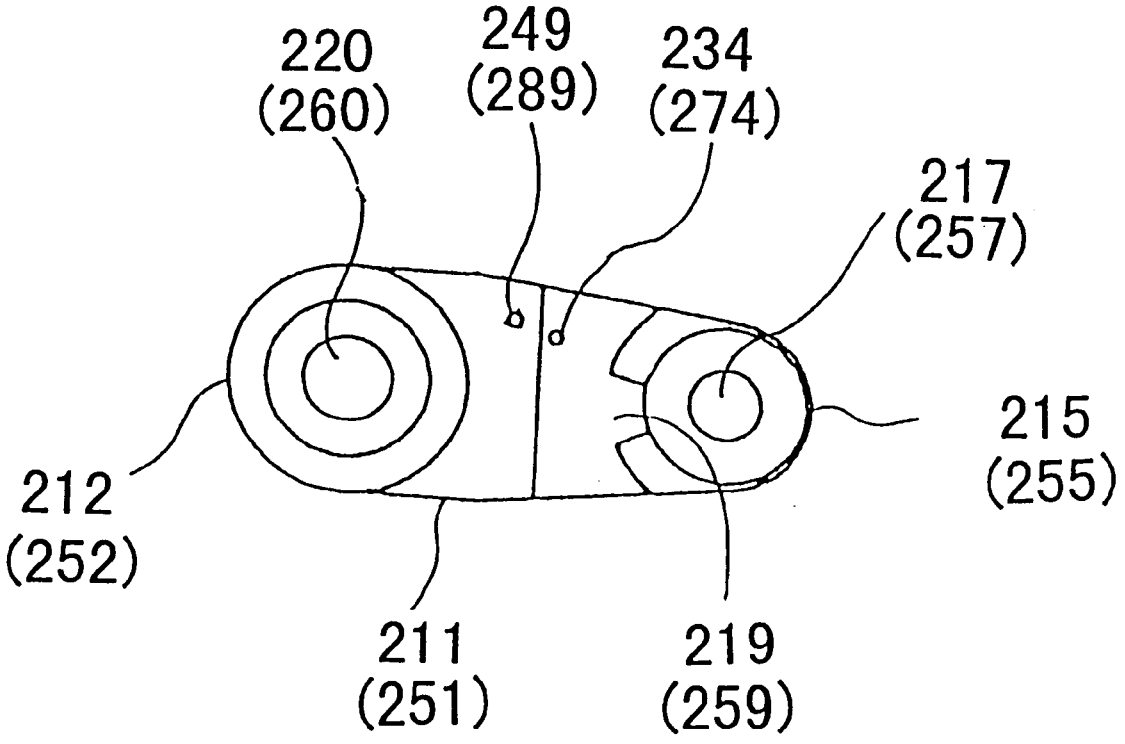
FIG. 61 is a bottom view showing the arm member of the gripping device.
Figure 62:
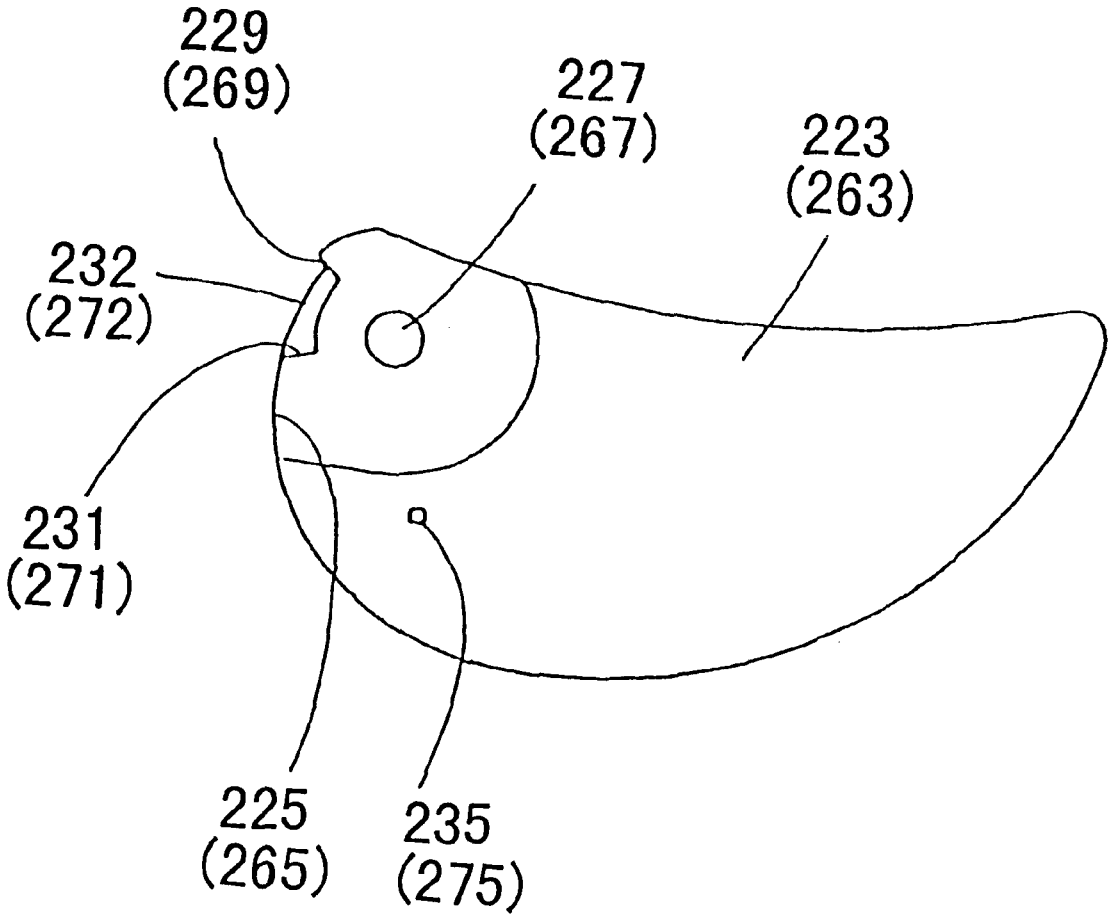
FIG. 62 is a top plan view showing a pawl member of the gripping device.
Figure 63:
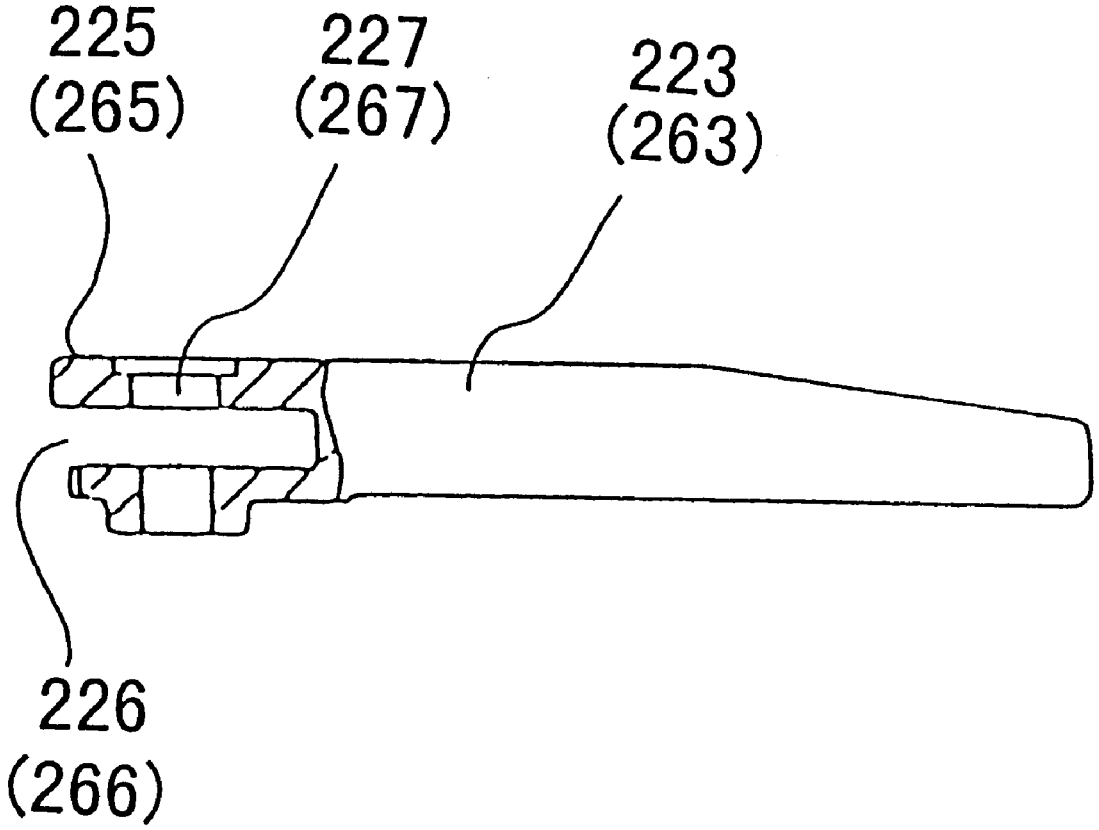
FIG. 63 is a partially sectional side elevation showing the pawl member of the gripping device.

Another embodiment according to the present invention will be described with reference to the accompanying drawings. FIG. 47 is a top plan view showing one mode of the gripper. FIG. 48 is a side elevation showing an essential portion of FIG. 47 in section. FIGS. 49 to 51 are top plan views showing the actions of the gripper. FIG. 52 is a top plan view showing a hand member. FIG. 53 is a side elevation showing an essential portion of the hand member in section. FIG. 54 is an exploded side elevation showing the hand member. FIG. 55 is a top plan view showing one gear. FIG. 56 is a sectional side elevation showing the gear of FIG. 55. FIG. 57 is a top plan view showing another gear. FIG. 58 is a sectional side elevation of the gear of FIG. 57. FIG. 59 is a top plan view showing an arm member. FIG. 60 is a sectional side elevation showing the arm member. FIG. 61 is a bottom view showing the arm member. FIG. 62 is a top plan view showing a pawl member. FIG. 63 is a side elevation showing a portion of the pawl member in section.

A gripper 201 is constructed to include a gripper body 202 disposed movably in a prize acquisition game machine 301 of the prior art, and at least one pair of hand members 210 and 250 mounted in an opening/closing manner to the gripper body 202 for gripping a prize 300 disposed in the prize acquisition game machine 301.

Figure 68:
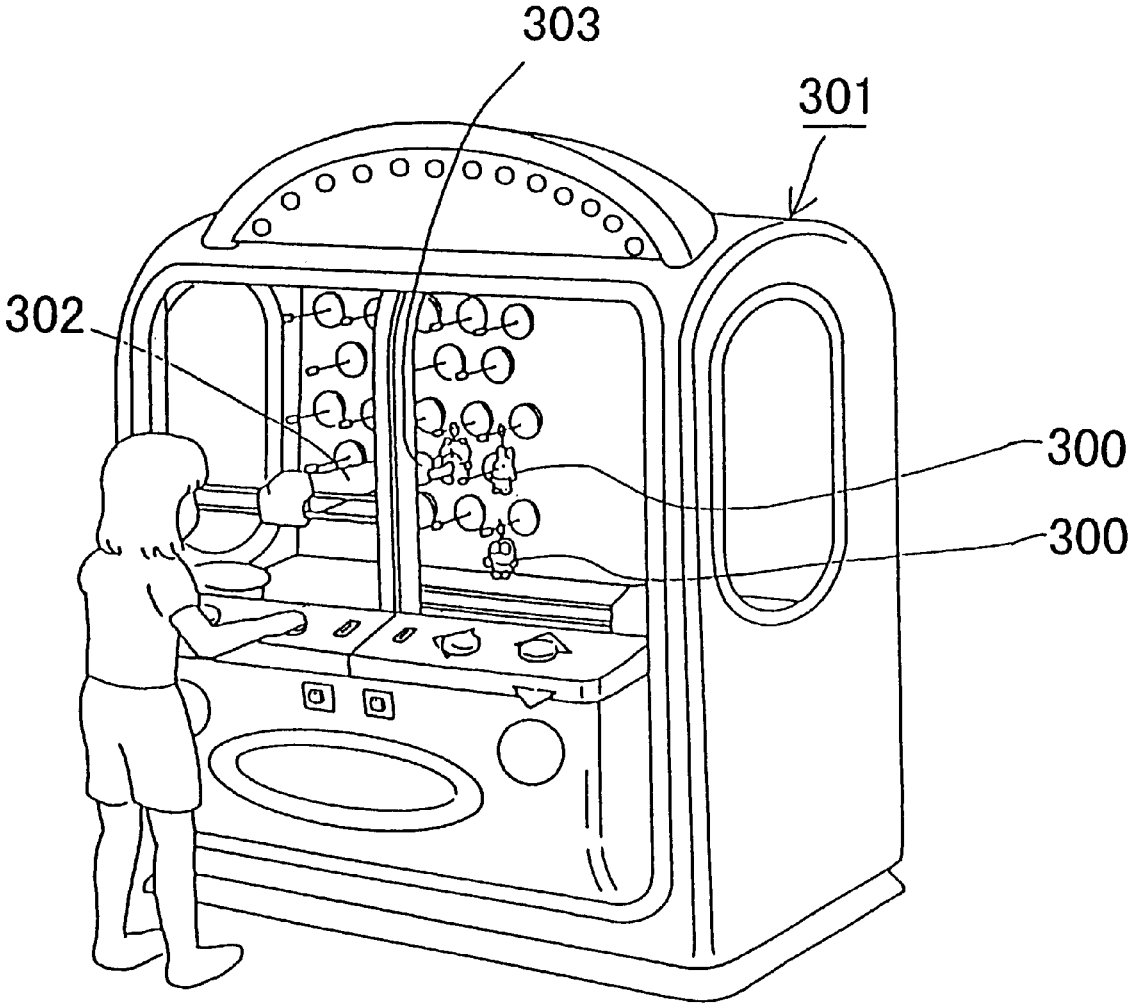
FIG. 68 is a perspective view showing the entirety of a prize acquisition game machine of the prior art.
Figure 69:
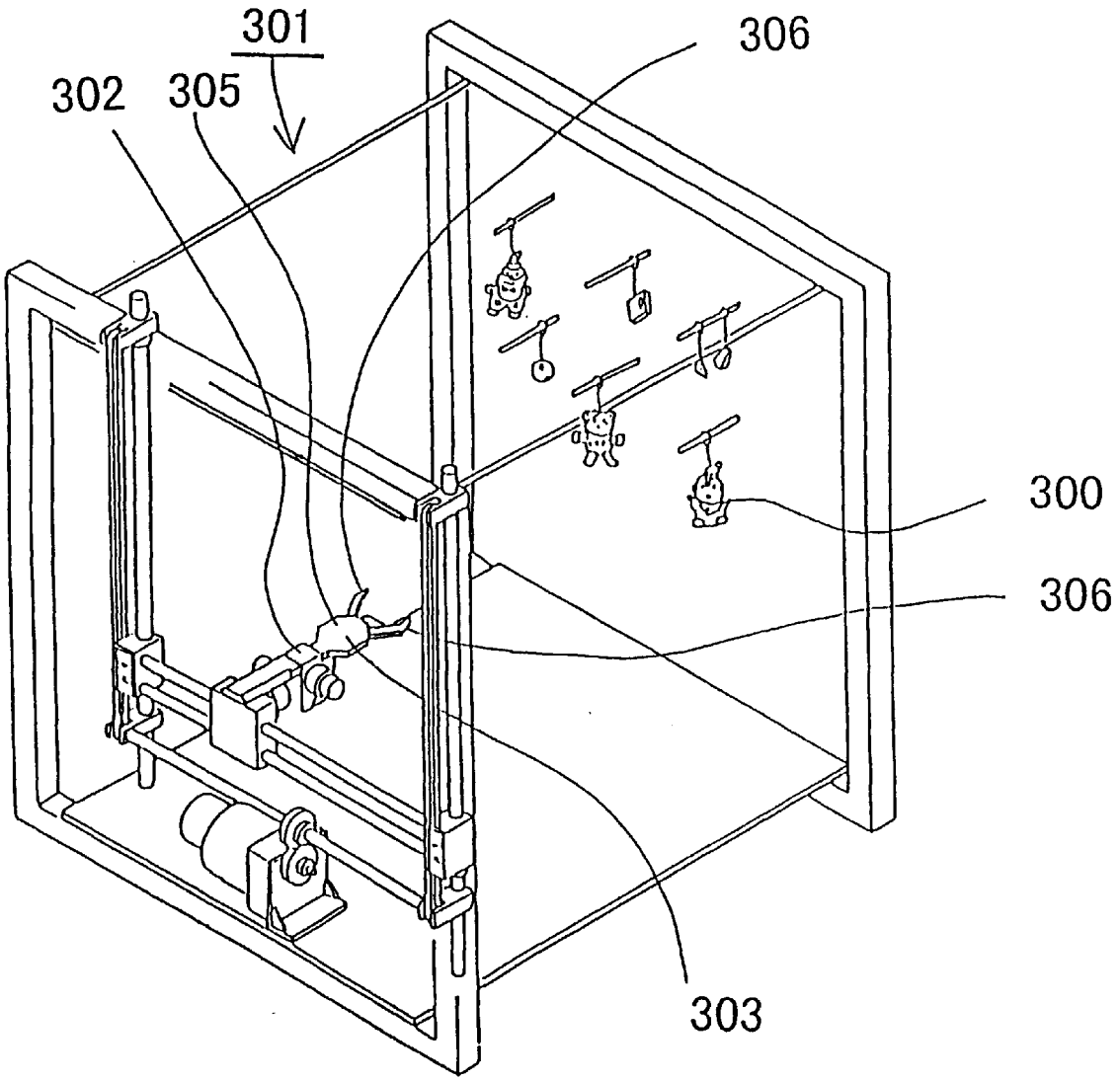
FIG. 69 is a perspective view showing the internal structure of FIG. 68.
Figure 70:
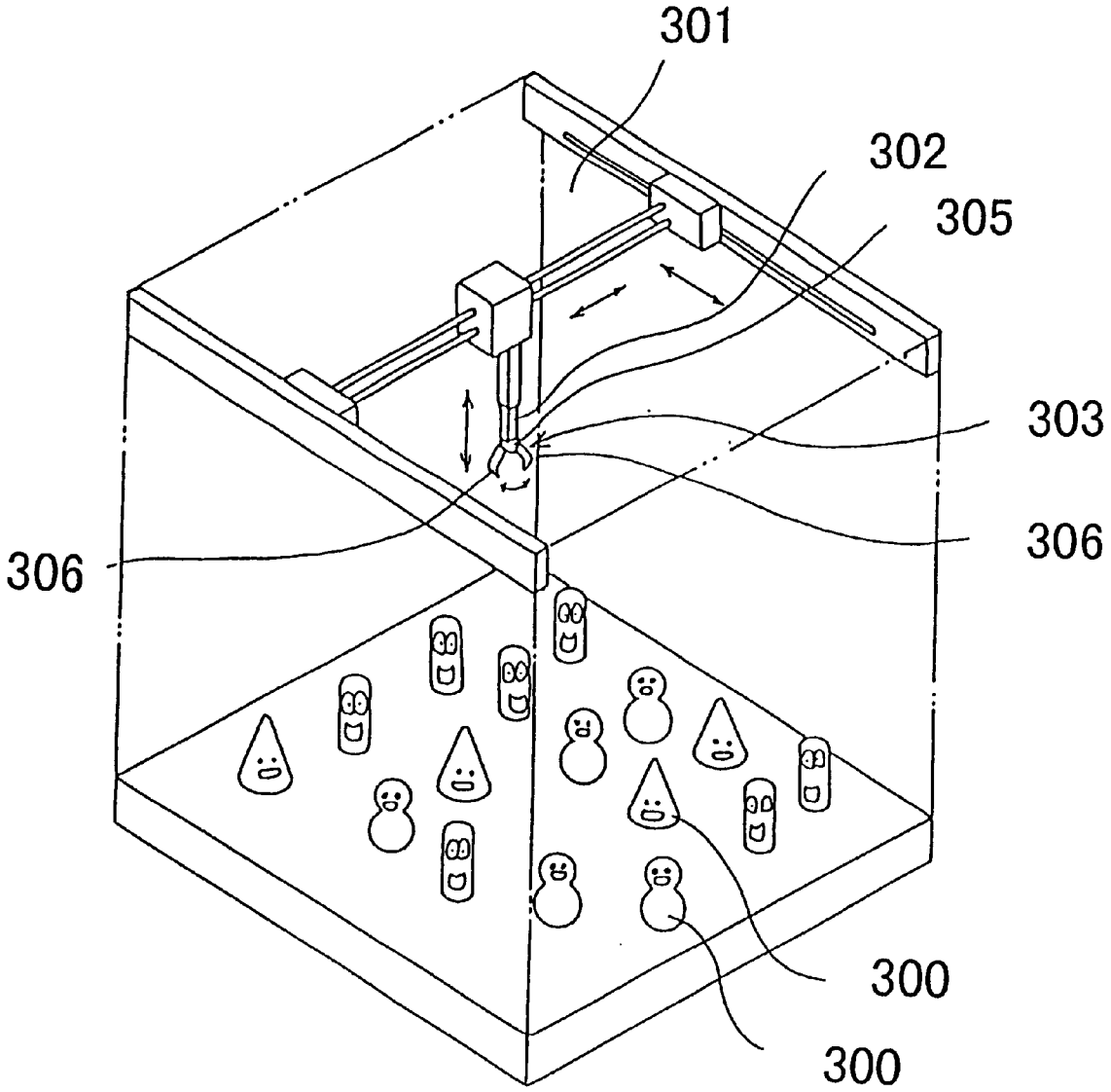
FIG. 70 is a perspective view showing the entirety of the prize acquisition game machine of the prior art.

The prize acquisition game machine 301 may be exemplified in FIGS. 68 to 70, although especially limitative thereto, either by the prize acquisition game machine 301, in which the gripper 201 is moved horizontally or vertically by an expander 302 to grip and acquire the prize 300 suspended from a suspending member in the game machine or placed on the bottom surface, or by the game machine (e.g., the so-called "crane game machine") in which the gripper 201 suspended by a string member is moved vertically to grip and crane the prize placed on the bottom surface in the game machine.

The gripper 201 is mounted to the leading end of the expander 302 or the string member, but its shape is not limited. In the present embodiment, the gripper body 202 is constructed to include a base plate 203, an auxiliary plate 205, and a stationary pin 206 fixing the base plate 203 and the auxiliary plate 205 in parallel at a predetermined spacing. The base plate 203 is formed into a strip shape having an omitted intermediate portion but may be given the same size as that of the auxiliary plate 205.

The hand members 210 and 250 are constructed to include arm members 211 and 251 and crescent pawl members 223 and 263. The root portions 212 and 252 of the arm members 211 and 251 are arranged between the base plate 203 and the auxiliary plate 205 of the gripper body 202 and are turnably mounted to the gripper body 202 by root pins 213 and 253. To the leading portions 215 and 255 of the arm members 211 and 251, there are turnably mounted the root portions 225 and 265 of the pawl members 223 and 263 by pivot pins 216 and 256.

In the arm members 211 and 251, as shown in FIG. 54, bearing holes 217 and 257 are formed in the leading portions 215 and 255, and first engaging projections 219 and 259 are formed around the back faces of the bearing holes 217 and 257. Bearing holes 220 and 260 are formed in the base portions 212 and 252, and second engaging projections 221 and 261 are formed around the surfaces of the bearing holes 220 and 260.

In the root portions 225 and 265 of the pawl members 223 and 263, there are formed fitting grooves 226 and 266 for fitting the leading portions 215 and 255 of the arm members 211 and 251 therein, and bearing holes 227 and 267. In the root portion 225 (265) of the pawl member 223 (263), as shown in FIG. 62, there is formed a recess 232 (272) having a first engaging portion 229 (269) and a second engaging portion 231 (271) for interposing the first engaging projections 219 and 259 of the arm members 211 and 251 at a predetermined clearance, so that the pawl members 223 and 263 can turn within a range of the clearance.

The arm members 211 and 251 mount thereto the pawl members 223 and 263 turnably by fitting the leading portions 215 and 255 in the fitting grooves 226 and 266 of the pawl members 223 and 263, by fitting the first engaging projections 219 and 259 in the recesses 232 and 272 of the pawl members 223 and 263, and by the pivot pins 216 and 256 in the bearing holes 227 and 267 of the pawl members 223 and 263 and in the bearing holes 217 and 257 of the arm members 211 and 251.

In the pawl members 223 and 263, on the other hand, helical springs (or first elastic members), as mounted around the pivot pins 216 and 256, are retained at their one-side ends in fixing holes 234 and 274 of the arm members 211 and 251 and at their other ends in fixing holes 235 and 275 of the pawl members 223 and 263, so that the pawl members 223 and 263 are biased in a closing direction with respect to the arm members 211 and 251. As a result, the first engaging portions 229 and 269 of the recesses 232 and 272 are in abutment against the first engaging projections of the arm members 211 and 251.

The arm members 211 and 251 are turnably mounted to the gripper body 202 by the root pins 213 and 253 fitted in the bearing holes 220 and 260. On these root pins 213 and 253, there are rotatably mounted gears 241 and 281. In these gears 241 and 281, there are formed recesses 245 and 285 which have third engaging portions 242 and 282 and fourth engaging portions 243 and 283 for interposing the second engaging projections 221 and 261 of the arm members 211 and 251 at a predetermined clearance.

Around these root pins 213 and 253, there are so mounted helical springs (or second elastic members) 246 and 286 as are sandwiched between the arm members 211 and 251 and the gears 241 and 281. The arm members 211 and 251 are biased in a closing direction with respect to the gears 241 and 281 by retaining the one-side ends of the helical springs (or second elastic members) 246 and 286, as mounted around the root pins 213 and 253, in fixing holes 247 and 287 of the gears 241 and 281, and by retaining the other ends in fixing holes 249 and 289 of the arm members 211 and 251. As a result, the second engaging projections 221 and 261 are in abutment against the third engaging portions 242 and 282 of the recesses 245 and 285 of the gears 241 and 281.

The paired gears 241 and 281 are in meshing engagement with each other. One gear 281 is meshing with a drive gear 292 which is mounted on the drive shaft of a drive motor 291 fixed on the back face of the base plate 203 of the gripper body 202 by bolts or the like. on the other hand, the other gear 241 is provided with an operation lever 293 which is projected from an arcuate slot 284 formed in the base plate 203. Here, the drive means for rotating the drive gear 292 should not be limited to the drive motor 291 but may be exemplified by an electromagnetic actuator such as a solenoid. Moreover, the drive motor 291 is not limitative but can be modified in various manners by a synchronous motor or a pulse motor in accordance with the situations.

This operation lever 293 turns ON/OFF a switch 295 which is fixed on the back face of the base plate 203 of the gripper body 202 by bolts or the like. This switch 295 is electrically connected with the drive motor 291 and the control means of the prize acquisition game machine 301 so that it is turned ON to stop the rotation of the drive motor 291 when the paired hand members 210 and 250 are opened to predetermined positions.

The gripper 201 thus constructed is mounted to the leading end of the expander 302 or the string member of the known prize acquisition game machine 301 of the prior art so that it is moved to a position for gripping a prize by pushing and controlling the play button (not shown) which is disposed on the front face of the prize acquisition game machine 301. The control means of the prize acquisition game machine 301 drives the drive motor 291.

When the drive motor 291 is activated, the drive gear 292 is rotated to rotate the gears 241 and 281. As these gears 241 and 281 are rotated, the arm members 211 and 251 are pulled in the closing direction by the helical springs (or second elastic members) 246 and 286 so that the hand members 210 and 250 are closed to grip the prize 300 from the two sides by the pawl members 223 and 263. The angle of turning in the closing directions of the hand members 210 and 250 can be changed according to the time period for activating the drive motor 291.

When the control means interrupts the power supply to the drive motor 291, the turning motions of the hand members 210 and 250 in the closing direction, and the control means returns the hand members 210 and 250 to the original positions while being closed. When the control means rotates the drive gear 292 of the drive motor 291 backward, the gears 241 and 281 are rotated backward to turn the hand members 210 and 250 in the opening direction so that the prize, as gripped by the hand members 210 and 250, can be fallen into the reception mouth and taken out from the take-out mouth formed in the front face of the prize acquisition game machine 301.

When the gears 241 and 281 rotate by the predetermined angle in the opening direction, the operation lever 293 carried on the gear 241 turns ON the switch 295 to inactivate the drive motor 291 through the control means. Thus, the hand members 210 and 250 stand by in the original open state when the gripper 201 is returned to the original position.

The opening/closing actions of the hand members 210 and 250 cover the state, in which the pawl members 223 and 263 are opened, as shown in FIG. 47, and the state in which the pawl members 223 and 263 are closed in abutment against each other, as shown in FIG. 49. When a prize 300 of a normal size is to be gripped, as shown in FIG. 50, the pawl members 223 and 263 are opened against the elasticities of the helical springs (or first elastic members) 233 and 273 with the arm members 211 and 251 being closed.

When a prize 300 larger than a normal one is to be gripped, as shown in FIG. 51, it cannot be gripped by opening only the pawl members 223 and 263 so that the arm members 211 and 251 are additionally opened against the elasticities of the helical springs (or second elastic members) 246 and 286. In this state, the second engaging portions 231 and 271 of the pawl members 223 and 263 are in engagement with the first engaging projections 219 and 259 of the arm members 211 and 251. Here, the fourth engaging portions 243 and 283 of the gears 241 and 281 are not indispensable but are enabled to prevent the excessive opening of the arm members 211 and 251 by their abutments against the second engaging projections 221 and 261 of the arm members 211 and 251.

The opening/closing actions described above occur in case the helical springs (or first elastic members) 233 and 273 are weaker than the helical springs (or second elastic members) 246 and 286. If the helical springs (or first elastic members) 233 and 273 are stronger than the helical springs (or second elastic members) 246 and 286, on the contrary, the arm members 211 and 251 are opened before the pawl members 223 and 263 are opened.

In the embodiment thus far described, the arm members 211 and 251 are set shorter than the pawl members 223 and 263, as could be understood from the drawings. If the arm members 211 and 251 are given a length substantially equal to that of the pawl members 223 and 263, however, the arm members 211 and 251 can also grip the prize 300. Then, the arm members 211 and 251 can grip the prize 300 reliably if the prize 300 is small, because the prize 300 is surrounded by the pawl members 223 and 263.

If the prize 300 is larger, on the other hand, the arm members 211 and 251 and the pawl members 223 and 263 are bent around the contour of the prize 300 so that the grip is more ensured by the linear contact than by the point contact of the prior art. By adjusting the elasticities of the helical springs (or first elastic members) 233 and 273 and the helical springs (or second elastic members) 246 and 286, moreover, the gripping force can be changed to grip a fragile prize softly.

Figure 64:
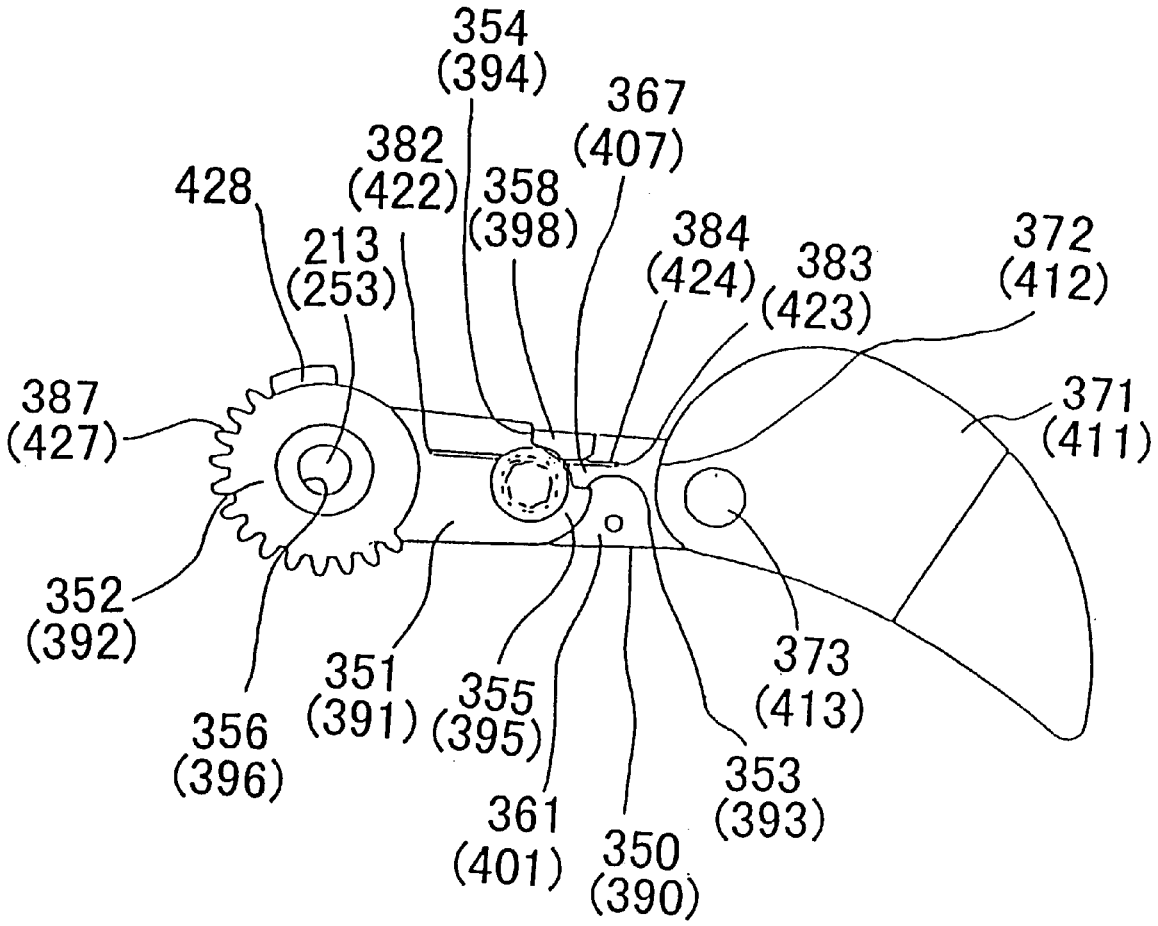
FIG. 64 is a top plan view showing another mode of a hand member of the gripping device.
Figure 65:
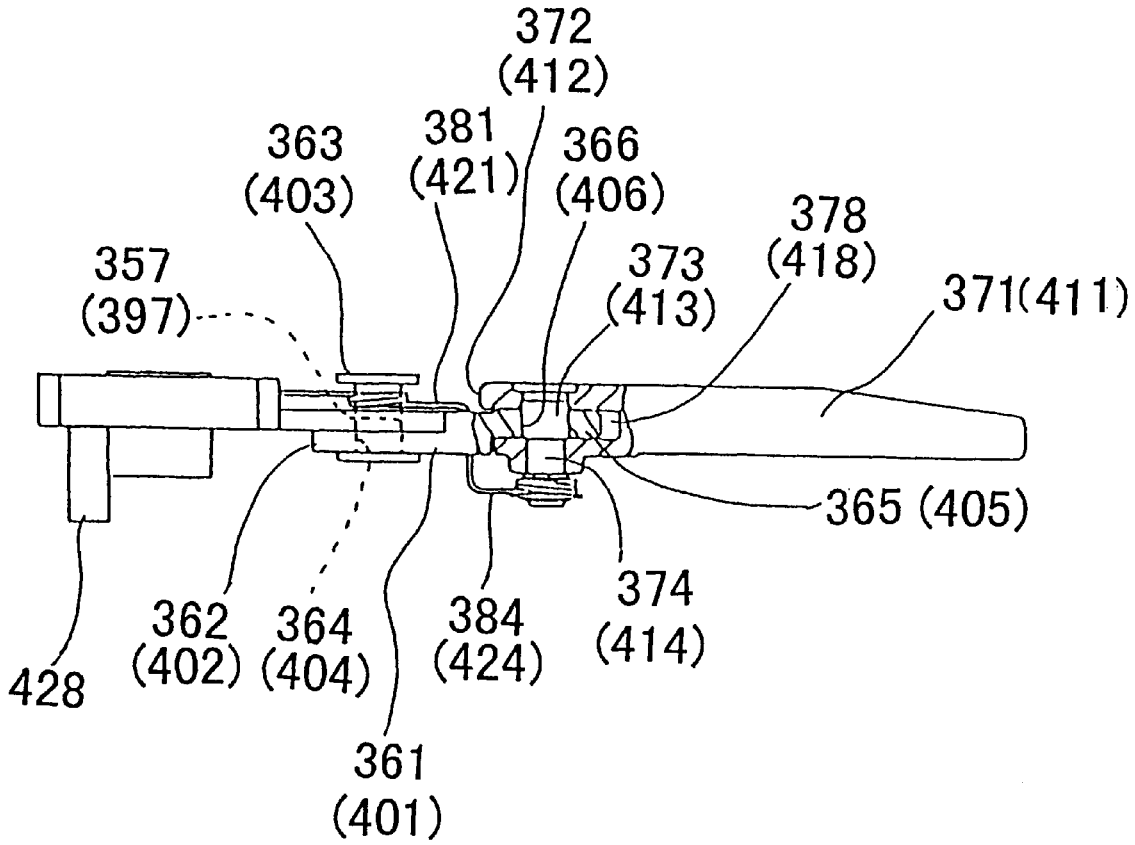
FIG. 65 is a partially sectional side elevation of FIG. 64.
Figure 66:
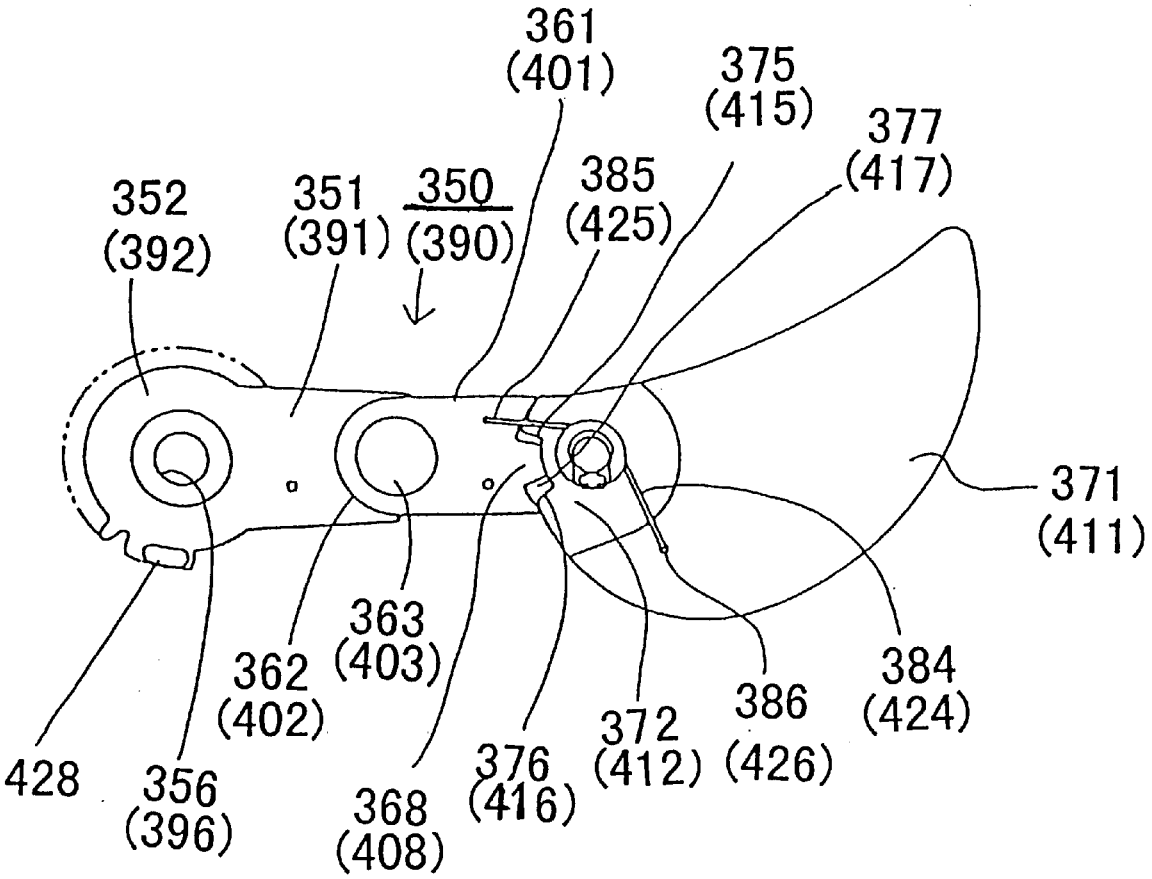
FIG. 66 is a bottom view of FIG. 64.
Figure 67:
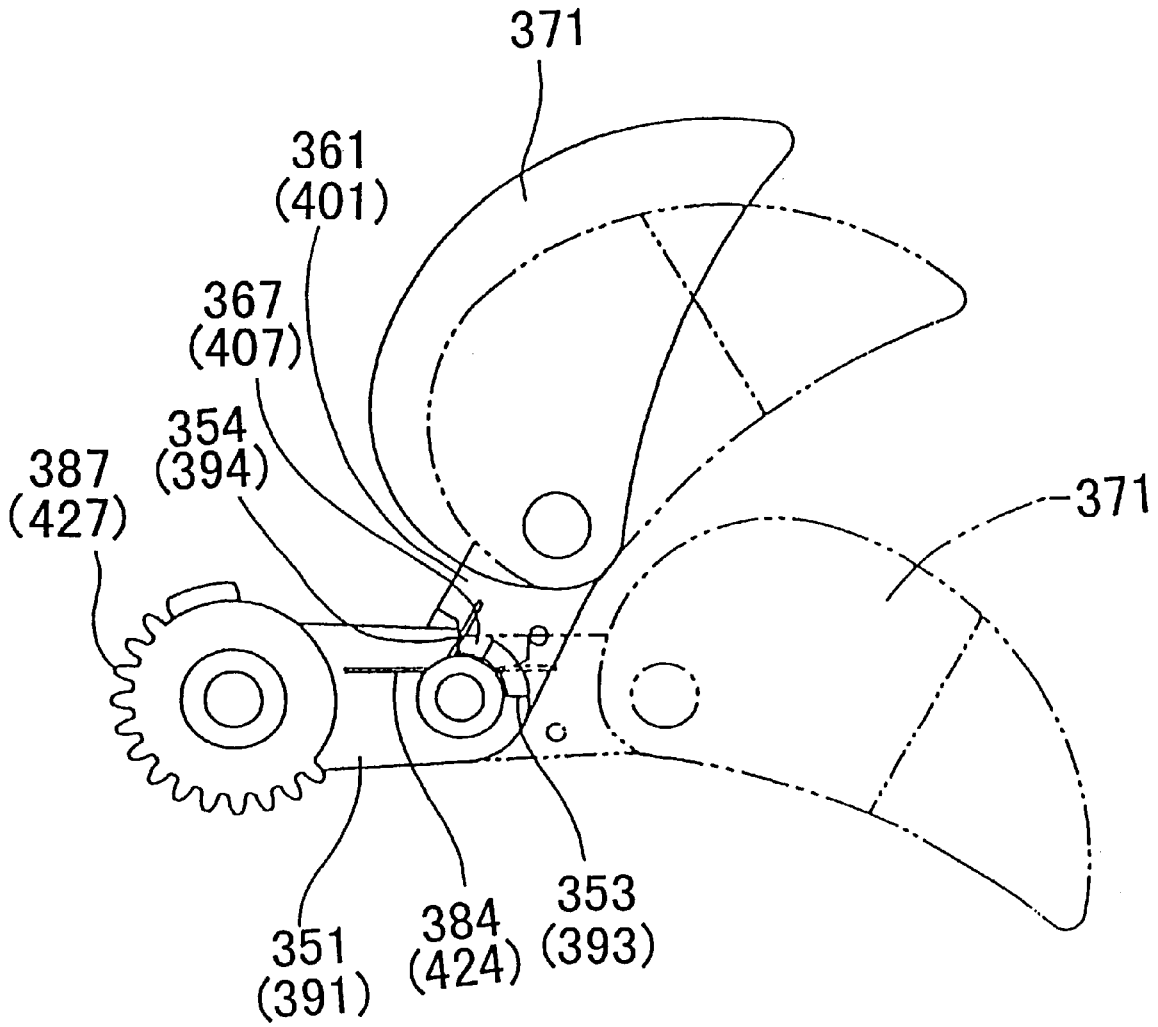
FIG. 67 is an explanatory diagram illustrating the motion of the hand member of FIG. 64.

Another embodiment according to the present invention will be described with reference to the accompanying drawings. FIG. 64 is a top plan view showing another mode of the hand member. FIG. 65 is a side elevation showing a portion of FIG. 64 in section. FIG. 66 is a bottom view of FIG. 64. FIG. 67 is an explanatory diagram showing the motion of the hand member. Here, the gripper body 202 is identical to that of the foregoing embodiment, and its description will be omitted.

The hand members 350 and 390 are constructed to include arm members 351 and 391, intermediate members 361 and 401 and crescent pawl members 371 and 411. The root portions 352 and 392 of the arm members 351 and 391 are arranged between the base plate 203 and the auxiliary plate 205 of the gripper body 202 and are turnably mounted to the gripper body 202 by root pins 213 and 253.

To the leading portions 355 and 395 of the arm members 351 and 391, there are turnably mounted the root portions 362 and 402 of the intermediate members 361 and 401 by first pivot pins 363 and 403. To the root portions 372 and 412 of the pawl members 371 and 411, there are turnably mounted the leading portions 365 and 405 of the intermediate members 361 and 401 by second pivot pins 373 and 413.

In the intermediate members 361 and 401, bearing holes 364 and 404 for the first pivot pins 363 and 403 are formed in the root portions 362 and 402, and bearing holes 366 and 406 for the second pivot pins 373 and 413 are formed in the leading portions 365 and 405. In the intermediate members 361 and 401, first engaging projections 367 and 407 are formed around the bearing holes 364 and 404, and second engaging projections 368 and 408 are formed around the bearing holes 366 and 406.

In the arm members 351 and 391, bearing holes 357 and 397 for the first pivot pins 363 and 403 are formed in the leading portions 355 and 395, and recesses 358 and 398 having first engaging portions 353 and 393 and second engaging portions 354 and 394 for interposing the first engaging projections 367 and 407 of the intermediate members 361 and 401 at a clearance of a predetermined distance are formed around the bearing holes 357 and 397, so that the intermediate members 361 and 401 can turn within the range of the aforementioned clearance. Moreover, bearing holes 356 and 396 for the root pins 213 and 253 are formed in the root portions 352 and 392 of the arm members 351 and 391.

In the pawl members 371 and 411, not only fitting grooves 378 and 418 for fitting the leading portions 365 and 405 of the intermediate members 361 and 401 but also bearing holes 374 and 414 for the second pivot pins 373 and 413 are formed in the root portions 372 and 412. In the pawl members 371 and 411, on the other hand, recesses 377 and 417 having third engaging portions 375 and 415 and fourth engaging portions 376 and 416 for interposing the second engaging projections 368 and 408 of the intermediate members 361 and 401 at a clearance of a predetermined distance are formed in the root portions 372 and 412, so that the pawl members 371 and 411 can turn within the range of the clearance.

The intermediate members 361 and 401 are biased in a closing direction with respect to the arm members 351 and 391 by retaining the one-side ends of helical springs (first elastic members) 381, 421, as mounted around the first pivot pins 363 and 403, in fixing holes 382 and 422 of the arm members 351 and 391, and by retaining the other ends in fixing holes 383 and 423 of the intermediate members 361 and 401. The first engaging projections 367 and 407 of the intermediate members 361 and 401 are abutting against the first engaging portions 353 and 393 of the recesses 358 and 398.

Likewise, the pawl members 371 and 411 are biased in a closing direction with respect to the intermediate members 361 and 401 by retaining the one-side ends of helical springs (or second elastic members) 384 and 424, as mounted around the second pivot pins 373 and 413, in fixing holes 385 and 425 of the intermediate members 361 and 401, and by fitting the other ends in fixing holes 386 and 426 of the pawl members 371 and 411. The third engaging portions 375 and 415 of the recesses 377 and 417 are abutting against the second engaging projections 368 and 408 of the intermediate members 361 and 401.

In the root portions 352 and 392 of the arm members 351 and 391, there are formed gears 387 and 427 meshing with each other. One gear 387 is in meshing engagement with the drive wheel 292 which is mounted on the drive shaft of the drive motor 291, as described hereinbefore, and the other gear 427 is provided with an operation lever 428 for turning ON/OFF the switch 295.

The opening/closing actions of the hand members 350 and 390 are substantially identical to those of the hand members 210 and 250. When a prize 300 of a normal size is to be gripped, the pawl members 371 and 411 are opened against the elasticities of the helical springs (or second elastic members) 384 and 424 with the arm members 351 and 391 and the intermediate members 361 and 401 being closed.

When a prize 300 larger than the normal one is to be gripped, it cannot be gripped by opening the pawl members 371 and 411 only, and the intermediate members 361 and 401 are additionally opened against the elasticities of the helical springs (or first elastic members) 381 and 421. In this state, the fourth engaging portions 376 and 416 of the pawl members 371 and 411 are engaging with the second engaging projections 368 and 408 of the intermediate members 361 and 401. Here, the second engaging portions 354 and 394 of the arm members 351 and 391 are not indispensable but are enabled to prevent the excessive opening of the intermediate members 361 and 401 by their abutments against the first engaging projections 367 and 407 of the intermediate members 361 and 401.

The opening/closing actions described above occur in case the helical springs (or second elastic members) 384 and 424 are weaker than the helical springs (or first elastic members) 381 and 421. If the helical springs (or second elastic members) 384 and 424 are stronger than the helical springs (or first elastic members) 381 and 421, on the contrary, the intermediate members 361 and 401 are opened before the pawl members 371 and 411 are opened.

In the embodiment described above, the arm members 351 and 391, the intermediate members 361 and 401 and the pawl members 371 and 411 are bent around the contour of the prize 300 so that the grip is more ensured by the linear contact than by the point contact of the prior art. By adjusting the elasticities of the helical springs (or second elastic members) 384 and 424 and the helical springs (or first elastic members) 381 and 421, moreover, the gripping force can be changed to grip a fragile prize softly.

The aforementioned elastic members 233, 246, 273, 286, 381, 384, 421 and 424 are mounted in the biased states in the predetermined positions but could be mounted without any bias, i.e., in the state where the two members are associated with each other. In the hand members 210 and 250 of FIG. 47, for example, the pawl members 223 and 263 are biased in the closing direction by the helical springs (or first elastic members) 233 and 273 mounted around the pivot pins 216 and 256, so that the first engaging portions 229 and 269 are abutting against the first engaging projections 219 and 259 of the arm members 211 and 251. If these helical springs (or first elastic members) 233 and 273 are mounted without any bias and if the first engaging projections 219 and 259 are removed, the pawl members 223 and 263 do not abut anywhere so that they can be widely opened with respect to the arm members 211 and 251 and can be returned to their original positions by the elastic restoring forces of the helical springs (or first elastic members) 233 and 273.

Figure 71:
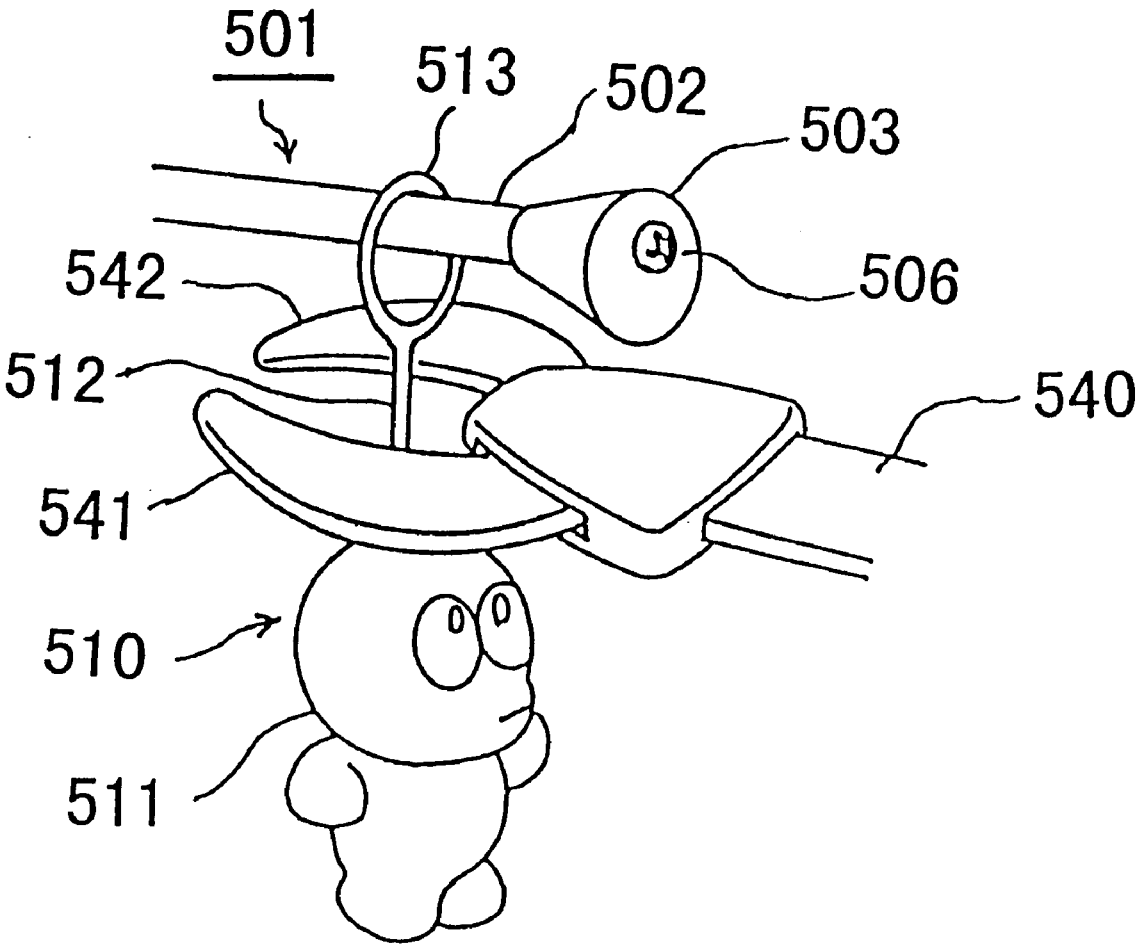
FIG. 71 is a perspective view showing one mode of the suspending device.
Figure 72:
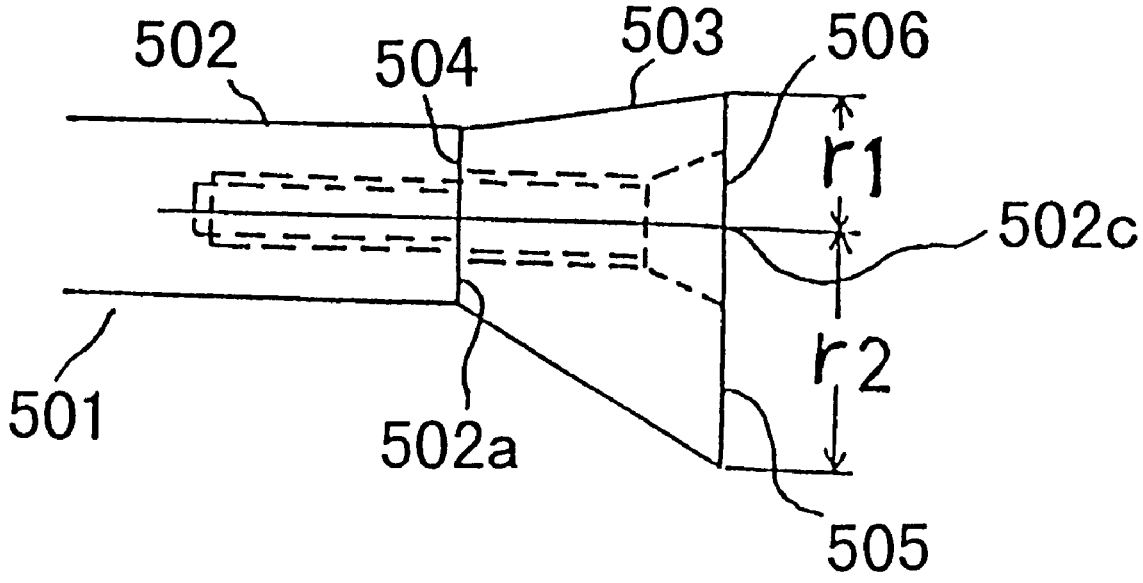
FIG. 72 is a side elevation showing the suspending device of FIG. 71.
Figure 73:
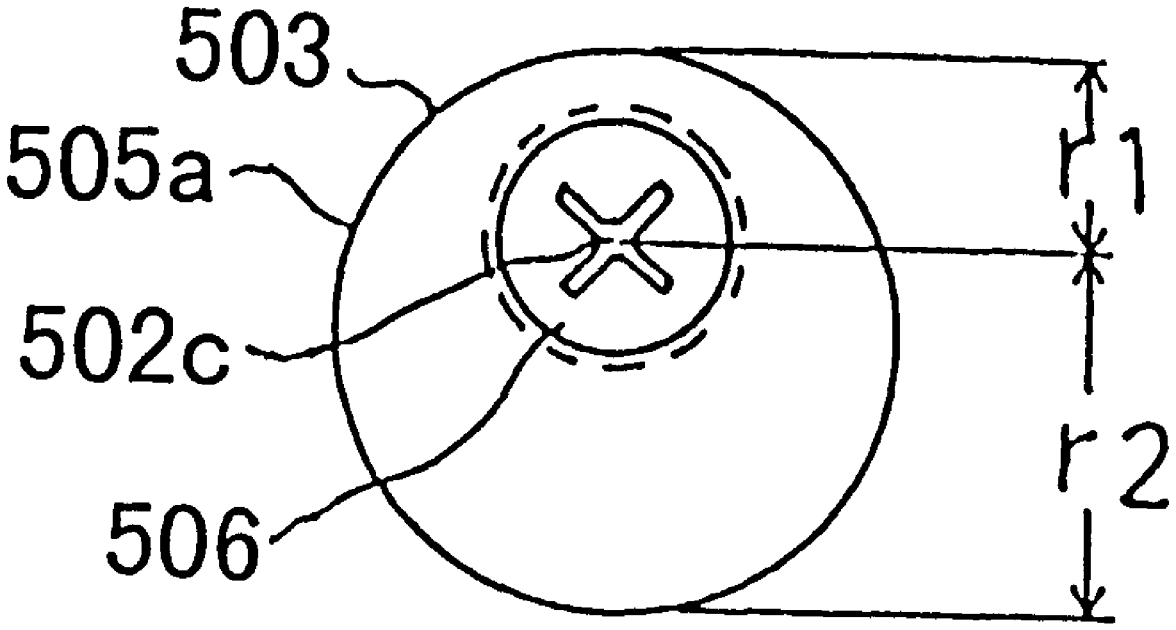
FIG. 73 is a front elevation showing the suspending device of FIG. 71.
Figure 74:
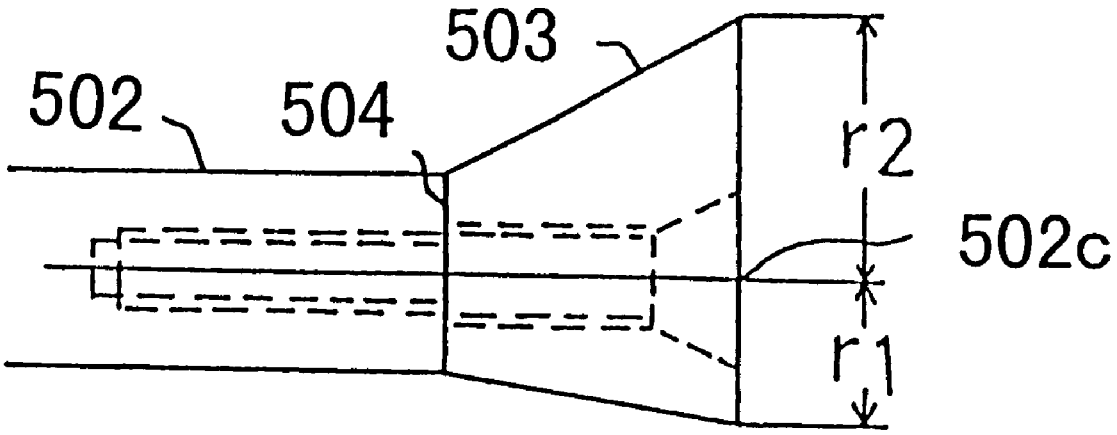
FIG. 74 is a side elevation showing the state in which a drop preventing member of FIG. 72 is turned.
Figure 75:
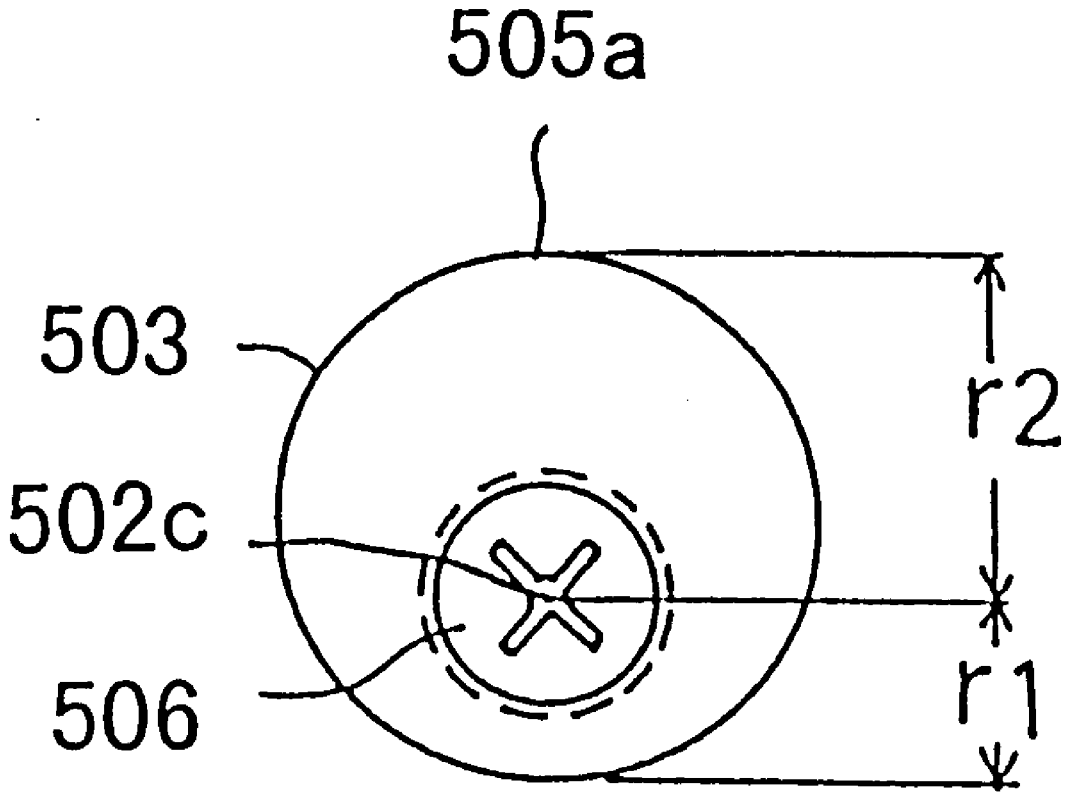
FIG. 75 is a front elevation of FIG. 74.
Figure 76:
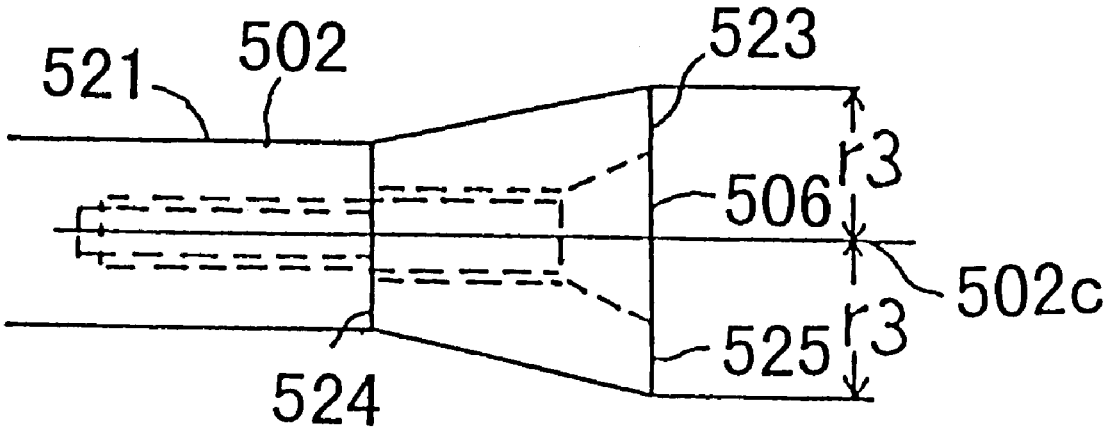
FIG. 76 is a side elevation showing another mode of the suspending device.
Figure 77:
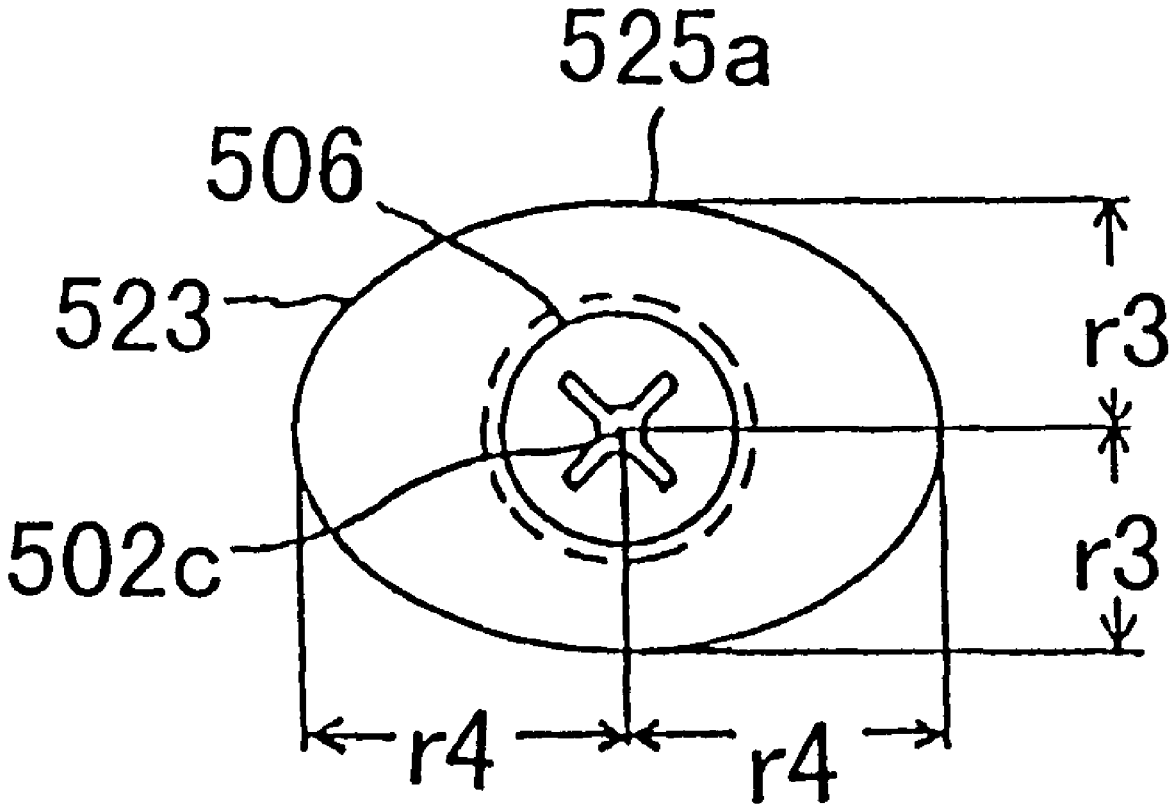
FIG. 77 is a front elevation of FIG. 76.
Figure 78:
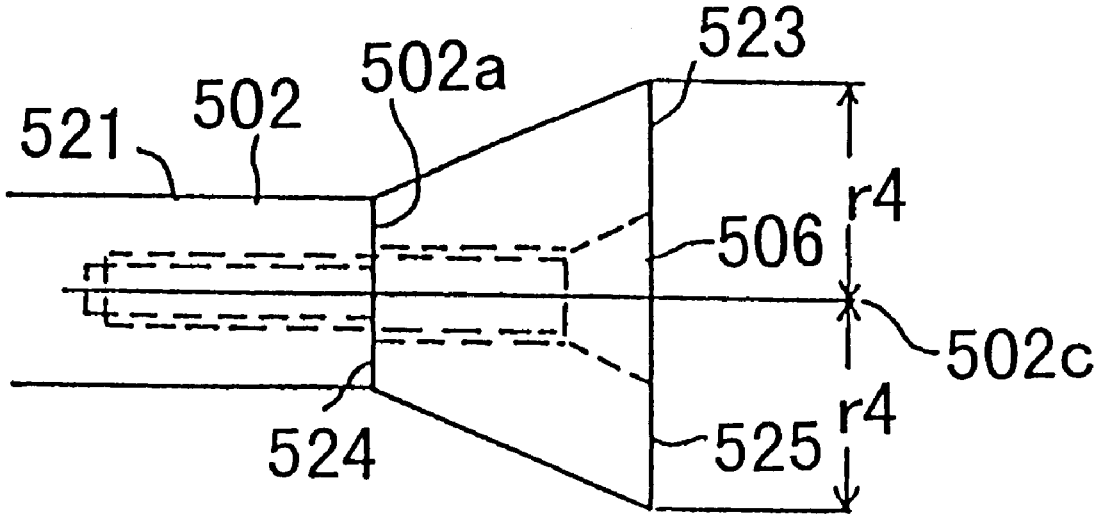
FIG. 78 is a side elevation showing the state in which a drop preventing member of FIG. 76 is turned.
Figure 79:
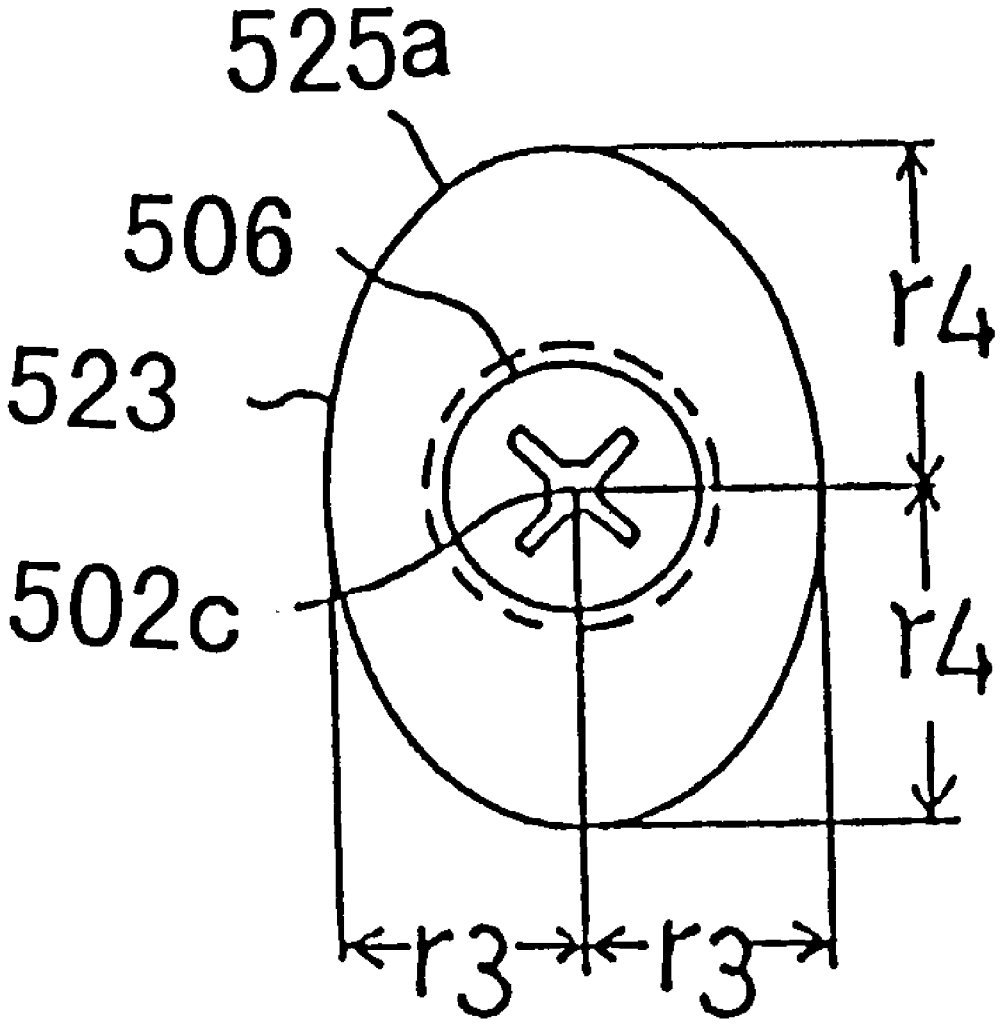
FIG. 79 is a front elevation of FIG. 78.
Figure 80:
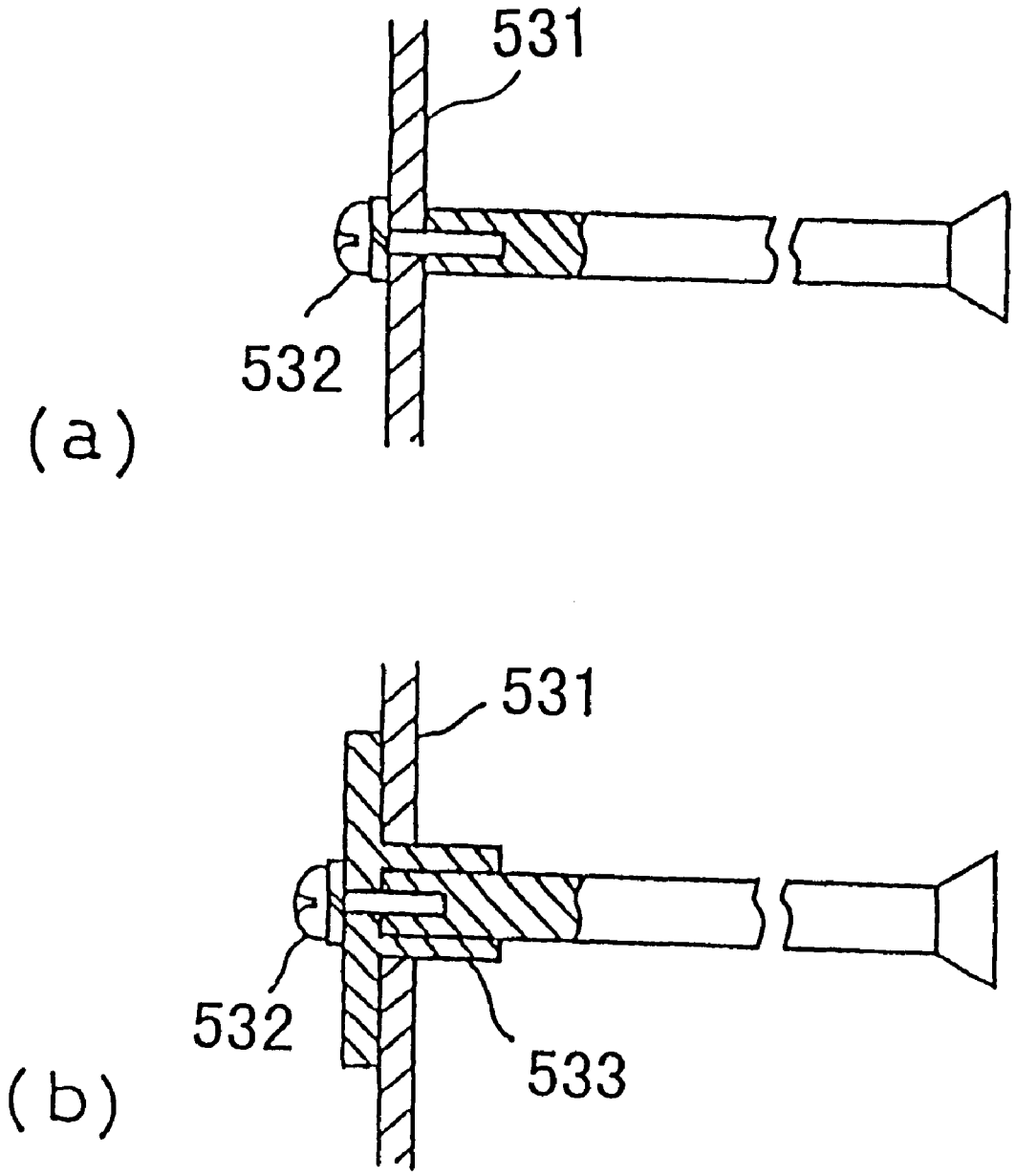
FIG. 80 is a side elevation showing the mode in which the suspending device is mounted on the game machine.

Embodiments of a suspender to be used in the foregoing embodiments will be described with reference to the accompanying drawings. FIG. 71 is a perspective view showing one mode of the suspender. FIG. 72 is a side elevation of FIG. 71. FIG. 73 is a front elevation of FIG. 71. FIG. 74 is a side elevation showing the state in which a drop preventing member is turned. FIG. 75 is a front elevation of FIG. 74. FIG. 76 is a side elevation showing another mode of the suspender. FIG. 77 is a front elevation of FIG. 76. FIG. 78 is a side elevation showing the state in which the drop preventing member of FIG. 76 is turned. FIG. 79 is a front elevation of FIG. 78. FIG. 80 is a side elevation showing the state in which the suspender is mounted to the game machine.

A suspender 501 of FIG. 71 is constructed, as shown in FIG. 72, to include a rod-shaped member 502 having a circular section, and a drop preventing member 503 carried on the leading end 502*a* of the rod-shaped member 502. The drop preventing member 503 has a root end portion 504 merging into the outer circumference edge of the leading end 502*a* of the rod-shaped member 502 and is formed into a generally conical shape having a section enlarged from the root end portion 504 to the leading end portion 505. Here, the sectional shape of the rod-shaped member 502 may be a square. Likewise, the drop preventing member 503 may be a pyramid.

In the drop preventing member 503, the distance between the outer circumference edge 505*a* of the leading end portion 505 and the axis 502*c* of the rod-shaped member 502 is not fixed but takes the shortest radius r1 and the longest radius r2. Moreover, the drop preventing member 503 is fixed on the axis 502*c* of the rod-shaped member 502 by a counter sunk head screw 506.

The drop preventing member 503 takes the shortest radius r1 at its portion over the axis 502*c*, as shown in FIGS. 71 to 73, but can be given the longest radius r2 at its portion over the axis 502*c,* as shown in FIGS. 74 and 75, by loosing the screw and turning the drop preventing mamber 503 by 180 degrees, and then fastening the screw 506.

Figure 82:
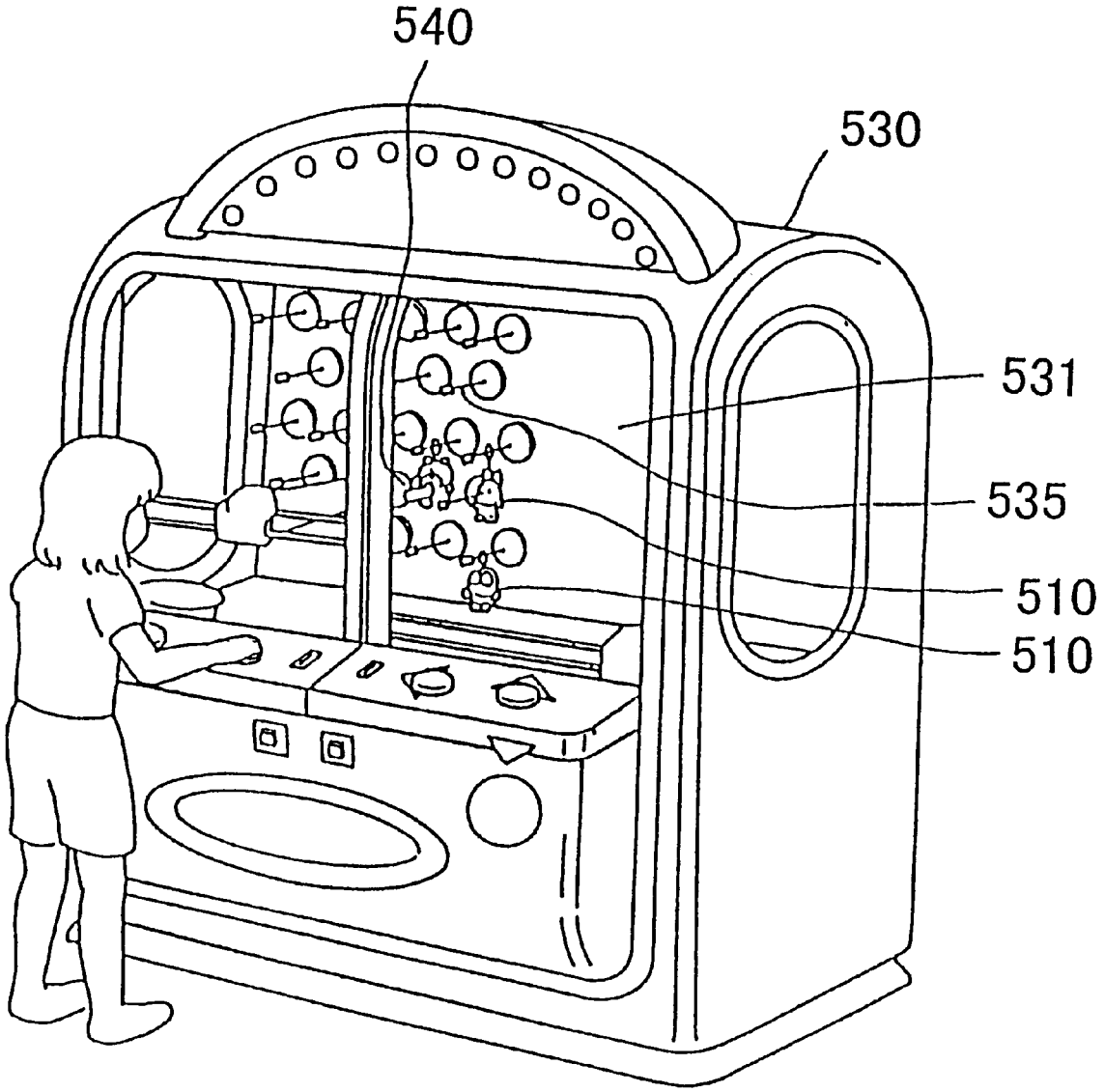
FIG. 82 is a perspective view showing the entirety of a game machine.
Figure 83:
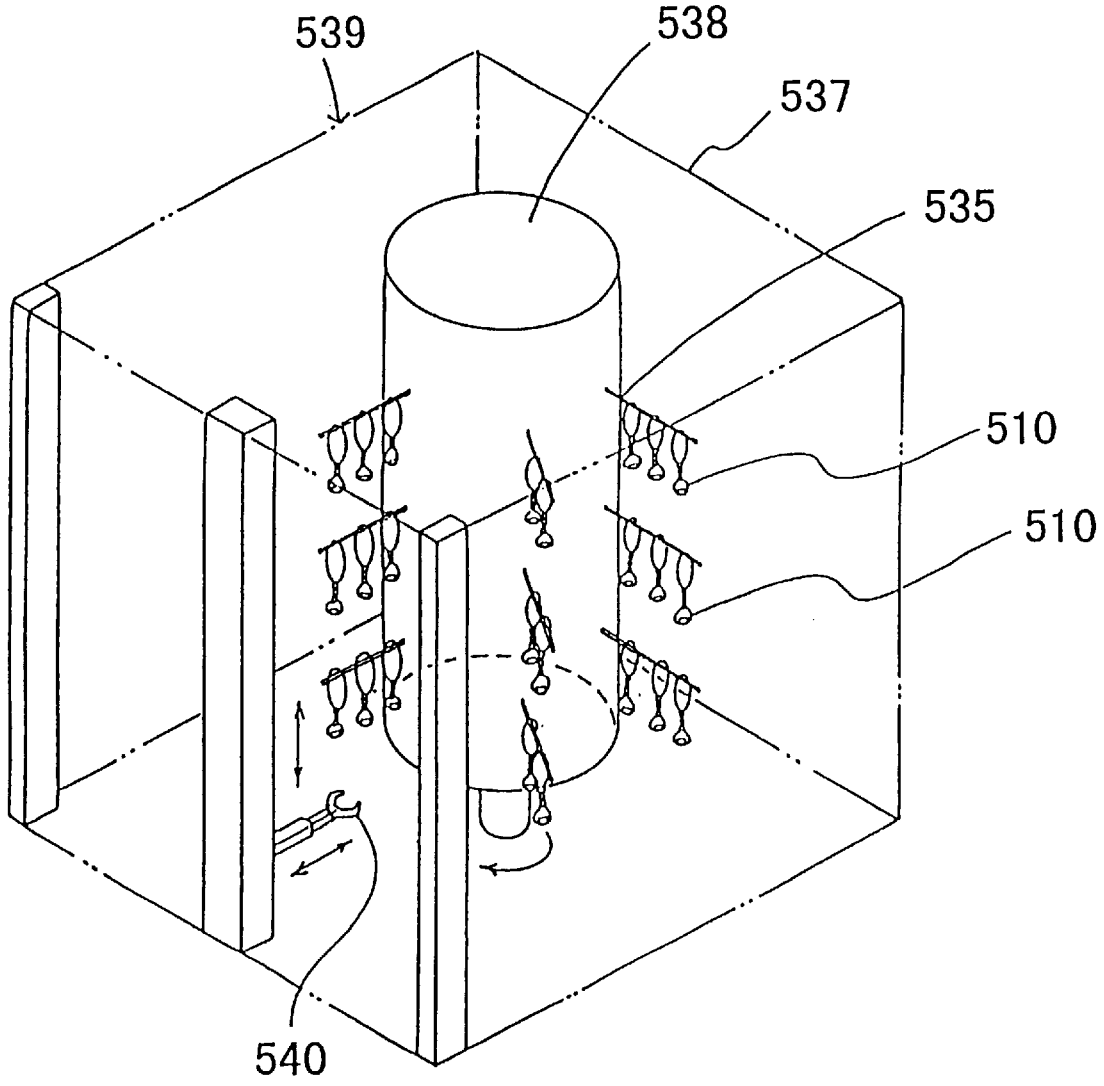
FIG. 83 is a perspective view showing the entirety of another game machine.
Figure 84:
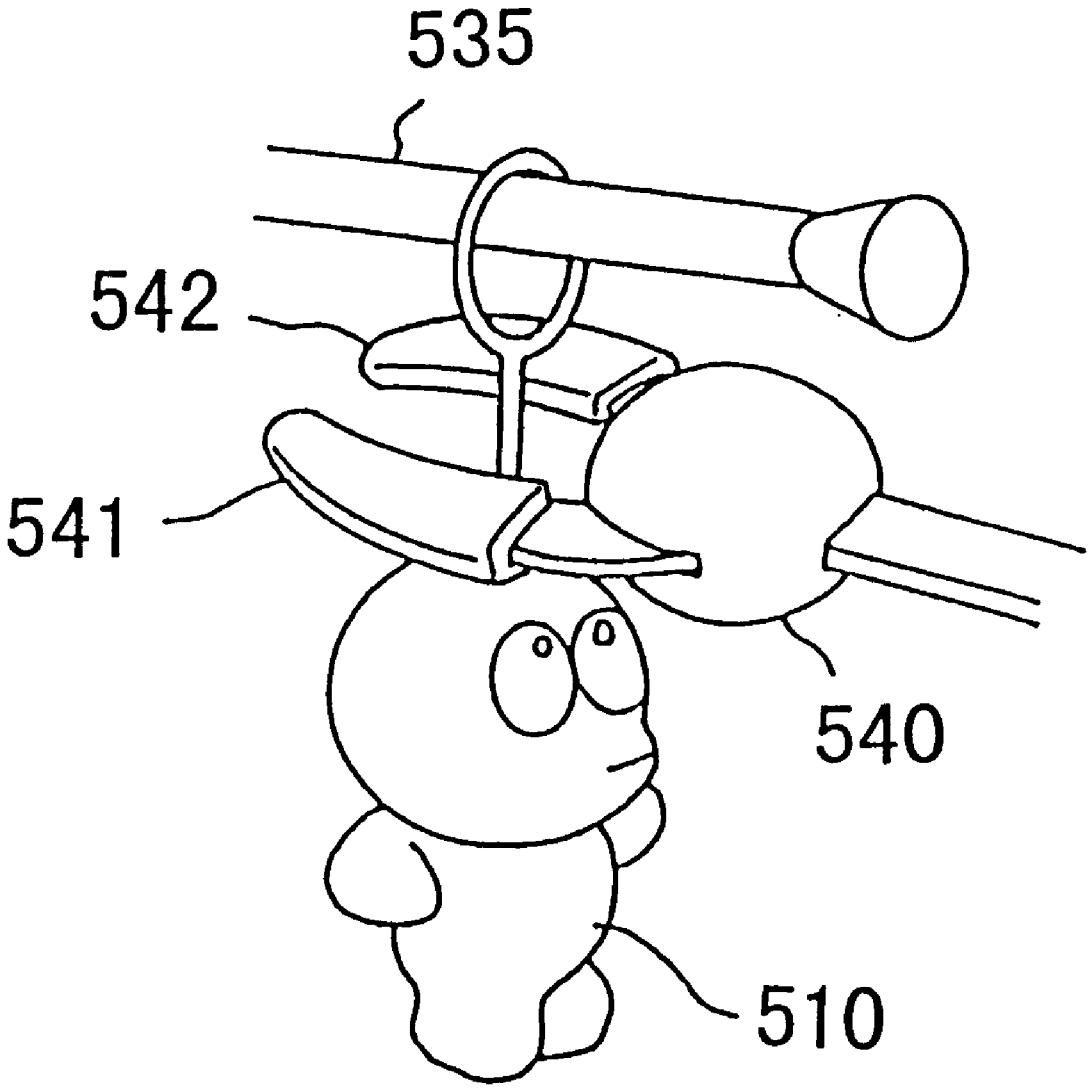
FIG. 84 is a perspective view showing a suspending device of the prior art.

The suspender 501 can be mounted directly to the rear wall 531 of a game machine 530 or 539 for taking out a suspended prize 510 by grip means 540, as shown in FIG. 82 or 83, by a mounting screw 532, as shown in FIG. 80(*a*), or can be mounted through a flange 533, as mounted to the rear wall 531 by the screws (not shown), to the rear wall 531, as shown in FIG. 80(*b*). Here, the mounting method of the suspender 501 should not be limited to the mounting screw 532 but can be exemplified merely by inserting into a pipe.

The prize 510 is composed of a prize body 511, a ring 513 and a string 512 connecting the ring 513 and the prize body 511 and is suspended from the suspender 501 by hooking the ring 513 on the suspender 501. The prize 510 is gripped and pulled out by a pair of pawl members 541 and 542 of the grip means 540 which is disposed in the game machine 530 or 539.

When the prize 510 is gripped and pulled to this side by the paired pawl members 541 and 542 of the grip means 540, the ring 513 slides. along the upper edge of the rod-shaped member 502 and the upper edge of the drop preventing member 503. When the drop preventing member 503 of the suspender 501 is located to have the shortest radius r1 at the upper side, as shown in FIG. 74, its upper edge has a gentle slope. As a result, the prize 510 can be easily taken out from the suspender 501.

When the drop preventing member 503 of the suspender 501 is located to have the longest radius r2 at the upper side, as shown in FIG. 74, its upper edge has a steep slope. As a result, the prize 510 is difficult to be taken out from the suspender 501. Thus, the suspender 501 is enabled to adjust the degree of difficulty in the take-out of the prize 510 by changing the angle of the drop preventing member 503.

A suspender 521 of FIG. 78 is composed of the aforementioned rod-shaped member 502 and a drop preventing member 523 mounted on the leading end 502*a* of the rod-shaped member 502. Thus, the drop preventing members 503 and 523 can be freely replaced according to the prize. The drop preventing member 523 has a root end portion 524 merging into the outer circumference edge of the leading end 502*a* of the rod-shaped member 502 and is formed into a generally conical shape having a section enlarged from the root end portion 524 to a leading end portion 525.

The leading end portion 525 of the drop preventing member 523 is formed into an elliptical shape although the leading end portion 505 of the aforementioned drop preventing member 503 was formed into the generally circular shape. As a result, even if the center of the drop preventing member 523 and the axis 502*c* of the rod-shaped member 502 are aligned, the distance between the outer circumference edge 525*a* of the drop preventing member 523 and the axis 502*c* of the rod-shaped member 502 is not fixed. As a result, the drop preventing member 523 is given the two shortest radii r3 and r3 and the two longest radii r4 and r4 at the outer circumference edge 525*a* of the leading end portion 525 and is fixed on the axis 502*c* of the rod-shaped member 502 by the counter sunk head screw 506.

In this drop preventing member 523, the distance between the axis 502*c* to the upper portion of the outer circumference edge 525*a* takes the shortest radius r3, as shown in FIGS. 76 and 77, but can be elongated to the largest radius r4, as shown in FIGS. 78 and 79, by loosening and turning the counter sunk head screw 506 and turning drop preventing member 525 by 90 degrees and by fastening the screw 506. The prize 510 is easily taken out along the gentle slope of the upper edge of the drop preventing member 523, when the shortest radius r3 is positioned at the upper side, but becomes difficult to come out from the steep slope of the upper edge when the longest radius r4 is positioned at the upper side.

In the foregoing embodiments, the rod-shaped member 502 and the drop preventing member 503 (523) were made separate from each other but could be made integral. In this modification, the gradient of the slope of the drop preventing member 503 (523) can be changed by loosening the mounting screw 532 (as shown in FIG. 80) from the rear wall 531 of the game machine 530, by turning the rod-shaped member 502 itself to adjust the angle of the drop preventing member 503 (523), and by tightening the mounting screw 532.

Figure 81:
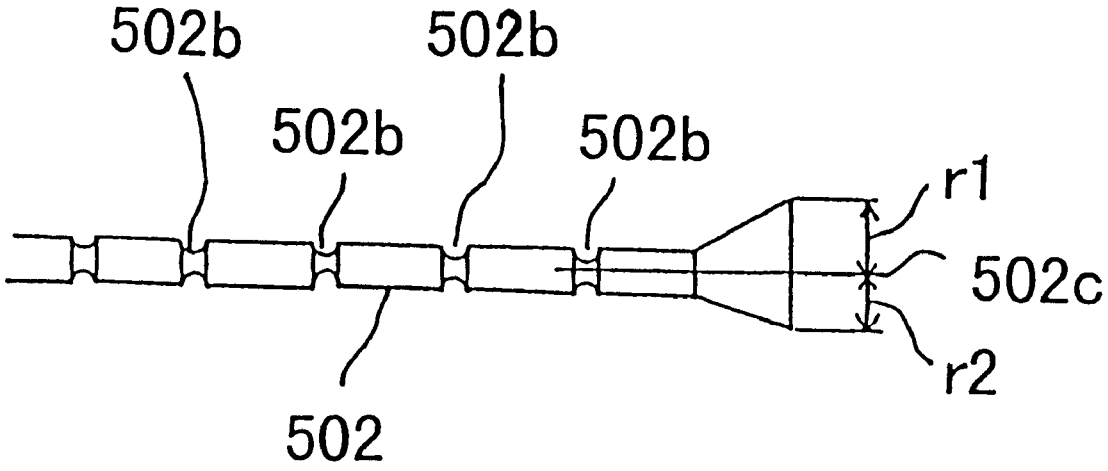
FIG. 81 is a side elevation showing another mode of the suspending device.

If grooves 502*b* are formed at a predetermined axial interval around the rod-shaped member 502, as shown in FIG. 81, the rings 513 of the prizes 510 can be hooked in the grooves 502*b* so that they can be suspended at the predetermined interval.

The suspender 501 or 521 is not constant in the distance between the leading end outer circumference edge 505*a* or 525*a* of the drop preventing member 503 or 523 and the general axis 502*c* of the rod-shaped member 502. By turning the drop preventing member 503 or 523, therefore, its upper edge slope can be changed to change the degree of difficulty in the acquisition of the prize 510 suspended. If this suspender 501 or 521 is used, a game machine can be provided separately for the skilled player and the beginner. Moreover, the degree of difficulty in the prize acquisition can be raised for a prize 510 easy to grip for the grip means 540 by increasing the slope gradient of the upper edge of the drop preventing member 503 or 523 and can be lowered for a prize 510 difficult to grip for the grip means 540 by decreasing the slope gradient of the upper edge of the drop preventing member 503 or 523, thereby to average the prize acquisition factor as a whole.

If the rod-shaped member 502 and the drop preventing member 503 or 523 are made integral in the suspender 501 or 521, the slope gradient of the upper edge of the drop preventing member 503 or 523 can be changed by turning the rod-shaped member 502.

If the rod-shaped member 502 and the drop preventing member 503 or 523 are made separate in the suspender 501 or 521, the slope gradient of the upper edge of the drop preventing member 503 or 523 can be changed by moving the drop preventing member 503 or 523 only.

In the suspender 501 or 521, the drop preventing member 503 or 523 is so mounted to the rod-shaped member 502 as to turn on the general axis 502*c* of the rod-shaped member 502. By turning the drop preventing member 503 or 523 only, therefore, the slope gradient of the upper edge of the drop preventing member 503 or 523 can be changed.

If the suspender 501 or 521 has the rod-shaped member 502 and the drop preventing member 503 or 523 made integral and if the rod-shaped member 502 is turnably mounted on one side of the game machine 530 or on one side of a turnable member 538, the rod-shaped member 502 can be easily turned to adjust the gradient slope of the upper edge of the drop preventing member 503 or 523 easily.

Figure 85:
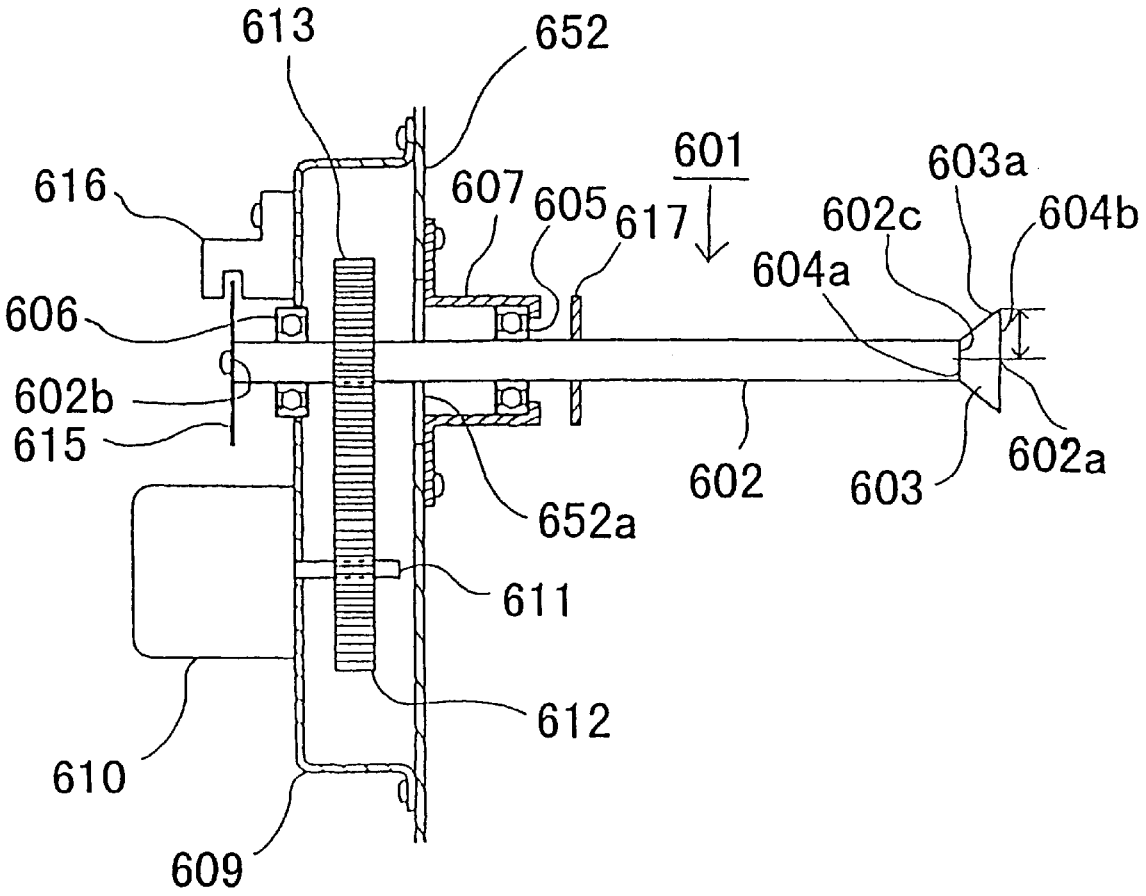
FIG. 85 is a side elevation showing one mode of a prize suspending device according to the present invention.
Figure 86:
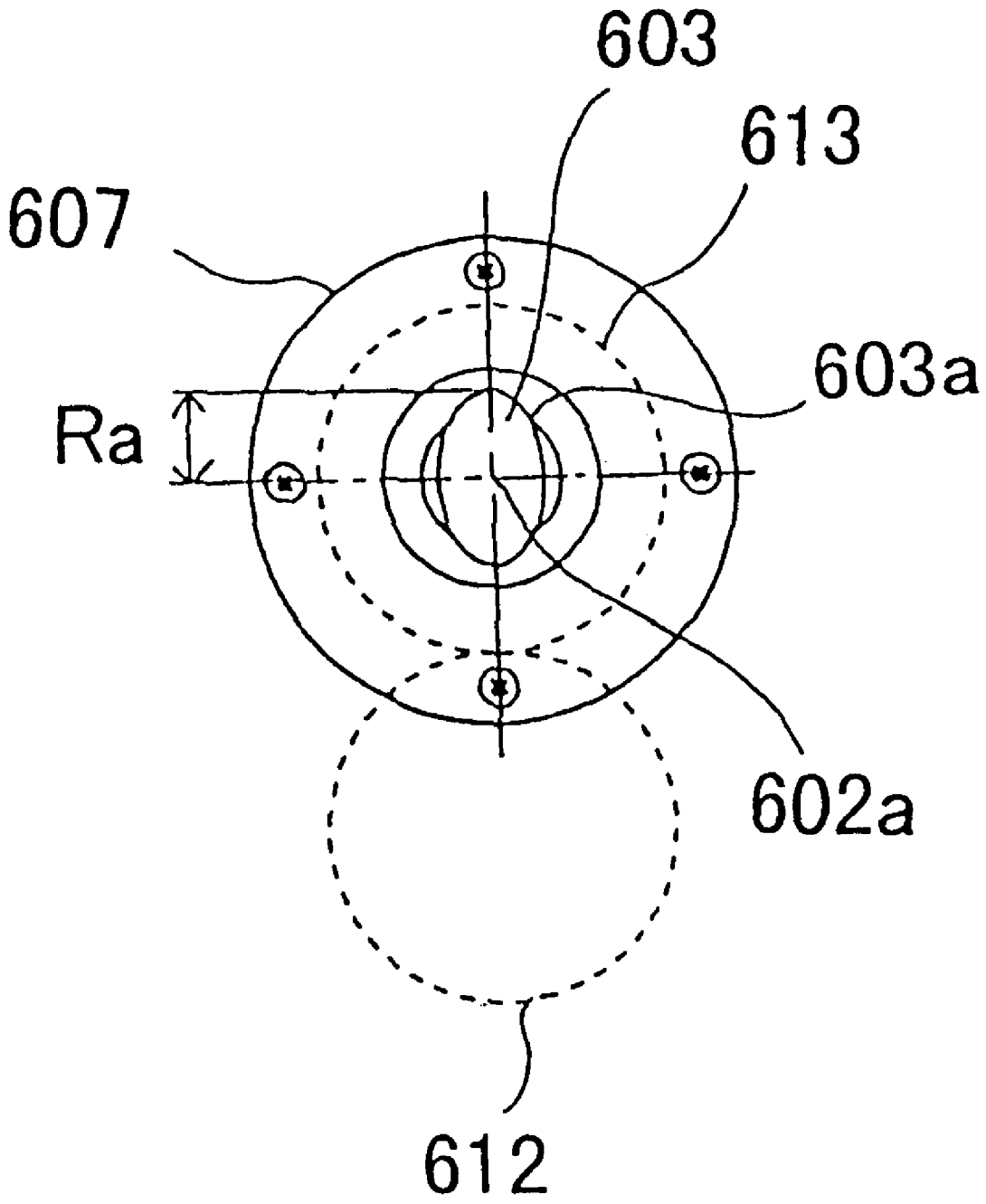
FIG. 86 is a front elevation of FIG. 85.

One embodiment of the invention according to claims 45 to 53 will be described with reference to the accompanying drawings. FIG. 85 is a side elevation showing one mode of a prize suspender. FIG. 86 is a front elevation of FIG. 85.

Figure 87:
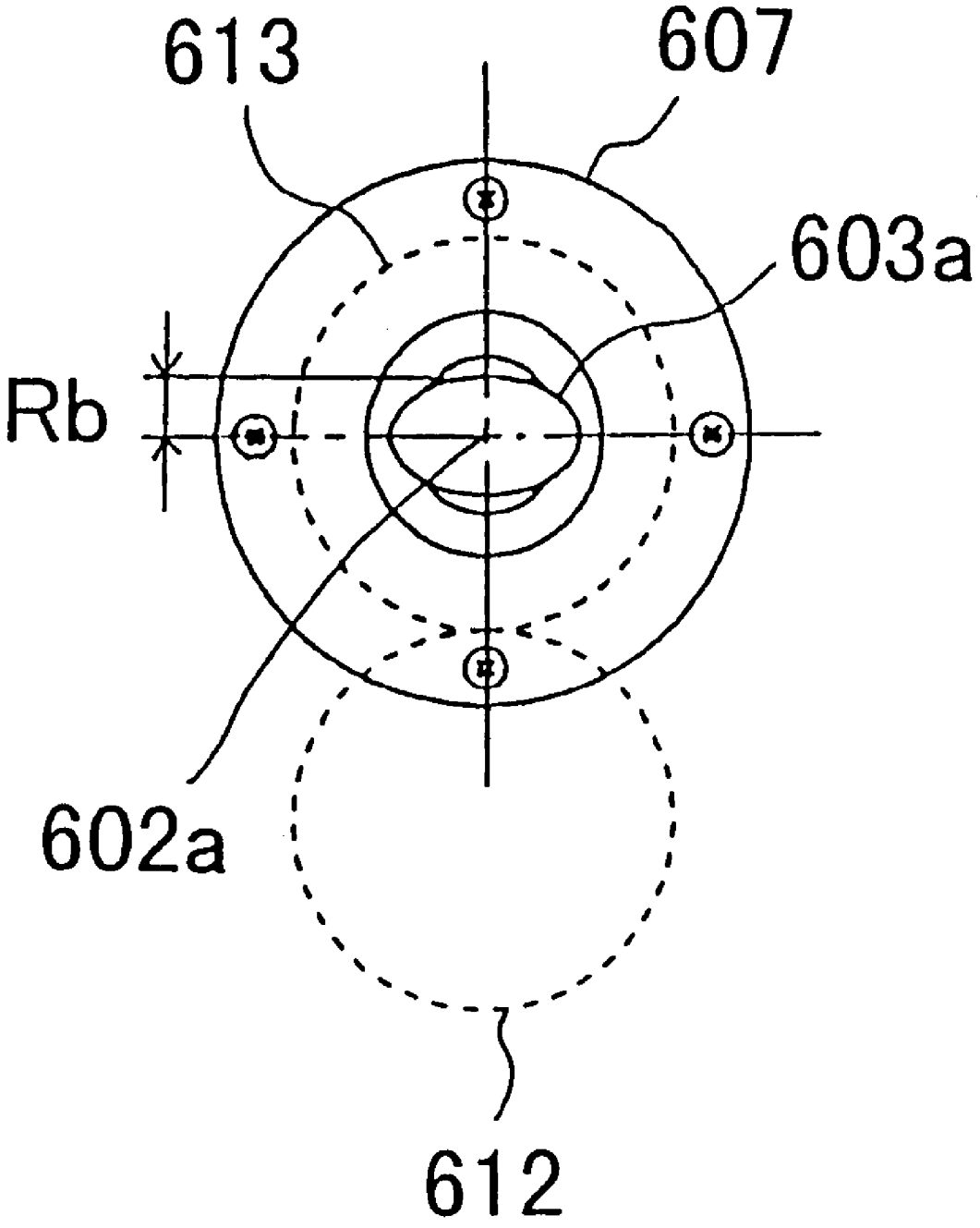
FIG. 87 is a front elevation showing the state in which the drop preventing member of FIG. 85 is turned by 90 degrees.
Figure 88:
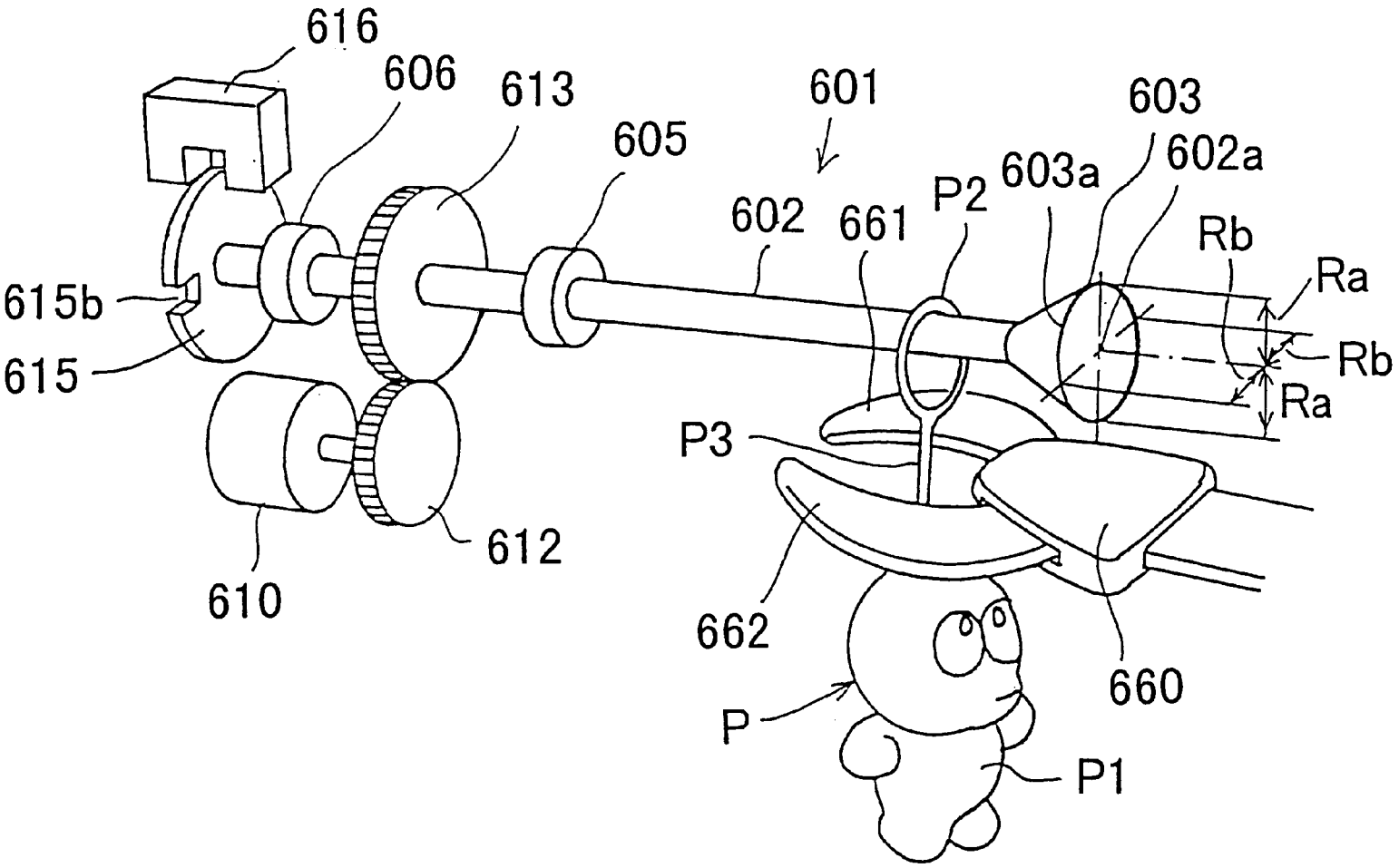
FIG. 88 is a schematic perspective view showing the prize suspending device of FIG. 85.
Figure 126:
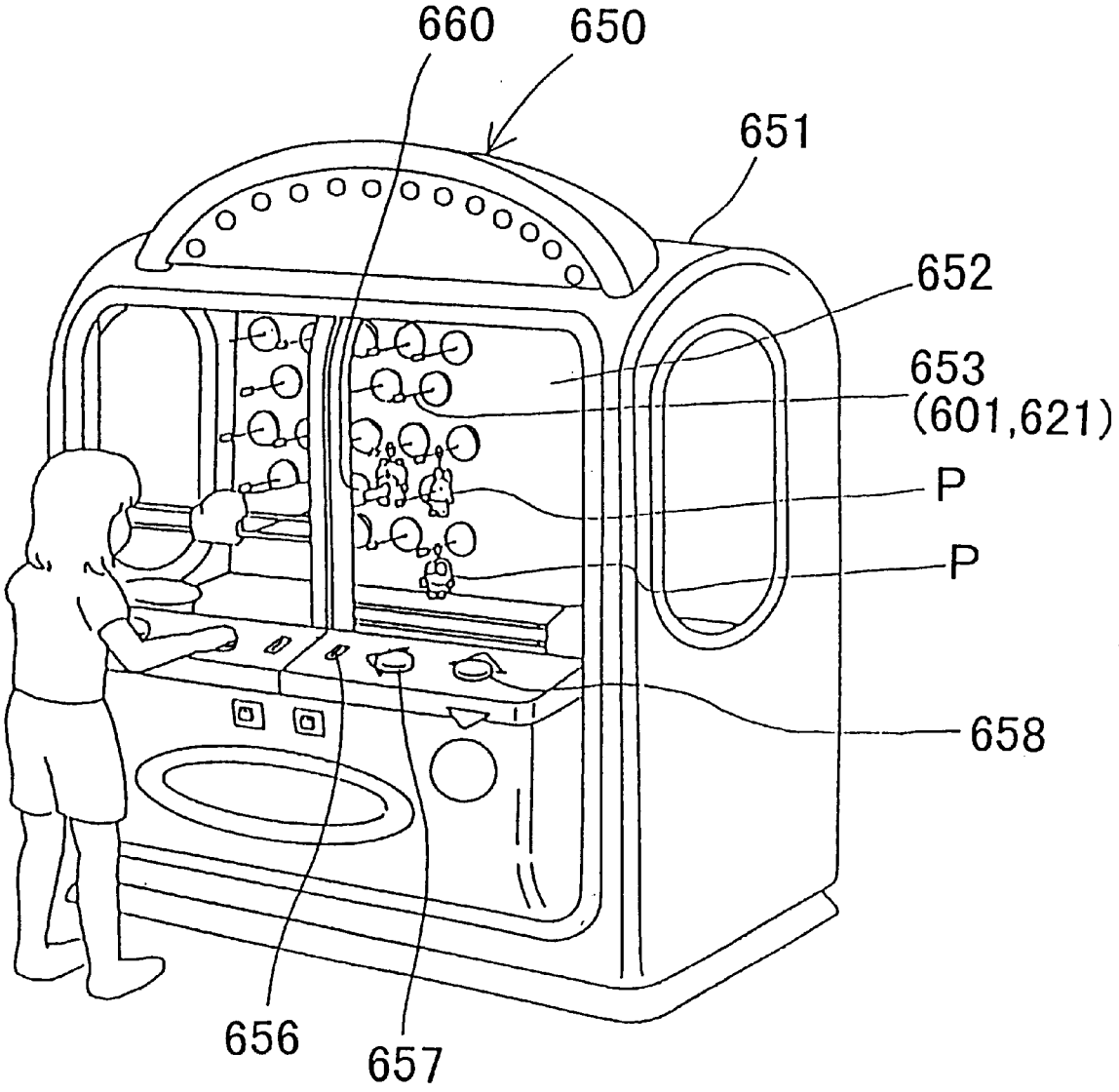
Figure 127:
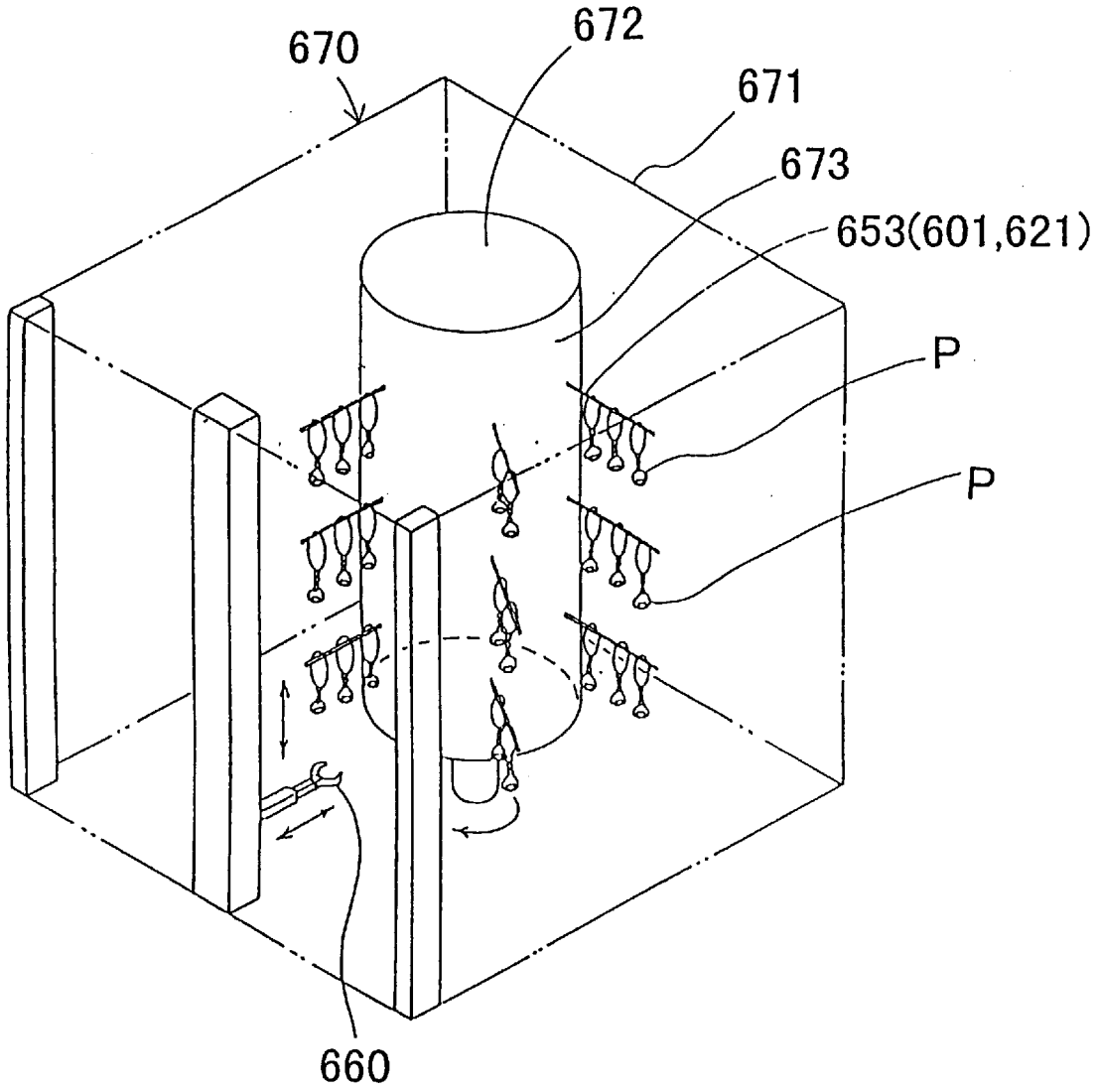
Figure 128:
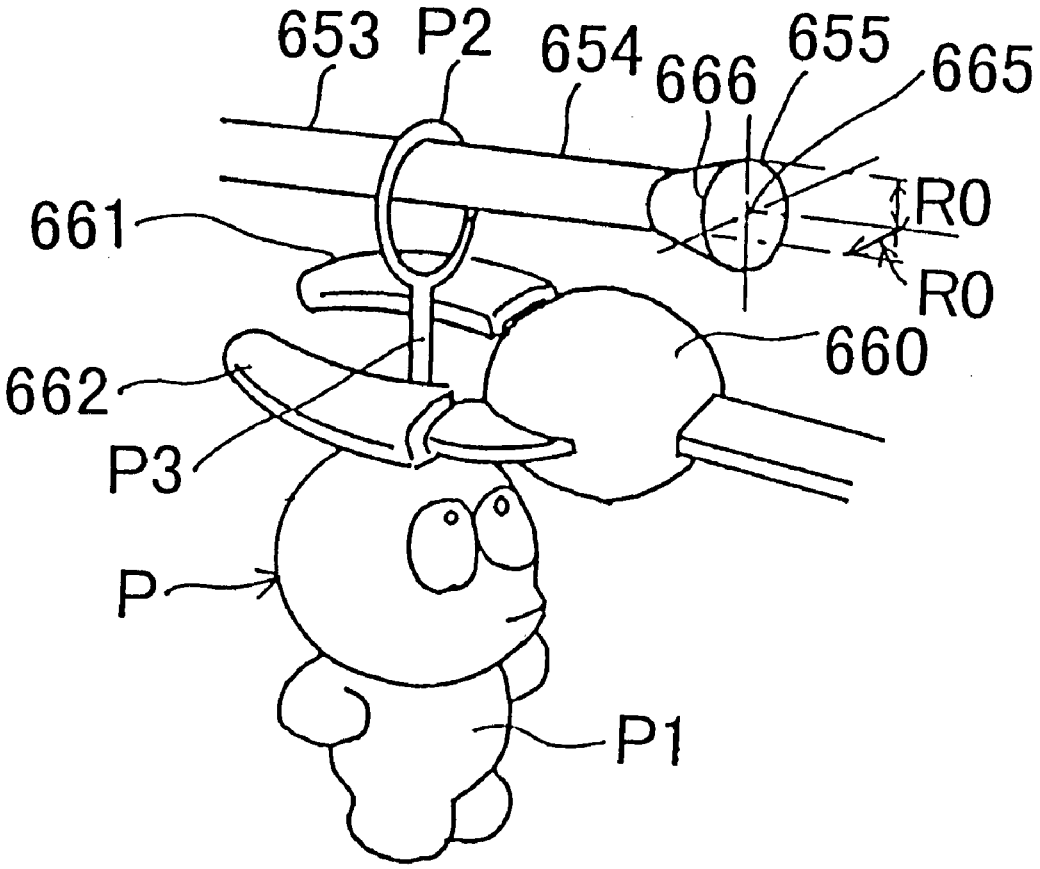

FIG. 87 is a front elevation for explaining the actions of FIG. 86. FIG. 88 is a schematic perspective view showing the prize suspender of FIG. 85. FIG. 126 is a schematic perspective view showing one mode of a conventional prize acquisition game machine 650 of the prior art. FIG. 127 is a schematic perspective view showing another mode of a conventional conventional prize acquisition game machine 670 of the prior art.

A prize suspender 601, as disposed in a game machine body 651 of the prize acquisition game machine 650 shown in FIG. 126 for suspending prizes P, is constructed to comprise a rod-shaped member 602 mounted at its rear portion to one side of the game machine body 651, and a drop preventing member 603 mounted on the leading portion of the rod-shaped member 602. The drop preventing member 603 is so fixed on the rod-shaped member 602 that the distance R between an outer circumference edge 603*a* and the general axis 602*a* of the rod-shaped member 602 may not be fixed to a constant value. The game machine body 651 is provided with drive means 610, 612 and 613 for turning the rod-shaped member 602 on the general axis 602*a*.

The prize suspender 601 thus constructed is disposed in the game machine body 651, and the prize P is suspended from the rod-shaped member 602. When the drive means 610, 612 and 613 are activated, the rod-shaped member 602 and the drop preventing member 603 are turned. The prize acquisition game machine 650 is activated by inserting a coin into a coin insertion slot 656, and a transverse play switch 657 and a vertical play switch 658 are depressed. Then, prize gripping means 660 is moved to a desired height and then automatically moved forward to the vicinity of the prize P.

Next, a pair of pawl members 661 and 662 are automatically closed to grip a prize body P1 and restores its original position while being closed. When the prize body P1 is gripped and pulled to this side by the paired pawl members 661 and 662 of the grip means 660, a ring P2 is slid along the upper edge of the rod-shaped member 602 and the upper edge of the drop preventing member 603. The distance R from the axis 602*a* of the rod-shaped member 602 to the upper edge of the drop preventing member 603 changes so that the prize P can be easily removed from the prize suspender 601 when the distance R is short. When the distance from the axis 602*a* of the rod-shaped member 602 to the upper edge of the drop preventing member 603 is long, however, the prize P cannot be easily removed from the prize suspender 601.

The prize suspender 601 can be mounted on one side of a turnable member 672 which is turnably disposed in a game machine body 671 of the prize acquisition game machine 670, as shown in FIG. 127. Thus, the prize suspender 601 is turned by the turnable member 672, and the drop preventing member 603 is also turned, as described above. This makes it difficult to acquire the prize P so that the prize acquisition game machine 670 can provide a remarkably interesting game.

Figure 89:
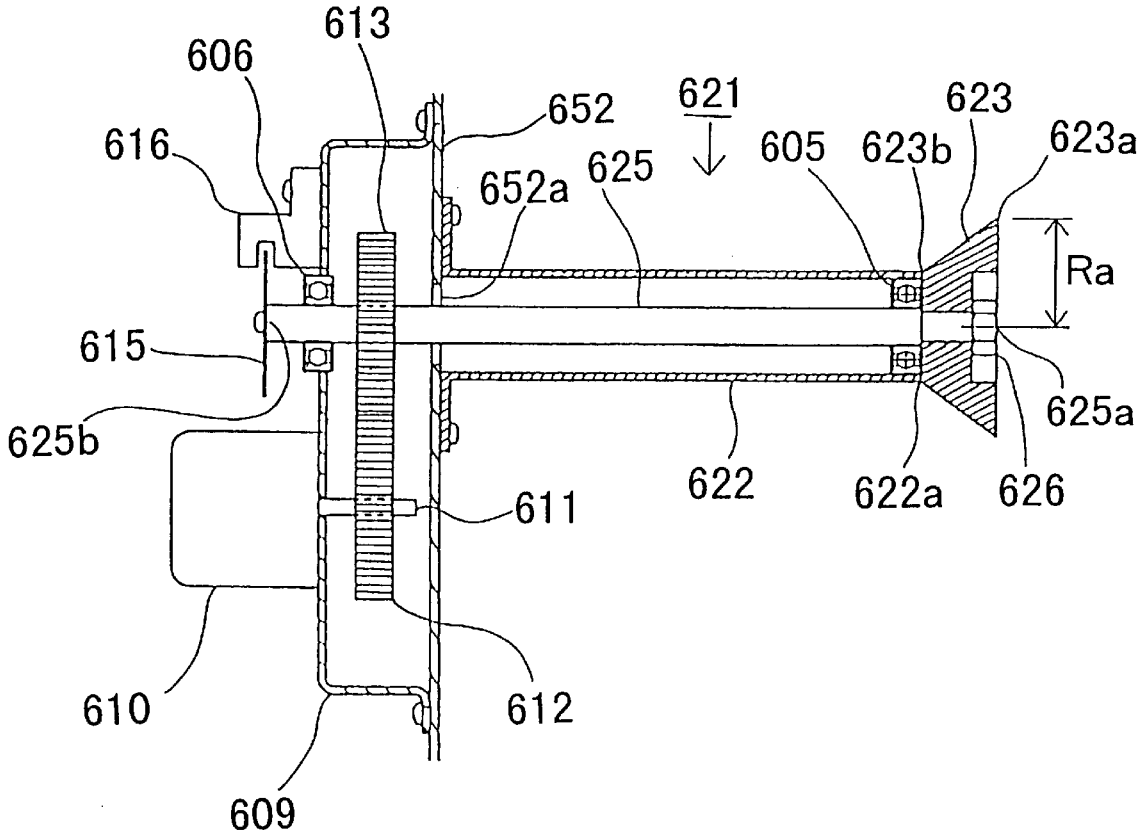
FIG. 89 is a side elevation showing another mode of the prize suspending device.
Figure 90:
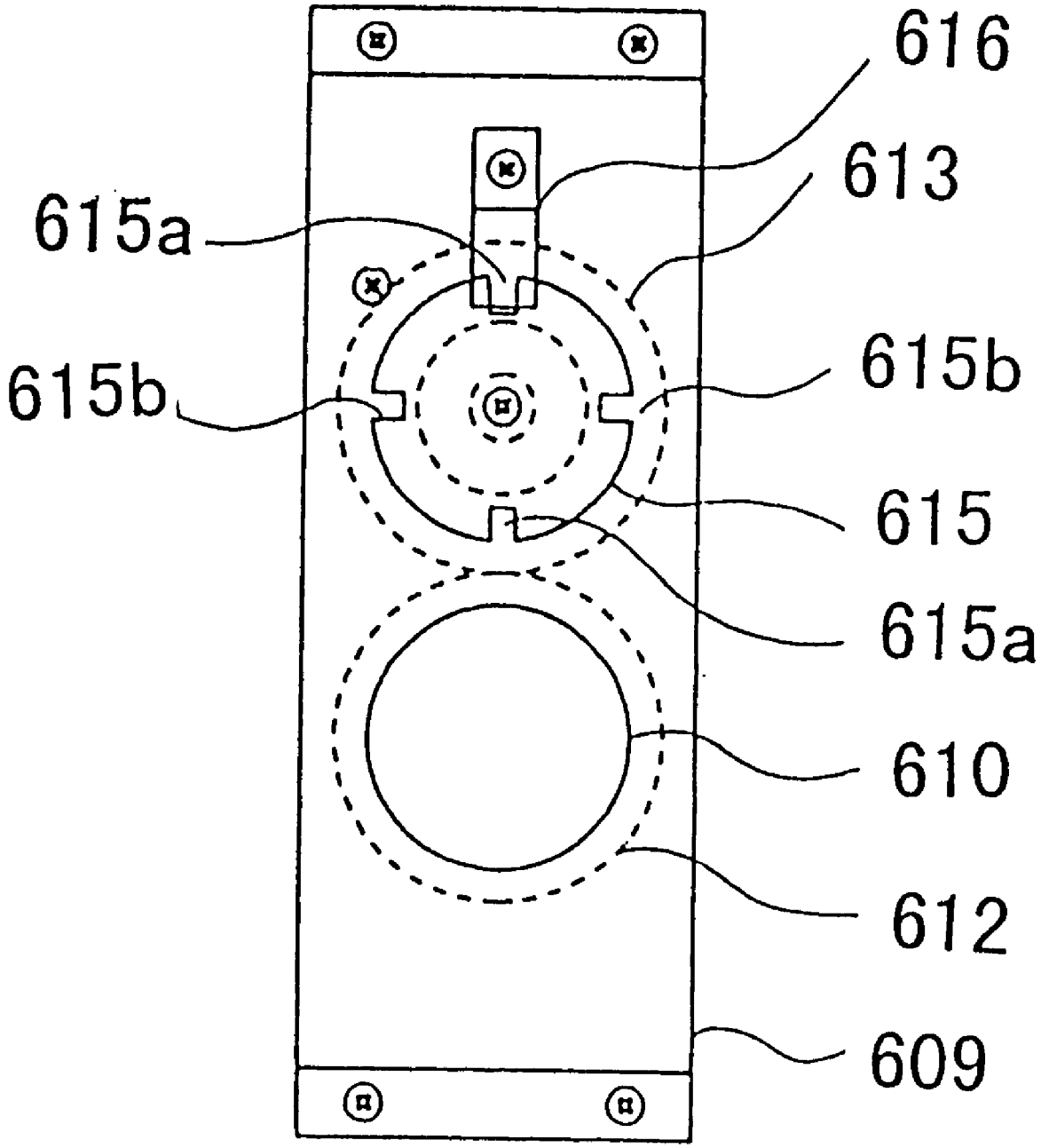
FIG. 90 is a back elevation of FIG. 89.
Figure 91:
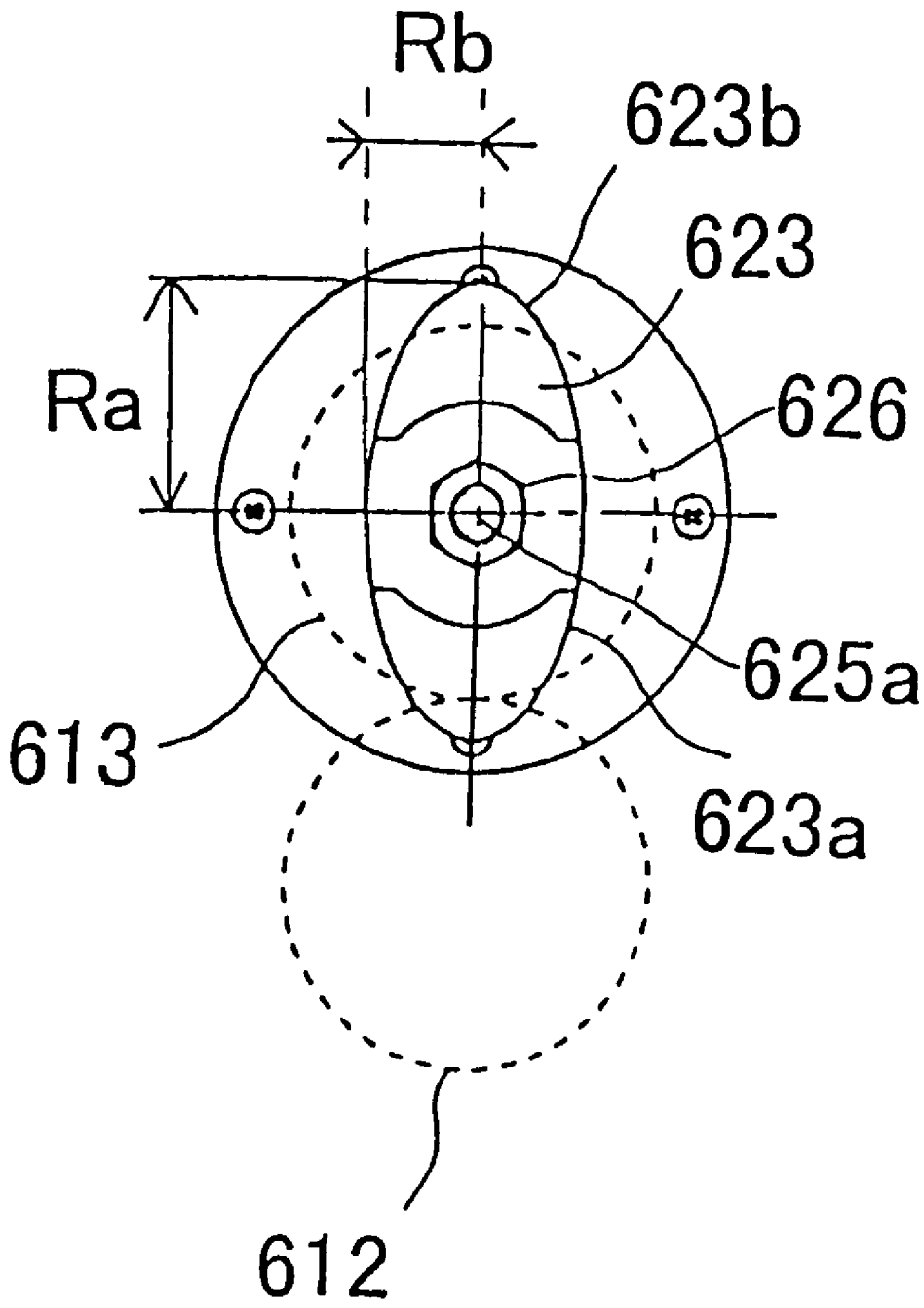
FIG. 91 is a front elevation of FIG. 89.
Figure 92:
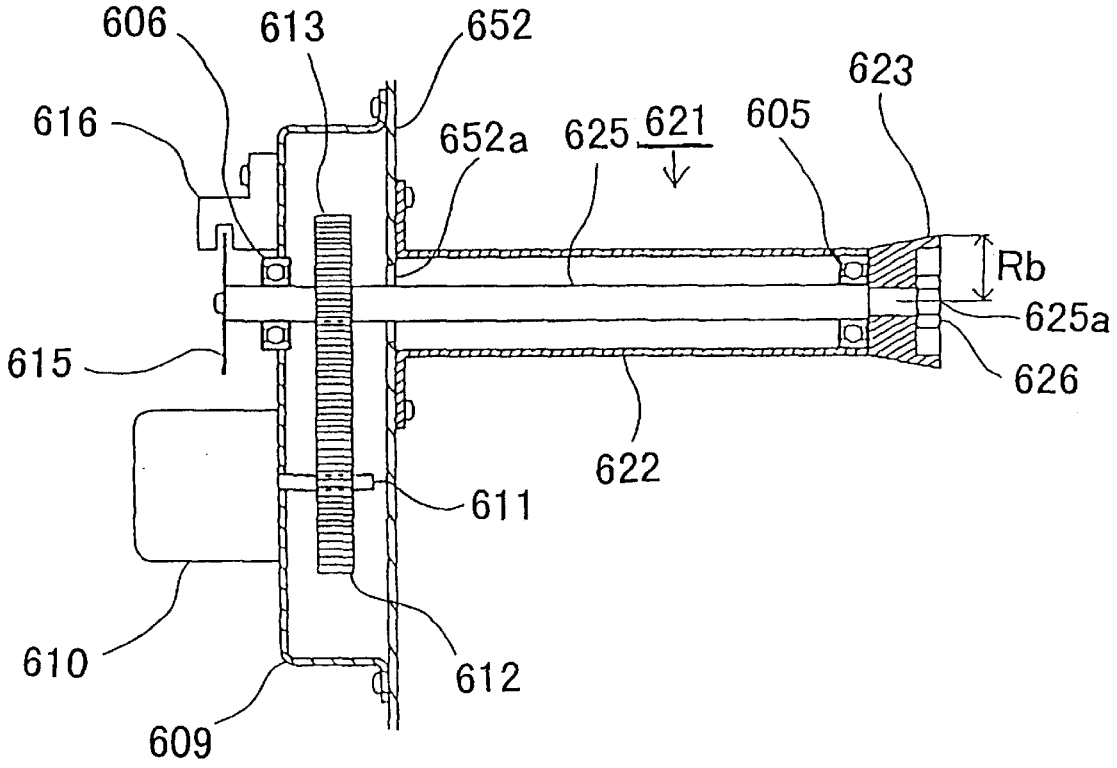
FIG. 92 is a side elevation showing the state in which the drop preventing member of FIG. 89 is turned by 90 degrees.
Figure 93:
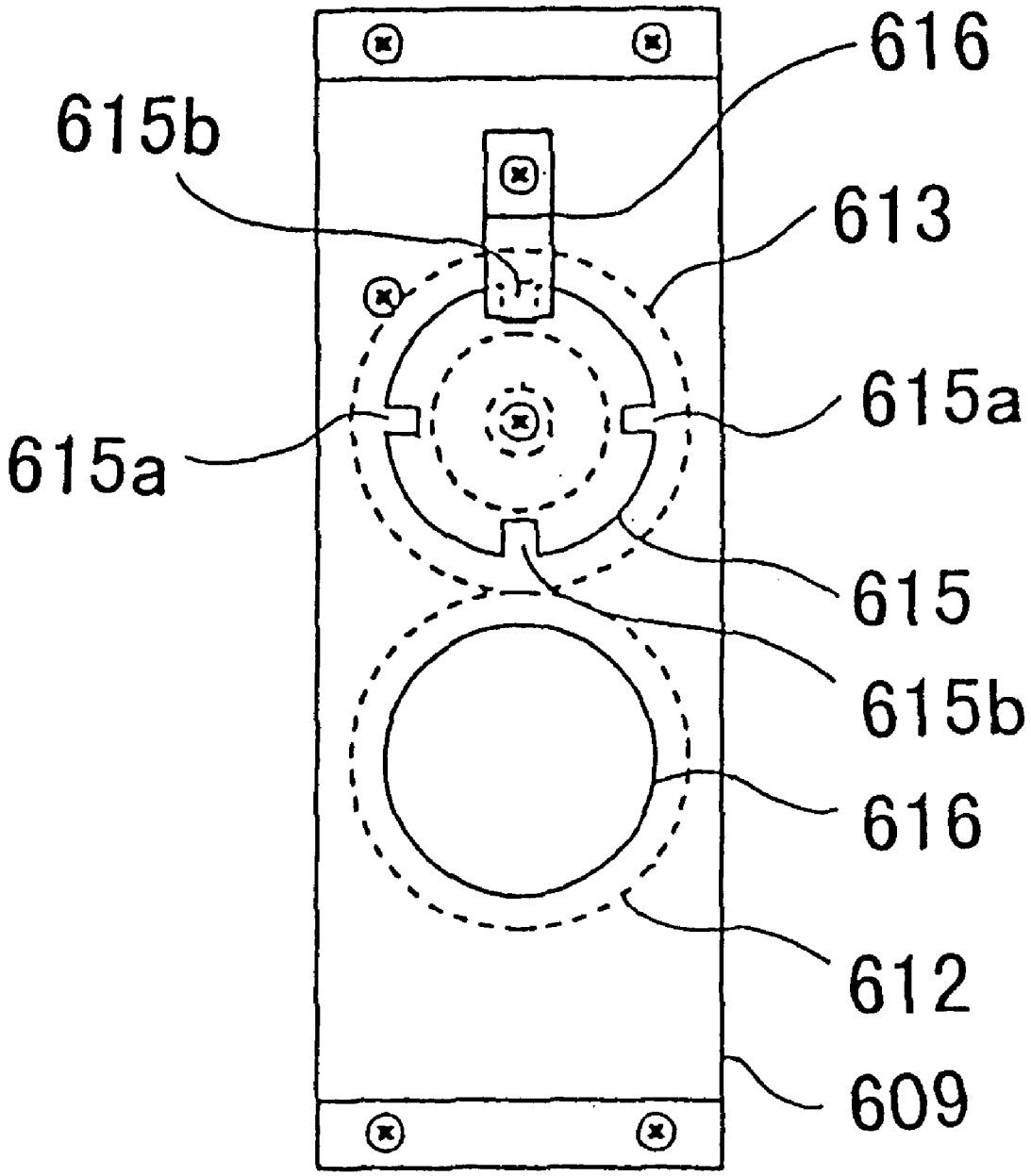
FIG. 93 is a back elevation of FIG. 92.
Figure 94:
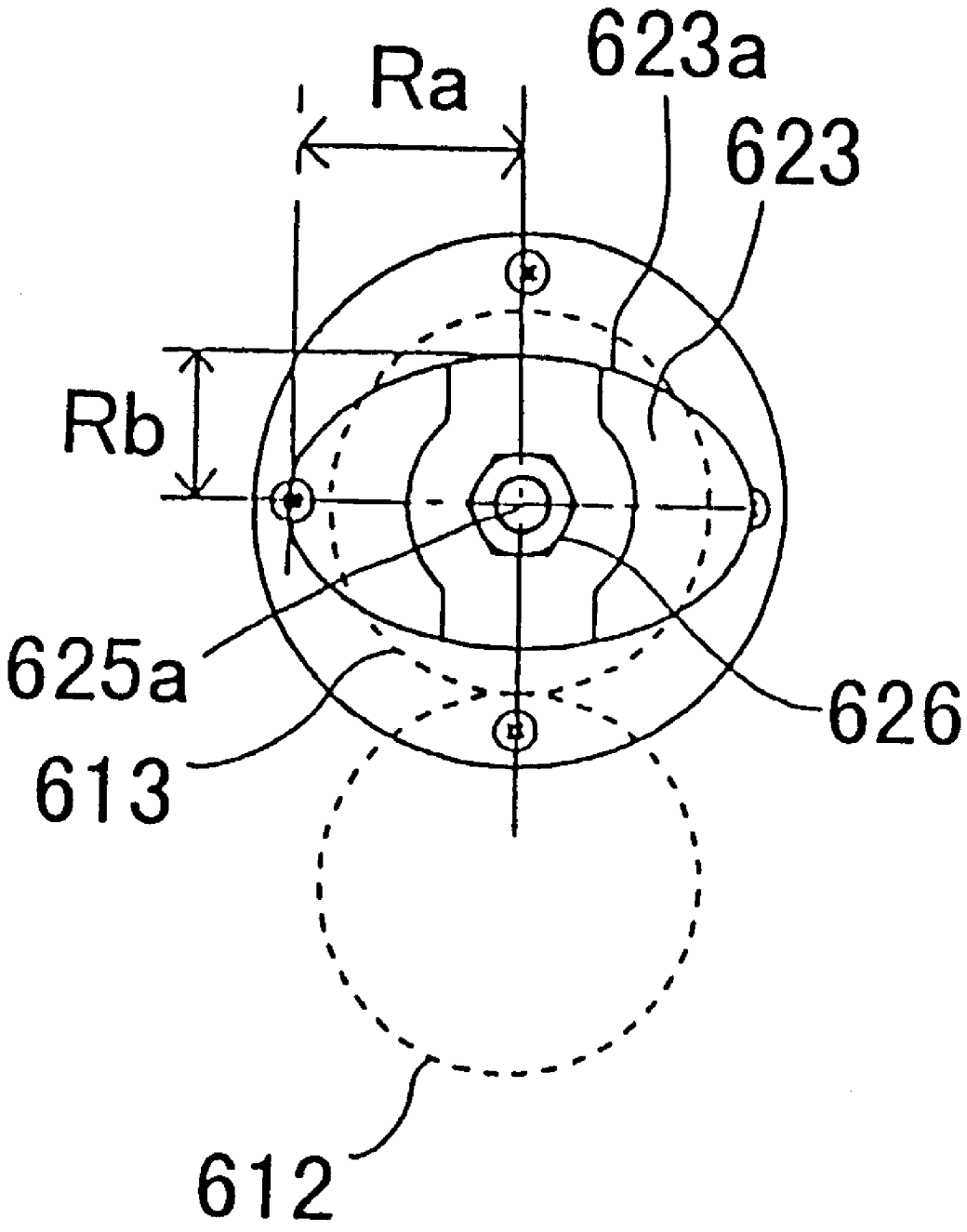
FIG. 94 is a front elevation of FIG. 92.

Another embodiment of the invention will be described with reference to the accompanying drawings. FIG. 89 is a side elevation showing another mode of the prize suspender. FIG. 90 is a back elevation of FIG. 89. FIG. 91 is a front elevation of FIG. 89. FIG. 92 is a side elevation showing the state in which the drop preventing member of FIG. 89 is turned by 90 degrees. FIG. 93 is a back elevation of FIG. 92. FIG. 94 is a front elevation of FIG. 92.

A prize suspender 621, as disposed in the game machine body 651 of the prize acquisition game machine 650 shown in FIG. 126 for suspending a prize P, is constructed to include a suspending member 622 mounted at its rear portion to one side of the game machine body 651 for suspending the prize P, a drop preventing member 623 mounted at the leading end of the suspending member 622, and a turning shaft 625 for turning the drop preventing member 623. This drop preventing member 623 is so fixed on the turning shaft 625 that the distance between the outer circumference edge 623*a* and the general axis 625*a* of the turning shaft 625 may not be fixed to a constant value. The game machine body 651 is provided with the drive means 610, 612 and 613 for turning the turning shaft 625 on the general axis 625*a*.

The prize suspender 621 thus constructed is disposed in the game machine body 651, and the prize P is suspended from the suspending member 622. When the drive means 610, 612 and 613 are activated, the turning shaft 625 and the drop preventing member 623 are turned. When the prize acquisition game machine 650 is operated as described above, the paired pawl members 661 and 662 of the prize gripping means 60 are automatically closed to grip the prize body P1.

When the prize body P1 is gripped and pulled to this side by the paired pawl members 661 and 662 of the grip means 660, the ring P2 is slid along the upper edge of the suspending member 622 and the upper edge of the drop preventing member 603. The distance from the general axis 625*a* of the turning shaft 625 to the upper edge of the drop preventing member 623 changes so that the prize P can be easily removed from the prize suspender 621 when the distance is short. When the distance from the general axis 625*a* of the turning shaft 625 to the upper edge of the drop preventing member 623 is long, however, the prize P cannot be easily removed from the prize suspender 601. Here, the prize P cannot be transversely swung because it is suspended from the suspending member 622 standing still.

The prize suspender 621 can be mounted on one side of the turnable member 672 which is turnably disposed in the game machine body 671 of the prize acquisition game machine 670, as shown in FIG. 127. Thus, not only the prize suspender 621 but also the drop preventing member 623 is turned by the turnable member 672. This makes it difficult to acquire the prize P so that the prize acquisition game machine 670 can provide a remarkably interesting game.

Figure 95:
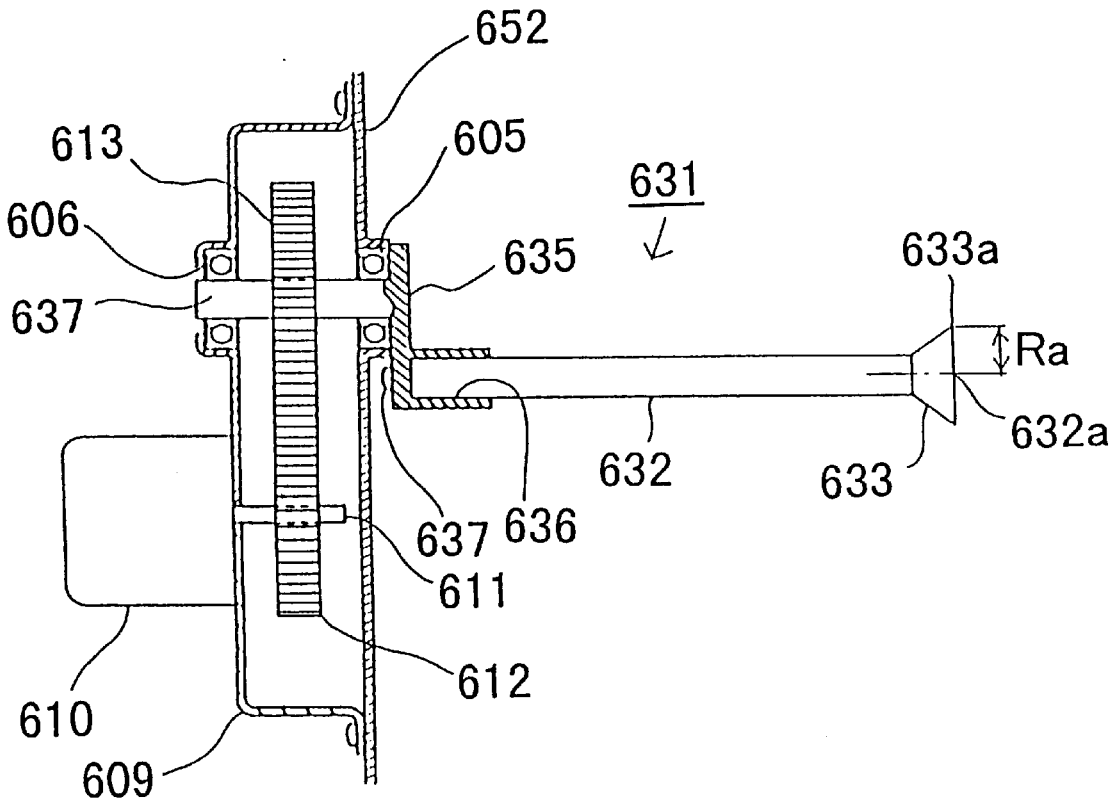
FIG. 95 is a side elevation showing another mode of the drop preventing member of the prize suspending device.
Figure 96:
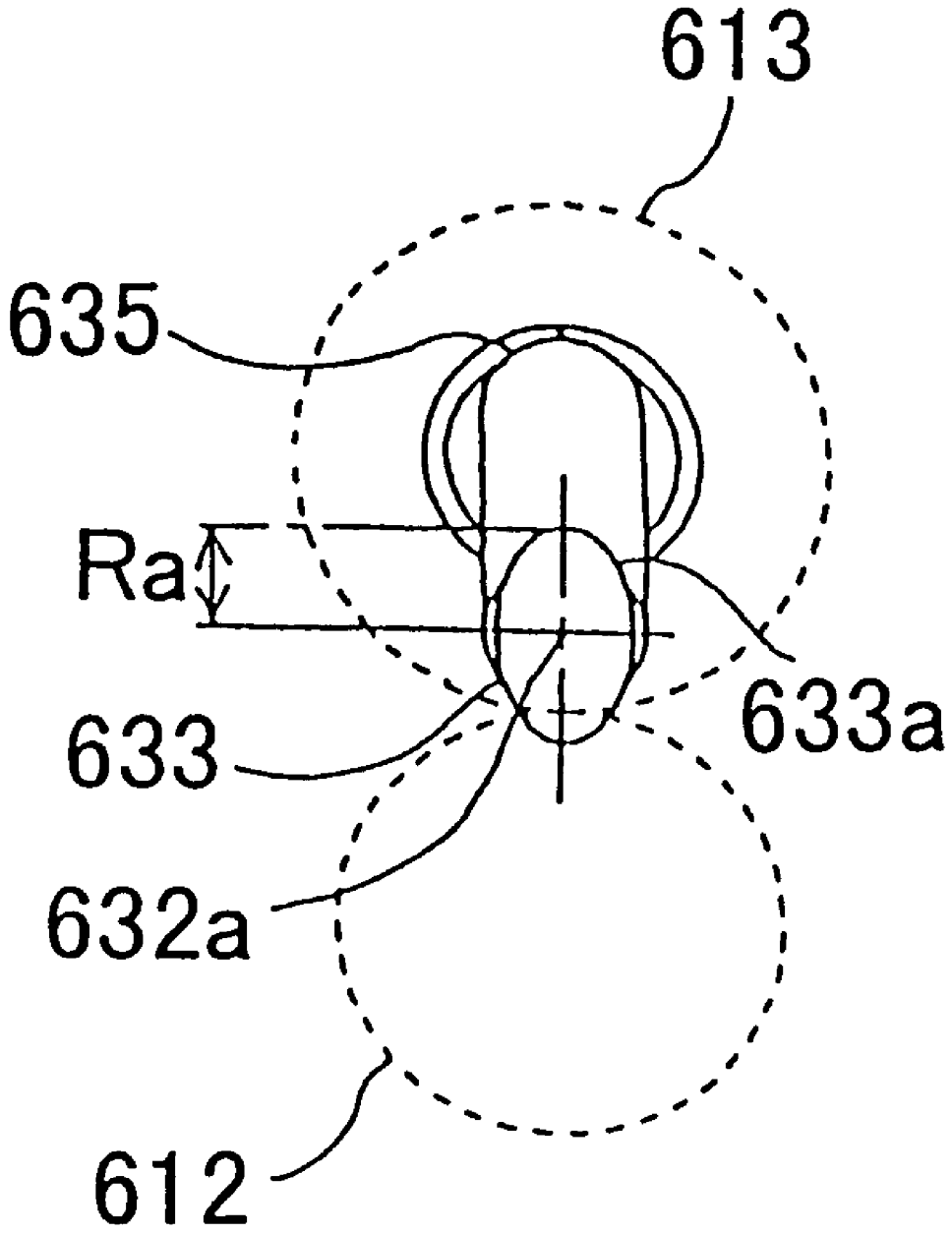
FIG. 96 is a front elevation of FIG. 95.
Figure 97:
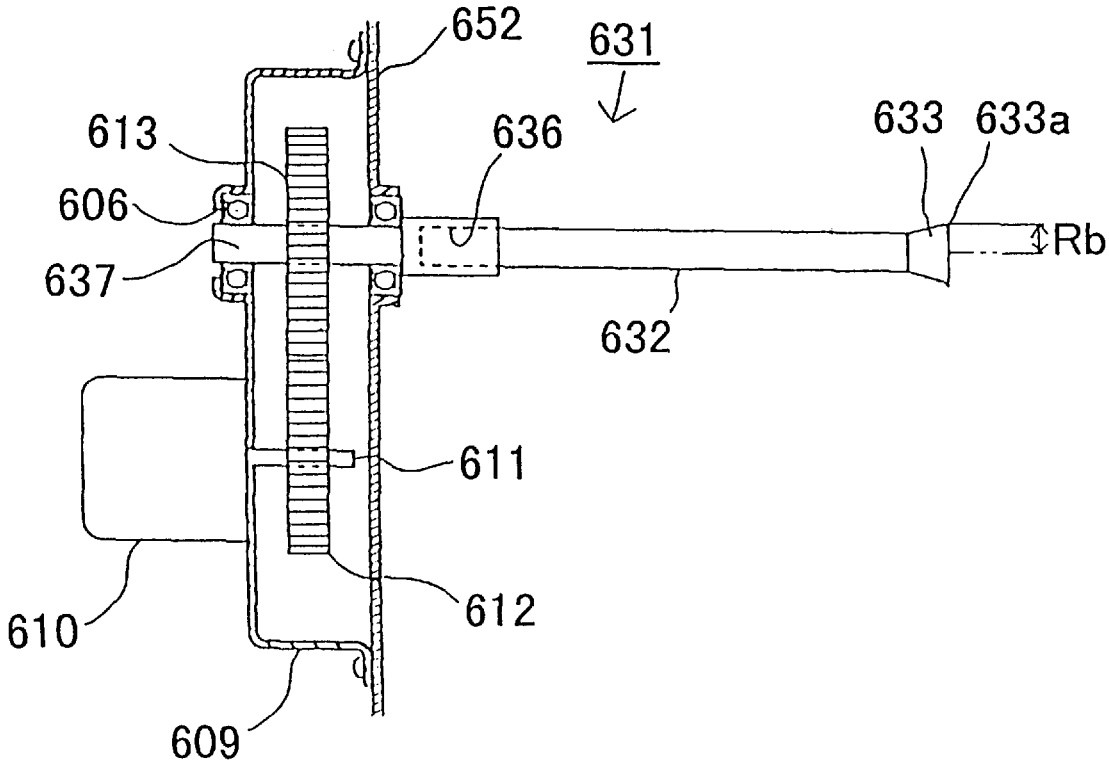
FIG. 97 is a side elevation showing the state in which the drop preventing member of FIG. 95 is turned by 90 degrees.
Figure 98:
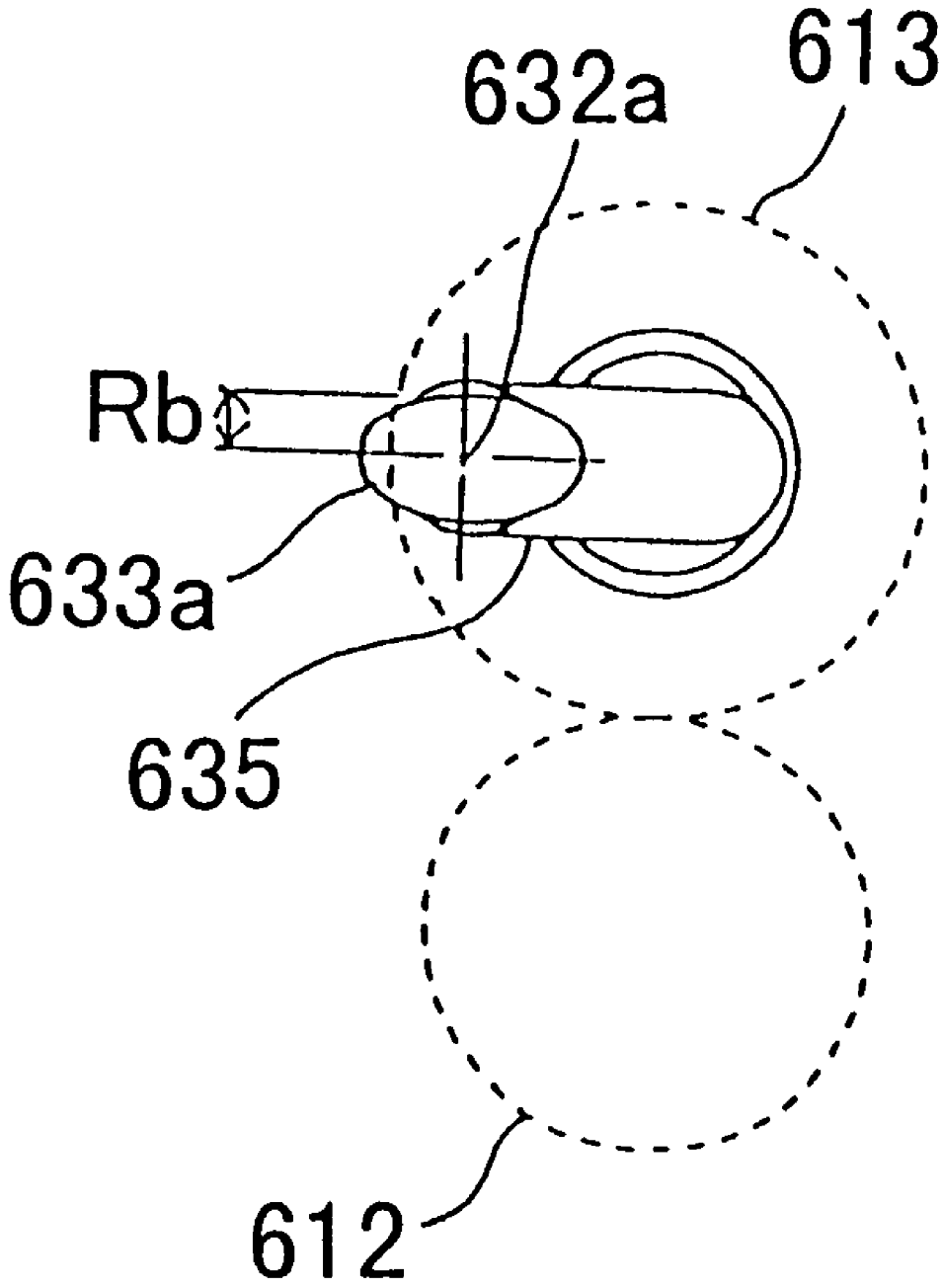
FIG. 98 is front elevation of FIG. 97.
Figure 99:
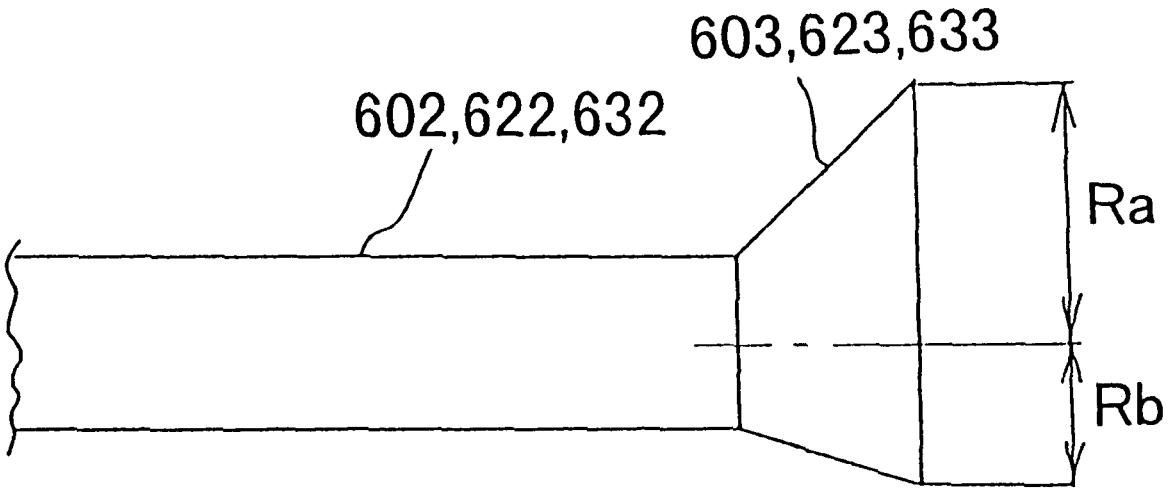
FIG. 99 is a side elevation showing another mode of the drop preventing member of the prize suspending device.

Another embodiment of the invention will be described with reference to the accompanying drawings. FIG. 95 is a side elevation showing another mode of the prize suspender. FIG. 96 is a front elevation of FIG. 95. FIG. 97 is a side elevation showing the state in which the drop preventing member is turned by 90 degrees. FIG. 98 is a front elevation of FIG. 97.

A prize suspender 631, as disposed in a game machine body 651 of the prize acquisition game machine 650 shown in FIG. 126 for suspending prizes P, is constructed to comprise a rod-shaped member 632 mounted at its rear portion to one side of the game machine body 651, and a drop preventing member 633 mounted on the leading portion of the rod-shaped member 632. The drop preventing member 633 is so fixed on the rod-shaped member 632 that the distance between an outer circumference edge 633*a* and the general axis 632*a* of the rod-shaped member 632 may not be fixed to a constant value. The game machine body 651 is constructed to comprise a turning arm 635 for turning the rod-shaped member 632, and drive means 610, 612, 613 and 637 for turning the turning arm 635.

The prize suspender 631 thus constructed is disposed in the game machine body 651, and the prize P is suspended from the rod-shaped member 632. When the drive means 610, 612, 613 and 637 are activated, the turning arm 635 is turned to rotate the rod-shaped member 632. The drop preventing member 633 is mounted on the leading portion of the rod-shaped member 632 so that it makes one rotation when the rod-shaped member 632 makes one turn.

When the prize acquisition game machine 650 is operated, as described above, the paired pawl members 661 and 662 of the prize gripping means 660 are automatically closed to grip the prize body P1. When the prize body P1 is gripped and pulled to this side by the paired pawl members 661 and 662 of the grip means 660, a ring P2 is slid along the upper edge of the rod-shaped member 632 and the upper edge of the drop preventing member 633.

The distance from the axis 632*a* of the rod-shaped member 632 to the upper edge of the drop preventing member 633 changes so that the prize P can be easily removed from the prize suspender 601 when the distance R is short. When the distance from the axis 632*a* of the rod-shaped member 632 to the upper edge of the drop preventing member 633 is long, however, the prize P cannot be easily removed from the prize suspender 601. Here, the prize suspender 631 is extremely difficult to time in its operation and requires an operation technique at a high level, because the rod-shaped member 632 is turned.

The prize suspender 631 can be mounted on one side of a turnable member 672 which is turnably disposed in a game machine body 671 of the prize acquisition game machine 670, as shown in FIG. 127. Thus, the prize suspender 631 is turned by the turnable member 672, and the rod-shaped member 632 is also turned, as described above. This makes it difficult to acquire the prize P so that the prize acquisition game machine 670 can provide a remarkably interesting game.

Here, the drop preventing members 603, 623 and 633 can be modified in various manners by a generally conical shape having a section enlarged toward the leading end, as shown in FIGS. 99 to 102, by a generally elliptical conical shape, as shown in FIGS. 85 and 89, a generally pyramid shape, as shown in FIGS. 103 to 106, by a generally circular column, as shown in FIGS. 111 to 114, by a generally elliptical column or a generally prism column, as shown in FIGS. 107 to 110, by a generally circular disc, as shown in FIGS. 119 to 122, or by a generally elliptical disc or a generally square plate, as shown in FIGS. 115 to 118.

Figure 123:
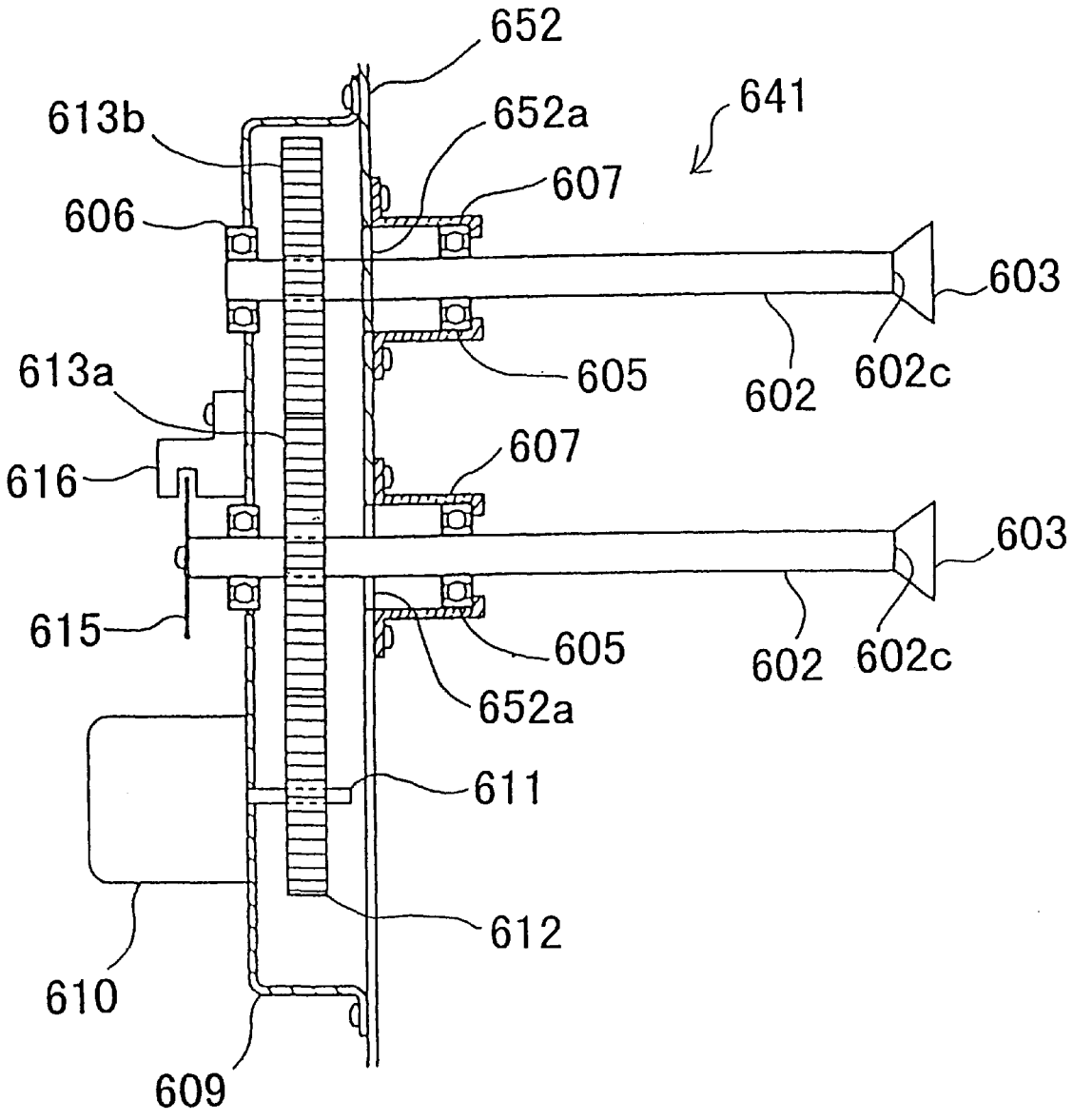
Figure 124:
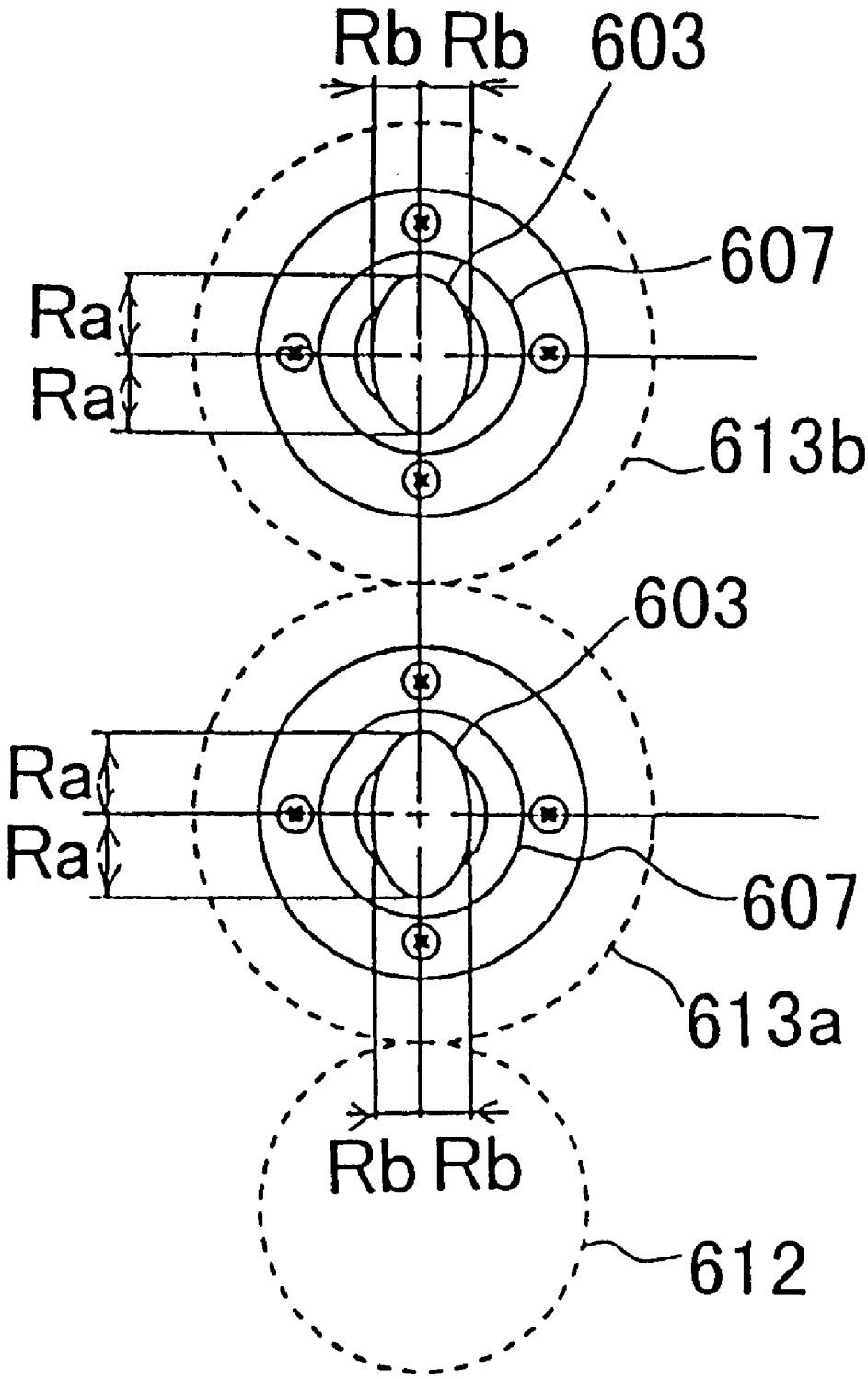

The drive means can be constructed, as shown in FIGS. 123 and 124, to include one power means 610, and power transmission means for turning a plurality of rod-shaped members 602, a plurality of turning shafts 625 or a plurality of turning arms 635 substantially simultaneously. Then, the plural drop preventing members 603, 623 and 633 can be simultaneously turned by the single power means 610. Here,the power transmission means can be variously modified by gears, chains or belts. On the other hand, the power means is exemplified by a drive motor or an electromagnetic actuator such as a solenoid. The drive motor can be variously modified into but should not be limited by a synchronous motor, a pulse motor or a stepping motor in accordance with the situations.

In the game machine body 651 or 671, there may be disposed detection means 616 for detecting the turning position of the drop preventing member 603, 623 or 633, and control means for changing the turning position of the drop preventing member 603, 623 or 633 by driving and controlling the drive means 610, 612 or 613 on the basis of the detection result of the detection means 616. Thus, the difficulty in the prize acquisition can be adjusted by the control means.

One specific embodiment of the invention will be described with reference to FIGS. 85 to 88. Numeral 601 designates a prize suspender for suspending a prize P in the game machine body 651 of the prize acquisition game machine 650 shown in FIG. 126. This prize suspender 601 is constructed to include the rod-shaped member 602 mounted at its rear portion on the back plate 652 of the game machine body 651, and the drop preventing member 603 mounted on the leading end 602*c* of the rod-shaped member 602.

The rod-shaped member 602 is fitted at its rear portion in a hole 652*a* formed in the back plate 652 and is rotatably borne by a first bearing member 605 and a second bearing member 606. The first bearing member 605 is mounted in a sleeve holder 607 which is fixed on the surface of the back plate 652 by screws or the like. The second bearing member 606 is mounted in a motor mounting plate 609 having a generally C-shaped section, which is fixed on the back of the back plate 652 by screws or the like.

On the motor mounting plate 609, there is mounted the synchronous motor 610 having an output shaft 611, on which the drive spur gear 612 is fixed. This drive spur gear 612 is always meshing with the driven spur gear 613 which is fixed on the rear portion of the rod-shaped member 602. Thus, the synchronous motor 610, the drive spur gear 612 and the driven spur gear 613 construct the drive means for turning the rod-shaped member 602 on the axis 602*a*.

The drop preventing member 603, as mounted on the leading end 602*c* of the rod-shaped member 602, is formed into a generally elliptical conical shape which has a root end portion 604*a* merging into the outer circumference edge of the leading end 602*c* of the rod-shaped member 602 and enlarged in section from the root end portion 604*a* to a leading end portion 604*b*. This drop preventing member 603 can be made integral with the rod-shaped member 602 or can be made separate from the rod-shaped member 602 so that it may be later fixed integrally on the rod-shaped member 602 by adhering or screwing it. Here, the prize P is suspended from the rod-shaped member 602, and a ring-shaped stopper plate 617 is provided so that the prize P may be kept away from abutting against the first bearing member 605.

The drop preventing member 603 is formed elliptical at the outer circumference edge 603*a* of its leading end portion 604*b* so that the distance R between the outer circumference edge 603*a* and the axis 602*a* of the rod-shaped member 602 is not fixed to have the longest radius Ra and the shortest radius Rb. On the rear end 602*b* of the rod-shaped member 602, as projected from the motor mounting plate 609, there is fixed a sensor disc 615 by means of screws. In this sensor disc 615, there is formed a generally C-shaped recess 615*b* which corresponds to the shortest radius Rb of the drop preventing member 603.

On the motor mounting plate 609, there is mounted the photo interrupter (or detecting means) 616 by means of screws. This photo interrupter 616 detects the C-shaped recess 615*b* of the sensor disc 615 to interrupt the rotation of the synchronous motor 610 when the shortest radius Rb of the drop preventing member 603 comes to the upper portion, that is, when the C-shaped recess 615*b* of the sensor disc 615 comes to the upper portion.

The prize acquisition game machine 650 thus constructed is provided, as described above, with the coin insertion slot 656, the transverse play switch 657 and the vertical play switch 658 for controlling the prize gripping means 660, and the switch(not-shown) lever for adjusting the degree of difficulty in the prize acquisition. On the other hand, the game machine body 651 is provided therein with control means for controlling the drives of the individual control means.

The prize suspender 601 thus constructed is mounted to the back plate 652 in the game machine body 651 of the prize acquisition game machine shown in FIG. 126, and its rod-shaped member 602 suspends the prize P. The prize acquisition game machine 650 is activated by inserting a coin into the coin insertion slot 656.

When the change lever makes a change to a simple mode, the control means activates the synchronous motor 610 to turn the rod-shaped member 602 and the drop preventing member 603 through the output shaft 611, the drive spur gear 612 and the driven spur gear 613. When the shortest radius Rb of the drop preventing member 603 comes to the upper side, the C-shaped recess 615*b* of the sensor disc 615 also comes to the upper side, and the photo interrupter detects the C-shaped recess 615*b* in this position to interrupt the rotation of the synchronous motor 610. When the shortest radius Rb of the drop preventing member 603 is positioned at the upper side, the slope gradient of the upper edge of the drop preventing member 603 is gentle, as shown in FIG. 87, so that the prize P can be easily pulled out from the prize suspender 601.

When the change lever makes a change to a difficult mode, on the contrary, the control means activates the synchronous motor 610 for a predetermined time period to turn the rod-shaped member 602 and drop preventing member 603 by 90 degrees through the output shaft 611, the drive spur gear 612 and the driven spur gear 613. When the drop preventing member 603 makes a turn of 90 degrees, the longest radius Ra of the drop preventing member 603 comes to the upper side. When the longest radius Ra of the drop preventing member 603 is positioned at the upper side, the prize P is extremely difficult to pull out from the prize suspender 601 because the upper edge of the drop preventing member 603 has the steep slope gradient.

When the transverse play switch 657 and the vertical play switch 658 are depressed, the prize gripping means 660 moves to a desired height and then automatically moves forward to the vicinity of the prize P. Next, the paired pawl members 661 and 662 are automatically closed to grip the prize body P1 and are returned to the original position while being closed. When the prize body P1 is pulled to this side while being gripped by the paired pawl members 661 and 662 of the grip means 660, the ring P2 is slid along the upper edge of the rod-shaped member 602 and the upper edge of the drop preventing member 603.

When the longest radius Ra of the drop preventing member 603 is positioned at the upper side, as described above, the prize P is difficult to pull out from the prize suspender 601 because the upper edge of the drop preventing member 603 has the steep slope gradient. When the shortest radius Rb of the drop preventing member 603 is positioned at the upper side, the prize P can be easily pulled out from the prize suspender 601 because the upper edge of the drop preventing member 603 has the gentle slope gradient.

The suspender 601 is attached to the back plate 652 in the game machine body 651 shown in FIG. 126 but may be mounted to the surface 673 of the turnable member 672 which is turnably disposed in the game machine body 671 of the prize acquisition game machine 670 shown in FIG. 127. In the foregoing embodiment, the power means is exemplified by the synchronous motor but may be modified into a stepping motor or a pulse motor. These two motors can make rotations of 90 degrees in response to a pulse signal coming from the control means. On the other hand, the detection means is exemplified by the photo interrupter but can naturally be modified into a photosensor.

Another specific embodiment of the invention will be described with reference to FIGS. 89 to 94. The reference numeral 621 designates the prize suspender which is disposed in the game machine body 651 for suspending a prize P as shown in FIG. 126. This prize suspender 621 is constructed to include the suspending member 622 which is mounted at its rear portion to the back plate 652 of the game machine body 651 for suspending the prize P, the drop preventing member 623 mounted on the leading end of the suspending member 622, and the turning shaft 625 for turning the drop preventing member 623.

The turning shaft 625 is inserted into the hole 652*a* formed in the back plate 652 and is rotatably borne by the first bearing member 605 and the second bearing member 606. The first bearing member 605 is mounted in the tubular suspending member 622 which is mounted to the surface of the back plate 652 by means of screws. The tubular suspending member 622 is extended substantially to the leading end of the turning shaft 625 and is provided with the first bearing member 605 in the vicinity of its leading end portion.

The second bearing member 606 is mounted in the motor mounting plate 609 having a generally C-shaped section, which is mounted on the back of the back plate 652 by means of screws. On the motor mounting plate 609, there is mounted the drive motor 610 having the output shaft 611, on which the drive spur gear 612 is fixed. This drive spur gear 612 is always meshing with the driven spur gear 613 which is fixed on the rear portion of the turning shaft 625. As a result, the drive motor 610, the drive spur gear 612 and the driven spur gear 613 construct the drive means for rotating the turning shaft 625 on the general axis 625*a*.

The turning shaft 625 is provided at its leading end with the drop preventing member 623 having an elliptical cone shape. This drop preventing member 623 either can be formed integrally with the turning shaft 625 or can be made separate from the turning shaft 625 and united later by adhering or screwing it to the turning shaft 625 or by fastening a nut member 626 on the leading end of the turning shaft 625, as shown in FIG. 89. The leading end circumference edge 623*b* of the drop preventing member 623 and the front end circumference edge 622*a* of the suspending member 622 are made to slidably contact into each other.

In the drop preventing member 623, the outer circumference edge 623*a* is given an elliptical shape so that the distance R between the outer circumference edge 623*a* and the axis 625*a* of the turning shaft 625 is not fixed to have the longest radius Ra and the shortest radius Rb. On the rear end 625*b* of the turning shaft 625, as protruded from the motor mounting plate 609, there is fixed the sensor disc 615 by means of screws. This sensor disc 615 has generally C-shaped recesses 615*a* and 615*b* corresponding to the longest radius Ra and the shortest radius Rb of the drop preventing member 623.

On the motor mounting plate 609, there is mounted the photo interrupter (or detecting means) 616 by means of screws. This photo interrupter 616 detects the C-shaped recess 615*a* or 615*b* to interrupt the rotation of the drive motor 610 when the longest radius Ra or the shortest radius Rb of the drop preventing member 623 comes to the upper portion, that is, when the C-shaped recess 615*a* or 615*b* of the sensor disc 615 comes to the upper portion.

The prize acquisition game machine 650 is provided, as described above, with the coin insertion slot 656, the transverse play switch 657 and the vertical play switch 658 for controlling the prize gripping means 660, when depressed, and the switch lever for adjusting the degree of difficulty in the prize acquisition(not shown). In the game machine body 651, on the other hand, there is provided the control means for controlling the drive of the drive means.

The prize suspender 621 thus constructed is mounted to the back plate 652 in the game machine body 651 of the prize acquisition game machine 650 shown in FIG. 126, and its suspending member 622 suspends a prize P. The prize acquisition game machine 650 is brought into an active state by inserting a coin into the coin insertion slot 656.

When the change lever makes a change to a simple mode, the control means activates the drive motor 610 to turn the turning shaft 625 and the drop preventing member 623 through the output shaft 611, the drive spur gear 612 and the driven spur gear 613. When the shortest radius Rb of the drop preventing member 623 comes to the upper side, the C-shaped 615*b* of the sensor disc 615 also comes to the upper side, as shown in FIGS. 93 and 94, and the photo interrupter 616 detects the C-shaped recess 615*b* in this position to interrupt the rotation of the drive motor 610. When the shortest radius Rb of the drop preventing member 623 is positioned at the upper side, the slope gradient of the upper edge of the drop preventing member 623 is gentle, as shown in FIG. 92, so that the prize P can be easily pulled out from the prize suspender 621.

When the change lever makes a change to a difficult mode, on the contrary, the control means activates the drive motor 610 to turn the turning shaft 625 and the drop preventing member 623 through the output shaft 611, the drive spur gear 612 and the driven spur gear 613. When the longest radius Ra of the drop preventing member 623 is positioned at the upper side, the C-shaped recess 615*a* of the sensor disc 615 is also positioned at the upper side, as shown in FIGS. 90 and 91, so that the photo interrupter 616 detects that C-shaped recess 615*a* to interrupt the rotation of the drive motor 610. When the longest radius Ra of the drop preventing member 623 is positioned at the upper side, the prize P is extremely difficult to pull out from the prize suspender 621 because the upper edge of the drop preventing member 623 has the steep slope gradient, as shown in FIG. 89.

When the transverse play switch 657 and the vertical play switch 658 are depressed, the prize gripping means 660 moves to a desired height and then automatically moves forward to the vicinity of the prize P. Next, the paired pawl members 661 and 662 are automatically closed to grip the prize body P1 and are returned to the original position while being closed. When the prize body P1 is pulled to this side while being gripped by the paired pawl members 661 and 662 of the grip means 660, the ring P2 is slid along the upper edge of the rod-shaped member 622 and the upper edge of the drop preventing member 623.

When the longest radius Ra of the drop preventing member 623 is positioned at the upper side, as described above, the prize P is difficult to pull out from the prize suspender 621 because the upper edge of the drop preventing member 623 has the steep slope gradient. When the shortest radius Rb of the drop preventing member 623 is positioned at the upper side, the prize P can be easily pulled out from the prize suspender 621 because the upper edge of the drop preventing member 623 has the gentle slope gradient.

The prize suspender 621 is attached to the back plate 652 in the game machine body 651 shown in FIG. 126 but may be mounted to the surface 673 of the turnable member 672 which is turnably disposed in the game machine body 671 of the prize acquisition game machine 670 shown in FIG. 127.

Another specific embodiment of the invention will be described with reference to FIGS. 95 to 98. The numeral 631 designates the prize suspender which is disposed in the game machine body 651 for suspending a prize P. This prize suspender 631 is constructed to include the rod-shaped member 632 which is mounted at its rear portion to the back plate 652 of the game machine body 651 for suspending the prize P, and the drop preventing member 633 mounted on the leading end of the rod-shaped member 632.

The rear portion of the rod-shaped member 632 is inserted into a mounting hole 636 formed in the leading portion of the turning arm 635 and is fixed by the screw 637. The turning arm 635 has the turning shaft 637 formed at its root portion. This turning shaft 637 is rotatably borne by the first bearing member 605 mounted in the back plate 652 and by the second bearing member 606. The second bearing member 606 is mounted in the motor mounting plate 609 having a generally C-shaped section, which is mounted in the back face of the back plate 652 by means of screws.

On the motor mounting plate 609, there is mounted the synchronous motor 610 having the output shaft 611, on which the drive spur gear 612 is fixed. This drive spur gear 612 is always meshing with the driven spur gear 613 which is fixed on the turning shaft 637. As a result, the synchronous motor 610, the drive spur gear 612 and the driven spur gear 613 construct the drive means for turning the turning arm 635.

The rod-shaped member 632 is provided at its leading end with the drop preventing member 633 having an elliptical cone shape. This drop preventing member 633 either can be formed integrally with the rod-shaped member 632 or can be made separate from the rod-shaped member 632 and united later by adhering or screwing it to the rod-shaped member 632.

In the drop preventing member 633, the outer circumference edge 633*a* is given an elliptical shape so that the distance R between the outer circumference edge 633*a* and the axis 632*a* of the rod-shaped member 632 is not fixed to have the longest radius Ra and the shortest radius Rb.

The prize suspender 631 thus constructed is mounted to the back plate 652 of the game machine body 651 of the prize acquisition game machine 650 shown in FIG. 126, and its suspending member 632 suspends a prize P. The prize acquisition game machine 650 is brought into an active state by inserting a coin into the coin insertion slot 656. The control means activates the synchronous motor 610 to turn the rod-shaped member 632 on the axis of the turning shaft 637 through the output shaft 611, the drive spur gear 612, the driven spur gear 613, the turning shaft 637 and the turning arm 635.

When the rod-shaped member 632 turns, the drop preventing member 633 turns. Specifically, the shortest radius Rb of the drop preventing member 633 is positioned at the upper side, when the rod-shaped member 632 is in the transverse position, and the longest radius Ra of the drop preventing member 633 is positioned at the upper side when the rod-shaped member 632 is in the vertical position. When the shortest radius Rb of the drop preventing member 633 is positioned at the upper side, the slope gradient of the upper edge of the drop preventing member 633 is gentle, as shown in FIGS. 97 and 98, so that the prize P can be easily pulled out from the prize suspender 631. When the longest radius Ra of the drop preventing member 633 is positioned at the upper side, on the contrary, the prize P is extremely difficult to pull out from the prize suspender 631 because the upper edge of the drop preventing member 633 has the steep slope gradient, as shown in FIGS. 95 and 96.

When the transverse play switch 657 and the vertical play switch 658 are depressed, the prize gripping means 660 moves to a desired height and then automatically moves forward to the vicinity of the prize P. Next, the paired pawl members 661 and 662 are automatically closed to grip the prize body P1 and are returned to the original position while being closed. When the prize body P1 is pulled to this side while being gripped by the paired pawl members 661 and 662 of the prize grip means 660, the ring P2 is slid along the upper edge of the rod-shaped member 632 and the upper edge of the drop preventing member 633.

When the longest radius Ra of the drop preventing member 633 is positioned at the upper side, as described above, the prize P is difficult to pull out from the prize suspender 631 because the upper edge of the drop preventing member 633 has the steep slope gradient. When the shortest radius Rb of the drop preventing member 633 is positioned at the upper side, the prize P can be easily pulled out from the prize suspender 631 because the upper edge of the drop preventing member 633 has the gentle slope gradient. Since the rod-shaped member 632 is turning, on the other hand, the prize P is also turning. By considering the turning rate of the prize P, therefore, the prize acquisition game machine 650 has to be operated. Here, the turning position of the rod-shaped member 632 can be freely set if the sensor disc 615 is mounted on the rear end of the turning shaft 637, as in the foregoing embodiment, if the photo interrupter 616 is mounted to the motor mounting plate 609 to detect the rotational position of the turning shaft 637 and if the synchronous motor 610 is controlled by the control means.

The aforementioned prize suspender 631 is mounted to the back plate 652 in the game machine body 651, as shown in FIG. 126, but may be mounted to the surface 673 of the turnable member 672 which is turnably disposed in the game machine body 671 of the prize acquisition game machine 670 shown in FIG. 127.

The drop preventing member 603, 623 and 633 formed into the generally elliptical cones in the foregoing embodiments, but should not be limited thereto. They can be formed into the generally conical shape having a section enlarged toward the leading end, as shown in FIGS. 99 to 102, into a general pyramid, as shown in FIGS. 103 to 106, into a generally elliptical column, as shown in FIGS. 107 to 110, into a generally circular column or a general prism, as shown in FIGS. 111 to 114, into a generally elliptical disc, as shown in FIGS. 115 to 118, or into a general disc or a generally square plate, as shown in FIGS. 119 to 122.

Figure 100:
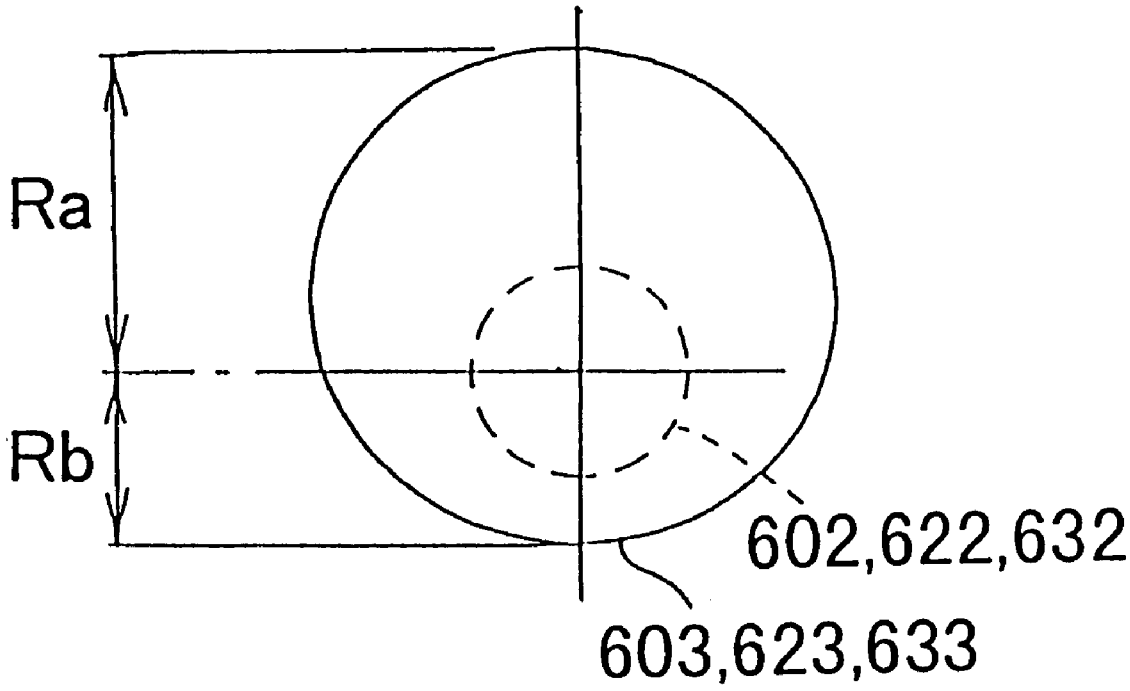
FIG. 100 is a front elevation of FIG. 99.
Figure 101:
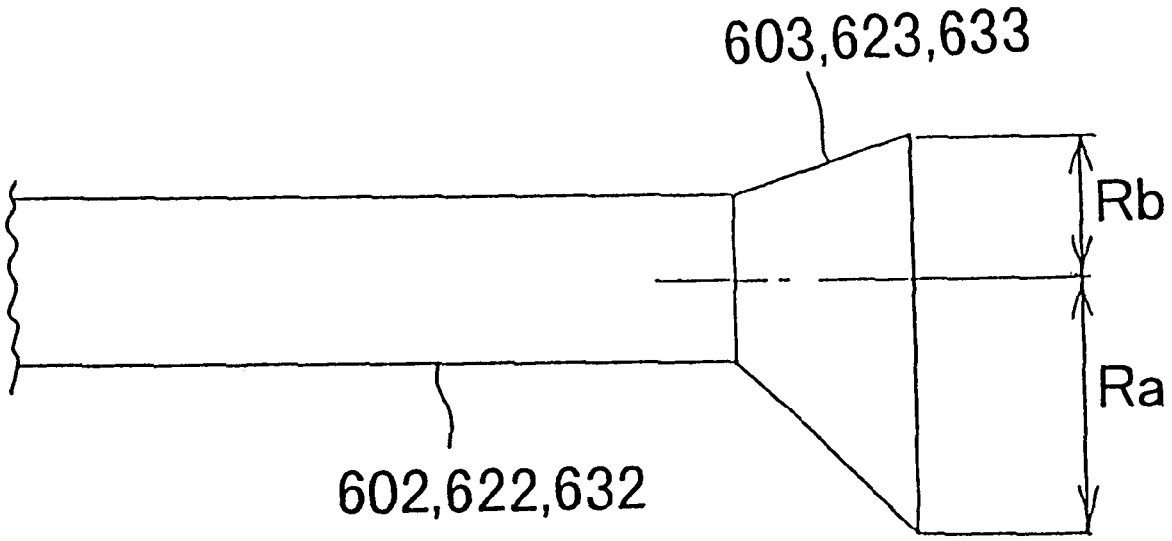
FIG. 101 is side elevation showing the state in which the drop preventing device of FIG. 99 is turned by 180 degrees.
Figure 102:
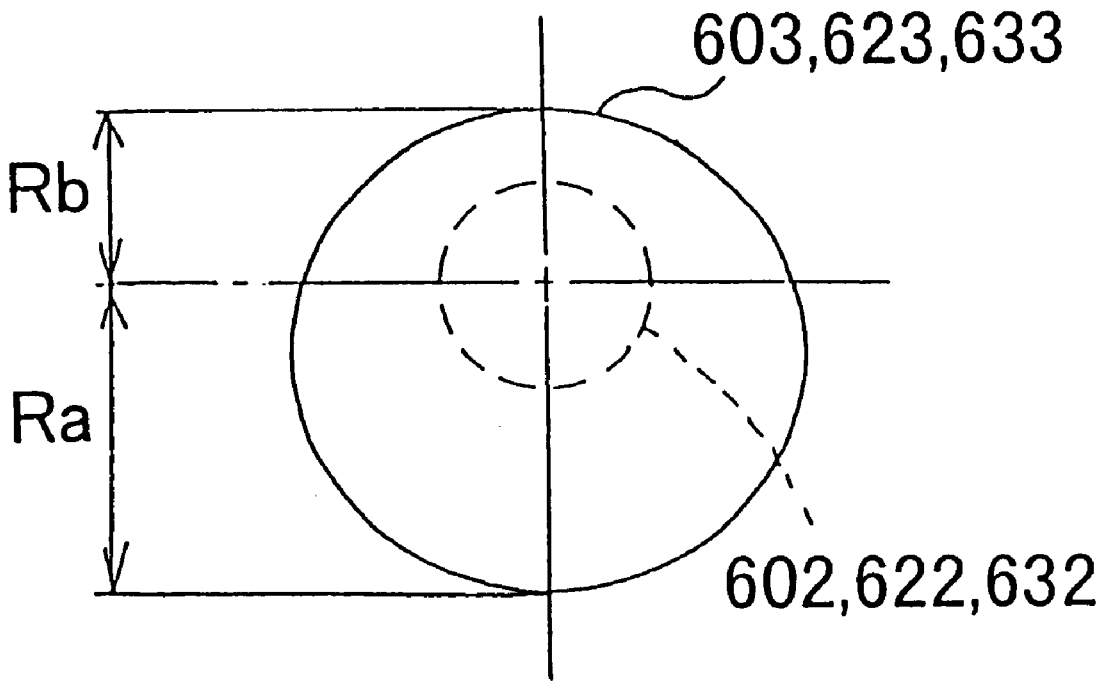
FIG. 102 is a front elevation of FIG. 101.
Figure 103:
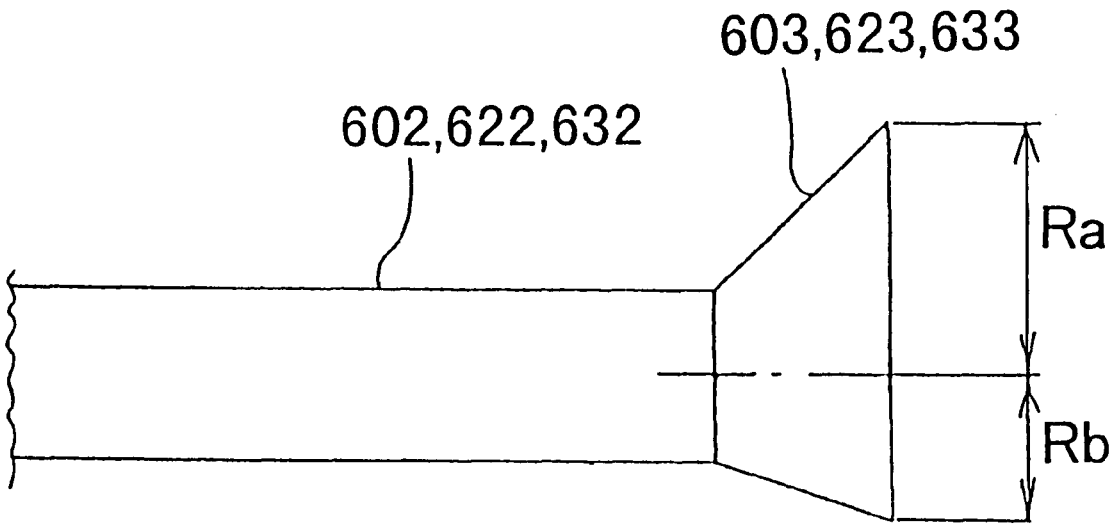
FIG. 103 is a side elevation showing another mode in which the drop preventing member of the prize suspending device.
Figure 104:
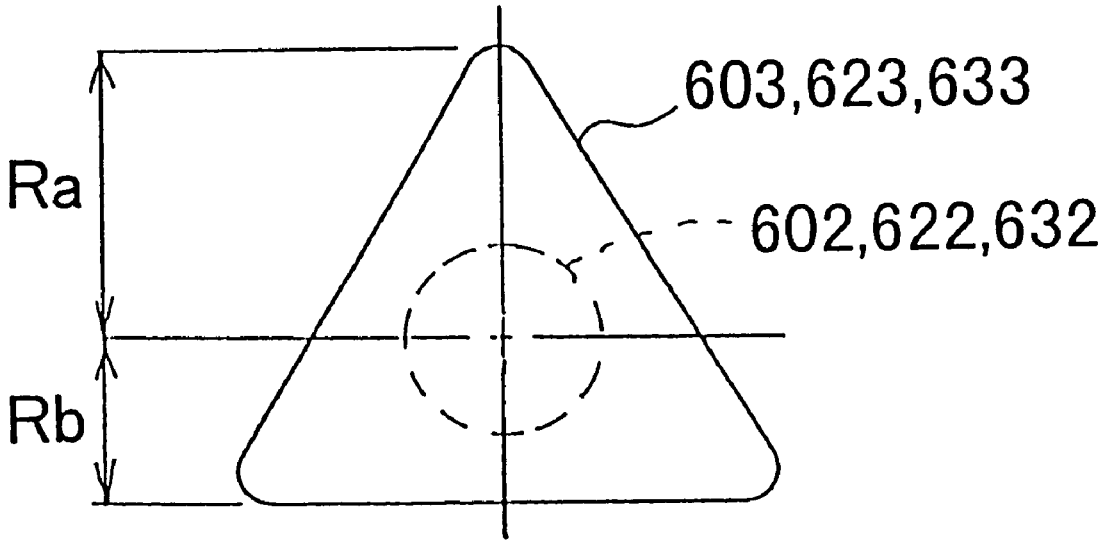
FIG. 104 is a front elevation of FIG. 103.
Figure 105:
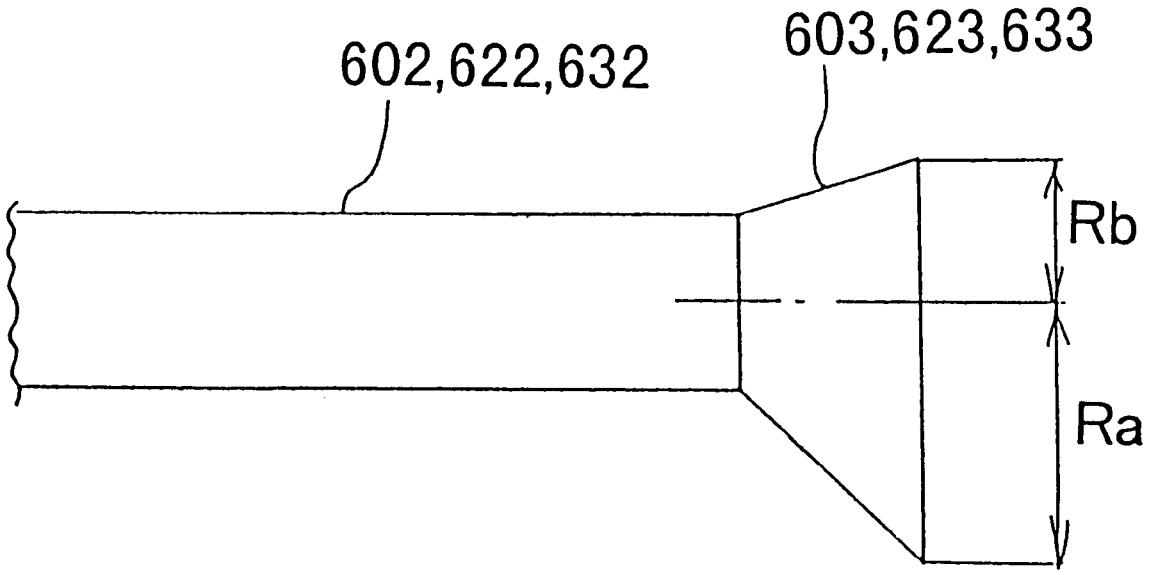
FIG. 105 is a side elevation showing the state in which the drop preventing member of FIG. 103 is turned by 180 degrees.
Figure 106:
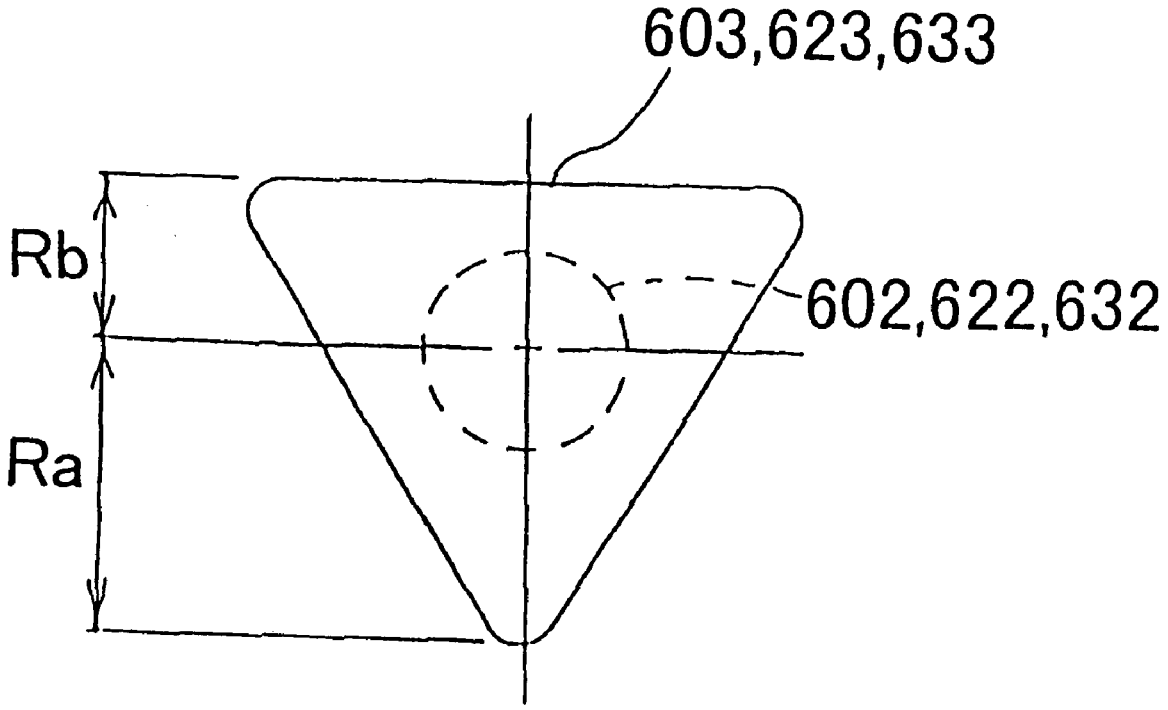
FIG. 106 is a front elevation of FIG. 105.
Figure 107:
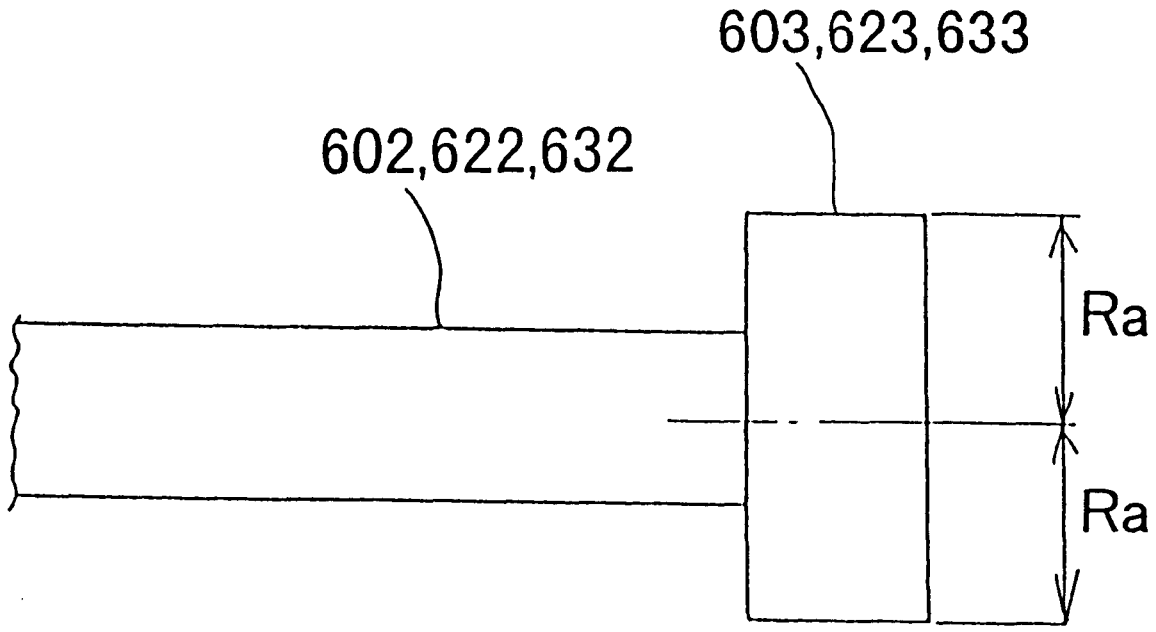
FIG. 107 is a side elevation showing another mode of the drop preventing member of the prize suspending device.
Figure 108:
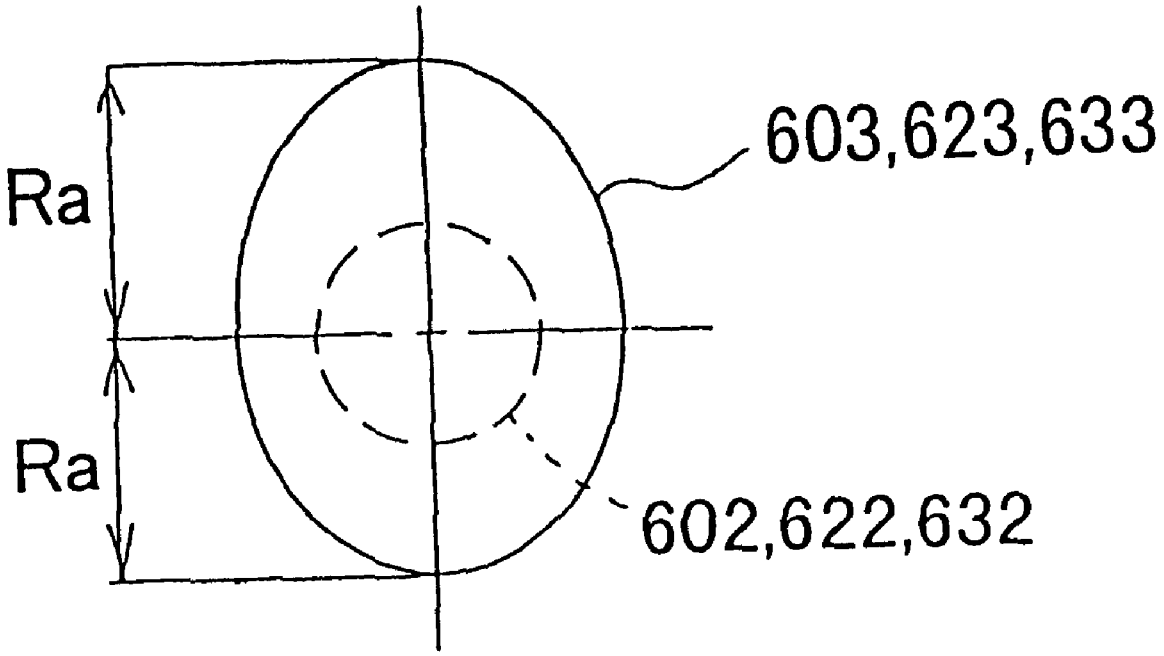
FIG. 108 is a front elevation of FIG. 107.
Figure 109:
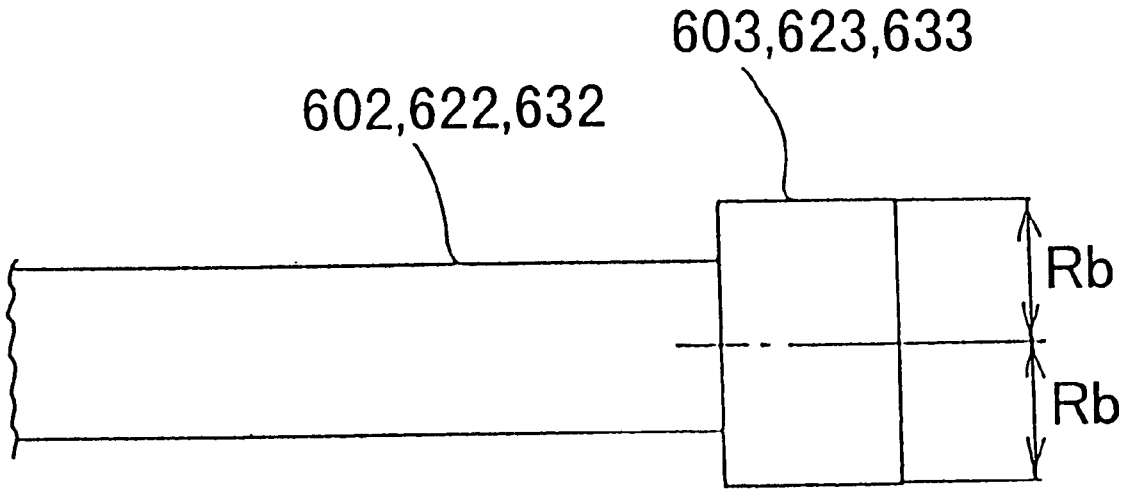
FIG. 109 is a side elevation showing the state in which the drop preventing member of FIG. 107 is turned by 90 degrees.
Figure 110:
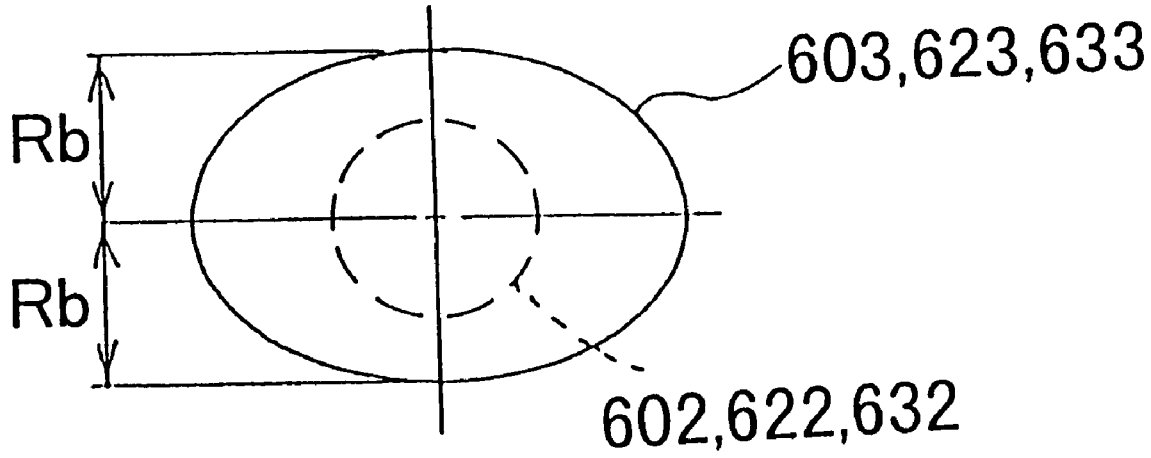
FIG. 110 is a front elevation of FIG. 109.
Figure 111:
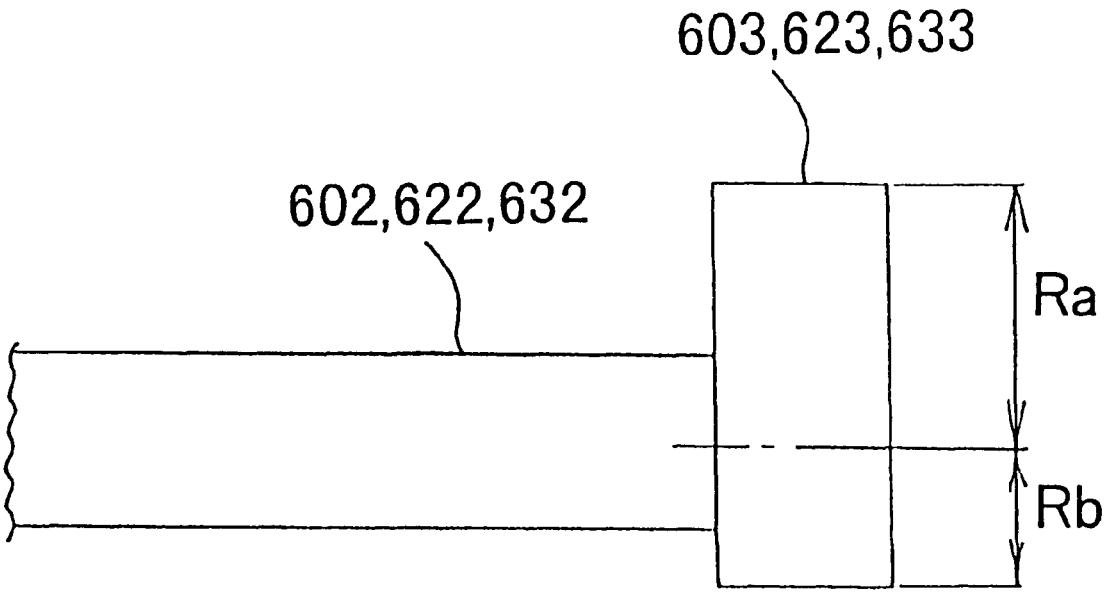
FIG. 111 is a side elevation showing another mode of the drop preventing member of the prize suspending device.
Figure 112:
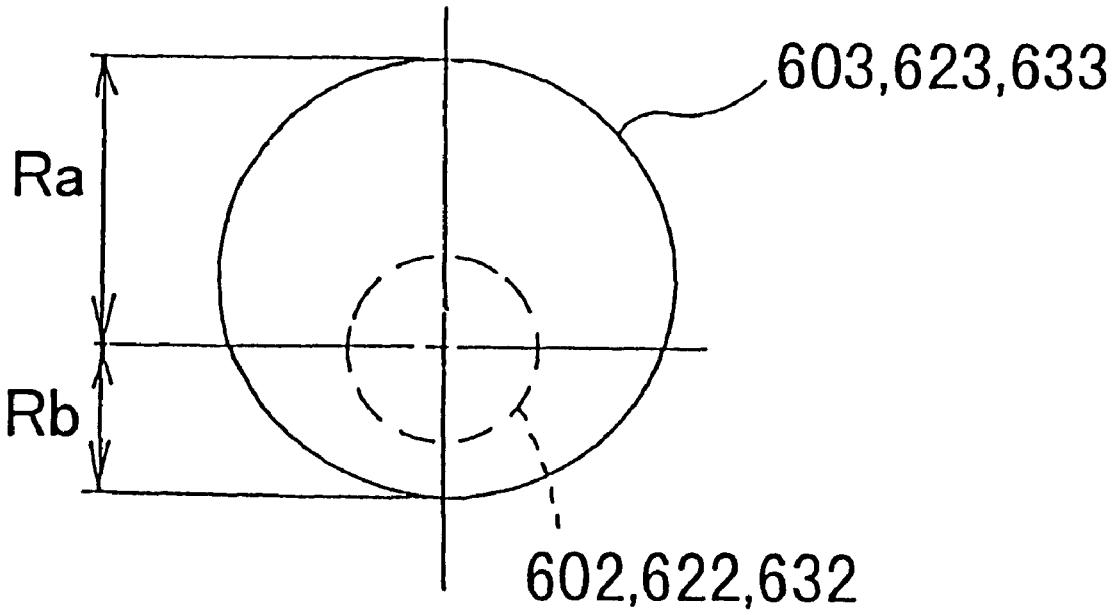
FIG. 112 is a front elevation of FIG. 111.
Figure 113:
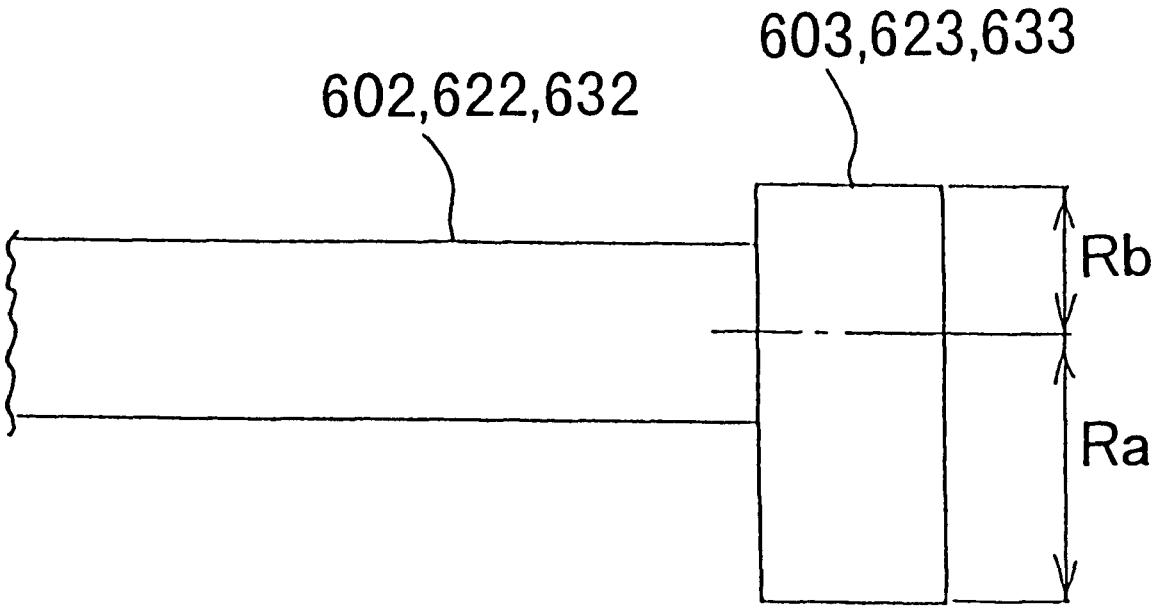
FIG. 113 is a side elevation showing the state in which the drop preventing member of FIG. 111 is turned by 180 degrees.
Figure 114:
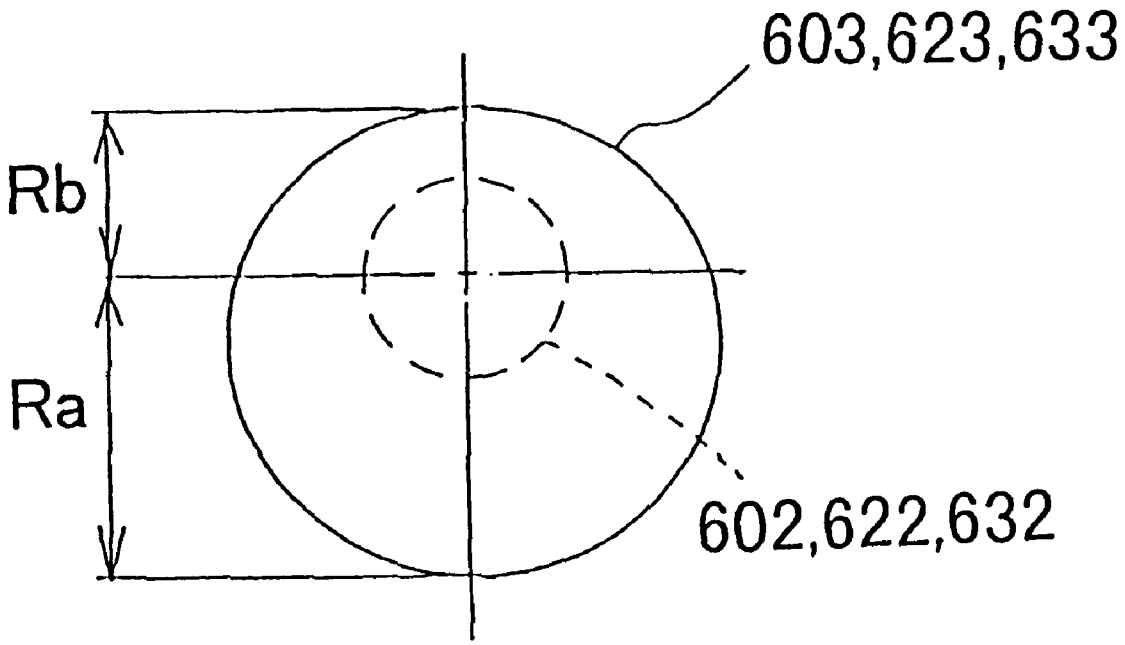
FIG. 114 is a front elevation of FIG. 113.
Figure 115:
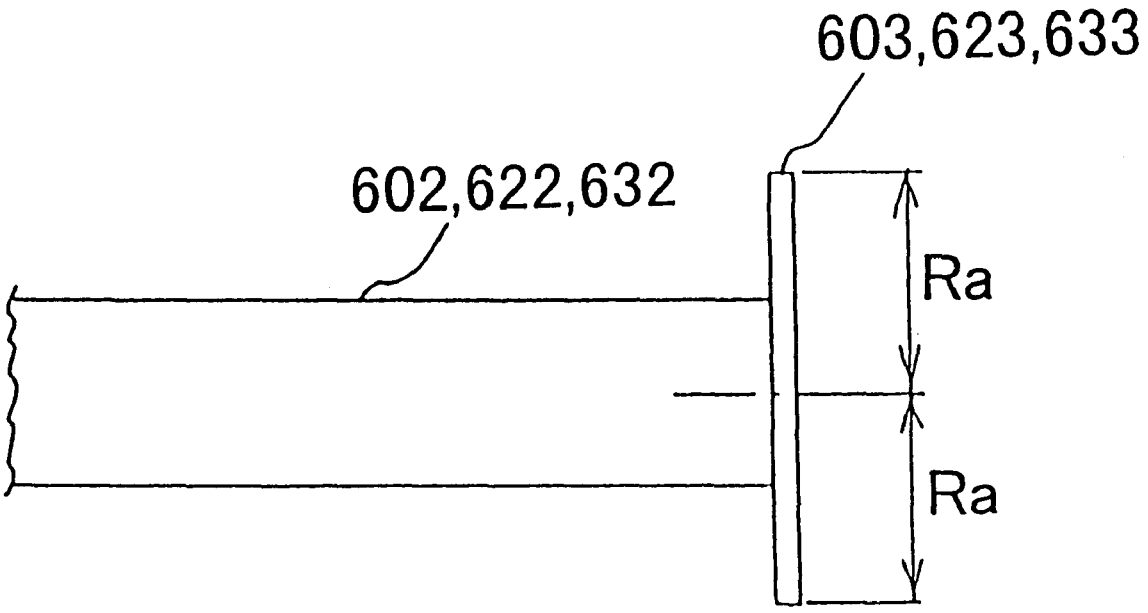
FIG. 115 is a side elevation showing another mode of the drop preventing member of the prize suspending device.
Figure 116:
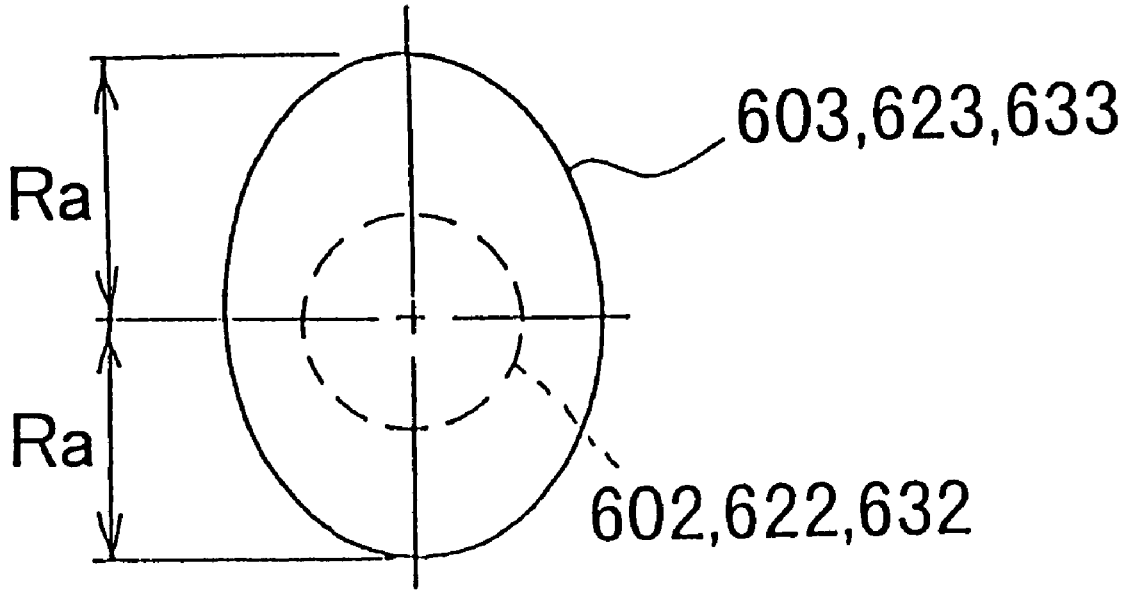
FIG. 116 is a front elevation of FIG. 115.
Figure 117:
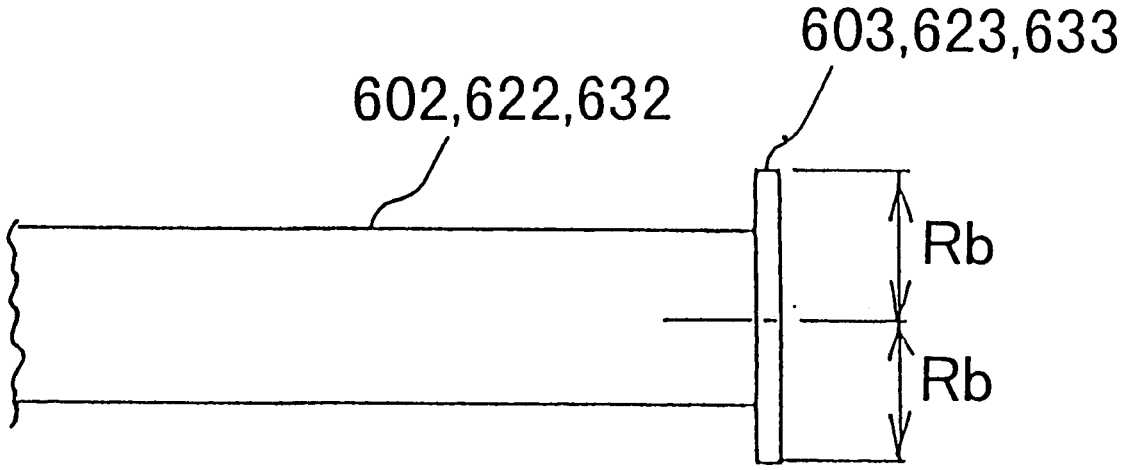
FIG. 117 is a side elevation showing the state in which the drop preventing member of FIG. 115 is turned by 90 degrees.
Figure 118:
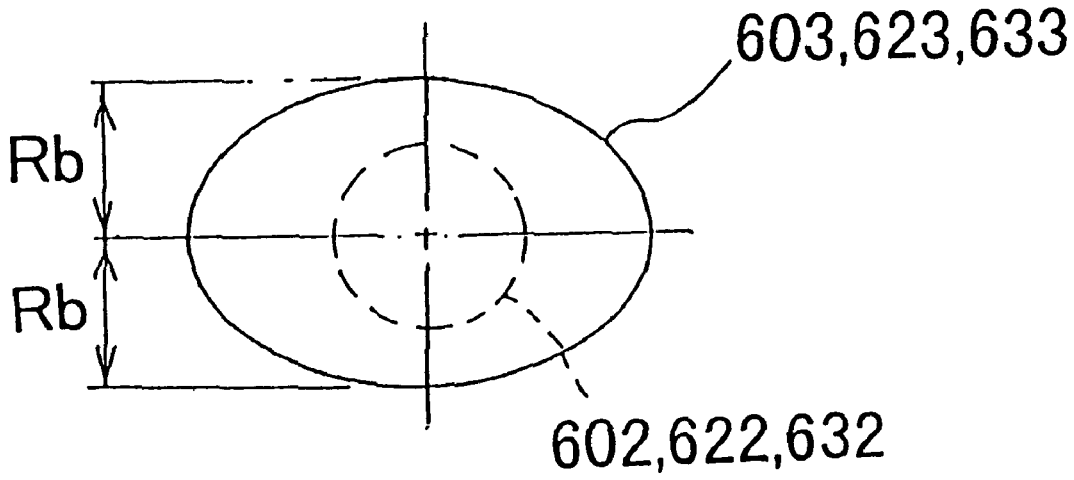
FIG. 118 is a front elevation of FIG. 117.
Figure 119:
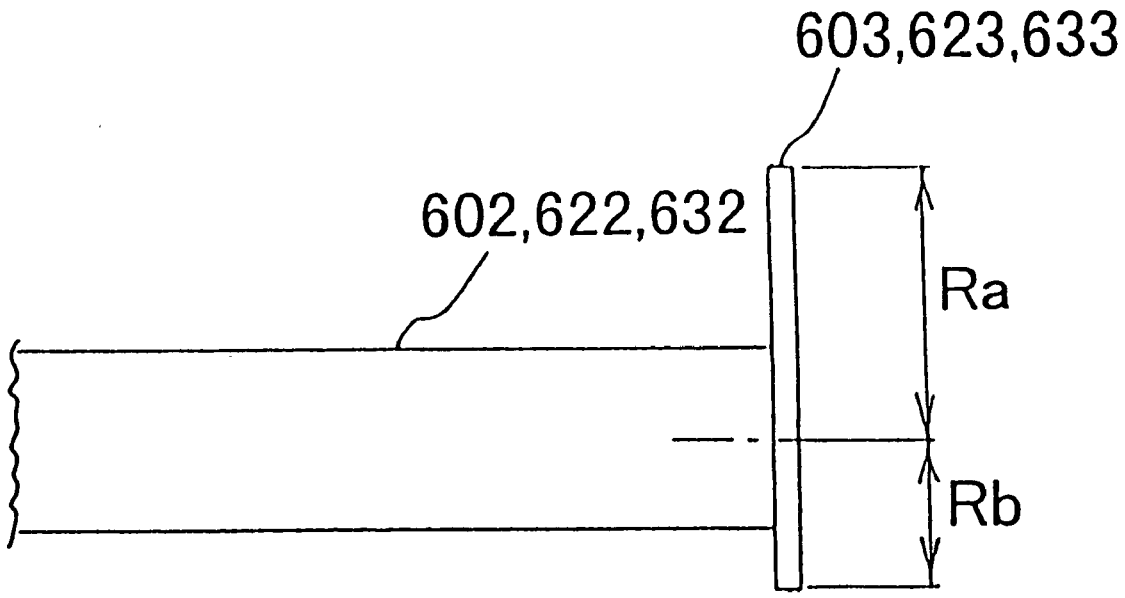
FIG. 119 is a side elevation showing another mode of the drop preventing member of the prize suspending device.
Figure 120:
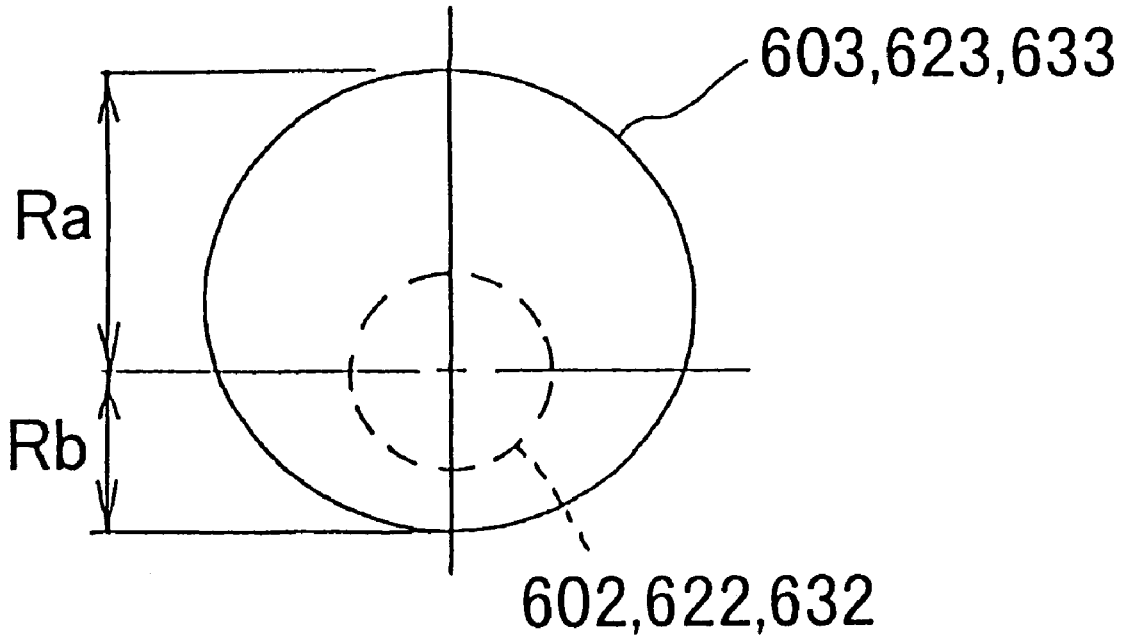
Figure 121:
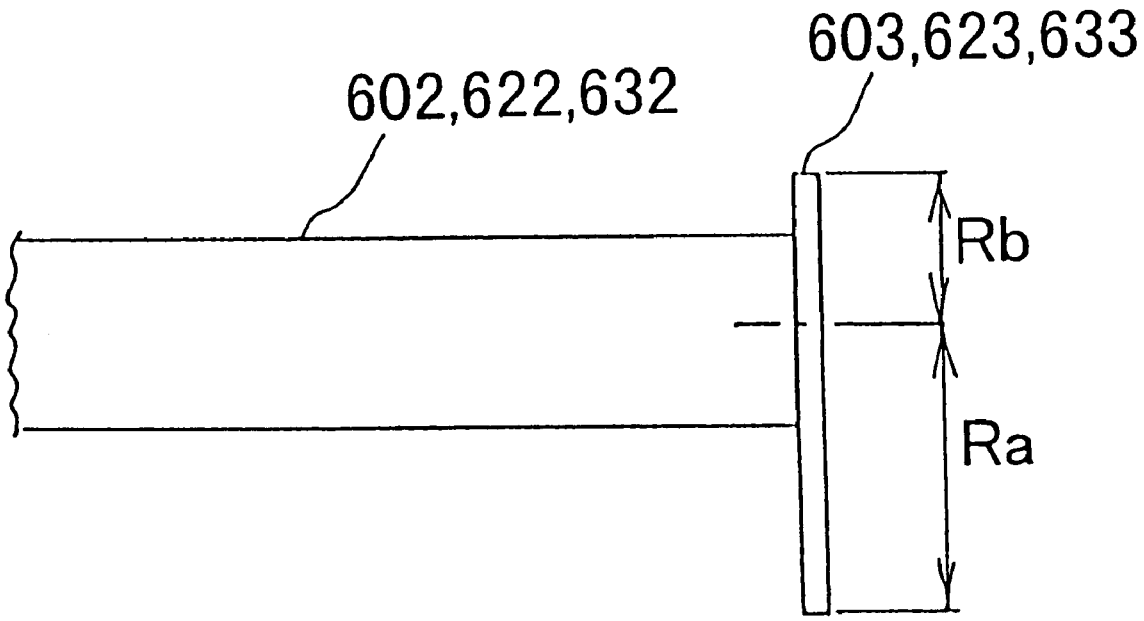
Figure 122:
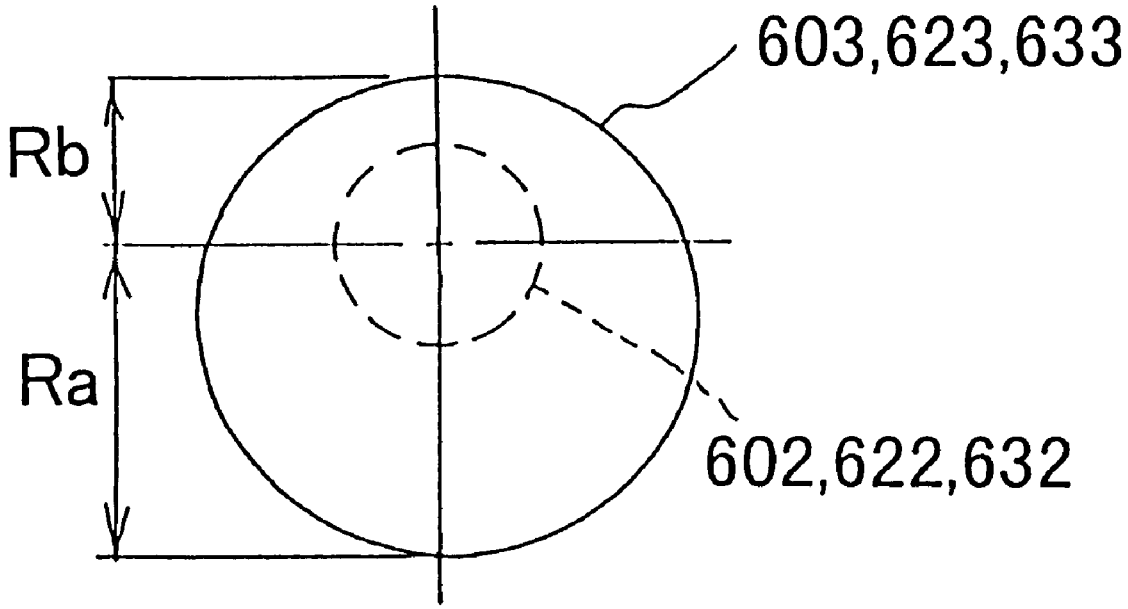

Here, as shown in FIGS. 100, 112 and 120, the generally conical, generally column-shaped or generally disc-shaped drop preventing member having a generally circular shape at the outer circumference edge of its leading end has not to be aligned with the axis of the rod-shaped member for mounting it or the axis of the turning shaft. With this alignment, the distance between the axis of the rod-shaped member or the turning shaft and the outer circumference edge of the drop preventing member is fixed at a constant value so that the slope gradient of the drop preventing member and accordingly the degree of difficulty in the prize acquisition cannot be changed.

Figure 125:
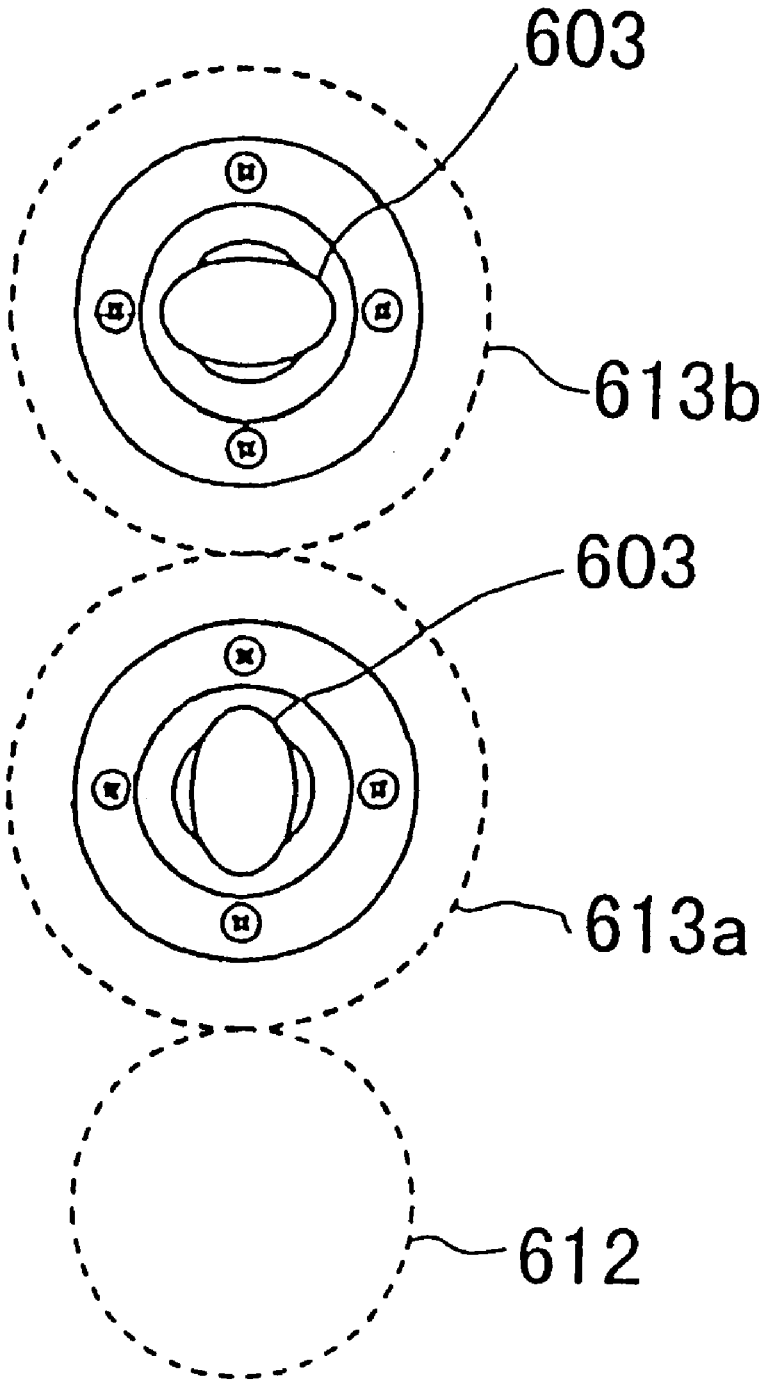

Another embodiment of the invention will be described with reference to FIGS. 123 to 125. Numeral 641 designates a prize suspender which is disposed in the game machine body 651 of the prize acquisition game machine 650 shown in FIG. 126 for suspending a prize P. This prize suspender 653 is constructed to include at least two rod-shaped members 602 and 602 mounted at their rear portions to the back plate 652 of the game machine body 651, and drop preventing members 603 and 603 having a generally elliptical shape mounted on the leading ends 602*c* and 602*c* of the two rod-shaped members 602 and 602.

The rear portions of the rod-shaped members 602 and 602 are inserted into the holes 652*a* and 652*a* formed in the back plate 652 and are turnably borne by the first bearing members 605 and 605 and the second bearing members 606 and 606. The first bearing members 605 and 605 are mounted in the tubular holders 607 and 607 which are mounted on the surface of the back plate 652 by means of screws. The second bearing members 606 and 606 are mounted on the motor mounting plate 609 having a generally C-shaped section, as mounted on the back of the back plate 652 by means of screws.

On the motor mounting plate 609, there is mounted the synchronous motor 610 having the output shaft 611, on which the drive spur gear 612 is fixed. This drive spur gear 612 is always meshing with a driven spur gear 613*a* which is fixed on the rear portion of one rod-shaped member 602. This driven spur gear 613*a* is always meshing with a driven spur gear 613*b* which is fixed on the rear portion of the other rod-shaped member 602. As a result, the synchronous motor 610, the drive spur gear 612 and the driven spur gears 613*a* and 613*b* construct drive means for turning the rod-shaped members 602 and 602 on the axes 602*a* and 602*a*.

The drop preventing members 603 and 603 are given the longest radius Ra and the shortest radius Rb, as described above. On the rear end 602*b* of one rod-shaped member 602, as protruded from the motor mounting plate 609, there is fixed the sensor disc 615. In this sensor disc 615, as in the foregoing embodiment, there is formed the generally C-shaped recess 615*b* which corresponds to the shortest radius Rb of the drop preventing member 603.

On the motor mounting plate 609, there is mounted the photo interrupter 616 for detecting the generally C-shaped recess 615*b* to interrupt the rotation of the synchronous motor 610. The prize acquisition game machine 650 is provided, as described above, with the coin insertion slot 656, the transverse play switch 657 and the vertical play switch 658 for controlling the prize gripping means 660, and the switch lever for adjusting the degree of difficulty in the prize acquisition(not shown). In the game machine body 651, moreover, there is provided the control means for controlling the individual drive means.

The prize suspender 653 thus constructed is mounted to the back plate 652 or the turnable member 672 in the game machine body 651 of the prize acquisition game machine 650 or 670 shown in FIG. 126 or 127, and its rod-shaped members 602 and 602 suspend a prize P. The prize acquisition game machine 650 or 670 is brought into an active state by inserting a coin into the coin insertion slot 656.

When the change lever makes a change to a simple mode, the control means activates the synchronous motor 610 to turn at least two rod-shaped members 602 and 602 and the drop preventing members 603 and 603 simultaneously through the output shaft 611, the drive spur gear 612 and the driven spur gears 613*a* and 613*b*. When the shortest radius Rb of the drop preventing member 603 comes to the upper side, the photo interrupter 616 detects the C-shaped recess 615*b* to interrupt the rotation of the synchronous motor 610.

When the change lever makes a change to a difficult mode, the control means energizes and activates the synchronous motor 610 for a predetermined time period to turn at least two rod-shaped members 602 and 602 and the drop preventing member 603 and 603 through the output shaft 611, the drive spur gear 612 and the driven spur gears 613*a* and 613*b*. When the drop preventing members 603 and 603 are turned by 90 degrees, the longest radius Ra of the drop preventing members 603 is positioned at the upper side.

Thus, the drive means can be constructed to include one synchronous motor (or power means) 610, and the power transmission means composed of the drive spur gear 612 and the driven spur gears 613*a* and 613*b* for turning the plural rod-shaped members 602 simultaneously. Here, this power transmission means should not be limited to the combination of gears but can include the transmission means such as the combination of a chain and sprockets or the combination of a belt and pulleys. On the other hand, the positions of the plural drop preventing members 603 and 603 should not be identical but may be displaced by 90 degrees, as shown in FIG. 125.

In the foregoing embodiments, there is provided the photo interrupter 616 for detecting the turning positions of the drop preventing members 603, 623 and 633. However, the photo interrupter 616 may be eliminated, and the drop preventing members 603, 623 and 633 may be turned at all times by the drive means. Then, the degree of difficulty in the prize acquisition from the drop preventing members 603, 623 and 633 can be changed at the unit of seconds to make the prize acquisition game machine more interesting.

The foregoing embodiments have been described on the point that the degree of difficulty in the prize acquisition of the prize suspenders 601, 621, 631 and 653 can be changed by the change lever. If this change lever is disposed at the player's side of the prize acquisition game machine, this game machine can be changed for the skilled and unskilled players by the player himself. If the change lever is disposed at the installer's side of the prize acquisition game machine, the degree of difficulty in the acquisition of prizes P can be adjusted according to the characteristics and prices of the prizes P.

Figure 129:
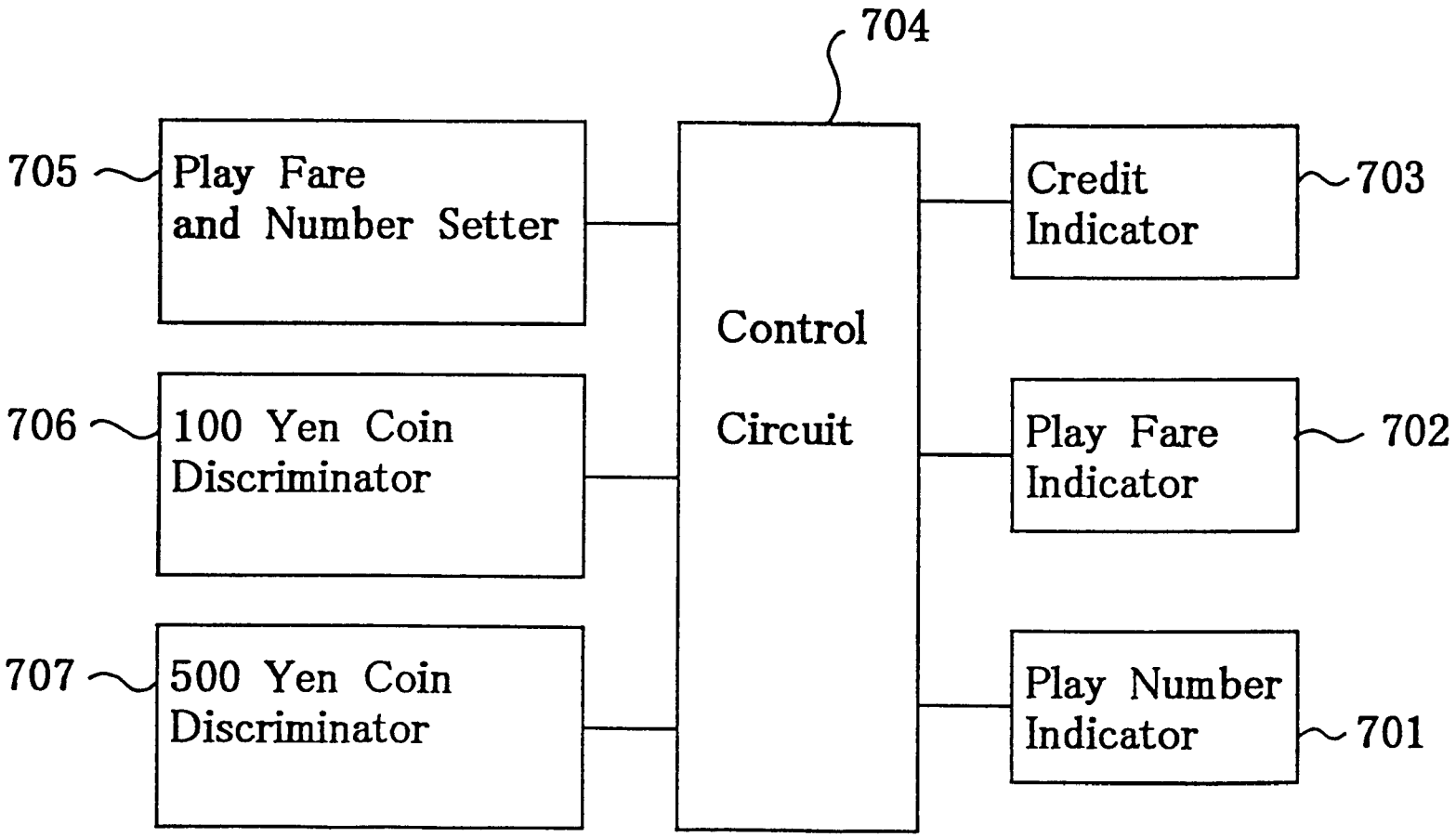
Figure 130:
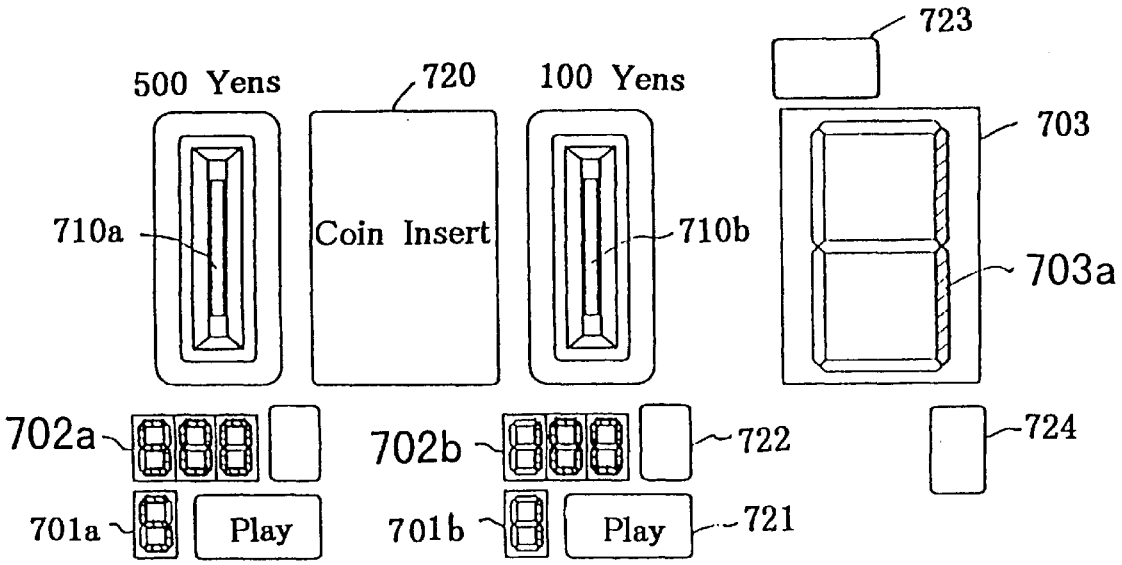
Figure 131:
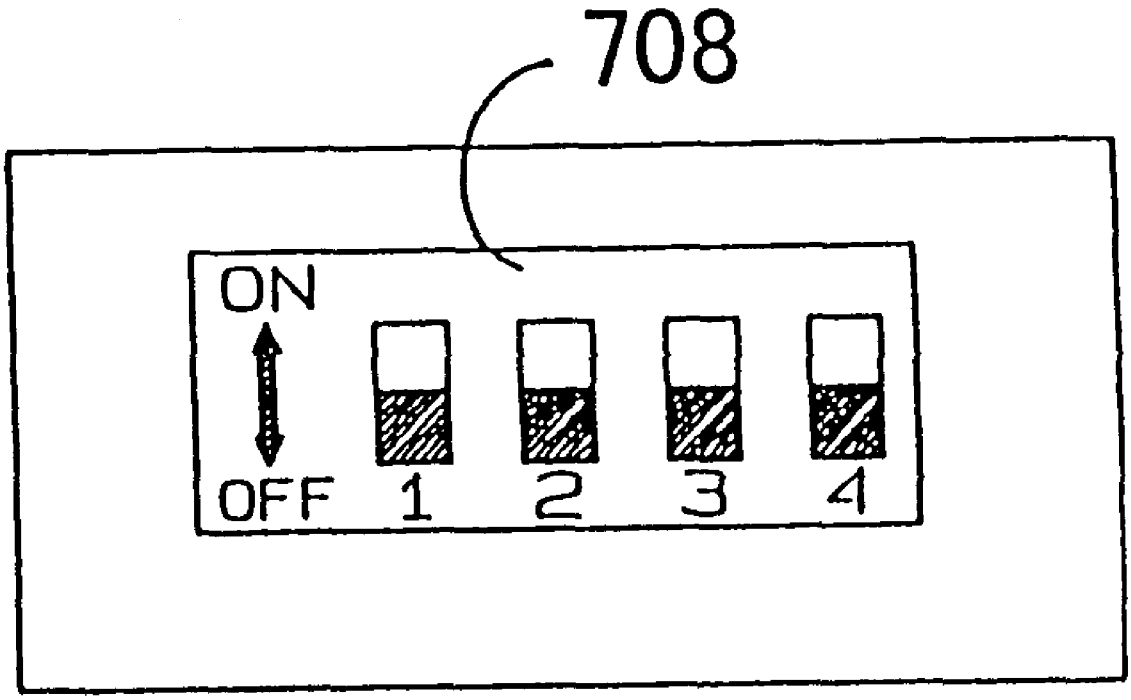

One embodiment of the game machine is shown in an essential block diagram in FIG. 129, and one embodiment of the display is shown in top plan view in FIG. 130. FIG. 131 shows one example for setting a shipped (or initial) product. The ON/OFF of a four-electrode dip switch 708 is set to OFF/OFF/OFF/OFF in the order of first/second/third/fourth electrodes to set 100 yens per play and 500 yens per play. At the side of 500 yens, a play fare indicating 7-segment LED 702*a* indicates "500", and a play number indicating 7-segment LED 701*a* indicates "5". At the side of 100 yens, a play fare indicating 7-segment LED 702*b* indicates "100", and a play number indicating 7-segment LED 701*b* indicates "1". Here, a seal for indicating the "yen" of a currency unit 722 and a seal for indicating "time" of the play number 721 can be eliminated by making the display means of a liquid crystal panel or the like.

When the setting is to be changed to 100 yens per two plays, the ON/OFF of the dip switch 708 shown in FIG. 131 is set to OFF/ON/OFF/OFF with reference to the example of FIG. 132. Then, the play fare indicating 7-segment LED 702*a* and the play number 7-segment LED 701*a* at the side of 500 yens are extinguished (without any display). At the side of 100 yens, the play fare indicating 7-segment LED 702*b* indicates "100", and the play number 7-segment LED 701*b* indicates "2". From now on, the indications are changed according to a change in the setting.

Here, the coin discriminators are specialized for coins of 100 yens and 500 yens in the aforementioned example. If there is employed the existing discriminator for 10, 50, 100 and 500 yens, it can respond to a change in the setting of the play fare/number at the unit of 10 yens and can cope with a change in the ratio of the consumption tax flexibly.

On the other hand, the coin discriminator may be replaced by a known medal discriminator or a discriminator for coins of foreign countries. Moreover, no difficulty arises even if the coin discriminator is replaced by a discriminator for discriminating an alternative of the money such as a paper currency discriminator, a prepaid card discriminator or an electronic money discriminator.

The 7-segment LED of the play fare display means should not be limited to three for indicating three figures but may be composed of only one 7-segment LED if one figure for 100 yens is sufficient, nor is limited to one the construction of the 7-segment LED for indicating the play number.

Still moreover, the display means should not be limited to the 7-segment LED but may be exemplified by a liquid crystal panel or a fluorescent display tube. Then, the display can be made including the money unit.

The play fare/number setter can be placed outside of the game machine body, e.g., at the management office of a game center, although not shown, so that the setting can be centrally changed. This setter can be constructed of a computer by using the well-known signal transmission means or signal conversion means.

The game machine of the present invention can recover a prize having failed to be acquired, into a predetermined recovery box without being accumulated on the floor surface of a storage compartment, and can reduce a fear of allowing a new player to recognize the kind of the failed prizes to suppress the management cost effectively.

The game machine of the present invention can recover a prize having failed to be acquired, into a predetermined recovery box without being accumulated on the floor surface of a storage compartment, and can reduce a fear of allowing the player to recognize the kind of the failed prizes to suppress the management cost effectively. Depending upon the failure in the prize acquisition, moreover, the prizes, as fallen due to the failure in the acquisition, can be employed as those to be delivered, to enhance the incentive to the game machine.

The game machine of the present invention can recover a prize having failed to be acquired, into a predetermined recovery box without being accumulated on the floor surface of a storage compartment, and can reduce a fear of allowing a new player to recognize the kind of the failed prizes to suppress the management cost efectively.

The game machine of the present invention can recover a prize having failed to be acquired, into a predetermined recovery box without being accumulated on the floor surface of a storage compartment, and can reduce a fear of allowing the player to recognize the kind of the failed prizes to suppress the management cost effectively. Depending upon the failure in the prize acquisition, moreover, the prizes, as fallen due to the failure in the acquisition, can be employed as those to be delivered, to enhance the incentive to the game machine.

In the gripper of the presnt invention, the driving force of the drive means such as the drive motor is transmitted to the hand members through the elastic members so that the hand members can be turned within the elastic deformations of the elastic members in the direction opposed to the driving direction of the drive means. When the prize is larger than the normal one to be gripped, therefore, there is achieved an effect that the paired hand members can be opened more widely than the normal ones within the elastic deformations of the elastic members, to make it possible to keep the drive means such as the drive motor away from an excessive load, and to prevent the failures of the hand members and the gears and the breakages of the prizes. Since the hand members are made bendable of at least two members, moreover, their is achieved an effect that the shape of the hand members can be changed along the contour of the prize. In the prize acquisition game machine equipped with the gripper according to one embodiment, therefore, there is achieved an effect that a variety of prizes can be accommodated independently of their sizes, shapes and materials.

In the prize suspender of the present invention, the distance between the leading end outer circumference edge of the drop preventing member and the general axis of the rod-shaped member is not fixed at a constant value. As the rod-shaped member is automatically turned, the length to the upper edge of the drop preventing member is changed to provide an effect for changing the degree of difficulty in the acquisition of a prize to be suspended.

In the prize suspender of the present invention, in addition to the aforementioned effect, the prize is suspended by the fixed suspending member to provide an effect that the prize can be stably suspended without being influenced by the turning shaft.

In the prize suspender of the present invention, the rod-shaped member is turned to give a motion to the prize, and the length to the upper edge of the drop preventing member changes with the turning position of the rod-shaped member. Another effect is to provide a remarkably interesting prize acquisition game machine.

In the prize suspender of the present invention, the shape of the drop preventing member can be changed in various manners so that the suspender can conform to the characteristics of the prize.

In the prize suspender of the present invention, the plural rod-shaped members, the plural turning shafts or the plural turning arms can be turned substantially simultaneously to provide an effect the prize suspender can be produced at a reasonable cost and assembled and repaired remarkably conveniently.

In the prize suspender of the present invention, the detecting means can detect the turning position of the drop preventing member so that the turning position of the drop preventing member can be changed to provide an effect that the degree of difficulty in the prize acquisition can be adjusted by the operations of the controller of the game machine body by connecting the control means with the controller. This makes it possible to divide one prize acquisition game machine for the skilled and unskilled players and to adjust the degree of difficulty in the prize acquisition according to the shapes, materials and prices of the prizes.

The display means of the game machine of the present invention can change the display in association with the means for changing the setting of play fare and number and is provided with the means for changing the indications of the play fare and number with no works to change the display seals to be adhered and for confirming the changes. As a result, there are achieved effects that the management cost can be suppressed and that the display means can be changed outside of the game machine so that it can be centrally managed.

Thus, it is seen that game machine, and gripper and prize suspender therefor is provided. One skilled in the art will appreciate that the present invention can be practiced by other than the preferred embodiments which are provided for purposes of illustration and not of limitation, and the present invention is limited only by the claims which follow.

What is claimed is:

1. A game machine for commercial use for plays by inserting money, and a coin, a prepaid card or electronic money in place of the money, comprising:

means for indicating a play fare and a play number of a game that can change an indication of the play fare and the play number automatically in response to a change in a setting of play fare and number setting means, wherein the changes in the play fare and the play number are effected by the play fare and number setting means disposed outside of said game machine.

2. The game machine as set forth in claim 1, further comprising display means having at least one 7-segment LED.

3. The game machine as set forth in claim 1, further comprising display means having a liquid crystal panel.

4. The game machine as set forth in claim 1, further comprising display means having a fluorescent display tube.

5. A game machine for commercial use for plays by inserting money, and a coin, a prepaid card or electronic money in place of the money, comprising:

means for indicating a play number of a game that can change an indication of the play number automatically in response to a change in a setting of play number setting means, wherein the changes in the play number are effected by the play number setting means disposed outside of said game machine.

6. A game machine for commercial use for plays by inserting money, and a coin, a prepaid card or electronic money in place of the money, comprising:

means for indicating a play fare of a game that can change an indication of the play fare automatically in response to a change in a setting of play fare setting means, wherein the changes in the play fare are effected by the play fare setting means disposed outside of said game machine.

* * * * *